US012123654B2

(12) United States Patent
Poltorak

(10) Patent No.: US 12,123,654 B2
(45) Date of Patent: Oct. 22, 2024

(54) SYSTEM AND METHOD FOR MAINTAINING EFFICIENCY OF A FRACTAL HEAT SINK

(71) Applicant: Fractal Heatsink Technologies, LLC, Miami, FL (US)

(72) Inventor: Alexander Poltorak, Monsey, NY (US)

(73) Assignee: Fractal Heatsink Technologies LLC, Miami, FL (US)

( * ) Notice: Subject to any disclaimer, the term of this patent is extended or adjusted under 35 U.S.C. 154(b) by 138 days.

(21) Appl. No.: 18/070,452

(22) Filed: Nov. 28, 2022

(65) Prior Publication Data

US 2023/0099224 A1 Mar. 30, 2023

Related U.S. Application Data

(60) Continuation of application No. 17/107,741, filed on Nov. 30, 2020, now Pat. No. 11,512,905, which is a division of application No. 15/205,906, filed on Jul. 8, 2016, now Pat. No. 10,852,069, which is a continuation-in-part of application No. 14/984,756, (Continued)

(51) Int. Cl.

| | |
|---|---|
| ***F28F 13/12*** | (2006.01) |
| ***F28D 15/00*** | (2006.01) |
| ***F28F 3/02*** | (2006.01) |
| ***F28G 1/16*** | (2006.01) |
| ***F28G 7/00*** | (2006.01) |
| ***F28G 9/00*** | (2006.01) |

(Continued)

(52) U.S. Cl.

CPC ..... *F28D 15/00* (2013.01); *F28F 3/02* (2013.01); *F28F 13/12* (2013.01); *F28G 1/16* (2013.01); *F28G 7/00* (2013.01); *F28G 9/00* (2013.01); *F28G 13/00* (2013.01); *F28G 15/003* (2013.01); *F28F 2215/10* (2013.01); *F28F 2255/14* (2013.01)

(58) Field of Classification Search

CPC .... F28F 2255/14; F28F 2255/10; F28F 13/12; F28F 3/02; F28G 15/003; F28G 13/00; F28G 9/00; F28G 7/00; F28G 1/16

USPC ..... 134/37

See application file for complete search history.

(56) References Cited

U.S. PATENT DOCUMENTS 2,269,385 A 1/1942 Tipton
2,342,944 A 2/1944 Kretske (Continued)

OTHER PUBLICATIONS

Andrews, Earl H. "Scramjet development and testing in the United States." AIAA paper 1927 (2001): 2001.

(Continued)

*Primary Examiner* — Devon Russell

(74) *Attorney, Agent, or Firm* — Hoffberg & Associates; Steven M. Hoffberg

(57) ABSTRACT

A heatsink comprising a heat exchange device having a plurality of heat exchange elements each having a surface boundary with respect to a heat transfer fluid, having successive elements or regions having varying size scales. According to one embodiment, an accumulation of dust or particles on a surface of the heatsink is reduced by a removal mechanism. The mechanism can be thermal pyrolysis, vibration, blowing, etc. In the case of vibration, adverse effects on the system to be cooled may be minimized by an active or passive vibration suppression system.

20 Claims, 22 Drawing Sheets

Related U.S. Application Data filed on Dec. 30, 2015, now Pat. No. 10,041,745, and a continuation-in-part of application No. 14/817,962, filed on Aug. 4, 2015, now Pat. No. 10,527,368, said application No. 14/984,756 is a continuation-in-part of application No. 13/106,640, filed on May 12, 2011, now Pat. No. 9,228,785, said application No. 14/817,962 is a continuation-in-part of application No. 13/106,640, filed on May 12, 2011, now Pat. No. 9,228,785.

(60) Provisional application No. 61/331,103, filed on May 4, 2010.

(51) Int. Cl.
*F28G 13/00* (2006.01)
*F28G 15/00* (2006.01)

(56) References Cited

U.S. PATENT DOCUMENTS 2,865,116 A 12/1958 Messer
3,966,877 A 6/1976 Kalach et al.
4,209,871 A 7/1980 Ernest et al.
4,589,078 A 5/1986 Rosenberg
4,660,242 A 4/1987 Vornberger et al.
4,679,269 A 7/1987 Becka et al.
4,763,282 A 8/1988 Rosenberg
4,829,932 A 5/1989 Bennett
4,866,802 A 9/1989 Stein et al.
5,216,594 A 6/1993 White et al.
5,341,229 A 8/1994 Rowan
5,373,651 A 12/1994 Wood
5,615,111 A 3/1997 Raskas et al.
5,626,140 A 5/1997 Feldman et al.
5,629,848 A 5/1997 Repperger et al.
5,642,096 A 6/1997 Leyerer et al.
5,694,142 A 12/1997 Dumoulin et al.
5,720,200 A 2/1998 Anderson et al.
5,764,518 A 6/1998 Collins
5,794,361 A 8/1998 Sadler
5,850,352 A 12/1998 Moezzi et al.
6,001,067 A 12/1999 Shults et al.
6,157,850 A 12/2000 Diab et al.
6,230,501 B1 5/2001 Bailey, Sr. et al.
6,236,872 B1 5/2001 Diab et al.
6,379,669 B1 4/2002 Sinha
6,424,847 B1 7/2002 Mastrototaro et al.
6,453,195 B1 9/2002 Thompson
6,477,395 B2 11/2002 Schulman et al.
6,484,046 B1 11/2002 Say et al.
6,512,939 B1 1/2003 Colvin et al.
6,558,351 B1 5/2003 Steil et al.
6,563,423 B2 5/2003 Smith
6,565,509 B1 5/2003 Say et al.
6,567,259 B2 5/2003 Stevenson et al.
6,572,545 B2 6/2003 Knobbe et al.
6,575,905 B2 6/2003 Knobbe et al.
6,579,690 B1 6/2003 Bonnecaze et al.
6,595,929 B2 7/2003 Stivoric et al.
6,675,049 B2 1/2004 Thompson et al.
6,768,246 B2 7/2004 Pelrine et al.
6,788,200 B1 9/2004 Jamel et al.
6,817,979 B2 11/2004 Nihtila
6,833,039 B2 12/2004 Andersen et al.
6,843,578 B1 1/2005 Cheung
6,865,825 B2 3/2005 Bailey, Sr. et al.
6,931,327 B2 8/2005 Goode, Jr. et al.
6,949,066 B2 9/2005 Bearnson et al.
7,010,869 B1 3/2006 Ellis, III
7,020,508 B2 3/2006 Stivoric et al.
7,044,911 B2 5/2006 Drinan et al.
7,059,070 B2 6/2006 Omstead et al.
7,070,398 B2 7/2006 Olsen et al.
7,097,662 B2 8/2006 Evans, III et al.
7,107,706 B1 9/2006 Bailey, Sr. et al.
7,108,659 B2 9/2006 Ross et al.
7,149,320 B2 12/2006 Haykin et al.
7,167,743 B2 1/2007 Heruth et al.
7,172,897 B2 2/2007 Blackburn et al.
7,188,439 B2 3/2007 DiBenedetto et al.
7,204,041 B1 4/2007 Bailey, Sr. et al.
7,215,986 B2 5/2007 Diab et al.
7,219,449 B1 5/2007 Hoffberg et al.
7,225,565 B2 6/2007 DiBenedetto et al.
7,231,254 B2 6/2007 DiLorenzo
7,261,690 B2 8/2007 Teller et al.
7,265,666 B2 9/2007 Daniel
7,267,665 B2 9/2007 Steil et al.
7,273,457 B2 9/2007 Penner
7,280,870 B2 10/2007 Nurmikko et al.
7,285,090 B2 10/2007 Stivoric et al.
7,291,114 B2 11/2007 Mault
7,310,544 B2 12/2007 Brister et al.
7,312,087 B2 12/2007 Duong et al.
7,313,440 B2 12/2007 Miesel
7,330,760 B2 2/2008 Heruth et al.
7,333,013 B2 2/2008 Berger
7,334,350 B2 2/2008 Ellis, III
7,354,420 B2 4/2008 Steil et al.
7,366,572 B2 4/2008 Heruth et al.
7,371,825 B2 5/2008 Das et al.
7,392,079 B2 6/2008 Donoghue et al.
7,395,113 B2 7/2008 Heruth et al.
7,395,614 B1 7/2008 Bailey, Sr. et al.
7,402,153 B2 7/2008 Steil et al.
7,404,263 B2 7/2008 Guzman
7,407,484 B2 8/2008 Korman
7,409,256 B2 8/2008 Lin et al.
7,414,534 B1 8/2008 Kroll et al.
7,414,611 B2 8/2008 Liberty
7,426,873 B1 9/2008 Kholwadwala et al.
7,447,545 B2 11/2008 Heruth et al.
7,463,142 B2 12/2008 Lindsay
7,489,298 B2 2/2009 Liberty et al.
7,489,299 B2 2/2009 Liberty et al.
7,491,181 B2 2/2009 Heruth et al.
7,493,230 B2 2/2009 Schwartz et al.
7,497,037 B2 3/2009 Vick et al.
7,506,460 B2 3/2009 DiBenedetto et al.
7,519,406 B2 4/2009 Blank et al.
7,519,512 B2 4/2009 Spence et al.
7,535,456 B2 5/2009 Liberty et al.
7,542,803 B2 6/2009 Heruth et al.
7,561,919 B2 7/2009 Shalev et al.
7,562,468 B2 7/2009 Ellis, III
RE40,879 E 8/2009 Jamel et al.
7,577,475 B2 8/2009 Cosentino et al.
7,579,946 B2 8/2009 Case, Jr.
7,590,453 B2 9/2009 Heruth et al.
7,590,455 B2 9/2009 Heruth et al.
7,598,878 B2 10/2009 Goldreich
7,607,243 B2 10/2009 Berner, Jr. et al.
7,610,094 B2 10/2009 Stahmann et al.
7,614,166 B2 11/2009 Vick et al.
7,616,991 B2 11/2009 Mann et al.
7,621,876 B2 11/2009 Hoctor et al.
7,623,919 B2 11/2009 Goetz et al.
7,623,928 B2 11/2009 DiLorenzo
7,630,755 B2 12/2009 Stahmann et al.
7,631,382 B2 12/2009 DiBenedetto et al.
RE41,087 E 1/2010 Jamel et al.
7,641,619 B2 1/2010 Penner
RE41,102 E 2/2010 Jamel et al.
RE41,122 E 2/2010 Jamel et al.
7,671,599 B1 3/2010 Tan et al.
7,676,960 B2 3/2010 DiBenedetto et al.
7,676,961 B2 3/2010 DiBenedetto et al.
7,695,512 B2 4/2010 Lashinski et al.
7,697,994 B2 4/2010 VanDanacker
7,707,742 B2 5/2010 Ellis, III
7,713,923 B2 5/2010 Genove et al.
7,716,008 B2 5/2010 Ohta

(56) References Cited

U.S. PATENT DOCUMENTS 7,717,848 B2 5/2010 Heruth et al.
7,727,143 B2 6/2010 Birk et al.
7,735,351 B2 6/2010 Profit et al.
7,758,523 B2 7/2010 Collings et al.
7,761,261 B2 7/2010 Shmueli et al.
7,765,005 B2 7/2010 Stevenson
7,765,012 B2 7/2010 Gerber
7,774,155 B2 8/2010 Sato et al.
7,775,993 B2 8/2010 Heruth et al.
7,780,590 B2 8/2010 Birk et al.
7,782,192 B2 8/2010 Jeckelmann et al.
7,783,442 B2 8/2010 Mueller, Jr. et al.
7,787,946 B2 8/2010 Stahmann et al.
7,787,958 B2 8/2010 Stevenson
7,792,583 B2 9/2010 Miesel et al.
7,793,430 B2 9/2010 Ellis
7,794,101 B2 9/2010 Galica et al.
7,801,591 B1 9/2010 Shusterman
7,805,196 B2 9/2010 Miesel et al.
7,806,886 B2 10/2010 Kanderian, Jr. et al.
7,813,778 B2 10/2010 Benaron et al.
7,816,632 B2 10/2010 Bourke, III et al.
7,819,909 B2 10/2010 Goetz et al.
7,825,794 B2 11/2010 Janetis et al.
7,842,092 B2 11/2010 Otto et al.
7,848,819 B2 12/2010 Goetz et al.
7,853,329 B2 12/2010 DiLorenzo
7,859,540 B2 12/2010 Dariush
7,860,676 B2 12/2010 Sheng et al.
7,876,228 B2 1/2011 Kroll et al.
7,877,224 B2 1/2011 Ohta
7,881,798 B2 2/2011 Miesel et al.
7,885,712 B2 2/2011 Goetz et al.
7,890,055 B1 2/2011 Stein
7,904,149 B2 3/2011 Gerber
7,908,000 B2 3/2011 Shalev
7,908,013 B2 3/2011 Miesel et al.
7,916,013 B2 3/2011 Stevenson
7,927,216 B2 4/2011 Ikeda et al.
7,930,035 B2 4/2011 DiLorenzo
7,930,131 B2 4/2011 Ridenour et al.
7,931,535 B2 4/2011 Ikeda et al.
7,932,825 B2 4/2011 Berger
7,942,745 B2 5/2011 Ikeda et al.
7,953,488 B2 5/2011 Casavant et al.
7,956,162 B2 6/2011 Chahal et al.
7,959,567 B2 6/2011 Stivoric et al.
7,966,075 B2 6/2011 Johnson et al.
7,970,470 B2 6/2011 Hartley et al.
7,974,696 B1 7/2011 DiLorenzo
7,978,062 B2 7/2011 LaLonde et al.
7,981,025 B2 7/2011 Pool et al.
7,983,435 B2 7/2011 Moses
7,983,763 B2 7/2011 Stevenson et al.
7,996,158 B2 8/2011 Hayter et al.
8,000,801 B2 8/2011 Stevenson et al.
8,005,539 B2 8/2011 Burnes et al.
8,010,189 B2 8/2011 Shalev
8,015,732 B2 9/2011 Berner, Jr. et al.
8,021,299 B2 9/2011 Miesel et al.
8,028,443 B2 10/2011 Case, Jr.
8,032,224 B2 10/2011 Miesel et al.
8,033,999 B2 10/2011 Xi
8,036,736 B2 10/2011 Snyder et al.
8,038,613 B2 10/2011 Stupp et al.
8,041,536 B2 10/2011 Ohta
8,055,330 B2 11/2011 Egozi
8,055,334 B2 11/2011 Savage et al.
8,055,348 B2 11/2011 Heruth et al.
8,056,268 B2 11/2011 DiBenedetto et al.
8,072,424 B2 12/2011 Liberty
8,078,278 B2 12/2011 Penner
8,078,282 B2 12/2011 Nycz
8,079,518 B2 12/2011 Turner et al.
8,081,925 B2 12/2011 Parramon et al.
8,086,250 B2 12/2011 Janetis et al.
8,086,302 B2 12/2011 Kracker
8,089,458 B2 1/2012 Barney et al.
8,093,991 B2 1/2012 Stevenson et al.
8,103,471 B2 1/2012 Hayter
8,103,802 B2 1/2012 Lay et al.
8,114,021 B2 2/2012 Robertson et al.
8,114,345 B2 2/2012 Dlugos, Jr. et al.
8,114,964 B2 2/2012 Das et al.
8,115,618 B2 2/2012 Robertson et al.
8,121,691 B2 2/2012 Gerber et al.
8,121,694 B2 2/2012 Molnar et al.
8,123,696 B2 2/2012 Childre et al.
8,127,470 B2 3/2012 Connor
8,135,473 B2 3/2012 Miesel et al.
8,137,195 B2 3/2012 Penzias
8,137,269 B2 3/2012 Sheikhzadeh-Nadjar et al.
8,140,161 B2 3/2012 Willerton et al.
8,141,276 B2 3/2012 Ellis
8,152,710 B2 4/2012 Dlugos, Jr. et al.
8,157,651 B2 4/2012 Ohta et al.
8,157,731 B2 4/2012 Teller et al.
8,160,273 B2 4/2012 Visser et al.
8,160,669 B2 4/2012 Brauker et al.
8,160,695 B2 4/2012 Dacey, Jr. et al.
8,160,702 B2 4/2012 Mann et al.
8,164,567 B1 4/2012 Barney et al.
8,165,691 B2 4/2012 Ellingson et al.
8,165,893 B1 4/2012 Goldberg et al.
8,169,406 B2 5/2012 Barney et al.
8,172,459 B2 5/2012 Abreu
8,174,378 B2 5/2012 Richman et al.
8,174,395 B2 5/2012 Samuelsson et al.
8,180,446 B2 5/2012 Dacey, Jr. et al.
8,180,447 B2 5/2012 Dacey, Jr. et al.
8,180,591 B2 5/2012 Yuen et al.
8,180,592 B2 5/2012 Yuen et al.
8,184,097 B1 5/2012 Barney et al.
8,185,181 B2 5/2012 Feldman et al.
8,186,081 B2 5/2012 Wilson, III et al.
8,190,253 B2 5/2012 Heruth et al.
8,192,406 B2 6/2012 Wells et al.
8,197,454 B2 6/2012 Mann et al.
8,200,342 B2 6/2012 Stevenson et al.
8,202,260 B2 6/2012 Mann et al.
8,204,590 B2 6/2012 Sambelashvili et al.
8,204,597 B2 6/2012 Gerber et al.
8,205,356 B2 6/2012 Ellis
8,207,316 B1 6/2012 Bentwich
8,214,045 B2 7/2012 Kronich et al.
8,216,139 B2 7/2012 Brauker et al.
8,217,946 B2 7/2012 Halpern et al.
8,226,493 B2 7/2012 Briggs et al.
8,233,958 B2 7/2012 Brauker et al.
8,233,959 B2 7/2012 Kamath et al.
8,233,976 B2 7/2012 Dacey, Jr. et al.
8,234,798 B2 8/2012 DiBenedetto et al.
8,237,657 B2 8/2012 Liberty et al.
8,239,166 B2 8/2012 Hayter et al.
8,246,533 B2 8/2012 Chang et al.
8,246,563 B2 8/2012 Wariar
8,248,367 B1 8/2012 Barney et al.
8,249,708 B2 8/2012 Krause et al.
8,250,782 B2 8/2012 Callahan et al.
8,251,061 B2 8/2012 Lee et al.
8,251,903 B2 8/2012 LeBoeuf et al.
8,251,906 B2 8/2012 Brauker et al.
8,251,946 B2 8/2012 Bardy
8,257,259 B2 9/2012 Brauker et al.
8,257,729 B2 9/2012 Schmitz et al.
8,258,941 B2 9/2012 Case, Jr.
8,260,393 B2 9/2012 Kamath et al.
8,260,412 B2 9/2012 Krause et al.
8,260,422 B2 9/2012 Ellingson et al.
8,260,558 B2 9/2012 Hayter et al.
8,261,468 B2 9/2012 Ellis, III
8,265,723 B1 9/2012 McHale et al.
8,265,725 B2 9/2012 Brauker et al.
8,265,771 B2 9/2012 Donofrio et al.

(56) References Cited

U.S. PATENT DOCUMENTS

| | | | |
|---|---|---|---|
| 8,267,786 | B2 | 9/2012 | Ikeda |
| 8,269,635 | B2 | 9/2012 | Kroll et al. |
| 8,269,636 | B2 | 9/2012 | Kroll et al. |
| 8,270,938 | B2 | 9/2012 | Flippo et al. |
| 8,271,072 | B2 | 9/2012 | Houben et al. |
| 8,273,032 | B2 | 9/2012 | Carney et al. |
| 8,275,437 | B2 | 9/2012 | Brauker et al. |
| 8,277,741 | B2 | 10/2012 | McCabe |
| 8,280,475 | B2 | 10/2012 | Brister et al. |
| 8,282,549 | B2 | 10/2012 | Brauker et al. |
| 8,287,520 | B2 | 10/2012 | Drew et al. |
| 8,290,561 | B2 | 10/2012 | Brauker et al. |
| 8,290,596 | B2 | 10/2012 | Wei et al. |
| 8,291,614 | B2 | 10/2012 | Ellis |
| 8,295,933 | B2 | 10/2012 | Gerber et al. |
| 8,301,219 | B2 | 10/2012 | Chen et al. |
| 8,301,243 | B2 | 10/2012 | Stevenson et al. |
| 8,306,610 | B2 | 11/2012 | Mirow |
| 8,306,766 | B2 | 11/2012 | Mueller, Jr. et al. |
| 8,308,563 | B2 | 11/2012 | Ikeda et al. |
| 8,308,661 | B2 | 11/2012 | Miesel et al. |
| 8,310,336 | B2 | 11/2012 | Muhsin et al. |
| 8,311,749 | B2 | 11/2012 | Brauker et al. |
| 8,311,769 | B2 | 11/2012 | Yuen et al. |
| 8,311,770 | B2 | 11/2012 | Yuen et al. |
| 8,313,379 | B2 | 11/2012 | Ikeda et al. |
| 8,321,003 | B2 | 11/2012 | Zhang et al. |
| 8,321,032 | B2 | 11/2012 | Frysz et al. |
| 8,321,149 | B2 | 11/2012 | Brauker et al. |
| 8,323,232 | B2 | 12/2012 | Bardy |
| 8,326,435 | B2 | 12/2012 | Stevenson |
| 8,328,420 | B2 | 12/2012 | Abreu |
| 8,332,038 | B2 | 12/2012 | Heruth et al. |
| 8,335,568 | B2 | 12/2012 | Heruth et al. |
| 8,337,431 | B2 | 12/2012 | Heruth et al. |
| 8,348,882 | B2 | 1/2013 | Bardy |
| 8,348,886 | B2 | 1/2013 | Kanderian, Jr. et al. |
| 8,348,923 | B2 | 1/2013 | Kanderian, Jr. et al. |
| 8,355,783 | B2 | 1/2013 | Goetz et al. |
| 8,359,095 | B2 | 1/2013 | Hedberg et al. |
| 8,359,545 | B2 | 1/2013 | Pixley et al. |
| 8,368,648 | B2 | 2/2013 | Barney et al. |
| 8,373,556 | B2 | 2/2013 | LaLonde et al. |
| 8,373,659 | B2 | 2/2013 | Barney et al. |
| 8,374,667 | B2 | 2/2013 | Brauker et al. |
| 8,374,697 | B2 | 2/2013 | Berger |
| 8,376,943 | B2 | 2/2013 | Kovach et al. |
| 8,384,668 | B2 | 2/2013 | Barney et al. |
| 8,385,971 | B2 | 2/2013 | Rhoads et al. |
| 8,386,004 | B2 | 2/2013 | Kamath et al. |
| 8,386,008 | B2 | 2/2013 | Yuen et al. |
| 8,388,347 | B2 | 3/2013 | Beville |
| 8,388,530 | B2 | 3/2013 | Shusterman |
| 8,388,544 | B2 | 3/2013 | Hoctor et al. |
| 8,389,286 | B2 | 3/2013 | Chahal et al. |
| 8,395,498 | B2 | 3/2013 | Gaskill et al. |
| 8,396,554 | B2 | 3/2013 | Miesel et al. |
| 8,396,557 | B2 | 3/2013 | DiLorenzo |
| 8,398,546 | B2 | 3/2013 | Pacione et al. |
| 8,406,893 | B2 | 3/2013 | Krause et al. |
| 8,407,022 | B2 | 3/2013 | Sheng et al. |
| 8,409,003 | B2 | 4/2013 | Ikeda |
| 8,410,940 | B2 | 4/2013 | Samuelsson et al. |
| 8,412,352 | B2 | 4/2013 | Griswold et al. |
| 8,417,311 | B2 | 4/2013 | Rule |
| 8,419,650 | B2 | 4/2013 | Cosentino et al. |
| 8,421,822 | B2 | 4/2013 | Odland et al. |
| 8,428,744 | B2 | 4/2013 | Stancer et al. |
| 8,430,753 | B2 | 4/2013 | Ikeda et al. |
| 8,433,395 | B1 | 4/2013 | Brockway et al. |
| 8,435,186 | B2 | 5/2013 | Hettrick et al. |
| 8,435,738 | B2 | 5/2013 | Holmes |
| 8,436,810 | B2 | 5/2013 | Langereis et al. |
| 8,437,980 | B2 | 5/2013 | Yuen et al. |
| 8,438,038 | B2 | 5/2013 | Cosentino et al. |
| 8,444,560 | B2 | 5/2013 | Hayter et al. |
| 8,444,653 | B2 | 5/2013 | Nycz et al. |
| 8,447,265 | B2 | 5/2013 | Flippo et al. |
| 8,447,401 | B2 | 5/2013 | Miesel et al. |
| 8,447,403 | B2 | 5/2013 | Sharma et al. |
| 8,447,404 | B2 | 5/2013 | Sharma et al. |
| 8,452,366 | B2 | 5/2013 | Gilland |
| 8,452,394 | B2 | 5/2013 | Burnes et al. |
| 8,454,552 | B2 | 6/2013 | Bardy |
| 8,457,727 | B2 | 6/2013 | Qu |
| 8,457,757 | B2 | 6/2013 | Cauller et al. |
| 8,457,760 | B2 | 6/2013 | Johnson et al. |
| 8,460,189 | B2 | 6/2013 | Libbus et al. |
| 8,461,979 | B2 | 6/2013 | Case, Jr. |
| 8,463,576 | B2 | 6/2013 | Yuen et al. |
| 8,463,577 | B2 | 6/2013 | Yuen et al. |
| 8,467,904 | B2 | 6/2013 | Dariush |
| 8,469,886 | B2 | 6/2013 | Brauker et al. |
| 8,473,245 | B2 | 6/2013 | Ohta |
| 8,475,275 | B2 | 7/2013 | Weston et al. |
| 8,475,739 | B2 | 7/2013 | Holmes et al. |
| 8,478,378 | B2 | 7/2013 | Lal et al. |
| 8,478,389 | B1 | 7/2013 | Brockway et al. |
| 8,478,557 | B2 | 7/2013 | Hayter et al. |
| 8,483,840 | B2 | 7/2013 | Stevenson et al. |
| 8,484,153 | B2 | 7/2013 | Mott et al. |
| 8,484,270 | B2 | 7/2013 | Kurtz et al. |
| 8,485,979 | B2 | 7/2013 | Giftakis et al. |
| 8,486,070 | B2 | 7/2013 | Morgan et al. |
| 8,491,389 | B2 | 7/2013 | Weston et al. |
| 8,493,187 | B2 | 7/2013 | Rowland et al. |
| 8,494,829 | B2 | 7/2013 | Teixeira |
| 8,496,657 | B2 | 7/2013 | Bonutti et al. |
| RE44,408 | E | 8/2013 | Lindsay |
| 8,499,476 | B2 | 8/2013 | Berner, Jr. et al. |
| 8,509,893 | B2 | 8/2013 | Xiao et al. |
| 8,509,913 | B2 | 8/2013 | Johnson et al. |
| 8,512,242 | B2 | 8/2013 | LeBoeuf et al. |
| 8,515,547 | B2 | 8/2013 | Mass et al. |
| 8,515,559 | B2 | 8/2013 | Roberts et al. |
| 8,521,292 | B2 | 8/2013 | Wei et al. |
| 8,527,045 | B2 | 9/2013 | Krause et al. |
| 8,527,064 | B2 | 9/2013 | Zhang et al. |
| 8,532,779 | B2 | 9/2013 | Krause et al. |
| 8,532,935 | B2 | 9/2013 | Budiman |
| 8,540,632 | B2 | 9/2013 | Robertson et al. |
| 8,543,185 | B2 | 9/2013 | Yuen et al. |
| 8,543,199 | B2 | 9/2013 | Snyder et al. |
| 8,543,351 | B2 | 9/2013 | Yuen et al. |
| 8,545,436 | B2 | 10/2013 | Robertson et al. |
| 8,547,248 | B2 | 10/2013 | Zdeblick et al. |
| 8,548,770 | B2 | 10/2013 | Yuen et al. |
| 8,554,325 | B2 | 10/2013 | Molnar et al. |
| 8,554,331 | B2 | 10/2013 | Gerber et al. |
| 8,557,772 | B2 | 10/2013 | Popel et al. |
| 8,560,038 | B2 | 10/2013 | Hayter et al. |
| 8,565,848 | B2 | 10/2013 | Brister et al. |
| 8,565,886 | B2 | 10/2013 | Nelson et al. |
| 8,571,808 | B2 | 10/2013 | Hayter |
| 8,571,881 | B2 | 10/2013 | Rousso et al. |
| 8,574,146 | B2 | 11/2013 | Gillespie, Jr. et al. |
| 8,577,453 | B1 | 11/2013 | Stevenson et al. |
| 8,577,465 | B2 | 11/2013 | Mashiach |
| 8,577,468 | B2 | 11/2013 | Mashiach et al. |
| 8,577,478 | B2 | 11/2013 | Mashiach et al. |
| 8,583,227 | B2 | 11/2013 | Savage et al. |
| 8,583,402 | B2 | 11/2013 | Yuen et al. |
| 8,587,427 | B2 | 11/2013 | LaLonde et al. |
| 8,600,681 | B2 | 12/2013 | Hayter et al. |
| 8,606,355 | B1 | 12/2013 | Krause |
| 8,608,535 | B2 | 12/2013 | Weston et al. |
| 8,609,973 | B2 | 12/2013 | D'Amours |
| 8,611,996 | B2 | 12/2013 | Donofrio et al. |
| 8,612,163 | B2 | 12/2013 | Hayter et al. |
| 8,615,299 | B2 | 12/2013 | Goetz |
| 8,615,377 | B1 | 12/2013 | Yuen et al. |
| 8,615,405 | B2 | 12/2013 | Rousso et al. |
| 8,620,591 | B2 | 12/2013 | Wegerich |
| 8,620,617 | B2 | 12/2013 | Yuen et al. |

(56) References Cited

U.S. PATENT DOCUMENTS

| | | | |
|---|---|---|---|
| 8,620,679 | B2 | 12/2013 | Rousso et al. |
| 8,623,023 | B2 | 1/2014 | Ritchey et al. |
| 8,629,836 | B2 | 1/2014 | Liberty |
| 8,630,706 | B2 | 1/2014 | Dacey, Jr. et al. |
| 8,632,463 | B2 | 1/2014 | Drinan et al. |
| 8,632,465 | B1 | 1/2014 | Brockway |
| 8,639,524 | B2 | 1/2014 | Solomon |
| 8,641,220 | B1 | 2/2014 | Lin |
| 8,641,612 | B2 | 2/2014 | Teller et al. |
| 8,644,957 | B2 | 2/2014 | Mashiach |
| 8,644,967 | B2 | 2/2014 | Seiler |
| 8,655,441 | B2 | 2/2014 | Fletcher et al. |
| 8,656,607 | B2 | 2/2014 | Ellis |
| 8,657,745 | B2 | 2/2014 | Brauker et al. |
| 8,657,747 | B2 | 2/2014 | Kamath et al. |
| 8,663,106 | B2 | 3/2014 | Stivoric et al. |
| 8,663,109 | B2 | 3/2014 | Brister et al. |
| 8,666,471 | B2 | 3/2014 | Rogers et al. |
| 8,666,488 | B2 | 3/2014 | Duke |
| 8,667,709 | B2 | 3/2014 | Ellis |
| 8,670,953 | B2 | 3/2014 | Yuen et al. |
| 8,672,845 | B2 | 3/2014 | Kamath et al. |
| 8,673,194 | B2 | 3/2014 | Lee et al. |
| 8,674,825 | B2 | 3/2014 | Zdeblick et al. |
| 8,676,170 | B2 | 3/2014 | Porrati et al. |
| 8,679,014 | B2 | 3/2014 | Bennett et al. |
| 8,682,615 | B2 | 3/2014 | Hayter et al. |
| 8,683,850 | B2 | 4/2014 | Sheng et al. |
| 8,684,943 | B2 | 4/2014 | Schmidt et al. |
| 8,686,579 | B2 | 4/2014 | Barney et al. |
| 8,688,202 | B2 | 4/2014 | Brockway et al. |
| 8,688,210 | B2 | 4/2014 | Burnes et al. |
| 8,688,221 | B2 | 4/2014 | Miesel et al. |
| 8,694,282 | B2 | 4/2014 | Yuen et al. |
| 8,698,638 | B2 | 4/2014 | Samuelsson et al. |
| 8,702,515 | B2 | 4/2014 | Weston et al. |
| 8,706,232 | B2 | 4/2014 | Su et al. |
| 8,706,233 | B2 | 4/2014 | Su et al. |
| 8,706,237 | B2 | 4/2014 | Giftakis et al. |
| 8,707,040 | B2 | 4/2014 | Andersen |
| 8,708,821 | B2 | 4/2014 | Barney et al. |
| 8,708,824 | B2 | 4/2014 | Ohta et al. |
| 8,708,904 | B2 | 4/2014 | Stivoric et al. |
| 8,711,094 | B2 | 4/2014 | Barney et al. |
| 8,712,529 | B2 | 4/2014 | Sharma et al. |
| 8,712,530 | B2 | 4/2014 | Sharma et al. |
| 8,715,159 | B2 | 5/2014 | Pool et al. |
| 8,715,269 | B2 | 5/2014 | Wolff et al. |
| 8,718,193 | B2 | 5/2014 | Arne et al. |
| 8,718,753 | B2 | 5/2014 | Chon et al. |
| 8,718,776 | B2 | 5/2014 | Mashiach et al. |
| 8,718,965 | B2 | 5/2014 | Hayter et al. |
| 8,721,520 | B2 | 5/2014 | Caira et al. |
| 8,721,643 | B2 | 5/2014 | Morgan et al. |
| 8,725,244 | B2 | 5/2014 | Miesel et al. |
| 8,725,253 | B2 | 5/2014 | Johnson et al. |
| 8,727,995 | B2 | 5/2014 | Brunke |
| 8,730,031 | B2 | 5/2014 | Thompson et al. |
| 8,730,034 | B2 | 5/2014 | Case, Jr. |
| 8,738,323 | B2 | 5/2014 | Yuen et al. |
| 8,739,639 | B2 | 6/2014 | Owings et al. |
| 8,740,751 | B2 | 6/2014 | Shum |
| 8,742,623 | B1 | 6/2014 | Biederman et al. |
| 8,744,587 | B2 | 6/2014 | Miesel et al. |
| 8,744,803 | B2 | 6/2014 | Park et al. |
| 8,744,804 | B2 | 6/2014 | Messenger et al. |
| 8,747,315 | B2 | 6/2014 | Brauker et al. |
| 8,750,955 | B2 | 6/2014 | Brister et al. |
| 8,751,013 | B2 | 6/2014 | Johnson et al. |
| 8,751,194 | B2 | 6/2014 | Panther et al. |
| 8,751,320 | B1 | 6/2014 | Kemist |
| 8,753,165 | B2 | 6/2014 | Weston |
| 8,753,275 | B2 | 6/2014 | Najafi et al. |
| 8,755,837 | B2 | 6/2014 | Rhoads et al. |
| 8,755,871 | B2 | 6/2014 | Weng et al. |
| 8,758,136 | B2 | 6/2014 | Briggs et al. |
| 8,758,242 | B2 | 6/2014 | Miesel et al. |
| 8,761,852 | B2 | 6/2014 | Parthasarathy et al. |
| 8,762,101 | B2 | 6/2014 | Yuen et al. |
| 8,762,102 | B2 | 6/2014 | Yuen et al. |
| 8,763,261 | B1 | 7/2014 | Kemist |
| 8,766,789 | B2 | 7/2014 | Cosentino et al. |
| 8,766,805 | B2 | 7/2014 | Alameh et al. |
| 8,768,313 | B2 | 7/2014 | Rodriguez |
| 8,768,648 | B2 | 7/2014 | Panther et al. |
| 8,771,222 | B2 | 7/2014 | Kanderian, Jr. et al. |
| 8,774,918 | B2 | 7/2014 | Donofrio et al. |
| 8,775,120 | B2 | 7/2014 | Molettiere et al. |
| 8,777,924 | B2 | 7/2014 | Kanderian, Jr. et al. |
| 8,781,197 | B2 | 7/2014 | Wang et al. |
| 8,781,791 | B2 | 7/2014 | Panther et al. |
| 8,784,425 | B2 | 7/2014 | Ritchey et al. |
| 8,788,007 | B2 | 7/2014 | Brauker et al. |
| 8,788,028 | B2 | 7/2014 | Kumar et al. |
| 8,788,057 | B2 | 7/2014 | Stevenson et al. |
| 8,790,180 | B2 | 7/2014 | Barney et al. |
| 8,790,400 | B2 | 7/2014 | Boyden et al. |
| 8,792,982 | B2 | 7/2014 | Miesel et al. |
| 8,792,991 | B2 | 7/2014 | Gerber et al. |
| 8,793,101 | B2 | 7/2014 | Yuen et al. |
| 8,795,079 | B2 | 8/2014 | Penzias, III |
| 8,795,260 | B2 | 8/2014 | Drew |
| 8,795,359 | B2 | 8/2014 | Boyden et al. |
| 8,798,773 | B2 | 8/2014 | Mashiach |
| 8,801,610 | B2 | 8/2014 | Brauker et al. |
| 8,805,110 | B2 | 8/2014 | Rhoads et al. |
| 8,805,478 | B2 | 8/2014 | Powers et al. |
| 8,805,485 | B2 | 8/2014 | Sameni et al. |
| 8,805,508 | B2 | 8/2014 | Gerber et al. |
| 8,805,518 | B2 | 8/2014 | King et al. |
| 8,805,530 | B2 | 8/2014 | John |
| 8,805,646 | B2 | 8/2014 | Messenger et al. |
| 8,808,163 | B2 | 8/2014 | Pool et al. |
| 8,808,373 | B2 | 8/2014 | Boyden et al. |
| 8,812,259 | B2 | 8/2014 | Messenger et al. |
| 8,812,260 | B2 | 8/2014 | Yuen et al. |
| 8,814,688 | B2 | 8/2014 | Barney et al. |
| 8,814,868 | B2 | 8/2014 | Janna et al. |
| 8,818,505 | B2 | 8/2014 | Bhunia et al. |
| 8,818,522 | B2 | 8/2014 | Mass et al. |
| 8,818,753 | B2 | 8/2014 | Yuen et al. |
| 8,821,350 | B2 | 9/2014 | Maertz |
| 8,827,810 | B2 | 9/2014 | Weston et al. |
| 8,827,906 | B2 | 9/2014 | Yuen et al. |
| 8,834,020 | B2 | 9/2014 | Abreu |
| 8,834,271 | B2 | 9/2014 | Ikeda |
| 8,834,366 | B2 | 9/2014 | Hayter et al. |
| 8,838,235 | B2 | 9/2014 | Cowan et al. |
| 8,838,249 | B2 | 9/2014 | Nycz |
| 8,840,838 | B2 | 9/2014 | Holmes et al. |
| 8,842,176 | B2 | 9/2014 | Schofield et al. |
| 8,843,210 | B2 | 9/2014 | Simon et al. |
| 8,843,321 | B2 | 9/2014 | Duke et al. |
| 8,845,536 | B2 | 9/2014 | Brauker et al. |
| 8,847,766 | B2 | 9/2014 | Zdeblick et al. |
| 8,849,259 | B2 | 9/2014 | Rhoads et al. |
| 8,849,368 | B2 | 9/2014 | Madsen et al. |
| 8,849,610 | B2 | 9/2014 | Molettiere et al. |
| 8,849,682 | B2 | 9/2014 | Mahajan et al. |
| 8,852,095 | B2 | 10/2014 | Schlottau et al. |
| 8,852,098 | B2 | 10/2014 | Teller et al. |
| 8,855,712 | B2 | 10/2014 | Lord et al. |
| 8,855,785 | B1 | 10/2014 | Johnson et al. |
| 8,857,078 | B2 | 10/2014 | Berner, Jr. et al. |
| 8,857,934 | B2 | 10/2014 | Hirayama |
| 8,858,432 | B2 | 10/2014 | Robertson et al. |
| 8,868,377 | B2 | 10/2014 | Yuen et al. |
| 8,870,655 | B2 | 10/2014 | Ikeda |
| 8,870,736 | B2 | 10/2014 | Qu |
| 8,870,742 | B2 | 10/2014 | Dlugos, Jr. et al. |
| 8,870,766 | B2 | 10/2014 | Stivoric et al. |
| 8,875,714 | B2 | 11/2014 | Boyden et al. |
| 8,879,983 | B2 | 11/2014 | Yun et al. |
| 8,880,155 | B2 | 11/2014 | Mestek et al. |

(56) References Cited

U.S. PATENT DOCUMENTS 8,882,666 B1 11/2014 Goldberg et al.
8,884,809 B2 11/2014 Hyde et al.
8,886,206 B2 11/2014 Lord et al.
8,888,576 B2 11/2014 Briggs et al.
8,892,401 B2 11/2014 Yuen et al.
8,900,142 B2 12/2014 Old et al.
8,901,084 B2 12/2014 Genove et al.
8,907,782 B2 12/2014 Baker et al.
8,911,486 B1 12/2014 Drnek et al.
8,913,011 B2 12/2014 Barney et al.
8,915,785 B2 12/2014 Barney et al.
8,915,849 B2 12/2014 Brauker et al.
8,918,178 B2 12/2014 Simon et al.
8,920,332 B2 12/2014 Hong et al.
8,923,970 B2 12/2014 Bar-Yoseph et al.
8,923,976 B2 12/2014 Johanek
8,926,573 B2 1/2015 Smith et al.
8,929,877 B2 1/2015 Rhoads et al.
8,929,963 B2 1/2015 Lisogurski
8,929,999 B2 1/2015 Maschiach
8,932,221 B2 1/2015 Colliou et al.
8,935,119 B2 1/2015 Yuen
8,935,123 B2 1/2015 Yuen et al.
8,937,594 B2 1/2015 Liberty
8,938,368 B2 1/2015 Yuen et al.
8,938,892 B2 1/2015 Case, Jr.
8,942,777 B2 1/2015 Diab et al.
8,942,953 B2 1/2015 Yuen et al.
8,945,017 B2 2/2015 Venkatraman et al.
8,945,328 B2 2/2015 Longinotti-Buitoni et al.
8,946,390 B2 2/2015 Chahal et al.
8,948,832 B2 2/2015 Hong et al.
8,948,834 B2 2/2015 Diab et al.
8,948,839 B1 2/2015 Longinotti-Buitoni et al.
8,954,149 B2 2/2015 Shalev
8,954,290 B2 2/2015 Yuen et al.
8,954,291 B2 2/2015 Messenger et al.
8,956,228 B2 2/2015 Shum et al.
8,956,287 B2 2/2015 Zdeblick et al.
8,956,288 B2 2/2015 Hafezi et al.
8,956,303 B2 2/2015 Hong et al.
8,957,777 B2 2/2015 Baker et al.
8,958,870 B2 2/2015 Gerber et al.
8,961,260 B2 2/2015 Weston
8,961,312 B2 2/2015 Barney et al.
8,961,412 B2 2/2015 Hafezi et al.
8,961,414 B2 2/2015 Teller et al.
8,965,730 B2 2/2015 Yuen
8,965,824 B2 2/2015 Chun et al.
8,968,196 B2 3/2015 Teller et al.
8,970,392 B2 3/2015 LaLonde et al.
8,971,936 B2 3/2015 Derchak
8,973,197 B2 3/2015 Omidi
8,975,372 B2 3/2015 Ju et al.
8,979,757 B2 3/2015 Mottram et al.
8,979,763 B2 3/2015 Stivoric et al.
8,982,150 B2 3/2015 Odland et al.
8,983,628 B2 3/2015 Simon et al.
8,983,629 B2 3/2015 Simon et al.
8,986,209 B2 3/2015 Brauker et al.
8,989,858 B2 3/2015 Dacey, Jr. et al.
8,989,861 B2 3/2015 Su et al.
8,989,867 B2 3/2015 Chow et al.
8,989,870 B2 3/2015 Johnson et al.
8,990,924 B2 3/2015 Chow
8,994,657 B2 3/2015 Liberty et al.
8,998,815 B2 4/2015 Venkatraman et al.
9,000,973 B2 4/2015 Hyde et al.
9,002,471 B2 4/2015 Stevenson et al.
9,005,129 B2 4/2015 Venkatraman et al.
9,008,724 B2 4/2015 Lord
9,008,762 B2 4/2015 Brockway et al.
9,011,248 B2 4/2015 Ikeda et al.
9,011,361 B2 4/2015 de Juan, Jr. et al.
9,014,661 B2 4/2015 deCharms
9,014,790 B2 4/2015 Richards et al.
9,014,802 B2 4/2015 Dacey, Jr. et al.
9,014,986 B2 4/2015 Krieftewirth
9,017,380 B2 4/2015 Mayer et al.
9,019,106 B2 4/2015 Alameh et al.
9,020,591 B2 4/2015 Dacey, Jr. et al.
9,020,592 B2 4/2015 Dacey, Jr. et al.
9,020,597 B2 4/2015 Sharma et al.
9,026,190 B2 5/2015 Shenasa et al.
9,026,201 B2 5/2015 Zhang et al.
9,026,206 B2 5/2015 Krause et al.
9,026,792 B2 5/2015 Andersen
9,029,736 B2 5/2015 Lavin, Jr.
9,030,335 B2 5/2015 Ellis
9,031,637 B2 5/2015 Ritchey et al.
9,031,669 B2 5/2015 Zhang et al.
9,031,812 B2 5/2015 Roberts et al.
9,033,875 B2 5/2015 Teller et al.
9,033,876 B2 5/2015 Teller et al.
9,033,920 B2 5/2015 Miesel
9,039,533 B2 5/2015 Barney et al.
9,039,614 B2 5/2015 Yuen et al.
9,042,971 B2 5/2015 Brumback et al.
9,042,988 B2 5/2015 DiLorenzo
9,044,149 B2 6/2015 Richards et al.
9,044,150 B2 6/2015 Brumback et al.
9,044,171 B2 6/2015 Venkatraman et al.
9,044,180 B2 6/2015 LeBoeuf et al.
9,044,209 B2 6/2015 Dayton et al.
9,044,612 B2 6/2015 Mashiach et al.
9,044,671 B2 6/2015 Ikeda
9,049,998 B2 6/2015 Brumback et al.
9,050,007 B1 6/2015 Brockway et al.
9,050,041 B2 6/2015 Feldman et al.
9,055,791 B2 6/2015 Proud et al.
9,055,901 B2 6/2015 Brister et al.
9,060,719 B2 6/2015 Hayter et al.
9,060,722 B2 6/2015 Teixeira
9,060,746 B2 6/2015 Weng et al.
9,061,139 B2 6/2015 Stevenson et al.
9,061,147 B2 6/2015 Sharma et al.
9,061,151 B2 6/2015 Mashiach et al.
9,063,529 B2 6/2015 Ellis
9,064,342 B2 6/2015 Yuen et al.
9,066,209 B2 6/2015 Yuen et al.
9,067,073 B2 6/2015 Simms, Jr.
9,072,438 B2 7/2015 Brockway et al.
9,072,447 B2 7/2015 Chow
9,072,560 B2 7/2015 Doherty
9,072,870 B2 7/2015 Wu et al.
9,077,030 B2 7/2015 Norton et al.
9,079,045 B2 7/2015 Cowan et al.
9,079,060 B2 7/2015 Hong et al.
9,081,534 B2 7/2015 Yuen et al.
9,082,011 B2 7/2015 Komogortsev
9,083,589 B2 7/2015 Arne et al.
9,089,182 B2 7/2015 Schrock et al.
9,095,303 B2 8/2015 Osorio
9,100,495 B2 8/2015 Ellis
9,101,260 B2 8/2015 Desu-Kalyanam
9,101,334 B2 8/2015 Rath et al.
9,103,899 B2 8/2015 Hyde et al.
9,104,965 B2 8/2015 Fritsch et al.
9,107,614 B2 8/2015 Halkias et al.
9,107,623 B2 8/2015 Brauker et al.
9,108,098 B2 8/2015 Galasso et al.
9,113,794 B2 8/2015 Hong et al.
9,113,795 B2 8/2015 Hong et al.
9,113,801 B2 8/2015 DiLorenzo
9,113,823 B2 8/2015 Yuen et al.
9,113,844 B2 8/2015 Hollstien
9,119,528 B2 9/2015 Cobelli et al.
9,119,529 B2 9/2015 Hampapuram et al.
9,119,554 B2 9/2015 Zdeblick et al.
9,125,548 B2 9/2015 Hayter
9,125,577 B2 9/2015 Sameni et al.
9,125,981 B2 9/2015 Mann et al.
9,126,825 B2 9/2015 Molin et al.
9,128,015 B2 9/2015 Holmes et al.

(56) References Cited

U.S. PATENT DOCUMENTS

| | | | |
|---|---|---|---|
| 9,131,120 | B2 | 9/2015 | Schofield et al. |
| 9,131,842 | B2 | 9/2015 | Old et al. |
| 9,138,181 | B2 | 9/2015 | Haisley et al. |
| 9,138,523 | B2 | 9/2015 | Burnett et al. |
| 9,138,537 | B2 | 9/2015 | Miesel |
| 9,142,117 | B2 | 9/2015 | Muhsin et al. |
| 9,144,488 | B2 | 9/2015 | Boyden et al. |
| 9,144,489 | B2 | 9/2015 | Boyden et al. |
| 9,148,483 | B1 | 9/2015 | Molettiere et al. |
| RE45,766 | E | 10/2015 | Lindsay |
| 9,149,189 | B2 | 10/2015 | Proud |
| 9,149,577 | B2 | 10/2015 | Robertson et al. |
| 9,149,717 | B2 | 10/2015 | Barney et al. |
| 9,151,834 | B2 | 10/2015 | Hyde et al. |
| 9,155,885 | B2 | 10/2015 | Wei et al. |
| 9,159,223 | B2 | 10/2015 | Proud |
| 9,160,836 | B2 | 10/2015 | Ellis |
| 9,161,693 | B2 | 10/2015 | Rizwan |
| 9,162,148 | B2 | 10/2015 | Barney et al. |
| 9,164,167 | B2 | 10/2015 | Hyde et al. |
| 9,165,117 | B2 | 10/2015 | Teller et al. |
| 9,167,991 | B2 | 10/2015 | Yuen et al. |
| 9,168,001 | B2 | 10/2015 | Stivoric et al. |
| 9,168,374 | B2 | 10/2015 | Su |
| 9,168,419 | B2 | 10/2015 | Hong et al. |
| 9,171,201 | B2 | 10/2015 | Lake, II et al. |
| 9,173,574 | B2 | 11/2015 | Teixeira et al. |
| 9,174,058 | B2 | 11/2015 | Ellingson et al. |
| 9,185,489 | B2 | 11/2015 | Gerber et al. |
| 9,186,509 | B2 | 11/2015 | Nelson et al. |
| 9,186,585 | B2 | 11/2015 | Briggs et al. |
| 9,187,539 | B2 | 11/2015 | Popel et al. |
| 9,189,739 | B2 | 11/2015 | Mott et al. |
| 9,192,328 | B2 | 11/2015 | Brauker et al. |
| 9,192,329 | B2 | 11/2015 | Al-Ali |
| 9,192,816 | B2 | 11/2015 | Molyneux et al. |
| 9,198,478 | B2 | 12/2015 | Meschter et al. |
| 9,198,604 | B2 | 12/2015 | Venkatraman et al. |
| 9,198,911 | B2 | 12/2015 | Christiano et al. |
| 9,201,413 | B2 | 12/2015 | Hanft |
| 9,204,038 | B2 | 12/2015 | Lord et al. |
| 9,204,798 | B2 | 12/2015 | Proud |
| 9,204,806 | B2 | 12/2015 | Stivoric et al. |
| 9,205,264 | B2 | 12/2015 | Heruth et al. |
| 9,207,660 | B2 | 12/2015 | Ellis |
| 9,211,185 | B2 | 12/2015 | Boyden et al. |
| 9,215,290 | B2 | 12/2015 | Yuen et al. |
| 9,215,910 | B2 | 12/2015 | Dhillon |
| 9,218,454 | B2 | 12/2015 | Kiani et al. |
| 9,220,461 | B2 | 12/2015 | Samuelsson et al. |
| 9,226,663 | B2 | 1/2016 | Fei |
| 9,227,128 | B1 | 1/2016 | Carfagna, Jr. |
| 9,227,138 | B2 | 1/2016 | Ikeda |
| 9,233,245 | B2 | 1/2016 | Lamensdorf et al. |
| 9,237,012 | B2 | 1/2016 | Andersen |
| 9,237,855 | B2 | 1/2016 | Hong et al. |
| 9,237,858 | B2 | 1/2016 | Krusor et al. |
| 9,241,635 | B2 | 1/2016 | Yuen et al. |
| 9,247,911 | B2 | 2/2016 | Galloway et al. |
| 9,248,291 | B2 | 2/2016 | Mashiach |
| 9,248,302 | B2 | 2/2016 | Mashiach et al. |
| 9,250,229 | B2 | 2/2016 | Holmes |
| 9,250,716 | B2 | 2/2016 | Sheng et al. |
| 9,251,960 | B2 | 2/2016 | Brendel et al. |
| 9,254,092 | B2 | 2/2016 | Albert et al. |
| 9,259,180 | B2 | 2/2016 | McCaffrey |
| 9,261,978 | B2 | 2/2016 | Liberty et al. |
| 9,265,871 | B2 | 2/2016 | Jeevanandam et al. |
| 9,268,915 | B2 | 2/2016 | Holmes et al. |
| 9,269,251 | B2 | 2/2016 | LaLonde et al. |
| 9,270,025 | B2 | 2/2016 | Robertson et al. |
| 9,271,133 | B2 | 2/2016 | Rodriguez |
| RE45,905 | E | 3/2016 | Ikeda et al. |
| 9,271,857 | B2 | 3/2016 | Pool et al. |
| 9,272,206 | B2 | 3/2016 | Weston et al. |
| 9,277,534 | B2 | 3/2016 | Yun et al. |
| 9,279,734 | B2 | 3/2016 | Walker |
| 9,282,894 | B2 | 3/2016 | Banet et al. |
| 9,282,902 | B2 | 3/2016 | Richards et al. |
| 9,282,925 | B2 | 3/2016 | Kamath et al. |
| 9,288,298 | B2 | 3/2016 | Choudhary et al. |
| 9,288,614 | B1 | 3/2016 | Young et al. |
| 9,289,123 | B2 | 3/2016 | Weibel et al. |
| 9,289,607 | B2 | 3/2016 | Su et al. |
| 9,289,613 | B2 | 3/2016 | Burnes et al. |
| 9,294,074 | B2 | 3/2016 | Brockway |
| 9,295,403 | B1 | 3/2016 | Mirov et al. |
| 9,297,709 | B2 | 3/2016 | Dojan et al. |
| 9,298,282 | B2 | 3/2016 | Liberty |
| 9,301,573 | B2 | 4/2016 | Jasmine |
| 9,302,045 | B2 | 4/2016 | Rule |
| 9,305,559 | B2 | 4/2016 | Sharma et al. |
| 9,307,917 | B2 | 4/2016 | Hong et al. |
| 9,308,381 | B2 | 4/2016 | Mashiach et al. |
| 9,310,909 | B2 | 4/2016 | Myers et al. |
| 9,317,729 | B2 | 4/2016 | Krusor et al. |
| 9,317,743 | B2 | 4/2016 | Datta et al. |
| 9,317,920 | B2 | 4/2016 | Gluncic |
| 9,320,470 | B2 | 4/2016 | Keenan et al. |
| 9,320,677 | B2 | 4/2016 | Johnson et al. |
| 9,320,842 | B2 | 4/2016 | Orhan et al. |
| 9,320,900 | B2 | 4/2016 | DiLorenzo |
| 9,320,976 | B2 | 4/2016 | Weston |
| 9,323,894 | B2 | 4/2016 | Kiani |
| 9,326,566 | B2 | 5/2016 | Beers et al. |
| 9,326,708 | B2 | 5/2016 | Hanson et al. |
| 9,326,711 | B2 | 5/2016 | Kracker et al. |
| 9,326,720 | B2 | 5/2016 | McLaughlin |
| 9,326,730 | B2 | 5/2016 | Boyden et al. |
| 9,327,061 | B2 | 5/2016 | Govil et al. |
| 9,332,919 | B2 | 5/2016 | Crockford |
| 9,333,071 | B2 | 5/2016 | Boyden et al. |
| 9,333,350 | B2 | 5/2016 | Rise et al. |
| 9,339,188 | B2 | 5/2016 | Proud |
| 9,339,201 | B2 | 5/2016 | Banet et al. |
| 9,339,202 | B2 | 5/2016 | Brockway et al. |
| 9,339,203 | B2 | 5/2016 | Banet et al. |
| 9,339,372 | B2 | 5/2016 | Boyden et al. |
| 9,344,546 | B2 | 5/2016 | Choudhary et al. |
| 9,345,404 | B2 | 5/2016 | Proud |
| 9,345,879 | B2 | 5/2016 | Sharma et al. |
| 9,345,892 | B2 | 5/2016 | Corndorf et al. |
| 9,348,974 | B2 | 5/2016 | Goetz |
| 9,351,124 | B1 | 5/2016 | Shelton |
| 9,351,668 | B2 | 5/2016 | Brauker et al. |
| 9,352,156 | B2 | 5/2016 | Lane et al. |
| 9,356,473 | B2 | 5/2016 | Ghovanloo |
| 9,357,922 | B2 | 6/2016 | Proud |
| 9,358,374 | B2 | 6/2016 | Dacey, Jr. et al. |
| 9,358,378 | B2 | 6/2016 | Hanson et al. |
| 9,358,381 | B2 | 6/2016 | Simon et al. |
| 9,358,392 | B2 | 6/2016 | Mashiach |
| 9,361,572 | B2 | 6/2016 | Proud et al. |
| 9,364,042 | B2 | 6/2016 | Bahl et al. |
| 9,364,173 | B2 | 6/2016 | Brauker et al. |
| 9,364,609 | B2 | 6/2016 | Keenan et al. |
| 9,367,793 | B2 | 6/2016 | Proud et al. |
| 9,369,365 | B2 | 6/2016 | Molettiere et al. |
| 9,370,320 | B2 | 6/2016 | Messenger et al. |
| 9,370,326 | B2 | 6/2016 | McHale et al. |
| 9,370,618 | B2 | 6/2016 | Mann et al. |
| 9,370,619 | B2 | 6/2016 | Mann et al. |
| 9,374,279 | B2 | 6/2016 | Yuen et al. |
| 9,375,047 | B2 | 6/2016 | Ellis |
| 9,375,145 | B2 | 6/2016 | Chin et al. |
| 9,375,171 | B2 | 6/2016 | Teixeira |
| 9,380,834 | B2 | 7/2016 | Rushbrook et al. |
| 9,386,360 | B2 | 7/2016 | Sagan et al. |
| 9,386,924 | B2 | 7/2016 | Baker et al. |
| 9,388,873 | B1 | 7/2016 | Phipps et al. |
| 9,390,427 | B2 | 7/2016 | Messenger et al. |
| 9,392,939 | B2 | 7/2016 | Proud |
| 9,393,384 | B1 | 7/2016 | Kapur et al. |
| 9,393,491 | B2 | 7/2016 | Barney et al. |

(56) References Cited

U.S. PATENT DOCUMENTS 9,393,500 B2 7/2016 Barney et al.
9,398,787 B2 7/2016 Ellis, III
9,398,854 B2 7/2016 Proud
9,398,856 B2 7/2016 Abreu
9,398,872 B2 7/2016 Hayter et al.
9,399,134 B2 7/2016 Simon et al.
9,400,598 B2 7/2016 Pixley et al.
9,401,153 B2 7/2016 Sharma et al.
9,402,545 B2 8/2016 Baker et al.
9,402,552 B2 8/2016 Richards et al.
9,403,009 B2 8/2016 Mashiach
9,403,021 B2 8/2016 Dronov
9,408,549 B2 8/2016 Brockway et al.
9,409,018 B2 8/2016 Tourrel et al.
9,410,691 B2 8/2016 Lin
9,410,857 B2 8/2016 Walker
9,410,979 B2 8/2016 Yuen et al.
9,414,641 B2 8/2016 Ellis
9,414,651 B2 8/2016 Proud et al.
9,414,758 B1 8/2016 Brockway et al.
9,414,775 B2 8/2016 Colvin, Jr. et al.
9,415,125 B2 8/2016 Chen et al.
9,415,163 B2 8/2016 Ricotti et al.
9,415,219 B2 8/2016 Simon et al.
9,418,390 B2 8/2016 Chun et al.
9,420,083 B2 8/2016 Roberts et al.
9,420,856 B2 8/2016 Proud et al.
9,420,857 B2 8/2016 Proud et al.
9,420,956 B2 8/2016 Gopalakrishnan et al.
9,420,965 B2 8/2016 Brauker et al.
9,421,388 B2 8/2016 John
9,424,508 B2 8/2016 Proud et al.
9,427,053 B2 8/2016 Proud et al.
9,427,160 B2 8/2016 Proud et al.
9,427,165 B2 8/2016 Finlay et al.
9,427,189 B2 8/2016 Proud et al.
9,427,190 B1 8/2016 Proud
9,427,581 B2 8/2016 Simon et al.
9,431,694 B2 8/2016 Li et al.
9,433,371 B2 9/2016 Hafezi et al.
9,433,376 B2 9/2016 Estes et al.
9,433,783 B2 9/2016 Wei et al.
9,436,903 B2 9/2016 Proud et al.
9,436,923 B1 9/2016 Sriram et al.
9,439,567 B2 9/2016 Carter et al.
9,439,599 B2 9/2016 Thompson et al.
9,440,025 B2 9/2016 Kanderian, Jr. et al.
9,444,503 B2 9/2016 Arne et al.
9,445,651 B2 9/2016 Proud et al.
9,445,730 B2 9/2016 Snyder et al.
9,445,767 B2 9/2016 Abreu
9,446,235 B2 9/2016 Su et al.
9,446,319 B2 9/2016 Barney et al.
9,451,886 B2 9/2016 Teixeira
9,452,258 B2 9/2016 Dobbles et al.
9,452,259 B2 9/2016 Dobbles et al.
9,454,644 B2 9/2016 Cosentino et al.
9,456,755 B2 10/2016 Soykan et al.
9,456,787 B2 10/2016 Venkatraman et al.
9,457,146 B2 10/2016 Dobbles et al.
9,462,856 B2 10/2016 Proud et al.
9,462,962 B2 10/2016 Doerr
9,462,979 B2 10/2016 Lisogurski et al.
9,463,012 B2 10/2016 Bonutti et al.
9,463,277 B2 10/2016 Dobbles et al.
9,463,325 B1 10/2016 Young et al.
9,463,380 B2 10/2016 Weston et al.
9,468,854 B2 10/2016 Briggs et al.
9,474,461 B2 10/2016 Fisher et al.
9,474,855 B2 10/2016 McCann et al.
9,474,888 B2 10/2016 Wiley et al.
9,474,962 B2 10/2016 Barney et al.
9,480,424 B2 11/2016 Darty et al.
9,483,608 B2 11/2016 Hayter et al.
9,486,128 B1 11/2016 Hannaford et al.
9,486,168 B2 11/2016 Bonmassar et al.
9,486,578 B2 11/2016 Finan et al.
9,492,084 B2 11/2016 Behar et al.
9,492,096 B2 11/2016 Brockway et al.
9,492,656 B2 11/2016 Chow et al.
9,492,657 B2 11/2016 Gerber
9,492,678 B2 11/2016 Chow
9,498,137 B2 11/2016 Kovacs
9,498,155 B2 11/2016 Brauker et al.
9,498,195 B2 11/2016 Schutt et al.
9,498,624 B2 11/2016 Bar-Yoseph et al.
9,498,709 B2 11/2016 Ikeda
9,498,728 B2 11/2016 Ikeda et al.
9,501,735 B2 11/2016 Proud et al.
9,504,291 B2 11/2016 Ellis
9,504,408 B2 11/2016 Hong et al.
9,504,425 B2 11/2016 Jooste
9,506,802 B2 11/2016 Chu et al.
9,510,788 B2 12/2016 Galeev
9,514,338 B1 12/2016 Bromberg et al.
9,517,023 B2 12/2016 McMillan et al.
9,517,306 B2 12/2016 Morales
9,520,638 B2 12/2016 Baringer et al.
9,521,868 B2 12/2016 Cobbett et al.
9,521,962 B2 12/2016 LeBoeuf
9,522,282 B2 12/2016 Chow et al.
9,522,317 B2 12/2016 Bleich et al.
9,526,422 B2 12/2016 Proud
9,526,430 B2 12/2016 Srinivas et al.
9,526,433 B2 12/2016 Lapetina et al.
9,526,650 B2 12/2016 Pool et al.
9,526,834 B2 12/2016 Keenan et al.
9,526,859 B2 12/2016 Rembrand
9,529,972 B2 12/2016 Giftakis et al.
9,530,089 B2 12/2016 Proud et al.
9,532,716 B2 1/2017 Proud
9,532,722 B2 1/2017 Lamego et al.
9,532,738 B2 1/2017 Delbeke et al.
9,533,157 B2 1/2017 Chow
9,538,921 B2 1/2017 LeBoeuf et al.
9,538,922 B2 1/2017 Wang
9,539,037 B2 1/2017 Janna et al.
9,542,685 B2 1/2017 Proud et al.
9,542,706 B2 1/2017 Case, Jr.
9,543,636 B2 1/2017 Baringer et al.
9,545,506 B2 1/2017 Quigley
9,549,585 B2 1/2017 Amos et al.
9,553,486 B2 1/2017 Proud et al.
9,554,705 B2 1/2017 Huang
9,554,719 B2 1/2017 Banet et al.
9,559,353 B2 1/2017 Norton et al.
9,561,367 B2 2/2017 Sharma et al.
9,564,777 B2 2/2017 Yeh et al.
9,565,512 B2 2/2017 Rhoads et al.
9,568,492 B2 2/2017 Yuen
9,569,719 B2 2/2017 Proud et al.
9,569,720 B2 2/2017 Proud et al.
9,569,771 B2 2/2017 Lesavich et al.
9,572,395 B2 2/2017 Roser
9,572,499 B2 2/2017 Gopalakrishnan et al.
9,572,533 B2 2/2017 Venkatraman et al.
9,572,935 B2 2/2017 Dobbles et al.
9,572,936 B2 2/2017 Dobbles et al.
9,572,992 B2 2/2017 Shahandeh et al.
9,575,570 B2 2/2017 Liberty et al.
9,576,236 B2 2/2017 Proud et al.
9,577,992 B2 2/2017 Zizi et al.
9,578,903 B2 2/2017 Cobbett et al.
9,579,020 B2 2/2017 Libbus et al.
9,579,048 B2 2/2017 Rayner et al.
9,579,060 B1 2/2017 Lisy et al.
9,579,422 B2 2/2017 Ju et al.
9,579,510 B2 2/2017 Meskens
9,579,516 B2 2/2017 Kaib et al.
9,579,568 B2 2/2017 Barney et al.
9,582,748 B2 2/2017 Proud et al.
9,582,749 B2 2/2017 Proud et al.
9,583,256 B2 2/2017 Lapetina et al.
9,585,566 B2 3/2017 Samuelsson et al.

(56) References Cited

U.S. PATENT DOCUMENTS 9,585,606 B2 3/2017 Lisogurski
9,585,722 B2 3/2017 Ritchey et al.
9,586,004 B2 3/2017 Dobbles et al.
9,590,986 B2 3/2017 Zizi et al.
9,592,328 B2 3/2017 Jeevanandam et al.
9,592,379 B2 3/2017 Heruth et al.
9,592,508 B2 3/2017 Holmes et al.
9,595,996 B2 3/2017 Yun et al.
9,596,997 B1 3/2017 Ritscher et al.
9,597,014 B2 3/2017 Venkatraman et al.
9,597,023 B2 3/2017 Lisogurski
9,597,453 B2 3/2017 Dobbles et al.
9,597,505 B2 3/2017 Donofrio et al.
9,599,632 B2 3/2017 Yuen
9,600,676 B1 3/2017 Farmer et al.
9,603,416 B1 3/2017 Walsh et al.
9,603,569 B2 3/2017 Mirov et al.
9,603,997 B2 3/2017 Humayun et al.
9,610,391 B2 4/2017 Vollmers et al.
9,613,184 B2 4/2017 Giftakis et al.
9,614,337 B2 4/2017 Lisogurski et al.
9,615,215 B2 4/2017 Yuen et al.
9,615,794 B2 4/2017 Kaskoun et al.
9,616,225 B2 4/2017 Sharma et al.
9,616,334 B2 4/2017 Weston et al.
9,622,537 B2 4/2017 Amos et al.
9,622,691 B2 4/2017 Budiman
9,623,179 B2 4/2017 Mastrototaro et al.
9,623,238 B2 4/2017 Sharma et al.
9,623,240 B2 4/2017 Simon et al.
9,623,248 B2 4/2017 Heruth et al.
9,629,418 B2 4/2017 Rushbrook et al.
9,629,558 B2 4/2017 Yuen et al.
9,632,102 B2 4/2017 Holmes et al.
9,633,170 B2 4/2017 Goetz
9,634,921 B2 4/2017 Proud et al.
9,635,901 B1 5/2017 Morrison et al.
9,636,509 B2 5/2017 Hintz
9,639,170 B2 5/2017 Yuen et al.
9,641,239 B2 5/2017 Panther et al.
9,641,342 B2 5/2017 Sriram et al.
9,641,469 B2 5/2017 Choudhary et al.
9,642,414 B2 5/2017 Lindsay et al.
9,645,143 B2 5/2017 Holmes et al.
9,646,481 B2 5/2017 Messenger et al.
9,648,926 B2 5/2017 Marks
9,649,036 B2 5/2017 Teixeira
9,651,533 B2 5/2017 Islam
9,652,838 B1 5/2017 Manmatha et al.
9,655,405 B2 5/2017 Hamill
9,655,519 B2 5/2017 Darty et al.
9,655,548 B2 5/2017 Hong et al.
9,655,558 B2 5/2017 Proud et al.
9,655,565 B2 5/2017 Hampapuram et al.
9,658,066 B2 5/2017 Yuen et al.
9,659,484 B1 5/2017 Mehta et al.
9,662,015 B2 5/2017 Proud et al.
9,662,053 B2 5/2017 Richards et al.
9,662,262 B2 5/2017 Hollander et al.
9,662,445 B2 5/2017 Parikh et al.
9,664,556 B2 5/2017 Chu et al.
9,664,702 B2 5/2017 Holmes et al.
9,669,262 B2 6/2017 Yuen et al.
9,672,393 B1 6/2017 Zhu et al.
9,672,715 B2 6/2017 Roberts et al.
9,672,754 B2 6/2017 Yuen et al.
9,675,273 B2 6/2017 Gluncic
9,675,290 B2 6/2017 Budiman et al.
9,675,809 B2 6/2017 Chow
9,675,878 B2 6/2017 Barney et al.
9,680,831 B2 6/2017 Jooste et al.
9,681,814 B2 6/2017 Galloway et al.
9,681,842 B2 6/2017 Zdeblick et al.
9,685,802 B1 6/2017 Mirov et al.
9,687,194 B2 6/2017 Cantwell et al.
9,687,577 B2 6/2017 Dobrinsky et al.
9,687,658 B2 6/2017 Wu et al.
9,692,230 B2 6/2017 Biederman et al.
9,692,844 B2 6/2017 Messenger et al.
9,692,984 B2 6/2017 Lord
9,693,605 B2 7/2017 Beers
9,693,696 B2 7/2017 Kovacs et al.
9,693,777 B2 7/2017 Schellin et al.
9,696,199 B2 7/2017 Chu et al.
9,700,222 B2 7/2017 Quinlan et al.
9,700,223 B2 7/2017 Quinlan et al.
9,700,234 B2 7/2017 Mickle et al.
9,700,253 B2 7/2017 Estes et al.
9,700,806 B2 7/2017 Ikeda et al.
9,704,209 B2 7/2017 Proud et al.
9,706,956 B2 7/2017 Brockway et al.
9,706,957 B2 7/2017 Wu et al.
9,706,963 B2 7/2017 Gupta et al.
9,706,964 B2 7/2017 Ferber et al.
9,707,466 B2 7/2017 Bleich et al.
9,707,478 B2 7/2017 Barney et al.
9,709,971 B2 7/2017 Ellis
9,712,629 B2 7/2017 Molettiere et al.
9,713,445 B2 7/2017 Freeman et al.
9,713,701 B2 7/2017 Sarkar et al.
9,713,766 B2 7/2017 Barney et al.
9,715,012 B2 7/2017 Fernandes et al.
9,719,990 B2 8/2017 Holmes et al.
9,723,898 B2 8/2017 Proud et al.
9,723,986 B1 8/2017 Mullin et al.
9,724,098 B2 8/2017 Baxter, III et al.
9,724,183 B2 8/2017 Mayer et al.
9,724,509 B2 8/2017 Su et al.
9,724,510 B2 8/2017 Sharma et al.
9,724,511 B2 8/2017 Wei et al.
9,724,517 B2 8/2017 Giftakis et al.
9,724,521 B2 8/2017 Cong et al.
9,724,562 B2 8/2017 Bailly et al.
9,730,025 B2 8/2017 Yuen et al.
9,730,601 B2 8/2017 Sarkar et al.
9,730,619 B2 8/2017 Messenger et al.
9,730,625 B2 8/2017 Krasnow et al.
9,731,104 B2 8/2017 Linden et al.
9,731,194 B2 8/2017 Briggs et al.
9,732,322 B2 8/2017 Dalton et al.
9,734,304 B2 8/2017 Blackadar et al.
9,734,527 B2 8/2017 Collier et al.
9,736,603 B2 8/2017 Osborne et al.
9,737,249 B2 8/2017 Hayter et al.
9,737,263 B1 8/2017 Kumar et al.
9,737,797 B2 8/2017 Barney et al.
9,743,861 B2 8/2017 Giedwoyn et al.
9,747,431 B2 8/2017 Chow
9,749,232 B2 8/2017 Sampath et al.
9,750,441 B2 9/2017 Brauker et al.
9,750,977 B2 9/2017 Yuen et al.
9,752,925 B2 9/2017 Chu et al.
9,755,704 B2 9/2017 Hviid et al.
9,756,169 B2 9/2017 Mehta et al.
9,756,895 B2 9/2017 Rice et al.
9,757,040 B2 9/2017 Islam
9,757,124 B2 9/2017 Schellin et al.
9,757,302 B2 9/2017 Mayer
9,757,510 B2 9/2017 Finan
9,763,489 B2 9/2017 Amos et al.
9,763,490 B2 9/2017 Seiler
9,763,616 B2 9/2017 Dugan
9,764,050 B1 9/2017 Almeida et al.
9,766,959 B2 9/2017 Faaborg et al.
9,769,564 B2 9/2017 Goran et al.
9,770,185 B2 9/2017 Wheeler et al.
9,770,652 B2 9/2017 Barney et al.
9,774,298 B2 9/2017 Kuroda et al.
9,775,543 B2 10/2017 Brister et al.
9,775,987 B2 10/2017 Donofrio et al.
9,776,041 B1 10/2017 Lachwani et al.
9,776,042 B2 10/2017 Prokhorov
9,777,817 B2 10/2017 Strom et al.
9,778,280 B2 10/2017 Yuen et al.

(56) References Cited

U.S. PATENT DOCUMENTS 9,779,502 B1 10/2017 Lovberg et al.
9,782,084 B2 10/2017 Maertz
9,782,125 B2 10/2017 Berner, Jr. et al.
9,782,132 B2 10/2017 Golda et al.
9,788,785 B2 10/2017 LeBoeuf
9,789,252 B2 10/2017 Gerber et al.
9,789,309 B2 10/2017 Sharma et al.
9,789,315 B2 10/2017 Dacey, Jr. et al.
9,795,323 B2 10/2017 Yuen et al.
9,795,737 B2 10/2017 Finan et al.
9,795,782 B2 10/2017 Krusor et al.
9,797,880 B2 10/2017 Hayter et al.
9,801,547 B2 10/2017 Yuen et al.
9,801,571 B2 10/2017 Hayter
9,801,577 B2 10/2017 Budiman et al.
9,804,150 B2 10/2017 Hayter et al.
9,804,672 B2 10/2017 Anderson et al.
9,808,198 B2 11/2017 Takahashi et al.
9,808,204 B2 11/2017 LeBoeuf et al.
9,810,591 B2 11/2017 Walker
9,810,704 B2 11/2017 Holmes et al.
9,811,730 B2 11/2017 Komogortsev
9,814,388 B2 11/2017 Soro et al.
9,814,400 B1 11/2017 Cendrillon et al.
9,814,886 B2 11/2017 Zhou et al.
9,814,973 B2 11/2017 Barney et al.
9,817,440 B2 11/2017 Longinotti-Buitoni et al.
9,818,092 B2 11/2017 Pennanen
9,820,120 B2 11/2017 deCharms
9,820,698 B2 11/2017 Fonseca et al.
9,826,903 B2 11/2017 Derchak
9,826,922 B2 11/2017 Datta et al.
9,826,940 B1 11/2017 Lengerich
9,826,963 B2 11/2017 Scott et al.
9,827,372 B2 11/2017 Dobbles et al.
9,830,781 B2 11/2017 Mirov et al.
9,833,254 B1 12/2017 Barral et al.
9,833,353 B2 12/2017 Witt et al.
9,836,896 B2 12/2017 Zizi et al.
9,839,422 B2 12/2017 Schellin et al.
9,839,423 B2 12/2017 Vendely et al.
9,846,231 B2 12/2017 D'Angelo et al.
9,847,006 B2 12/2017 Asano
9,847,012 B2 12/2017 Zomet et al.
9,848,668 B2 12/2017 Smith, III
9,848,789 B2 12/2017 Hu et al.
9,849,239 B2 12/2017 Grosman et al.
9,849,364 B2 12/2017 Tran et al.
9,852,736 B2 12/2017 Sharma et al.
9,853,819 B2 12/2017 Truu et al.
9,853,976 B2 12/2017 Zizi et al.
9,854,370 B2 12/2017 Meskens
9,854,872 B2 1/2018 Bertagna et al.
9,854,986 B2 1/2018 Quinlan et al.
9,855,433 B2 1/2018 Shahandeh et al.
9,855,785 B1 1/2018 Nagelberg et al.
9,861,165 B2 1/2018 Schneider et al.
9,861,286 B1 1/2018 Islam
9,861,887 B1 1/2018 Briggs et al.
9,862,222 B1 1/2018 Nagelberg et al.
9,863,823 B2 1/2018 McMillen et al.
9,864,842 B2 1/2018 Hyde et al.
9,868,332 B2 1/2018 Anderson et al.
9,869,973 B2 1/2018 Raymann et al.
9,872,652 B2 1/2018 Salehizadeh et al.
9,872,968 B2 1/2018 de Zambotti et al.
9,874,923 B1 1/2018 Brown et al.
9,876,537 B2 1/2018 Zhu et al.
9,877,523 B2 1/2018 Ellis
9,877,650 B2 1/2018 Muhsin et al.
9,878,096 B2 1/2018 Roy et al.
9,878,159 B2 1/2018 Mashiach
9,879,741 B2 1/2018 Phipps et al.
9,882,610 B1 1/2018 Baker et al.
9,883,800 B2 2/2018 Pekander
9,884,150 B2 2/2018 Jho et al.
9,884,456 B2 2/2018 Schellin et al.
9,885,698 B2 2/2018 Islam
9,886,845 B2 2/2018 Rhoads et al.
9,888,848 B2 2/2018 Samuelsson et al.
9,889,305 B1 2/2018 Hellman et al.
9,894,691 B1 2/2018 Hellman et al.
9,895,063 B1 2/2018 Hannaford et al.
9,895,301 B2 2/2018 Christiano et al.
9,897,985 B2 2/2018 Zeltzer
9,900,287 B1 2/2018 Jooste et al.
9,900,669 B2 2/2018 Touma et al.
9,901,269 B2 2/2018 Hu et al.
9,901,276 B2 2/2018 Sarkar
9,901,305 B2 2/2018 Massey et al.
9,901,741 B2 2/2018 Chapman et al.
9,905,105 B1 2/2018 Ikonen et al.
9,907,909 B2 3/2018 Finan et al.
9,913,509 B2 3/2018 Case, Jr.
9,913,591 B2 3/2018 Lapetina et al.
9,913,599 B2 3/2018 Bernstein et al.
9,913,617 B2 3/2018 Al-Ali et al.
9,913,619 B2 3/2018 Budiman
9,918,183 B2 3/2018 Rhoads et al.
9,918,646 B2 3/2018 Singh Alvarado et al.
9,918,716 B2 3/2018 Baxter, III et al.
9,919,099 B2 3/2018 Tai et al.
9,921,726 B1 3/2018 Sculley et al.
9,922,380 B2 3/2018 Isaacson et al.
9,922,381 B2 3/2018 Isaacson et al.
9,924,760 B2 3/2018 Molyneux et al.
9,931,040 B2 4/2018 Homyk et al.
9,931,578 B2 4/2018 Weston
9,936,763 B2 4/2018 Semperlotti et al.
9,936,890 B2 4/2018 Sarkar et al.
9,936,910 B2 4/2018 Hayter et al.
9,936,916 B2 4/2018 Sahin
9,936,919 B2 4/2018 Baxi et al.
9,942,304 B2 4/2018 Gold
9,943,247 B2 4/2018 Ernst et al.
9,943,267 B2 4/2018 Ferber et al.
9,943,269 B2 4/2018 Muhsin et al.
9,943,461 B1 4/2018 Muench et al.
9,943,697 B2 4/2018 John
9,943,719 B2 4/2018 Smith et al.
9,946,356 B2 4/2018 Liberty
9,950,166 B2 4/2018 Mashiach et al.
9,950,236 B1 4/2018 Jooste et al.
9,952,095 B1 4/2018 Hotelling et al.
9,952,240 B2 4/2018 Holmes et al.
9,953,041 B2 4/2018 Hilsdale et al.
9,955,919 B2 5/2018 LeBoeuf et al.
9,956,393 B2 5/2018 Perez et al.
9,956,470 B2 5/2018 Bleich et al.
9,961,963 B2 5/2018 Schneider et al.
9,965,059 B2 5/2018 Myers et al.
9,968,159 B2 5/2018 Morrison et al.
9,968,238 B2 5/2018 Patel et al.
9,968,788 B2 5/2018 Ecker et al.
9,974,484 B2 5/2018 Kaskoun et al.
9,974,705 B2 5/2018 Rapoport
9,975,196 B2 5/2018 Zhang et al.
9,977,578 B1 5/2018 Pereira et al.
9,980,535 B2 5/2018 Bohnsack et al.
9,984,549 B2 5/2018 Poisner et al.
9,985,825 B2 5/2018 Huang
9,986,771 B2 6/2018 Longinotti-Buitoni et al.
9,986,782 B2 6/2018 Odland et al.
9,986,924 B2 6/2018 Rogers et al.
9,987,489 B2 6/2018 Goodall et al.
9,987,497 B2 6/2018 Kaib et al.
9,991,920 B2 6/2018 Sadasivam et al.
9,993,207 B2 6/2018 Al-Ali et al.
9,993,724 B2 6/2018 Barney et al.
9,998,804 B2 6/2018 Awiszus et al.
9,999,355 B2 6/2018 Kirenko
9,999,728 B2 6/2018 Parikh et al.
10,002,233 B2 6/2018 Hayter et al.
10,003,862 B2 6/2018 Rowland et al.

(56) References Cited

U.S. PATENT DOCUMENTS 10,004,406 B2 6/2018 Yuen et al.
10,004,949 B2 6/2018 Brothers et al.
10,005,564 B1 6/2018 Bhatia et al.
10,007,758 B2 6/2018 Al-Ali et al.
10,008,090 B2 6/2018 Yuen et al.
10,010,129 B2 7/2018 Beers et al.
10,010,278 B2 7/2018 Darty et al.
10,010,753 B2 7/2018 Brothers et al.
10,010,790 B2 7/2018 Weston et al.
10,012,664 B2 7/2018 Wasson et al.
10,012,969 B2 7/2018 Ellis
10,013,633 B1 7/2018 Manmatha et al.
10,016,015 B2 7/2018 Ellis, III
10,016,613 B2 7/2018 Kavounas
10,018,643 B2 7/2018 Holmes et al.
10,021,733 B2 7/2018 Hellman et al.
10,022,061 B2 7/2018 Quinlan et al.
10,022,062 B1 7/2018 Krusor et al.
10,022,613 B2 7/2018 Tran et al.
10,022,614 B1 7/2018 Tran et al.
10,022,624 B2 7/2018 Barney et al.
10,024,660 B2 7/2018 Otis et al.
10,024,740 B2 7/2018 Rice et al.
10,025,973 B2 7/2018 Datta et al.
10,026,118 B2 7/2018 Castinado et al.
10,026,410 B2 7/2018 Gurijala et al.
10,028,037 B2 7/2018 Gartseev et al.
10,028,659 B2 7/2018 Schwartz et al.
10,028,660 B2 7/2018 Mullin et al.
10,028,706 B2 7/2018 Brockway et al.
10,028,743 B2 7/2018 Shelton, IV et al.
10,029,172 B2 7/2018 Galasso et al.
10,031,002 B2 7/2018 Hayter et al.
10,032,002 B2 7/2018 Kiani et al.
10,034,512 B2 7/2018 Rushbrook et al.
10,034,625 B1 7/2018 Schwartz et al.
10,034,743 B2 7/2018 Boyden et al.
10,039,113 B2 7/2018 Ogrinz
10,039,661 B2 8/2018 Pool et al.
10,039,928 B2 8/2018 Hyde et al.
10,043,354 B2 8/2018 Mirov et al.
10,045,117 B2 8/2018 Boesen et al.
10,045,439 B2 8/2018 Longinotti-Buitoni et al.
10,045,713 B2 8/2018 Old et al.
10,045,720 B2 8/2018 Hayter et al.
10,045,764 B2 8/2018 Scott et al.
10,045,798 B2 8/2018 Beyar et al.
10,046,113 B2 8/2018 Ruchti et al.
10,046,228 B2 8/2018 Tran et al.
10,049,187 B2 8/2018 Chait et al.
10,051,912 B2 8/2018 Darden et al.
10,052,486 B2 8/2018 Denison et al.
10,054,909 B2 8/2018 Raymann et al.
10,055,550 B2 8/2018 Goetz
10,055,715 B1 8/2018 Grassadonia et al.
10,058,146 B2 8/2018 Meschter et al.
10,058,274 B2 8/2018 Kracker
10,060,788 B2 8/2018 Fei
10,061,911 B2 8/2018 Zizi et al.
10,064,562 B2 9/2018 Al-Ali
10,064,624 B2 9/2018 Shelton, IV et al.
10,066,203 B2 9/2018 Fryer et al.
10,070,680 B2 9/2018 Molyneux et al.
10,070,683 B2 9/2018 Rushbrook et al.
10,070,805 B1 9/2018 Friedman et al.
10,070,992 B2 9/2018 Pagani
10,071,285 B2 9/2018 Smith et al.
10,076,282 B2 9/2018 LeBoeuf et al.
10,076,462 B2 9/2018 Johnson et al.
10,078,839 B1 9/2018 Mullins et al.
10,080,498 B1 9/2018 Gibson
10,080,499 B2 9/2018 Kuhn
10,080,527 B2 9/2018 Golda et al.
10,080,530 B2 9/2018 Cheng et al.
10,085,643 B2 10/2018 Bandic et al.
10,088,356 B2 10/2018 Chu et al.
10,089,446 B2 10/2018 Budiman
10,092,065 B2 10/2018 Rushbrook et al.
10,092,193 B2 10/2018 Mestek et al.
10,092,203 B2 10/2018 Mirov
10,092,355 B1 10/2018 Hannaford et al.
10,092,692 B2 10/2018 Dacey, Jr. et al.
10,093,112 B1 10/2018 Irizarry et al.
10,095,649 B2 10/2018 Joshua et al.
10,095,837 B2 10/2018 Corey et al.
10,097,179 B2 10/2018 Yang et al.
10,098,546 B2 10/2018 Islam
10,098,548 B2 10/2018 Abreu
10,098,549 B2 10/2018 Tan et al.
10,098,558 B2 10/2018 Huiku
10,098,810 B1 10/2018 Muench et al.
10,099,053 B2 10/2018 Hyde et al.
10,103,936 B2 10/2018 Kurian et al.
10,104,026 B2 10/2018 Choudhary et al.
10,105,080 B1 10/2018 Kam et al.
10,105,081 B2 10/2018 Delbeke et al.
10,105,100 B2 10/2018 Biederman et al.
10,105,487 B2 10/2018 DiPierro et al.
10,105,547 B2 10/2018 Gustavson et al.
10,106,222 B1 10/2018 Teksler
10,108,785 B2 10/2018 Kamen et al.
10,108,938 B1 10/2018 Brock et al.
10,109,175 B2 10/2018 Roberts et al.
10,111,496 B2 10/2018 Schneider et al.
10,115,068 B2 10/2018 Vivier
10,117,600 B2 11/2018 Keen et al.
10,117,606 B2 11/2018 Feldman et al.
10,117,621 B2 11/2018 Berger et al.
10,118,035 B2 11/2018 Perez et al.
10,118,041 B2 11/2018 Goetz et al.
10,119,715 B2 11/2018 Hou et al.
10,119,956 B2 11/2018 Hayter et al.
10,120,888 B2 11/2018 Almasan et al.
10,121,186 B2 11/2018 Isaacson et al.
10,122,421 B2 11/2018 Hviid et al.
10,123,098 B2 11/2018 Case, Jr.
10,123,679 B2 11/2018 Desu-Kalyanam
10,124,179 B2 11/2018 Norton et al.
10,124,182 B2 11/2018 Kivi et al.
10,126,283 B2 11/2018 Islam
10,126,998 B2 11/2018 Yuen et al.
10,127,247 B1 11/2018 Arora et al.
10,129,032 B2 11/2018 Vandervort
10,130,305 B2 11/2018 Moya et al.
10,130,476 B2 11/2018 Nycz et al.
10,130,550 B2 11/2018 Zipper
10,130,767 B2 11/2018 Grosman et al.
10,132,677 B2 11/2018 Chu et al.
10,135,076 B1 11/2018 Liu
10,135,835 B1 11/2018 Kandel et al.
10,136,817 B2 11/2018 Baker et al.
10,136,819 B2 11/2018 Islam
10,136,842 B2 11/2018 Ashby
10,137,230 B2 11/2018 Novack
10,137,365 B2 11/2018 Ikeda
10,140,842 B2 11/2018 Mehta et al.
10,141,073 B2 11/2018 Chin et al.
10,142,312 B2 11/2018 Johnsrud et al.
10,143,395 B2 12/2018 Chakravarthy et al.
10,143,409 B2 12/2018 Hayter
10,143,426 B2 12/2018 Hampapuram et al.
10,143,840 B2 12/2018 Perez et al.
10,143,847 B1 12/2018 Edmonson et al.
10,147,076 B2 12/2018 Zhou et al.
10,149,616 B2 12/2018 Al-Ali et al.
10,151,648 B2 12/2018 Walker
10,152,756 B2 12/2018 Isaacson et al.
10,152,957 B2 12/2018 Lenhert
10,153,537 B2 12/2018 Baringer et al.
10,154,129 B2 12/2018 Repka et al.
10,154,789 B2 12/2018 Raghuram et al.
10,154,922 B1 12/2018 Perez et al.
10,155,110 B2 12/2018 Finch et al.
10,155,170 B2 12/2018 Ikeda et al.

(56) References Cited

U.S. PATENT DOCUMENTS 10,159,415 B2 12/2018 Gopalakrishnan et al.
10,159,897 B2 12/2018 Penzias et al.
10,160,251 B1 12/2018 Nagelberg et al.
10,163,079 B1 12/2018 Brock et al.
10,163,080 B2 12/2018 Chow et al.
10,163,314 B2 12/2018 Tofighbakhsh
10,164,685 B2 12/2018 Dobyns et al.
10,164,952 B2 12/2018 Vandervort
10,165,977 B2 1/2019 Wu et al.
10,166,164 B2 1/2019 Johnson et al.
10,166,333 B2 1/2019 Friedli et al.
10,168,693 B2 1/2019 Kingston et al.
10,170,135 B1 1/2019 Pearce et al.
10,172,396 B2 1/2019 Ellis
10,172,409 B1 1/2019 Andon
10,172,423 B2 1/2019 Walker et al.
10,172,523 B2 1/2019 Islam
10,176,412 B2 1/2019 Geissler et al.
10,176,418 B1 1/2019 Osborn et al.
10,176,481 B2 1/2019 Aljawhari
10,178,105 B2 1/2019 Kurian et al.
10,178,890 B1 1/2019 Andon et al.
10,178,973 B2 1/2019 Venkatraman et al.
10,179,064 B2 1/2019 Connor
10,179,065 B2 1/2019 Drnek et al.
10,179,246 B2 1/2019 Schneider et al.
10,179,283 B2 1/2019 Barney et al.
10,182,336 B1 1/2019 Stockton et al.
10,182,608 B2 1/2019 Smith et al.
10,182,729 B2 1/2019 Zielinski et al.
10,182,744 B2 1/2019 Amos et al.
10,182,819 B2 1/2019 Shelton, IV
10,186,760 B2 1/2019 Heppell
10,188,173 B1 1/2019 Walsh et al.
10,188,296 B2 1/2019 Al-Ali et al.
10,188,299 B2 1/2019 Islam
10,188,319 B2 1/2019 Schwartz et al.
10,188,334 B2 1/2019 Budiman et al.
10,188,394 B2 1/2019 Shelton, IV et al.
10,188,953 B2 1/2019 Barney et al.
10,192,198 B2 1/2019 Nazzari et al.
10,193,695 B1 1/2019 Endress et al.
10,194,418 B2 1/2019 Blahnik et al.
10,194,702 B2 2/2019 Cobbett et al.
10,194,714 B2 2/2019 McGinnity et al.
10,194,802 B2 2/2019 Windolf
10,194,808 B1 2/2019 Thompson et al.
10,194,809 B2 2/2019 Mirov et al.
10,194,816 B2 2/2019 Perschbacher et al.
10,194,836 B2 2/2019 Venkatraman et al.
10,194,850 B2 2/2019 Kovatchev et al.
10,195,513 B2 2/2019 Tran et al.
10,196,596 B2 2/2019 Glazier et al.
10,200,199 B2 2/2019 Truu et al.
10,200,834 B2 2/2019 Tran et al.
10,201,283 B2 2/2019 Islam
10,201,295 B2 2/2019 Wasson et al.
10,201,702 B2 2/2019 Bonde et al.
10,204,160 B1 2/2019 Yelton et al.
10,207,041 B2 2/2019 Soykan et al.
10,209,365 B2 2/2019 Venkatraman et al.
10,210,741 B2 2/2019 Chen et al.
10,213,113 B2 2/2019 Islam
10,213,150 B2 2/2019 Leschinsky
10,215,619 B1 2/2019 Kovacs
10,218,433 B2 2/2019 Panther et al.
10,219,746 B2 3/2019 McHale et al.
10,219,754 B1 3/2019 Lamego
10,220,217 B2 3/2019 Chow et al.
10,222,283 B2 3/2019 Thillainadarajah et al.
10,223,459 B2 3/2019 Liu et al.
10,225,085 B2 3/2019 Drouin et al.
10,226,082 B2 3/2019 Ellis
10,226,187 B2 3/2019 Al-Ali et al.
10,226,188 B2 3/2019 Watson et al.
10,226,217 B2 3/2019 Dubin et al.
10,226,396 B2 3/2019 Ashby
10,227,063 B2 3/2019 Abreu
10,230,699 B2 3/2019 Juels
10,231,666 B2 3/2019 Zuckerman-Stark et al.
10,231,784 B2 3/2019 Hettrick et al.
10,234,330 B2 3/2019 Fei
10,234,340 B2 3/2019 Severinkangas et al.
10,234,942 B2 3/2019 Connor
10,236,006 B1 3/2019 Gurijala et al.
10,238,978 B2 3/2019 Ikeda et al.
10,248,302 B2 4/2019 Raymann et al.
10,248,985 B2 4/2019 Rohr et al.
10,251,571 B1 4/2019 Cendrillon et al.
10,251,595 B2 4/2019 Heruth et al.
10,251,601 B2 4/2019 Berner, Jr. et al.
10,252,140 B1 4/2019 Jooste et al.
10,255,994 B2 4/2019 Sampath et al.
10,258,092 B2 4/2019 Longinotti-Buitoni et al.
10,258,288 B2 4/2019 Penders et al.
10,258,828 B2 4/2019 Dalebout et al.
10,261,069 B2 4/2019 Hayter et al.
10,264,971 B1 4/2019 Kennedy et al.
10,269,452 B2 4/2019 Volpe
10,271,587 B2 4/2019 Cobbett et al.
10,271,792 B2 4/2019 Inagaki
10,272,242 B2 4/2019 Sharma et al.
10,275,640 B2 4/2019 Seuss et al.
10,277,963 B2 4/2019 Case, Jr.
10,278,217 B2 4/2019 Wu et al.
10,278,624 B2 5/2019 Short et al.
10,279,152 B2 5/2019 Kapur et al.
10,279,200 B2 5/2019 Hyde et al.
10,279,201 B2 5/2019 Hyde et al.
10,284,537 B2 5/2019 Liu et al.
10,289,098 B2 5/2019 Livaccari et al.
10,289,806 B2 5/2019 Hyde et al.
10,292,453 B2 5/2019 Bertagna et al.
10,292,611 B2 5/2019 Katra et al.
10,292,631 B1 5/2019 Homyk et al.
10,293,158 B2 5/2019 Goodall et al.
10,293,184 B2 5/2019 Pishdad et al.
10,293,208 B2 5/2019 Bailly et al.
10,293,565 B1 5/2019 Tran et al.
10,299,693 B2 5/2019 Sarkar et al.
10,299,722 B1 5/2019 Tran et al.
10,299,725 B2 5/2019 Mirov et al.
10,299,734 B2 5/2019 Watson et al.
10,299,736 B2 5/2019 Najafi et al.
10,300,283 B2 5/2019 Miesel et al.
10,300,303 B2 5/2019 Brooks et al.
10,300,374 B2 5/2019 Briggs et al.
10,302,469 B2 5/2019 Bhatt et al.
10,305,692 B2 5/2019 Peterson
10,306,726 B2 5/2019 Wilken et al.
10,307,081 B2 6/2019 Nino et al.
10,307,101 B1 6/2019 Miller et al.
10,307,111 B2 6/2019 Muhsin et al.
10,307,671 B2 6/2019 Barney et al.
10,307,683 B2 6/2019 Weston
10,311,451 B2 6/2019 McCormack
10,311,696 B2 6/2019 Janssen
10,311,706 B2 6/2019 M et al.
10,314,488 B2 6/2019 Samuelsson et al.
10,314,546 B2 6/2019 Lisogurski et al.
10,314,547 B2 6/2019 Miller et al.
10,314,928 B2 6/2019 Dobrinsky et al.
10,321,732 B2 6/2019 Folske et al.
10,325,681 B2 6/2019 Sampath et al.
10,327,672 B2 6/2019 Giedwoyn et al.
10,327,674 B2 6/2019 Hong et al.
10,327,689 B2 6/2019 Krasnow et al.
10,327,708 B2 6/2019 Yu et al.
10,327,984 B2 6/2019 Goodall et al.
10,328,228 B2 6/2019 Zapol et al.
10,328,266 B2 6/2019 Whiting et al.
10,332,315 B2 6/2019 Samec et al.
10,333,932 B2 6/2019 Zizi et al.
10,334,906 B1 7/2019 Andon et al.

(56) References Cited

U.S. PATENT DOCUMENTS 10,339,352 B2 7/2019 Ackley et al.
10,339,654 B2 7/2019 Lovberg et al.
10,349,872 B2 7/2019 Varsavsky et al.
10,352,787 B2 7/2019 McMillen et al.
10,357,078 B2 7/2019 Rice et al.
10,357,210 B2 7/2019 Zizi et al.
10,358,106 B2 7/2019 Sumiya et al.
10,362,830 B2 7/2019 Campbell
10,363,420 B2 7/2019 Fried et al.
10,369,463 B2 8/2019 Barney et al.
10,370,785 B2 8/2019 McGinnity et al.
10,376,018 B2 8/2019 Rushbrook et al.
10,760,062 B2 9/2020 Naesby et al.
2001/0035723 A1 11/2001 Pelrine et al.
2001/0045104 A1 11/2001 Bailey, Sr. et al.
2002/0001588 A1 1/2002 Sinha
2002/0019586 A1 2/2002 Teller et al.
2002/0090487 A1 7/2002 Andersen et al.
2002/0099282 A1 7/2002 Knobbe et al.
2002/0111547 A1 8/2002 Knobbe et al.
2002/0121979 A1 9/2002 Smith
2002/0128544 A1 9/2002 Diab et al.
2002/0133196 A1 9/2002 Thompson
2002/0177135 A1 11/2002 Doung et al.
2002/0177782 A1 11/2002 Penner
2002/0183646 A1 12/2002 Stivoric et al.
2003/0004403 A1 1/2003 Drinan et al.
2003/0018369 A1 1/2003 Thompson et al.
2003/0053284 A1 3/2003 Stevenson et al.
2003/0070324 A1 4/2003 Nelson
2003/0107487 A1 6/2003 Korman et al.
2003/0130616 A1 7/2003 Steil et al.
2003/0195404 A1 10/2003 Knobbe et al.
2003/0220579 A1 11/2003 Mault
2004/0002634 A1 1/2004 Nihtila
2004/0034289 A1 2/2004 Teller et al.
2004/0034295 A1 2/2004 Salganicoff
2004/0035446 A1* 2/2004 Laurence ..... B08B 5/02 134/30
2004/0039243 A1 2/2004 Bearnson et al.
2004/0039254 A1 2/2004 Stivoric et al.
2004/0053290 A1 3/2004 Terbrueggen et al.
2004/0078067 A1 4/2004 Thompson et al.
2004/0133081 A1 7/2004 Teller et al.
2004/0147818 A1 7/2004 Levy et al.
2004/0152956 A1 8/2004 Korman
2004/0152957 A1 8/2004 Stivoric et al.
2004/0158194 A1 8/2004 Wolff et al.
2004/0176822 A1 9/2004 Thompson et al.
2004/0177531 A1 9/2004 DiBenedetto et al.
2004/0186390 A1 9/2004 Ross et al.
2004/0193025 A1 9/2004 Steil et al.
2005/0027463 A1 2/2005 Goode, Jr. et al.
2005/0043598 A1 2/2005 Goode, Jr. et al.
2005/0050750 A1 3/2005 Whiting
2005/0053757 A1 3/2005 Andersen et al.
2005/0060030 A1 3/2005 Lashinski et al.
2005/0061323 A1 3/2005 Lee et al.
2005/0065572 A1 3/2005 Hartley et al.
2005/0069162 A1 3/2005 Haykin et al.
2005/0075213 A1 4/2005 Arick
2005/0076909 A1 4/2005 Stahmann et al.
2005/0080322 A1 4/2005 Korman
2005/0091884 A1 5/2005 Omstead et al.
2005/0101845 A1 5/2005 Nihtila
2005/0115561 A1 6/2005 Stahmann et al.
2005/0116820 A1 6/2005 Goldreich
2005/0135948 A1 6/2005 Olsen et al.
2005/0136385 A1 6/2005 Mann et al.
2005/0142070 A1 6/2005 Hartley et al.
2005/0148828 A1 7/2005 Lindsay
2005/0154271 A1 7/2005 Rasdal et al.
2005/0165456 A1 7/2005 Mann et al.
2005/0181973 A1 8/2005 Genove et al.
2005/0182389 A1 8/2005 LaPorte et al.
2005/0183292 A1 8/2005 DiBenedetto et al.
2005/0192557 A1 9/2005 Brauker et al.
2005/0197677 A1 9/2005 Stevenson
2005/0203360 A1 9/2005 Brauker et al.
2005/0209511 A1 9/2005 Heruth et al.
2005/0209512 A1 9/2005 Heruth et al.
2005/0209513 A1 9/2005 Heruth et al.
2005/0209643 A1 9/2005 Heruth et al.
2005/0209644 A1 9/2005 Heruth et al.
2005/0209645 A1 9/2005 Heruth et al.
2005/0215847 A1 9/2005 Heruth et al.
2005/0215947 A1 9/2005 Heruth et al.
2005/0216064 A1 9/2005 Heruth et al.
2005/0217142 A1 10/2005 Ellis
2005/0222522 A1 10/2005 Heruth et al.
2005/0222643 A1 10/2005 Heruth et al.
2005/0234514 A1 10/2005 Heruth et al.
2005/0234518 A1 10/2005 Heruth et al.
2005/0240242 A1 10/2005 DiLorenzo
2005/0245988 A1 11/2005 Miesel
2005/0247319 A1 11/2005 Berger
2005/0256385 A1 11/2005 Diab et al.
2005/0261609 A1 11/2005 Collings et al.
2005/0267342 A1 12/2005 Blank et al.
2005/0268487 A1 12/2005 Ellis
2006/0020187 A1 1/2006 Brister et al.
2006/0020297 A1 1/2006 Gerber et al.
2006/0030890 A1 2/2006 Cosentino et al.
2006/0047283 A1 3/2006 Evans et al.
2006/0064030 A1 3/2006 Cosentino et al.
2006/0085040 A1 4/2006 VanDanacker
2006/0103538 A1 5/2006 Daniel
2006/0122474 A1 6/2006 Teller et al.
2006/0122864 A1 6/2006 Gottesman et al.
2006/0149324 A1 7/2006 Mann et al.
2006/0149330 A1 7/2006 Mann et al.
2006/0149331 A1 7/2006 Mann et al.
2006/0160205 A1 7/2006 Blackburn et al.
2006/0211942 A1 9/2006 Hoctor et al.
2006/0212096 A1 9/2006 Stevenson
2006/0222566 A1 10/2006 Brauker et al.
2006/0224051 A1 10/2006 Teller et al.
2006/0224109 A1 10/2006 Steil et al.
2006/0230641 A1 10/2006 Vick et al.
2006/0230642 A1 10/2006 Vick et al.
2006/0235472 A1 10/2006 Goetz et al.
2006/0248749 A1 11/2006 Ellis
2006/0248750 A1 11/2006 Rosenberg
2006/0253005 A1 11/2006 Drinan et al.
2006/0264730 A1 11/2006 Stivoric et al.
2006/0265024 A1 11/2006 Goetz et al.
2006/0265025 A1 11/2006 Goetz et al.
2006/0287677 A1 12/2006 Shalev et al.
2006/0293571 A1 12/2006 Bao et al.
2007/0000154 A1 1/2007 DiBenedetto et al.
2007/0000188 A1 1/2007 Smushkovich
2007/0006489 A1 1/2007 Case et al.
2007/0011919 A1 1/2007 Case
2007/0011920 A1 1/2007 DiBenedetto et al.
2007/0015976 A1 1/2007 Miesel et al.
2007/0016381 A1 1/2007 Kamath et al.
2007/0021269 A1 1/2007 Shum
2007/0021979 A1 1/2007 Cosentino et al.
2007/0027371 A1 2/2007 Benaron et al.
2007/0027385 A1 2/2007 Brister et al.
2007/0032706 A1 2/2007 Kamath et al.
2007/0039205 A1 2/2007 Erb et al.
2007/0039209 A1 2/2007 White et al.
2007/0043582 A1 2/2007 Peveto et al.
2007/0060800 A1 3/2007 Drinan et al.
2007/0088226 A1 4/2007 Spence et al.
2007/0088521 A1 4/2007 Shmueli et al.
2007/0098600 A1 5/2007 Kayyem
2007/0100666 A1 5/2007 Stivoric et al.
2007/0106138 A1 5/2007 Beiski et al.
2007/0106172 A1 5/2007 Abreu
2007/0120683 A1 5/2007 Flippen et al.
2007/0123758 A1 5/2007 Miesel et al.
2007/0123779 A1 5/2007 Hoctor et al.

(56) References Cited

U.S. PATENT DOCUMENTS

2007/0142955 A1 6/2007 Lin et al.
2007/0146371 A1 6/2007 Dariush
2007/0154030 A1 7/2007 Moses
2007/0157488 A1 7/2007 Guzman
2007/0161919 A1 7/2007 DiLorenzo
2007/0162086 A1 7/2007 DiLorenzo
2007/0162090 A1 7/2007 Penner
2007/0162164 A1 7/2007 Dariush
2007/0167991 A1 7/2007 DiLorenzo
2007/0173705 A1 7/2007 Teller et al.
2007/0173761 A1 7/2007 Kanderian et al.
2007/0179562 A1 8/2007 Nycz
2007/0180736 A1 8/2007 DiBenedetto et al.
2007/0180737 A1 8/2007 DiBenedetto et al.
2007/0189921 A1 8/2007 Duong et al.
2007/0197890 A1 8/2007 Boock et al.
2007/0203966 A1 8/2007 Brauker et al.
2007/0208212 A1 9/2007 DiLorenzo
2007/0208245 A1 9/2007 Brauker et al.
2007/0219639 A1 9/2007 Otto et al.
2007/0239054 A1 10/2007 Giftakis et al.
2007/0239230 A1 10/2007 Giftakis et al.
2007/0247306 A1 10/2007 Case
2007/0249968 A1 10/2007 Miesel et al.
2007/0250121 A1 10/2007 Miesel et al.
2007/0250134 A1 10/2007 Miesel et al.
2007/0255118 A1 11/2007 Miesel et al.
2007/0260421 A1 11/2007 Berner et al.
2007/0260491 A1 11/2007 Palmer et al.
2007/0265508 A1 11/2007 Sheikhzadeh-Nadjar et al.
2007/0265704 A1 11/2007 Mayer et al.
2007/0270668 A1 11/2007 Childre et al.
2007/0271817 A1 11/2007 Ellis
2007/0276439 A1 11/2007 Miesel et al.
2007/0282196 A1 12/2007 Birk et al.
2007/0282562 A1 12/2007 Schwartz et al.
2007/0293737 A1 12/2007 Heruth et al.
2008/0000108 A1 1/2008 Ellis
2008/0004642 A1 1/2008 Birk et al.
2008/0005931 A1 1/2008 Ellis
2008/0015421 A1 1/2008 Penner
2008/0020012 A1 1/2008 Ju et al.
2008/0033254 A1 2/2008 Kamath et al.
2008/0048855 A1 2/2008 Berger
2008/0049376 A1 2/2008 Stevenson et al.
2008/0051667 A1 2/2008 Goldreich
2008/0065181 A1 3/2008 Stevenson
2008/0071150 A1 3/2008 Miesel et al.
2008/0071324 A1 3/2008 Miesel et al.
2008/0071326 A1 3/2008 Heruth et al.
2008/0071327 A1 3/2008 Miesel et al.
2008/0077440 A1 3/2008 Doron
2008/0091092 A1 4/2008 Al-Ali
2008/0097263 A1 4/2008 Grigoriev et al.
2008/0097496 A1 4/2008 Chang et al.
2008/0102096 A1 5/2008 Molin et al.
2008/0103534 A1 5/2008 Gerber
2008/0106419 A1 5/2008 Sakama et al.
2008/0108942 A1 5/2008 Brister et al.
2008/0119703 A1 5/2008 Brister et al.
2008/0119900 A1 5/2008 DiLorenzo
2008/0120802 A1* 5/2008 Harvey ..... F28G 1/166 15/405
2008/0122657 A1 5/2008 Chen
2008/0129486 A1 6/2008 Jeckelmann et al.
2008/0131362 A1 6/2008 Rousso et al.
2008/0132981 A1 6/2008 Gerber
2008/0132982 A1 6/2008 Gerber
2008/0140161 A1 6/2008 Goetz et al.
2008/0140162 A1 6/2008 Goetz et al.
2008/0140163 A1 6/2008 Keacher et al.
2008/0161654 A1 7/2008 Teller et al.
2008/0161655 A1 7/2008 Teller et al.
2008/0167535 A1 7/2008 Stivoric et al.
2008/0167536 A1 7/2008 Teller et al.
2008/0167537 A1 7/2008 Teller et al.
2008/0167538 A1 7/2008 Teller et al.
2008/0167539 A1 7/2008 Teller et al.
2008/0167700 A1 7/2008 Shalev et al.
2008/0167741 A1 7/2008 Lay et al.
2008/0171919 A1 7/2008 Stivoric et al.
2008/0171920 A1 7/2008 Teller et al.
2008/0171921 A1 7/2008 Teller et al.
2008/0171922 A1 7/2008 Teller et al.
2008/0172102 A1 7/2008 Shalev
2008/0177355 A1 7/2008 Miesel et al.
2008/0180242 A1 7/2008 Cottingham
2008/0188796 A1 8/2008 Steil et al.
2008/0189194 A1 8/2008 Bentvelzen
2008/0195249 A1 8/2008 Rousso et al.
2008/0197126 A1 8/2008 Bourke et al.
2008/0202927 A1 8/2008 Kayyem et al.
2008/0207983 A1 8/2008 Boyden et al.
2008/0208010 A1 8/2008 Boyden et al.
2008/0208538 A1 8/2008 Visser et al.
2008/0214903 A1 9/2008 Orbach
2008/0234598 A1 9/2008 Snyder et al.
2008/0242553 A1 10/2008 Kayyem
2008/0243431 A1 10/2008 Wai
2008/0249806 A1 10/2008 Dlugos et al.
2008/0250340 A1 10/2008 Dlugos et al.
2008/0250341 A1 10/2008 Dlugos et al.
2008/0254944 A1 10/2008 Muri et al.
2008/0260212 A1 10/2008 Moskal et al.
2008/0275309 A1 11/2008 Stivoric et al.
2008/0275349 A1 11/2008 Halperin et al.
2008/0287751 A1 11/2008 Stivoric et al.
2008/0287817 A1 11/2008 Stivoric et al.
2008/0288027 A1 11/2008 Kroll et al.
2008/0294020 A1 11/2008 Sapounas
2008/0294024 A1 11/2008 Cosentino et al.
2008/0300449 A1 12/2008 Gerber et al.
2008/0300470 A1 12/2008 Gerber et al.
2008/0300649 A1 12/2008 Gerber et al.
2008/0300650 A1 12/2008 Gerber et al.
2008/0300651 A1 12/2008 Gerber et al.
2008/0303728 A1 12/2008 Lee et al.
2008/0306357 A1 12/2008 Korman
2008/0312511 A1 12/2008 Osler et al.
2008/0314395 A1 12/2008 Kovatchev et al.
2009/0012372 A1 1/2009 Burnett et al.
2009/0012766 A1 1/2009 Miyake et al.
2009/0022336 A1 1/2009 Visser et al.
2009/0024161 A1 1/2009 Bonutti et al.
2009/0028957 A1 1/2009 Daniloff
2009/0030263 A1 1/2009 Heruth et al.
2009/0036951 A1 2/2009 Heruth et al.
2009/0040041 A1 2/2009 Janetis et al.
2009/0057147 A1 3/2009 Kayyem
2009/0058635 A1 3/2009 LaLonde et al.
2009/0058636 A1 3/2009 Gaskill et al.
2009/0062825 A1 3/2009 Pool et al.
2009/0062887 A1 3/2009 Mass et al.
2009/0063193 A1 3/2009 Barton et al.
2009/0069869 A1 3/2009 Stouffer et al.
2009/0076343 A1 3/2009 James et al.
2009/0076346 A1 3/2009 James et al.
2009/0082640 A1 3/2009 Kovach et al.
2009/0082641 A1 3/2009 Giftakis et al.
2009/0083070 A1 3/2009 Giftakis et al.
2009/0099626 A1 4/2009 de Juan, Jr. et al.
2009/0099627 A1 4/2009 Molnar et al.
2009/0105605 A1 4/2009 Abreu
2009/0105785 A1 4/2009 Wei et al.
2009/0112071 A1 4/2009 LeBoeuf et al.
2009/0112478 A1 4/2009 Mueller, Jr. et al.
2009/0113295 A1 4/2009 Halpern et al.
2009/0118599 A1 5/2009 Heruth et al.
2009/0118683 A1 5/2009 Hanson et al.
2009/0126233 A1 5/2009 Rastegar et al.
2009/0128487 A1 5/2009 Langereis et al.
2009/0131739 A1 5/2009 Shalev
2009/0135001 A1 5/2009 Yuk
2009/0138207 A1 5/2009 Cosentino et al.

(56) References Cited

U.S. PATENT DOCUMENTS

2009/0148496 A1 6/2009 Schmitz et al.
2009/0149148 A1 6/2009 Kurtz et al.
2009/0149797 A1 6/2009 Dacey, Jr. et al.
2009/0149798 A1 6/2009 Dacey, Jr. et al.
2009/0149799 A1 6/2009 Dacey, Jr. et al.
2009/0149895 A1 6/2009 Dacey, Jr. et al.
2009/0149896 A1 6/2009 Dacey, Jr. et al.
2009/0149897 A1 6/2009 Dacey, Jr. et al.
2009/0149914 A1 6/2009 Dacey, Jr. et al.
2009/0151199 A1 6/2009 Connor
2009/0155900 A1 6/2009 Vemuri et al.
2009/0156309 A1 6/2009 Weston et al.
2009/0157147 A1 6/2009 Cauller et al.
2009/0157151 A1 6/2009 Cauller et al.
2009/0163980 A1 6/2009 Stevenson
2009/0163981 A1 6/2009 Stevenson et al.
2009/0171163 A1 7/2009 Mates et al.
2009/0177068 A1 7/2009 Stivoric et al.
2009/0178305 A1 7/2009 Maxwell et al.
2009/0192556 A1 7/2009 Wu et al.
2009/0193689 A1 8/2009 Galica et al.
2009/0198293 A1 8/2009 Cauller et al.
2009/0199429 A1 8/2009 Ellis
2009/0202387 A1 8/2009 Dlugos, Jr. et al.
2009/0204360 A1 8/2009 Ridenour et al.
2009/0206087 A1 8/2009 Reinmuller
2009/0222065 A1 9/2009 Dlugos, Jr. et al.
2009/0227862 A1 9/2009 Smith et al.
2009/0228078 A1 9/2009 Zhang et al.
2009/0234916 A1 9/2009 Cosentino et al.
2009/0241378 A1 10/2009 Ellis
2009/0254179 A1 10/2009 Burnett
2009/0259216 A1 10/2009 Drew et al.
2009/0264789 A1 10/2009 Molnar et al.
2009/0264955 A1 10/2009 Giftakis et al.
2009/0264956 A1 10/2009 Rise et al.
2009/0264957 A1 10/2009 Giftakis et al.
2009/0264967 A1 10/2009 Giftakis et al.
2009/0265958 A1 10/2009 DiBenedetto et al.
2009/0270942 A1 10/2009 Heruth et al.
2009/0274737 A1 11/2009 Borck
2009/0276002 A1 11/2009 Sommer et al.
2009/0276004 A1 11/2009 Kronich et al.
2009/0281594 A1 11/2009 King et al.
2009/0281597 A1 11/2009 Parramon et al.
2009/0284368 A1 11/2009 Case, Jr.
2009/0287452 A1 11/2009 Stanley et al.
2009/0292180 A1 11/2009 Mirow
2009/0299428 A1 12/2009 Chow
2009/0305972 A1 12/2009 Chahal et al.
2009/0306740 A1 12/2009 Heruth et al.
2009/0312622 A1 12/2009 Regittnig
2009/0313853 A1 12/2009 Tadin
2009/0326346 A1 12/2009 Kracker et al.
2009/0326350 A1 12/2009 Kracker
2009/0326356 A1 12/2009 Kracker
2010/0015201 A1 1/2010 Borck et al.
2010/0016918 A1 1/2010 Mann et al.
2010/0022856 A1 1/2010 Cinbis et al.
2010/0022861 A1 1/2010 Cinbis et al.
2010/0023089 A1 1/2010 DiLorenzo
2010/0028984 A1 2/2010 Duong et al.
2010/0030043 A1 2/2010 Kuhn
2010/0030088 A1 2/2010 Carney et al.
2010/0030090 A1 2/2010 Zhang et al.
2010/0030286 A1 2/2010 Goetz et al.
2010/0030289 A1 2/2010 Casavant et al.
2010/0030293 A1 2/2010 Sarkar et al.
2010/0035688 A1 2/2010 Picunko
2010/0036211 A1 2/2010 La Rue et al.
2010/0037489 A1 2/2010 Berner, Jr. et al.
2010/0041975 A1 2/2010 Chen et al.
2010/0048242 A1 2/2010 Rhoads et al.
2010/0049010 A1 2/2010 Goldreich
2010/0050478 A1 3/2010 DiBenedetto et al.
2010/0058462 A1 3/2010 Chow
2010/0063347 A1 3/2010 Yomtov et al.
2010/0069841 A1 3/2010 Miesel
2010/0082102 A1 4/2010 Govil et al.
2010/0090477 A1 4/2010 Keating et al.
2010/0094654 A1 4/2010 Stewart
2010/0104470 A1 4/2010 McCabe
2010/0106212 A1 4/2010 Hedberg et al.
2010/0114015 A1 5/2010 Kanderian, Jr. et al.
2010/0114195 A1 5/2010 Burnes et al.
2010/0114196 A1 5/2010 Burnes et al.
2010/0114197 A1 5/2010 Burnes et al.
2010/0114198 A1 5/2010 Donofrio et al.
2010/0114199 A1 5/2010 Krause et al.
2010/0114200 A1 5/2010 Krause et al.
2010/0114201 A1 5/2010 Donofrio et al.
2010/0114202 A1 5/2010 Donofrio et al.
2010/0114203 A1 5/2010 Burnes et al.
2010/0114204 A1 5/2010 Burnes et al.
2010/0114208 A1 5/2010 Donofrio et al.
2010/0114209 A1 5/2010 Krause et al.
2010/0114216 A1 5/2010 Krause et al.
2010/0114217 A1 5/2010 Krause et al.
2010/0114221 A1 5/2010 Krause et al.
2010/0114224 A1 5/2010 Krause et al.
2010/0114237 A1 5/2010 Giftakis et al.
2010/0114241 A1 5/2010 Donofrio et al.
2010/0114244 A1 5/2010 Manda et al.
2010/0121170 A1 5/2010 Rule
2010/0121215 A1 5/2010 Giftakis et al.
2010/0121413 A1 5/2010 Willerton et al.
2010/0122472 A1 5/2010 Griffin et al.
2010/0138379 A1 6/2010 Mott et al.
2010/0139672 A1 6/2010 Kroll et al.
2010/0143871 A1 6/2010 Berger
2010/0144641 A1 6/2010 Popel et al.
2010/0145337 A1 6/2010 Janna et al.
2010/0152573 A1 6/2010 Ritchey et al.
2010/0152815 A1 6/2010 Vandanacker
2010/0160014 A1 6/2010 Galasso et al.
2010/0160800 A1 6/2010 Xi
2010/0160804 A1 6/2010 Qu
2010/0160807 A1 6/2010 Schmidt et al.
2010/0160997 A1 6/2010 Johnson et al.
2010/0161004 A1 6/2010 Najafi et al.
2010/0168538 A1 7/2010 Keenan et al.
2010/0168607 A1 7/2010 Miesel
2010/0168821 A1 7/2010 Johnson et al.
2010/0170115 A1 7/2010 Smith
2010/0174155 A1 7/2010 Heruth et al.
2010/0174180 A1 7/2010 Rousso et al.
2010/0174240 A1 7/2010 Wells et al.
2010/0174349 A1 7/2010 Stevenson et al.
2010/0185064 A1 7/2010 Bandic et al.
2010/0185225 A1 7/2010 Albrecht et al.
2010/0187305 A1 7/2010 Holcomb
2010/0191236 A1 7/2010 Johnson et al.
2010/0191306 A1 7/2010 Stevenson et al.
2010/0194631 A1 8/2010 Janetis et al.
2010/0198034 A1 8/2010 Thomas et al.
2010/0198279 A1 8/2010 Corndorf et al.
2010/0198280 A1 8/2010 Corndorf et al.
2010/0198284 A1 8/2010 Zhou et al.
2010/0198291 A1 8/2010 Sambelashvili et al.
2010/0198308 A1 8/2010 Zhou et al.
2010/0210924 A1 8/2010 Parthasarathy et al.
2010/0217239 A1 8/2010 Mann et al.
2010/0217240 A1 8/2010 Mann et al.
2010/0217241 A1 8/2010 Mann et al.
2010/0217242 A1 8/2010 Mann et al.
2010/0217243 A1 8/2010 Mann
2010/0217244 A1 8/2010 Mann et al.
2010/0222686 A1 9/2010 Fisher et al.
2010/0222802 A1 9/2010 Gillespie, Jr. et al.
2010/0222845 A1 9/2010 Goetz
2010/0222846 A1 9/2010 Goetz
2010/0228314 A1 9/2010 Goetz
2010/0238019 A1 9/2010 Richman et al.
2010/0242303 A1 9/2010 Callahan et al.

(56) References Cited

U.S. PATENT DOCUMENTS

2010/0245077 A1 9/2010 Shmueli et al.
2010/0249540 A1 9/2010 Lisogurski
2010/0261526 A1 10/2010 Anderson et al.
2010/0268040 A1 10/2010 Ben-Oren et al.
2010/0268477 A1 10/2010 Mueller, Jr. et al.
2010/0273738 A1 10/2010 Valcke et al.
2010/0274100 A1 10/2010 Behar et al.
2010/0274102 A1 10/2010 Teixeira
2010/0274106 A1 10/2010 Heruth et al.
2010/0274121 A1 10/2010 Ritchey et al.
2010/0280330 A1 11/2010 Samuelsson et al.
2010/0280334 A1 11/2010 Carlson et al.
2010/0280335 A1 11/2010 Carlson et al.
2010/0280336 A1 11/2010 Giftakis et al.
2010/0280574 A1 11/2010 Carlson et al.
2010/0280579 A1 11/2010 Denison et al.
2010/0285981 A1 11/2010 Kayyem
2010/0289971 A1 11/2010 Odland et al.
2010/0305545 A1 12/2010 Kanderian, Jr. et al.
2010/0305665 A1 12/2010 Miesel et al.
2010/0308974 A1 12/2010 Rowland et al.
2010/0311388 A1 12/2010 Flippo et al.
2010/0311640 A1 12/2010 Genove et al.
2010/0312081 A1 12/2010 Benaron et al.
2010/0317955 A1 12/2010 Madsen et al.
2010/0318160 A1 12/2010 Stevenson et al.
2010/0321163 A1 12/2010 Stevenson
2010/0324382 A1 12/2010 Cantwell et al.
2010/0324578 A1 12/2010 Bardy
2010/0324579 A1 12/2010 Bardy
2010/0324639 A1 12/2010 Stevenson et al.
2010/0331868 A1 12/2010 Bardy
2010/0331874 A1 12/2010 Bardy
2010/0331932 A1 12/2010 Stevenson et al.
2011/0003664 A1 1/2011 Richard
2011/0004110 A1 1/2011 Shusterman
2011/0022123 A1 1/2011 Stancer et al.
2011/0022140 A1 1/2011 Stevenson et al.
2011/0023343 A1 2/2011 Turner et al.
2011/0029043 A1 2/2011 Frysz et al.
2011/0029269 A1 2/2011 Hayter et al.
2011/0034176 A1 2/2011 Lord et al.
2011/0040197 A1 2/2011 Welch et al.
2011/0040343 A1 2/2011 Johnson et al.
2011/0040546 A1 2/2011 Gerber et al.
2011/0040547 A1 2/2011 Gerber et al.
2011/0043297 A1 2/2011 Stevenson et al.
2011/0044524 A1 2/2011 Wang et al.
2011/0046697 A1 2/2011 Gerber et al.
2011/0054270 A1 3/2011 Derchak
2011/0054359 A1 3/2011 Sazonov et al.
2011/0056093 A1 3/2011 Ellis
2011/0056097 A1 3/2011 Ellis
2011/0057037 A1 3/2011 Frysz et al.
2011/0061647 A1 3/2011 Stahmann et al.
2011/0063088 A1 3/2011 Stevenson et al.
2011/0066079 A1 3/2011 Otto et al.
2011/0074349 A1 3/2011 Ghovanloo
2011/0076984 A1 3/2011 Flippo et al.
2011/0077706 A1 3/2011 Ellingson et al.
2011/0082377 A1 4/2011 Mahajan et al.
2011/0093040 A1 4/2011 Ellingson et al.
2011/0093046 A1 4/2011 Ellingson et al.
2011/0094127 A1 4/2011 Dana
2011/0098576 A1 4/2011 Hollstien
2011/0105860 A1 5/2011 Houben et al.
2011/0105873 A1 5/2011 Feldman et al.
2011/0105921 A1 5/2011 Wang
2011/0106200 A1 5/2011 Ziegler
2011/0106453 A1 5/2011 Krieftewirth
2011/0112442 A1 5/2011 Meger et al.
2011/0118805 A1 5/2011 Wei et al.
2011/0124983 A1 5/2011 Kroll et al.
2011/0130092 A1 6/2011 Yun et al.
2011/0130636 A1 6/2011 Daniel et al.
2011/0143811 A1 6/2011 Rodriguez
2011/0144463 A1 6/2011 Pesach et al.
2011/0144967 A1 6/2011 Adirovich
2011/0152632 A1 6/2011 Le Neel et al.
2011/0152756 A1 6/2011 Drew
2011/0160623 A1 6/2011 Shalev
2011/0160796 A1 6/2011 Lane et al.
2011/0172504 A1 7/2011 Wegerich
2011/0172545 A1 7/2011 Grudic et al.
2011/0179637 A1 7/2011 Eberman et al.
2011/0180425 A1 7/2011 Kayyem
2011/0183305 A1 7/2011 Orbach
2011/0184267 A1 7/2011 Duke et al.
2011/0184482 A1 7/2011 Eberman et al.
2011/0184483 A1 7/2011 Norton et al.
2011/0190570 A1 8/2011 Zaimi
2011/0190580 A1 8/2011 Bennett et al.
2011/0190581 A1 8/2011 Bennett et al.
2011/0190595 A1 8/2011 Bennett et al.
2011/0190654 A1 8/2011 Hettrick et al.
2011/0208012 A1 8/2011 Gerber et al.
2011/0208015 A1 8/2011 Welch et al.
2011/0212717 A1 9/2011 Rhoads et al.
2011/0237861 A1 9/2011 Pool et al.
2011/0237916 A1 9/2011 Hanson et al.
2011/0245633 A1 10/2011 Goldberg et al.
2011/0249381 A1 10/2011 Diebold
2011/0251516 A1 10/2011 Doerr
2011/0260857 A1 10/2011 Hamill
2011/0264034 A1 10/2011 Roberts et al.
2011/0264058 A1 10/2011 Linden et al.
2011/0273287 A1 11/2011 LaLonde et al.
2011/0275930 A1 11/2011 Jho et al.
2011/0285853 A1 11/2011 Chu
2011/0288600 A1 11/2011 Ritchey et al.
2011/0295335 A1 12/2011 Sharma et al.
2011/0295336 A1 12/2011 Sharma et al.
2011/0301436 A1 12/2011 Teixeira
2011/0301441 A1 12/2011 Bandic et al.
2011/0301662 A1 12/2011 Bar-Yoseph et al.
2011/0305672 A1 12/2011 Dalton et al.
2011/0307027 A1 12/2011 Sharma et al.
2011/0307028 A1 12/2011 Sharma et al.
2011/0314700 A1 12/2011 Case, Jr.
2011/0314702 A1 12/2011 Berner, Jr. et al.
2011/0319785 A1 12/2011 Snyder et al.
2012/0001751 A1 1/2012 Baker et al.
2012/0001920 A1 1/2012 Halpern et al.
2012/0003933 A1 1/2012 Baker et al.
2012/0008714 A1 1/2012 Rizwan
2012/0010543 A1 1/2012 Johnson et al.
2012/0022336 A1 1/2012 Teixeira
2012/0022340 A1 1/2012 Heruth et al.
2012/0022350 A1 1/2012 Teixeira
2012/0022384 A1 1/2012 Teixeira
2012/0022805 A1 1/2012 Teixeira et al.
2012/0022844 A1 1/2012 Teixeira
2012/0029586 A1 2/2012 Kumar et al.
2012/0053585 A1 3/2012 Nycz et al.
2012/0058106 A1 3/2012 Chahal et al.
2012/0059389 A1 3/2012 Larson et al.
2012/0059434 A1 3/2012 Nycz
2012/0065507 A1 3/2012 Brunke
2012/0073165 A1 3/2012 McKeown
2012/0083650 A1 4/2012 Raven
2012/0083705 A1 4/2012 Yuen et al.
2012/0083714 A1 4/2012 Yuen et al.
2012/0083715 A1 4/2012 Yuen et al.
2012/0083716 A1 4/2012 Yuen et al.
2012/0084053 A1 4/2012 Yuen et al.
2012/0084054 A1 4/2012 Yuen et al.
2012/0086550 A1 4/2012 LeBlanc et al.
2012/0094649 A1 4/2012 Porrati et al.
2012/0095306 A1 4/2012 Egozi
2012/0108998 A1 5/2012 Molnar et al.
2012/0109237 A1 5/2012 Xiao et al.
2012/0116475 A1 5/2012 Nelson et al.
2012/0123221 A1 5/2012 Windolf
2012/0123232 A1 5/2012 Najarian et al.

(56) References Cited

U.S. PATENT DOCUMENTS

2012/0130286 A1 5/2012 Miesel et al.
2012/0130444 A1 5/2012 Wei et al.
2012/0132211 A1 5/2012 Halperin et al.
2012/0136261 A1 5/2012 Sethi et al.
2012/0136413 A1 5/2012 Bonde et al.
2012/0144068 A1 6/2012 Lay et al.
2012/0149996 A1 6/2012 Stivoric et al.
2012/0150258 A1 6/2012 Miesel et al.
2012/0161901 A1 6/2012 Stevenson et al.
2012/0167325 A1 7/2012 Omidi
2012/0172652 A1 7/2012 Dacey, Jr. et al.
2012/0184878 A1 7/2012 Najafi et al.
2012/0190386 A1 7/2012 Anderson
2012/0197336 A1 8/2012 Su
2012/0197337 A1 8/2012 Su et al.
2012/0197338 A1 8/2012 Su et al.
2012/0197349 A1 8/2012 Griswold et al.
2012/0197350 A1 8/2012 Roberts et al.
2012/0203079 A1 8/2012 McLaughlin
2012/0203118 A1 8/2012 Samuelsson et al.
2012/0203131 A1 8/2012 DiLorenzo
2012/0220986 A1 8/2012 Wolff et al.
2012/0223705 A1 9/2012 Lowery et al.
2012/0226118 A1 9/2012 Delbeke et al.
2012/0226471 A1 9/2012 Yuen et al.
2012/0226472 A1 9/2012 Yuen et al.
2012/0232012 A1 9/2012 Popel et al.
2012/0234111 A1 9/2012 Molyneux et al.
2012/0234433 A1 9/2012 Shih et al.
2012/0245439 A1 9/2012 Andre et al.
2012/0249324 A1 10/2012 Richman et al.
2012/0258776 A1 10/2012 Lord et al.
2012/0265026 A1 10/2012 Shenasa et al.
2012/0265031 A1 10/2012 Feldman et al.
2012/0273354 A1 11/2012 Orhan et al.
2012/0277545 A1 11/2012 Teixeira
2012/0277546 A1 11/2012 Soykan et al.
2012/0277859 A1 11/2012 Govil et al.
2012/0283577 A1 11/2012 LeBoeuf et al.
2012/0283578 A1 11/2012 LeBoeuf et al.
2012/0291563 A1 11/2012 Schrock et al.
2012/0291564 A1 11/2012 Amos et al.
2012/0293326 A1 11/2012 Case, Jr.
2012/0296184 A1 11/2012 LeBoeuf et al.
2012/0296399 A1 11/2012 Cauller et al.
2012/0302874 A1 11/2012 Hollstien
2012/0311885 A1 12/2012 Moreshead
2012/0318781 A1 12/2012 Lavin, Jr.
2012/0321759 A1 12/2012 Marinkovich et al.
2012/0324763 A1 12/2012 Ellis
2012/0330112 A1 12/2012 Lamego et al.
2013/0006076 A1 1/2013 McHale et al.
2013/0008058 A1 1/2013 Jasmine
2013/0018239 A1 1/2013 Lisogurski
2013/0018668 A1 1/2013 Goldberg et al.
2013/0019503 A1 1/2013 Vogt
2013/0019694 A1 1/2013 Molyneux et al.
2013/0023954 A1 1/2013 Meskens
2013/0030255 A1 1/2013 Embry
2013/0030259 A1 1/2013 Thomsen et al.
2013/0035544 A1 2/2013 Pool et al.
2013/0035575 A1 2/2013 Mayou et al.
2013/0035740 A1 2/2013 Sharma et al.
2013/0035865 A1 2/2013 Mayou et al.
2013/0035871 A1 2/2013 Mayou et al.
2013/0053657 A1 2/2013 Ziarno et al.
2013/0053711 A1 2/2013 Kotlanka et al.
2013/0053913 A1 2/2013 Koh et al.
2013/0060098 A1 3/2013 Thomsen et al.
2013/0064388 A1 3/2013 Jacobs
2013/0067775 A1 3/2013 Ellis
2013/0070387 A1 3/2013 Stevenson et al.
2013/0072998 A1 3/2013 Su et al.
2013/0073254 A1 3/2013 Yuen et al.
2013/0073255 A1 3/2013 Yuen et al.
2013/0074614 A1 3/2013 Holmes et al.
2013/0078149 A1 3/2013 Holmes et al.
2013/0078244 A1 3/2013 Christiano et al.
2013/0078624 A1 3/2013 Holmes et al.
2013/0078625 A1 3/2013 Holmes et al.
2013/0078733 A1 3/2013 Holmes et al.
2013/0079236 A1 3/2013 Holmes
2013/0079599 A1 3/2013 Holmes et al.
2013/0079646 A1 3/2013 Bhunia et al.
2013/0079840 A1 3/2013 Su et al.
2013/0080113 A1 3/2013 Yuen et al.
2013/0082837 A1 4/2013 Cosentino et al.
2013/0085401 A1 4/2013 Zhang et al.
2013/0085408 A1 4/2013 Pool
2013/0085679 A1 4/2013 Budiman
2013/0092564 A1 4/2013 Doherty
2013/0096843 A1 4/2013 Yuen et al.
2013/0102859 A1 4/2013 Schechter
2013/0104288 A1 5/2013 Schlottau et al.
2013/0109946 A1 5/2013 Shim et al.
2013/0109997 A1 5/2013 Linke et al.
2013/0114869 A1 5/2013 Hernandez Stark et al.
2013/0116664 A1 5/2013 Tai et al.
2013/0116665 A1 5/2013 Humayun et al.
2013/0116666 A1 5/2013 Shih et al.
2013/0116667 A1 5/2013 Ricotti et al.
2013/0118340 A1 5/2013 D'Amours
2013/0124039 A1 5/2013 Abreu
2013/0131679 A1 5/2013 Janna et al.
2013/0135108 A1 5/2013 Alameh et al.
2013/0147622 A1 6/2013 LaLonde et al.
2013/0151196 A1 6/2013 Yuen et al.
2013/0154838 A1 6/2013 Alameh et al.
2013/0154851 A1 6/2013 Gaskill et al.
2013/0158369 A1 6/2013 Yuen et al.
2013/0158372 A1 6/2013 Haisley et al.
2013/0158473 A1 6/2013 Kanderian, Jr. et al.
2013/0158503 A1 6/2013 Kanderian, Jr. et al.
2013/0165819 A1 6/2013 Tieu
2013/0165901 A1 6/2013 Ruchti et al.
2013/0172759 A1 7/2013 Melker et al.
2013/0179382 A1 7/2013 Fritsch et al.
2013/0185003 A1 7/2013 Carbeck et al.
2013/0190638 A1 7/2013 Chon et al.
2013/0191513 A1 7/2013 Kamen et al.
2013/0195806 A1 8/2013 Gay et al.
2013/0198463 A1 8/2013 Hintz
2013/0213144 A1 8/2013 Rice et al.
2013/0213145 A1 8/2013 Owings et al.
2013/0213146 A1 8/2013 Amos et al.
2013/0213147 A1 8/2013 Rice et al.
2013/0217440 A1 8/2013 Lord et al.
2013/0217979 A1 8/2013 Blackadar et al.
2013/0218070 A1 8/2013 Burnett et al.
2013/0218232 A1 8/2013 Giftakis et al.
2013/0225968 A1 8/2013 Auvray et al.
2013/0229287 A1 9/2013 Samuelsson et al.
2013/0233324 A1 9/2013 Witt et al.
2013/0238049 A1 9/2013 Simon et al.
2013/0238050 A1 9/2013 Simon et al.
2013/0238056 A1 9/2013 Poore et al.
2013/0243799 A1 9/2013 Chahal et al.
2013/0245401 A1 9/2013 Estes et al.
2013/0245462 A1 9/2013 Capdevila et al.
2013/0245480 A1 9/2013 Crockford
2013/0245711 A1 9/2013 Simon et al.
2013/0245712 A1 9/2013 Simon et al.
2013/0245981 A1 9/2013 Estes et al.
2013/0253297 A1 9/2013 Johnson et al.
2013/0253334 A1 9/2013 Al-Ali et al.
2013/0253351 A1 9/2013 Qu
2013/0253380 A1 9/2013 Miesel et al.
2013/0253660 A1 9/2013 Nycz et al.
2013/0263349 A1 10/2013 Roser
2013/0265157 A1 10/2013 Case, Jr.
2013/0268029 A1 10/2013 Cauller et al.
2013/0268236 A1 10/2013 Yuen et al.
2013/0273968 A1 10/2013 Rhoads et al.
2013/0274584 A1 10/2013 Finlay et al.

(56) References Cited

U.S. PATENT DOCUMENTS

2013/0274705 A1 10/2013 Burnes et al.
2013/0278435 A1 10/2013 Ellis
2013/0278436 A1 10/2013 Ellis
2013/0282322 A1 10/2013 Hayter et al.
2013/0282646 A1 10/2013 Mott et al.
2013/0289424 A1 10/2013 Brockway et al.
2013/0289446 A1 10/2013 Stone et al.
2013/0289529 A1 10/2013 Caira et al.
2013/0289659 A1 10/2013 Nelson et al.
2013/0289664 A1 10/2013 Johanek
2013/0294969 A1 11/2013 Chen et al.
2013/0295894 A1 11/2013 Rhoads et al.
2013/0296669 A1 11/2013 Chen et al.
2013/0296670 A1 11/2013 Chen et al.
2013/0297220 A1 11/2013 Yuen et al.
2013/0297330 A1 11/2013 Kamen et al.
2013/0297344 A1 11/2013 Cosentino et al.
2013/0303843 A1 11/2013 Raven
2013/0310706 A1 11/2013 Stone et al.
2013/0310896 A1 11/2013 Mass
2013/0312291 A1 11/2013 Berner, Jr. et al.
2013/0317580 A1 11/2013 Simon et al.
2013/0317584 A1 11/2013 Stevenson et al.
2013/0317753 A1 11/2013 Kamen et al.
2013/0325394 A1 12/2013 Yuen et al.
2013/0325396 A1 12/2013 Yuen et al.
2013/0325404 A1 12/2013 Yuen et al.
2013/0326912 A1 12/2013 Lindsay et al.
2013/0331660 A1 12/2013 Al-Ali et al.
2013/0331919 A1 12/2013 Zhang et al.
2013/0333054 A1 12/2013 Duke
2013/0338448 A1 12/2013 Libbus et al.
2013/0338494 A1 12/2013 Wiley et al.
2013/0338768 A1 12/2013 Boyden et al.
2013/0338769 A1 12/2013 Boyden et al.
2013/0338770 A1 12/2013 Boyden et al.
2013/0338771 A1 12/2013 Boyden et al.
2013/0338772 A1 12/2013 Boyden et al.
2013/0338773 A1 12/2013 Boyden et al.
2013/0345561 A1 12/2013 Quigley
2014/0005633 A1 1/2014 Finan
2014/0012105 A1 1/2014 LeBoeuf et al.
2014/0012111 A1 1/2014 Snyder et al.
2014/0018644 A1 1/2014 Colvin, Jr. et al.
2014/0025447 A1 1/2014 Odland et al.
2014/0031787 A1 1/2014 Burnes et al.
2014/0033572 A1 2/2014 Steier et al.
2014/0035761 A1 2/2014 Burton et al.
2014/0036643 A1 2/2014 Messenger et al.
2014/0039383 A1 2/2014 Dobbles et al.
2014/0039804 A1 2/2014 Park et al.
2014/0039839 A1 2/2014 Yuen et al.
2014/0039840 A1 2/2014 Yuen et al.
2014/0039841 A1 2/2014 Yuen et al.
2014/0039842 A1 2/2014 Yuen et al.
2014/0043149 A1 2/2014 Cowan et al.
2014/0045757 A1 2/2014 Popel et al.
2014/0046391 A1 2/2014 Cowan et al.
2014/0048214 A1 2/2014 Dhillon
2014/0049377 A1 2/2014 Krusor et al.
2014/0051949 A1 2/2014 Old et al.
2014/0051962 A1 2/2014 Krusor et al.
2014/0052091 A1 2/2014 Dobbles et al.
2014/0052092 A1 2/2014 Dobbles et al.
2014/0052093 A1 2/2014 Dobbles et al.
2014/0052094 A1 2/2014 Dobbles et al.
2014/0052095 A1 2/2014 Dobbles et al.
2014/0052790 A1 2/2014 Yuen et al.
2014/0056757 A1 2/2014 Chen et al.
2014/0058221 A1 2/2014 Old et al.
2014/0059897 A1 3/2014 Sayed
2014/0062717 A1 3/2014 Mudumbai et al.
2014/0062718 A1 3/2014 LaLonde et al.
2014/0065153 A1 3/2014 Christiano et al.
2014/0066844 A1 3/2014 Rule
2014/0066884 A1 3/2014 Keenan et al.
2014/0066885 A1 3/2014 Keenan et al.
2014/0066886 A1 3/2014 Roy et al.
2014/0066887 A1 3/2014 Mastrototaro et al.
2014/0066888 A1 3/2014 Parikh et al.
2014/0066889 A1 3/2014 Grosman et al.
2014/0066892 A1 3/2014 Keenan et al.
2014/0067278 A1 3/2014 Yuen et al.
2014/0067423 A1 3/2014 Joao
2014/0073043 A1 3/2014 Holmes
2014/0073704 A1 3/2014 Ju et al.
2014/0073839 A1 3/2014 Yomtov et al.
2014/0073969 A1 3/2014 Zou et al.
2014/0077956 A1 3/2014 Sampath et al.
2014/0080428 A1 3/2014 Rhoads et al.
2014/0081076 A1 3/2014 Schutt et al.
2014/0081100 A1 3/2014 Muhsin et al.
2014/0081665 A1 3/2014 Holmes
2014/0081667 A1 3/2014 Joao
2014/0082963 A1 3/2014 Beers
2014/0088393 A1 3/2014 Bernstein et al.
2014/0088664 A1 3/2014 Sharma et al.
2014/0088922 A1 3/2014 Messenger et al.
2014/0089399 A1 3/2014 Chun et al.
2014/0089514 A1 3/2014 Messenger et al.
2014/0095420 A1 4/2014 Chun et al.
2014/0100432 A1 4/2014 Golda et al.
2014/0107433 A1 4/2014 Wegerich
2014/0107509 A1 4/2014 Banet et al.
2014/0107511 A1 4/2014 Banet et al.
2014/0107513 A1 4/2014 Banet et al.
2014/0107567 A1 4/2014 Goetz
2014/0108020 A1 4/2014 Sharma et al.
2014/0114278 A1 4/2014 Dobbles et al.
2014/0118138 A1 5/2014 Cobelli et al.
2014/0118166 A1 5/2014 Hampapuram et al.
2014/0123838 A1 5/2014 D'Amours
2014/0128803 A1 5/2014 Dobbles et al.
2014/0130370 A1 5/2014 Knudson et al.
2014/0135594 A1 5/2014 Yuen et al.
2014/0135631 A1 5/2014 Brumback et al.
2014/0139405 A1 5/2014 Ribble et al.
2014/0142403 A1 5/2014 Brumback et al.
2014/0142549 A1 5/2014 Su et al.
2014/0142958 A1 5/2014 Sharma et al.
2014/0144049 A1 5/2014 Ellis
2014/0145915 A1 5/2014 Ribble et al.
2014/0156043 A1 6/2014 Blackadar et al.
2014/0156228 A1 6/2014 Molettiere et al.
2014/0163432 A1 6/2014 Dacey, Jr. et al.
2014/0163483 A1 6/2014 Dacey, Jr. et al.
2014/0163517 A1 6/2014 Finan et al.
2014/0163644 A1 6/2014 Scott et al.
2014/0163647 A1 6/2014 Dacey, Jr. et al.
2014/0163927 A1 6/2014 Molettiere et al.
2014/0164320 A1 6/2014 Yuen et al.
2014/0164611 A1 6/2014 Molettiere et al.
2014/0170735 A1 6/2014 Holmes
2014/0171749 A1 6/2014 Chin et al.
2014/0172310 A1 6/2014 Chin et al.
2014/0172362 A1 6/2014 Burton et al.
2014/0176475 A1 6/2014 Myers et al.
2014/0180020 A1 6/2014 Stivoric et al.
2014/0180021 A1 6/2014 Stivoric et al.
2014/0180022 A1 6/2014 Stivoric et al.
2014/0180023 A1 6/2014 Stivoric et al.
2014/0180137 A1 6/2014 Stivoric et al.
2014/0180240 A1 6/2014 Finan et al.
2014/0180358 A1 6/2014 Giftakis et al.
2014/0182166 A1 7/2014 Ellis
2014/0186238 A1 7/2014 Holmes et al.
2014/0188516 A1 7/2014 Kamen et al.
2014/0191866 A1 7/2014 Yuen et al.
2014/0191867 A1 7/2014 Yuen et al.
2014/0194701 A1 7/2014 Drinan et al.
2014/0200421 A1 7/2014 Gilland
2014/0201024 A1 7/2014 Collier et al.
2014/0203797 A1 7/2014 Stivoric et al.
2014/0206955 A1 7/2014 Stivoric et al.

(56) References Cited

U.S. PATENT DOCUMENTS

2014/0206959 A1 7/2014 Samuelsson et al.
2014/0206976 A1 7/2014 Thompson et al.
2014/0213855 A1 7/2014 Teller et al.
2014/0213856 A1 7/2014 Teller et al.
2014/0213857 A1 7/2014 Teller et al.
2014/0213926 A1 7/2014 Vaidyanathan
2014/0213940 A1 7/2014 Mayer
2014/0213941 A1 7/2014 Johnson et al.
2014/0214502 A1 7/2014 Bahl et al.
2014/0221732 A1 8/2014 Dayton et al.
2014/0221769 A1 8/2014 Teller et al.
2014/0221770 A1 8/2014 Teller et al.
2014/0221774 A1 8/2014 Teller et al.
2014/0221784 A1 8/2014 Pacione et al.
2014/0221785 A1 8/2014 Pacione et al.
2014/0221787 A1 8/2014 Teller et al.
2014/0221788 A1 8/2014 Teller et al.
2014/0221789 A1 8/2014 Pacione et al.
2014/0221790 A1 8/2014 Pacione et al.
2014/0221791 A1 8/2014 Pacione et al.
2014/0221855 A1 8/2014 McCaffrey
2014/0222101 A1 8/2014 Miesel et al.
2014/0222106 A1 8/2014 Sharma et al.
2014/0222173 A1 8/2014 Giedwoyn et al.
2014/0222174 A1 8/2014 Teller et al.
2014/0223406 A1 8/2014 Teller et al.
2014/0223407 A1 8/2014 Teller et al.
2014/0223421 A1 8/2014 Carter et al.
2014/0228649 A1 8/2014 Rayner et al.
2014/0228911 A1 8/2014 Sharma et al.
2014/0232516 A1 8/2014 Stivoric et al.
2014/0234949 A1 8/2014 Wasson et al.
2014/0236105 A1 8/2014 Hanson et al.
2014/0236493 A1 8/2014 Park et al.
2014/0236536 A1 8/2014 Hayter et al.
2014/0236538 A1 8/2014 Messenger et al.
2014/0237028 A1 8/2014 Messenger et al.
2014/0239528 A1 8/2014 Govil et al.
2014/0240122 A1 8/2014 Roberts et al.
2014/0244395 A1 8/2014 Case, Jr.
2014/0245161 A1 8/2014 Yuen et al.
2014/0245783 A1 9/2014 Proud et al.
2014/0245784 A1 9/2014 Proud et al.
2014/0245785 A1 9/2014 Proud et al.
2014/0245786 A1 9/2014 Proud et al.
2014/0245787 A1 9/2014 Proud et al.
2014/0245788 A1 9/2014 Proud et al.
2014/0245789 A1 9/2014 Proud et al.
2014/0245790 A1 9/2014 Proud et al.
2014/0245791 A1 9/2014 Proud et al.
2014/0246497 A1 9/2014 Proud et al.
2014/0246498 A1 9/2014 Proud et al.
2014/0246499 A1 9/2014 Proud et al.
2014/0246500 A1 9/2014 Proud et al.
2014/0246501 A1 9/2014 Proud et al.
2014/0246502 A1 9/2014 Proud et al.
2014/0246917 A1 9/2014 Proud et al.
2014/0247136 A1 9/2014 Proud et al.
2014/0247137 A1 9/2014 Proud et al.
2014/0247142 A1 9/2014 Proud
2014/0247143 A1 9/2014 Proud
2014/0247144 A1 9/2014 Proud
2014/0247146 A1 9/2014 Proud
2014/0247147 A1 9/2014 Proud
2014/0247149 A1 9/2014 Proud
2014/0247150 A1 9/2014 Proud
2014/0247151 A1 9/2014 Proud et al.
2014/0247154 A1 9/2014 Proud
2014/0247155 A1 9/2014 Proud
2014/0247156 A1 9/2014 Proud
2014/0249379 A1 9/2014 Proud
2014/0249594 A1 9/2014 Sharma et al.
2014/0249600 A1 9/2014 Heruth et al.
2014/0249605 A1 9/2014 Heruth et al.
2014/0249760 A1 9/2014 Proud et al.
2014/0249774 A1 9/2014 Yuen et al.
2014/0249853 A1 9/2014 Proud et al.
2014/0250726 A1 9/2014 Meschter
2014/0257055 A1 9/2014 Pacione et al.
2014/0257058 A1 9/2014 Clarysse et al.
2014/0257437 A1 9/2014 Simon et al.
2014/0257540 A1 9/2014 Pacione et al.
2014/0258220 A1 9/2014 Yuen et al.
2014/0259798 A1 9/2014 Hollander
2014/0260677 A1 9/2014 Dojan et al.
2014/0260689 A1 9/2014 Walker
2014/0266939 A1 9/2014 Baringer et al.
2014/0273824 A1 9/2014 Fenner et al.
2014/0273858 A1 9/2014 Panther et al.
2014/0275812 A1 9/2014 Stivoric et al.
2014/0275813 A1 9/2014 Stivoric et al.
2014/0275850 A1 9/2014 Venkatraman et al.
2014/0275852 A1 9/2014 Hong et al.
2014/0275854 A1 9/2014 Venkatraman et al.
2014/0275886 A1 9/2014 Teixeira
2014/0276119 A1 9/2014 Venkatraman et al.
2014/0276130 A1 9/2014 Mirelman et al.
2014/0276192 A1 9/2014 Stivoric et al.
2014/0276554 A1 9/2014 Finan et al.
2014/0276555 A1 9/2014 Morales
2014/0277250 A1 9/2014 Su et al.
2014/0277277 A1 9/2014 Gordon et al.
2014/0277631 A1 9/2014 Rice et al.
2014/0277632 A1 9/2014 Walker
2014/0277658 A1 9/2014 Hanft
2014/0278220 A1 9/2014 Yuen
2014/0278229 A1 9/2014 Hong et al.
2014/0285311 A1 9/2014 Ellis
2014/0285396 A1 9/2014 Lee et al.
2014/0288390 A1 9/2014 Hong et al.
2014/0288391 A1 9/2014 Hong et al.
2014/0288392 A1 9/2014 Hong et al.
2014/0288435 A1 9/2014 Richards et al.
2014/0288436 A1 9/2014 Venkatraman et al.
2014/0288438 A1 9/2014 Venkatraman et al.
2014/0288619 A1 9/2014 Johnson et al.
2014/0288620 A1 9/2014 DiLorenzo
2014/0288647 A1 9/2014 Boyden et al.
2014/0295537 A1 10/2014 Omidi
2014/0296089 A1 10/2014 Holmes et al.
2014/0296658 A1 10/2014 Yuen et al.
2014/0296663 A1 10/2014 Boyden et al.
2014/0296978 A1 10/2014 Boyden et al.
2014/0297217 A1 10/2014 Yuen
2014/0297218 A1 10/2014 Yuen
2014/0303552 A1 10/2014 Kanderian, Jr. et al.
2014/0305204 A1 10/2014 Hong et al.
2014/0305470 A1 10/2014 Desu-Kalyanam
2014/0306807 A1 10/2014 Rowland et al.
2014/0307878 A1 10/2014 Osborne et al.
2014/0308661 A1 10/2014 Holmes et al.
2014/0309505 A1 10/2014 Euliano et al.
2014/0316191 A1 10/2014 de Zambotti et al.
2014/0316192 A1 10/2014 de Zambotti et al.
2014/0316305 A1 10/2014 Venkatraman et al.
2014/0318699 A1 10/2014 Longinotti-Buitoni et al.
2014/0320284 A1 10/2014 Messenger et al.
2014/0320331 A1 10/2014 Fernandes et al.
2014/0323897 A1 10/2014 Brown et al.
2014/0324118 A1 10/2014 Simon et al.
2014/0327320 A1 11/2014 Muhs et al.
2014/0328517 A1 11/2014 Gluncic
2014/0330094 A1 11/2014 Pacione et al.
2014/0330244 A1 11/2014 Hyde et al.
2014/0330256 A1 11/2014 Hyde et al.
2014/0330257 A1 11/2014 Hyde et al.
2014/0330347 A1 11/2014 Simms, Jr.
2014/0330357 A1 11/2014 Stevenson et al.
2014/0330431 A1 11/2014 Hollander et al.
2014/0331523 A1 11/2014 Ellis
2014/0336980 A1 11/2014 Yuen et al.
2014/0337450 A1 11/2014 Choudhary et al.
2014/0337451 A1 11/2014 Choudhary et al.
2014/0340221 A1 11/2014 Yuen et al.

(56) References Cited

U.S. PATENT DOCUMENTS

2014/0342328 A1 11/2014 Pacione et al.
2014/0343370 A1 11/2014 Stivoric et al.
2014/0343691 A1 11/2014 Guillory et al.
2014/0343867 A1 11/2014 Yuen et al.
2014/0343892 A1 11/2014 Yuen et al.
2014/0350636 A1 11/2014 King et al.
2014/0358012 A1 12/2014 Richards et al.
2014/0358024 A1 12/2014 Nelson et al.
2014/0358196 A1 12/2014 Mashiach
2014/0358197 A1 12/2014 Mashiach et al.
2014/0361147 A1 12/2014 Fei
2014/0364705 A1 12/2014 Parthasarathy et al.
2014/0368601 A1 12/2014 deCharms
2014/0371556 A1 12/2014 Maertz
2014/0371821 A1 12/2014 Mashiach et al.
2014/0371824 A1 12/2014 Mashiach et al.
2014/0371913 A1 12/2014 Zeltzer
2014/0374276 A1 12/2014 Guthrie et al.
2014/0376336 A1 12/2014 Steckner et al.
2014/0378787 A1 12/2014 Brumback et al.
2014/0379090 A1 12/2014 Diomidis et al.
2015/0003047 A1 1/2015 Lin
2015/0005650 A1 1/2015 Banet et al.
2015/0005652 A1 1/2015 Banet et al.
2015/0005911 A1 1/2015 Lake et al.
2015/0011194 A1 1/2015 Rodriguez
2015/0011860 A1 1/2015 Pool et al.
2015/0011914 A1 1/2015 Berner, Jr. et al.
2015/0018660 A1 1/2015 Thomson et al.
2015/0018702 A1 1/2015 Galloway et al.
2015/0019135 A1 1/2015 Kacyvenski et al.
2015/0019257 A1 1/2015 Doyle et al.
2015/0022675 A1 1/2015 Lord et al.
2015/0025393 A1 1/2015 Hong et al.
2015/0025394 A1 1/2015 Hong et al.
2015/0025478 A1 1/2015 Hibdon et al.
2015/0031964 A1 1/2015 Bly et al.
2015/0031970 A1 1/2015 Lain
2015/0032178 A1 1/2015 Simon et al.
2015/0039040 A1 2/2015 Cowan et al.
2015/0039053 A1 2/2015 Kaib et al.
2015/0040282 A1 2/2015 Longinotti-Buitoni et al.
2015/0040428 A1 2/2015 Davis et al.
2015/0045634 A1 2/2015 Goldberg et al.
2015/0048942 A1 2/2015 Bertagna et al.
2015/0050888 A1 2/2015 Baker et al.
2015/0057595 A1 2/2015 Gunn et al.
2015/0057718 A1 2/2015 Sharma et al.
2015/0065786 A1 3/2015 Jeevanandam et al.
2015/0065826 A1 3/2015 Mulligan et al.
2015/0066124 A1 3/2015 Stevenson et al.
2015/0071934 A1 3/2015 Christiano
2015/0073498 A1 3/2015 Kothandaraman
2015/0073499 A1 3/2015 Kothandaraman
2015/0073500 A1 3/2015 Kothandaraman et al.
2015/0073723 A1 3/2015 Mulligan et al.
2015/0076909 A1 3/2015 Biederman et al.
2015/0077050 A1 3/2015 Van Funderburk
2015/0080746 A1 3/2015 Bleich et al.
2015/0080756 A1 3/2015 Robinson et al.
2015/0080982 A1 3/2015 Van Funderburk
2015/0080992 A1 3/2015 Drnek et al.
2015/0088024 A1 3/2015 Sackellares et al.
2015/0088226 A1 3/2015 Tourrel et al.
2015/0088457 A1 3/2015 Yuen et al.
2015/0094547 A1 4/2015 Mickle et al.
2015/0094552 A1 4/2015 Golda et al.
2015/0094914 A1 4/2015 Abreu
2015/0096204 A1 4/2015 Case, Jr.
2015/0096597 A1 4/2015 Patel et al.
2015/0097701 A1 4/2015 Al-Ali et al.
2015/0099943 A1 4/2015 Russell
2015/0099959 A1 4/2015 Bonmassar et al.
2015/0100038 A1 4/2015 McCann et al.
2015/0100108 A1 4/2015 Vansickle et al.
2015/0100109 A1 4/2015 Feldman et al.
2015/0100270 A1 4/2015 Yuen et al.
2015/0102923 A1 4/2015 Messenger et al.
2015/0112151 A1 4/2015 Muhsin et al.
2015/0112170 A1 4/2015 Amerson et al.
2015/0113417 A1 4/2015 Yuen et al.
2015/0116053 A1 4/2015 Stevenson et al.
2015/0119728 A1 4/2015 Blackadar et al.
2015/0119951 A1 4/2015 Nelson et al.
2015/0119952 A1 4/2015 Sharma et al.
2015/0120496 A1 4/2015 Watson
2015/0122018 A1 5/2015 Yuen
2015/0125945 A1 5/2015 Holmes et al.
2015/0126822 A1 5/2015 Chavan et al.
2015/0129664 A1 5/2015 Brar
2015/0134107 A1 5/2015 Hyde et al.
2015/0134268 A1 5/2015 Yuen et al.
2015/0134345 A1 5/2015 Hyde et al.
2015/0134346 A1 5/2015 Hyde et al.
2015/0137935 A1 5/2015 Ellis
2015/0137997 A1 5/2015 Huang
2015/0141769 A1 5/2015 Mulligan et al.
2015/0141873 A1 5/2015 Fei
2015/0142074 A1 5/2015 Bar-Yoseph et al.
2015/0142082 A1 5/2015 Simon et al.
2015/0143601 A1 5/2015 Longinotti-Buitoni et al.
2015/0146939 A1 5/2015 Datta et al.
2015/0148637 A1 5/2015 Golda et al.
2015/0148697 A1 5/2015 Burnes et al.
2015/0148700 A1 5/2015 Mhuircheartaigh et al.
2015/0148868 A1 5/2015 Shahandeh et al.
2015/0149096 A1 5/2015 Soykan
2015/0149217 A1 5/2015 Rath et al.
2015/0150453 A1 6/2015 Abreu
2015/0150505 A1 6/2015 Kaskoun et al.
2015/0154364 A1 6/2015 Biasi et al.
2015/0156749 A1 6/2015 Yun et al.
2015/0157256 A1 6/2015 Galeev
2015/0157269 A1 6/2015 Lisogurski et al.
2015/0157512 A1 6/2015 Abir
2015/0164321 A1 6/2015 Weibel et al.
2015/0164322 A1 6/2015 Derchak
2015/0164349 A1 6/2015 Gopalakrishnan et al.
2015/0164376 A1 6/2015 Huang
2015/0164377 A1 6/2015 Nathan et al.
2015/0164432 A1 6/2015 Gupta et al.
2015/0170504 A1 6/2015 Jooste
2015/0173452 A1 6/2015 Semperlotti et al.
2015/0173628 A1 6/2015 Yuen et al.
2015/0173631 A1 6/2015 Richards et al.
2015/0173674 A1 6/2015 Hayes et al.
2015/0174296 A1 6/2015 Ju et al.
2015/0174406 A1 6/2015 Lamensdorf et al.
2015/0177081 A1 6/2015 Steier
2015/0179038 A1 6/2015 Daniel et al.
2015/0183828 A1 7/2015 Genove et al.
2015/0189062 A1 7/2015 Ellis
2015/0189063 A1 7/2015 Ellis
2015/0190053 A1 7/2015 Baker et al.
2015/0190636 A1 7/2015 Simon et al.
2015/0190637 A1 7/2015 Simon et al.
2015/0193612 A1 7/2015 Chow
2015/0194052 A1 7/2015 Sagan et al.
2015/0196229 A1 7/2015 Old et al.
2015/0196256 A1 7/2015 Venkatraman et al.
2015/0196378 A1 7/2015 Mayer et al.
2015/0196409 A1 7/2015 Pool et al.
2015/0201853 A1 7/2015 Hong et al.
2015/0201854 A1 7/2015 Hong et al.
2015/0206408 A1 7/2015 LaLonde et al.
2015/0207915 A1 7/2015 Roberts et al.
2015/0208943 A1 7/2015 Shenasa et al.
2015/0220700 A1 8/2015 Chait et al.
2015/0221208 A1 8/2015 Knighton et al.
2015/0223700 A1 8/2015 Kirenko
2015/0223708 A1 8/2015 Richards et al.
2015/0224310 A1 8/2015 Sharma et al.
2015/0226619 A1 8/2015 Rice et al.
2015/0230722 A1 8/2015 Sarkar et al.

(56) References Cited

U.S. PATENT DOCUMENTS

2015/0230735 A1 8/2015 Venkatraman et al.
2015/0230761 A1 8/2015 Brumback et al.
2015/0231402 A1 8/2015 Aghassian
2015/0238097 A1 8/2015 Teller et al.
2015/0238277 A1 8/2015 Ritchey et al.
2015/0243967 A1 8/2015 Norton et al.
2015/0245797 A1 9/2015 Teller et al.
2015/0250429 A1 9/2015 Hampapuram et al.
2015/0254710 A1 9/2015 Black et al.
2015/0255858 A1 9/2015 Li et al.
2015/0257479 A1 9/2015 Ellis
2015/0258261 A1 9/2015 Novack
2015/0258415 A1 9/2015 Trivedi et al.
2015/0260514 A1 9/2015 Menelas et al.
2015/0265150 A1 9/2015 Darty et al.
2015/0265164 A1 9/2015 Gopalakrishnan et al.
2015/0265195 A1 9/2015 Darty et al.
2015/0265207 A1 9/2015 Wu et al.
2015/0265214 A1 9/2015 De Kok et al.
2015/0265217 A1 9/2015 Penders et al.
2015/0265903 A1 9/2015 Kolen et al.
2015/0269009 A1 9/2015 Faaborg et al.
2015/0269624 A1 9/2015 Cheng et al.
2015/0272511 A1 10/2015 Najafi et al.
2015/0278453 A1 10/2015 Joao
2015/0282711 A1 10/2015 Thomas et al.
2015/0282713 A1 10/2015 Fei
2015/0282767 A1 10/2015 Stivoric et al.
2015/0283365 A1 10/2015 Dacey, Jr. et al.
2015/0283386 A1 10/2015 Chow
2015/0288772 A1 10/2015 Molettiere et al.
2015/0289594 A1 10/2015 Rushbrook et al.
2015/0289595 A1 10/2015 Rushbrook et al.
2015/0289596 A1 10/2015 Beers et al.
2015/0289797 A1 10/2015 Pacione et al.
2015/0289798 A1 10/2015 Pacione et al.
2015/0289799 A1 10/2015 Pacione et al.
2015/0289800 A1 10/2015 Pacione et al.
2015/0289808 A1 10/2015 Pacione et al.
2015/0289809 A1 10/2015 Pacione et al.
2015/0289810 A1 10/2015 Pacione et al.
2015/0289811 A1 10/2015 Pacione et al.
2015/0289812 A1 10/2015 Pacione et al.
2015/0289820 A1 10/2015 Miller et al.
2015/0289911 A1 10/2015 Beyar et al.
2015/0294574 A1 10/2015 Pacione et al.
2015/0294575 A1 10/2015 Pacione et al.
2015/0294576 A1 10/2015 Pacione et al.
2015/0294583 A1 10/2015 Pacione et al.
2015/0294594 A1 10/2015 Pacione et al.
2015/0296922 A1 10/2015 Rushbrook et al.
2015/0297059 A1 10/2015 Desu-Kalyanam
2015/0297103 A1 10/2015 Hu et al.
2015/0297134 A1 10/2015 Albert et al.
2015/0297904 A1 10/2015 Kavounas
2015/0304797 A1 10/2015 Rhoads et al.
2015/0305682 A1 10/2015 LeBoeuf et al.
2015/0313308 A1 11/2015 Rice et al.
2015/0313309 A1 11/2015 Darden et al.
2015/0314166 A1 11/2015 Hong et al.
2015/0317515 A1 11/2015 Lake et al.
2015/0320588 A1 11/2015 Connor
2015/0321084 A1 11/2015 Galasso et al.
2015/0327989 A1 11/2015 Boyden et al.
2015/0331997 A1 11/2015 Joao
2015/0335096 A1 11/2015 Semperlotti et al.
2015/0335385 A1 11/2015 Miao et al.
2015/0335507 A1 11/2015 Emmons et al.
2015/0338428 A1 11/2015 Holmes et al.
2015/0339946 A1 11/2015 Pacione et al.
2015/0347689 A1 12/2015 Neagle
2015/0351695 A1 12/2015 Cronin
2015/0351698 A1 12/2015 Cronin
2015/0356524 A1 12/2015 Pennanen
2015/0356555 A1 12/2015 Pennanen
2015/0358525 A1 12/2015 Lord
2015/0359429 A1 12/2015 Al-Ali et al.
2015/0359457 A1 12/2015 Blumenthal et al.
2015/0359489 A1 12/2015 Baudenbacher et al.
2015/0359490 A1 12/2015 Massey et al.
2015/0360038 A1 12/2015 Zottola et al.
2015/0364018 A1 12/2015 Mirov et al.
2015/0364938 A1 12/2015 Lapetina et al.
2015/0365738 A1 12/2015 Purvis et al.
2015/0366746 A1 12/2015 Ashby
2015/0366915 A1 12/2015 Gay et al.
2015/0367144 A1 12/2015 Flynn et al.
2015/0368717 A1 12/2015 Holmes et al.
2015/0371516 A1 12/2015 Petersen et al.
2015/0374289 A1 12/2015 Teller et al.
2015/0374541 A1 12/2015 de Juan, Jr. et al.
2016/0000188 A1 1/2016 Hanft
2016/0000385 A1 1/2016 Petersen et al.
2016/0000640 A1 1/2016 Lai et al.
2016/0000642 A1 1/2016 Zipper
2016/0000984 A1 1/2016 Burnett et al.
2016/0001034 A1 1/2016 Rembrand
2016/0001071 A1 1/2016 Sharma et al.
2016/0003823 A1 1/2016 Holmes
2016/0005299 A1 1/2016 Zomet et al.
2016/0007890 A1 1/2016 Kovatchev et al.
2016/0007925 A1 1/2016 Mirov et al.
2016/0008632 A1 1/2016 Wetmore et al.
2016/0011215 A1 1/2016 Holmes
2016/0011225 A1 1/2016 Holmes
2016/0012465 A1 1/2016 Sharp
2016/0015280 A1 1/2016 Hyde et al.
2016/0015972 A1 1/2016 Hyde et al.
2016/0016041 A1 1/2016 Giedwoyn et al.
2016/0022193 A1 1/2016 Rau et al.
2016/0023007 A1 1/2016 Stouffer et al.
2016/0025760 A1 1/2016 Holmes
2016/0025763 A1 1/2016 Holmes
2016/0025854 A1 1/2016 D'Angelo et al.
2016/0029905 A1 2/2016 Kovacs
2016/0029931 A1 2/2016 Salas-Boni et al.
2016/0029966 A1 2/2016 Salas-Boni et al.
2016/0030650 A1 2/2016 Yomtov et al.
2016/0030741 A1 2/2016 Wei et al.
2016/0030756 A1 2/2016 Dronov
2016/0032361 A1 2/2016 Holmes et al.
2016/0033544 A1 2/2016 Holmes et al.
2016/0034696 A1 2/2016 Jooste et al.
2016/0036118 A1 2/2016 Baringer et al.
2016/0037855 A1 2/2016 Ellis
2016/0038037 A1 2/2016 Kovacs
2016/0038038 A1 2/2016 Kovacs
2016/0038042 A1 2/2016 Mulligan et al.
2016/0038043 A1 2/2016 Mulligan et al.
2016/0038055 A1 2/2016 Wheeler et al.
2016/0038324 A1 2/2016 Pool et al.
2016/0038673 A1 2/2016 Morales
2016/0038744 A1 2/2016 Ellingson et al.
2016/0044993 A1 2/2016 Meschter et al.
2016/0047787 A1 2/2016 Islam
2016/0051169 A1 2/2016 Hong et al.
2016/0051825 A1 2/2016 Ter-Petrosyan et al.
2016/0054343 A1 2/2016 Holmes et al.
2016/0058286 A1 3/2016 Joshua et al.
2016/0058302 A1 3/2016 Raghuram et al.
2016/0058324 A1 3/2016 Cao
2016/0058329 A1 3/2016 Srinivas et al.
2016/0058331 A1 3/2016 Keen et al.
2016/0058332 A1 3/2016 Tan et al.
2016/0058333 A1 3/2016 Arnold et al.
2016/0058356 A1 3/2016 Raghuram et al.
2016/0058370 A1 3/2016 Raghuram et al.
2016/0058371 A1 3/2016 Singh Alvarado et al.
2016/0058372 A1 3/2016 Raghuram et al.
2016/0058375 A1 3/2016 Rothkopf
2016/0059010 A1 3/2016 Sharma et al.
2016/0059064 A1 3/2016 Smith et al.
2016/0066803 A1 3/2016 Hu et al.
2016/0066844 A1 3/2016 Venkatraman et al.

(56) References Cited

U.S. PATENT DOCUMENTS

2016/0067584 A1 3/2016 Giedwoyn et al.
2016/0069919 A1 3/2016 Holmes et al.
2016/0069920 A1 3/2016 Holmes et al.
2016/0069921 A1 3/2016 Holmes et al.
2016/0072690 A1 3/2016 Molettiere et al.
2016/0073884 A1 3/2016 Samuelsson et al.
2016/0073914 A1 3/2016 Lapetina et al.
2016/0074278 A1 3/2016 Muench et al.
2016/0074547 A1 3/2016 Dobrinsky et al.
2016/0074600 A1 3/2016 Miesel
2016/0077015 A1 3/2016 Holmes et al.
2016/0078061 A1 3/2016 Hilsdale et al.
2016/0080166 A1 3/2016 Chen et al.
2016/0081418 A1 3/2016 Amos et al.
2016/0081435 A1 3/2016 Marks
2016/0081574 A1 3/2016 Krusor et al.
2016/0081622 A1 3/2016 Abreu
2016/0082187 A1 3/2016 Schaible et al.
2016/0084863 A1 3/2016 Holmes et al.
2016/0084869 A1 3/2016 Yuen et al.
2016/0089028 A1 3/2016 Chatterjee et al.
2016/0089575 A1 3/2016 Smith et al.
2016/0095550 A1 4/2016 Lin et al.
2016/0098723 A1 4/2016 Feeney
2016/0098730 A1 4/2016 Feeney
2016/0100801 A1 4/2016 Clark et al.
2016/0103123 A1 4/2016 Holmes et al.
2016/0106177 A1 4/2016 De Laurentis
2016/0113838 A1 4/2016 Paydarfar et al.
2016/0117951 A1 4/2016 Fleischer et al.
2016/0124009 A1 5/2016 Wasson et al.
2016/0135516 A1 5/2016 Cobbett et al.
2016/0135695 A1 5/2016 Cobbett et al.
2016/0135696 A1 5/2016 Cobbett et al.
2016/0135697 A1 5/2016 Rinderknecht et al.
2016/0135706 A1 5/2016 Sullivan et al.
2016/0135741 A1 5/2016 Chetham et al.
2016/0135742 A1 5/2016 Cobbett et al.
2016/0135743 A1 5/2016 Cobbett et al.
2016/0136882 A1 5/2016 Cobbett et al.
2016/0139156 A1 5/2016 Lakdawala
2016/0143548 A1 5/2016 Al-Ali
2016/0143562 A1 5/2016 Ashby
2016/0143584 A1 5/2016 Inagaki
2016/0147964 A1 5/2016 Corey et al.
2016/0148531 A1 5/2016 Bleich et al.
2016/0151603 A1 6/2016 Shouldice et al.
2016/0158426 A1 6/2016 Jeevanandam et al.
2016/0158552 A1 6/2016 Heruth et al.
2016/0162662 A1 6/2016 Monirabbasi et al.
2016/0166156 A1 6/2016 Yuen et al.
2016/0169880 A1 6/2016 Holmes et al.
2016/0169923 A1 6/2016 Holmes et al.
2016/0170996 A1 6/2016 Frank et al.
2016/0174840 A1 6/2016 Udoh et al.
2016/0174898 A1 6/2016 Udoh et al.
2016/0180440 A1 6/2016 Dibenedetto et al.
2016/0183818 A1 6/2016 Richards et al.
2016/0186140 A1 6/2016 Dalton et al.
2016/0188856 A1 6/2016 Miki et al.
2016/0191120 A1 6/2016 Dobyns et al.
2016/0192166 A1 6/2016 deCharms
2016/0192865 A1 7/2016 Datta et al.
2016/0193462 A1 7/2016 Krusor et al.
2016/0193679 A1 7/2016 Zhang et al.
2016/0195440 A1 7/2016 Amos et al.
2016/0198961 A1 7/2016 Homyk et al.
2016/0203522 A1 7/2016 Shiffert et al.
2016/0203572 A1 7/2016 McConaghy et al.
2016/0205450 A1 7/2016 Gartseev et al.
2016/0206215 A1 7/2016 Takahashi et al.
2016/0206922 A1 7/2016 Dalebout et al.
2016/0210679 A1 7/2016 Rohr et al.
2016/0213314 A1 7/2016 Zuckerman-Stark et al.
2016/0213334 A1 7/2016 Oleson
2016/0216286 A1 7/2016 Holmes et al.
2016/0216287 A1 7/2016 Holmes et al.
2016/0219266 A1 7/2016 Lane
2016/0219967 A1 8/2016 Smith et al.
2016/0220151 A1 8/2016 Zizi et al.
2016/0220186 A9 8/2016 Clark et al.
2016/0220198 A1 8/2016 Proud
2016/0224130 A1 8/2016 Myers et al.
2016/0224803 A1 8/2016 Frank et al.
2016/0227870 A1 8/2016 Odland et al.
2016/0227883 A1 8/2016 Beers et al.
2016/0228034 A1 8/2016 Gluncic
2016/0228052 A1 8/2016 Proud
2016/0231402 A1 8/2016 Rothberg et al.
2016/0232131 A1 8/2016 Liu et al.
2016/0232137 A1 8/2016 Liu
2016/0232201 A1 8/2016 Goran et al.
2016/0232244 A1 8/2016 Liu et al.
2016/0232726 A1 8/2016 Zizi et al.
2016/0232807 A1 8/2016 Ghaffari et al.
2016/0234143 A1 8/2016 Choudhary et al.
2016/0234174 A1 8/2016 Zizi et al.
2016/0234184 A1 8/2016 Liu et al.
2016/0234595 A1 8/2016 Goran et al.
2016/0235317 A1 8/2016 Sarkar et al.
2016/0235318 A1 8/2016 Sarkar
2016/0235352 A1 8/2016 DiLorenzo
2016/0235374 A1 8/2016 Miller et al.
2016/0238439 A1 8/2016 Chu et al.
2016/0238440 A1 8/2016 Chu et al.
2016/0238441 A1 8/2016 Chu et al.
2016/0238443 A1 8/2016 Chu et al.
2016/0238444 A1 8/2016 Chu et al.
2016/0239084 A1 8/2016 Connor
2016/0239624 A1 8/2016 Short et al.
2016/0240721 A1 8/2016 Chu et al.
2016/0241554 A1 8/2016 Zizi et al.
2016/0242646 A1 8/2016 Obma
2016/0242654 A1 8/2016 Quinlan et al.
2016/0242665 A1 8/2016 Galloway et al.
2016/0242700 A1 8/2016 Ferber et al.
2016/0243373 A1 8/2016 Kalgren et al.
2016/0252412 A1 9/2016 McMillen et al.
2016/0253471 A1 9/2016 Volpe
2016/0256095 A1 9/2016 Krasnow et al.
2016/0256097 A1 9/2016 Manautou et al.
2016/0256106 A1 9/2016 Krasnow et al.
2016/0256112 A1 9/2016 Brockway et al.
2016/0256350 A1 9/2016 Johnson et al.
2016/0256629 A1 9/2016 Grosman et al.
2016/0256697 A1 9/2016 Shahandeh et al.
2016/0259426 A1 9/2016 Yuen et al.
2016/0260311 A1 9/2016 Asano
2016/0261458 A1 9/2016 Huang
2016/0262485 A1 9/2016 Walker
2016/0262486 A1 9/2016 Ellis
2016/0262670 A1 9/2016 Wasson et al.
2016/0263382 A1 9/2016 Heruth et al.
2016/0270656 A1 9/2016 Samec et al.
2016/0274752 A1 9/2016 Zhu et al.
2016/0278638 A1 9/2016 Schwartz et al.
2016/0278669 A1 9/2016 Messenger et al.
2016/0279021 A1 9/2016 Hyde et al.
2016/0279022 A1 9/2016 Hyde et al.
2016/0279023 A1 9/2016 Hyde et al.
2016/0279024 A1 9/2016 Hyde et al.
2016/0279025 A1 9/2016 Hyde et al.
2016/0279410 A1 9/2016 Simon et al.
2016/0279435 A1 9/2016 Hyde et al.
2016/0283706 A1 9/2016 Holmes
2016/0285985 A1 9/2016 Molettiere et al.
2016/0287184 A1 10/2016 Diebold et al.
2016/0287380 A1 10/2016 Shi et al.
2016/0287879 A1 10/2016 Denison et al.
2016/0287887 A1 10/2016 Wu et al.
2016/0290878 A1 10/2016 Severinkangas et al.
2016/0293172 A1 10/2016 Sharma et al.
2016/0296114 A1 10/2016 Finch et al.
2016/0296116 A1 10/2016 Baker et al.

(56) References Cited

U.S. PATENT DOCUMENTS

2016/0296145 A1 10/2016 Bajaj et al.
2016/0296169 A1 10/2016 McHale et al.
2016/0296759 A1 10/2016 Cong et al.
2016/0299021 A1 10/2016 Thillainadarajah et al.
2016/0300028 A1 10/2016 Abell et al.
2016/0300252 A1 10/2016 Frank et al.
2016/0302509 A1 10/2016 Amos et al.
2016/0302521 A1 10/2016 Rennex
2016/0302706 A1 10/2016 Richards et al.
2016/0302707 A1 10/2016 Pesach et al.
2016/0303313 A1 10/2016 Burke et al.
2016/0303371 A1 10/2016 Whiting et al.
2016/0306339 A1 10/2016 Rushbrook et al.
2016/0309829 A1 10/2016 Molyneux et al.
2016/0309830 A1 10/2016 Rushbrook et al.
2016/0309842 A1 10/2016 Ellis
2016/0310022 A1 10/2016 Stivoric et al.
2016/0310048 A1 10/2016 Pang et al.
2016/0310737 A1 10/2016 Tourrel et al.
2016/0314670 A1 10/2016 Roberts et al.
2016/0316849 A1 11/2016 McLeod et al.
2016/0317095 A1 11/2016 Berger et al.
2016/0317744 A1 11/2016 Rule
2016/0317797 A1 11/2016 Smith et al.
2016/0320381 A1 11/2016 Holmes et al.
2016/0321400 A1 11/2016 Durrant et al.
2016/0321598 A1 11/2016 Baughman et al.
2016/0321599 A1 11/2016 Baughman et al.
2016/0321654 A1 11/2016 Lesavich et al.
2016/0323401 A1 11/2016 Messenger et al.
2016/0324450 A1 11/2016 Estes et al.
2016/0324472 A1 11/2016 Kaskoun et al.
2016/0324478 A1 11/2016 Goldstein
2016/0324488 A1 11/2016 Olsen
2016/0325083 A1 11/2016 Linden et al.
2016/0325084 A1 11/2016 Linden et al.
2016/0325143 A1 11/2016 Yuen et al.
2016/0327476 A1 11/2016 Islam
2016/0331257 A1 11/2016 Baumann et al.
2016/0331273 A1 11/2016 Armoundas
2016/0331518 A1 11/2016 Cable, II et al.
2016/0331986 A1 11/2016 Piha et al.
2016/0331987 A1 11/2016 Chapman et al.
2016/0334087 A1 11/2016 Lin
2016/0334124 A1 11/2016 Hou et al.
2016/0335632 A1 11/2016 Proud et al.
2016/0335913 A1 11/2016 Grant et al.
2016/0337843 A1 11/2016 Repka et al.
2016/0341611 A1 11/2016 Walker
2016/0342744 A1 11/2016 Joao
2016/0342762 A1 11/2016 Goetz
2016/0342882 A1 11/2016 Proud et al.
2016/0345653 A1 12/2016 Beers et al.
2016/0345902 A1 12/2016 Degreef et al.
2016/0346501 A1 12/2016 Hooper et al.
2016/0346530 A1 12/2016 Jeffery et al.
2016/0346542 A1 12/2016 Simon et al.
2016/0346609 A1 12/2016 Bailly et al.
2016/0349076 A1 12/2016 Campos Gallo et al.
2016/0354606 A1 12/2016 Dacey, Jr. et al.
2016/0358063 A1 12/2016 Proud et al.
2016/0358155 A1 12/2016 Proud et al.
2016/0358156 A1 12/2016 Proud et al.
2016/0359222 A1 12/2016 Li et al.
2016/0361009 A1 12/2016 Proud et al.
2016/0361026 A1 12/2016 Sarkar et al.
2016/0361027 A1 12/2016 Jang et al.
2016/0366972 A1 12/2016 Wilken et al.
2016/0367803 A1 12/2016 Wei et al.
2016/0369861 A1 12/2016 Phipps et al.
2016/0370396 A1 12/2016 Wasson et al.
2016/0373161 A1 12/2016 Yun et al.
2016/0374171 A1 12/2016 Wilken et al.
2016/0374556 A1 12/2016 Colvin, Jr. et al.
2016/0374600 A1 12/2016 Short et al.
2016/0374608 A1 12/2016 Dugan
2016/0374618 A1 12/2016 Giovangrandi
2016/0374620 A1 12/2016 Lisogurski et al.
2016/0374625 A1 12/2016 Mulligan et al.
2016/0377640 A1 12/2016 Balwani et al.
2016/0378069 A1 12/2016 Rothkopf
2016/0378070 A1 12/2016 Rothkopf
2016/0378071 A1 12/2016 Rothkopf
2016/0379312 A1 12/2016 Arjomand et al.
2017/0000324 A1 1/2017 Samec et al.
2017/0000325 A1 1/2017 Samec et al.
2017/0000326 A1 1/2017 Samec et al.
2017/0000329 A1 1/2017 Samec et al.
2017/0000330 A1 1/2017 Samec et al.
2017/0000331 A1 1/2017 Samec et al.
2017/0000332 A1 1/2017 Samec et al.
2017/0000333 A1 1/2017 Samec et al.
2017/0000334 A1 1/2017 Samec et al.
2017/0000335 A1 1/2017 Samec et al.
2017/0000337 A1 1/2017 Samec et al.
2017/0000340 A1 1/2017 Samec et al.
2017/0000341 A1 1/2017 Samec et al.
2017/0000342 A1 1/2017 Samec et al.
2017/0000343 A1 1/2017 Samec et al.
2017/0000345 A1 1/2017 Samec et al.
2017/0000371 A1 1/2017 Quinlan et al.
2017/0000372 A1 1/2017 Quinlan et al.
2017/0000375 A1 1/2017 Demas et al.
2017/0000390 A1 1/2017 Biederman et al.
2017/0000391 A1 1/2017 Wasson et al.
2017/0000415 A1 1/2017 Lapetina et al.
2017/0000454 A1 1/2017 Samec et al.
2017/0000683 A1 1/2017 Samec et al.
2017/0000936 A1 1/2017 Soykan et al.
2017/0001032 A1 1/2017 Samec et al.
2017/0004106 A1 1/2017 Joshua et al.
2017/0007111 A1 1/2017 Samec et al.
2017/0007115 A1 1/2017 Samec et al.
2017/0007116 A1 1/2017 Samec et al.
2017/0007122 A1 1/2017 Samec et al.
2017/0007123 A1 1/2017 Samec et al.
2017/0007182 A1 1/2017 Samec et al.
2017/0007420 A1 1/2017 Stevenson et al.
2017/0007450 A1 1/2017 Samec et al.
2017/0007799 A1 1/2017 Samec et al.
2017/0007843 A1 1/2017 Samec et al.
2017/0010469 A1 1/2017 Samec et al.
2017/0010470 A1 1/2017 Samec et al.
2017/0017083 A1 1/2017 Samec et al.
2017/0017936 A1 1/2017 Bisikalo et al.
2017/0017954 A1 1/2017 McDonough et al.
2017/0017955 A1 1/2017 Stern et al.
2017/0020241 A1 1/2017 Proud et al.
2017/0020402 A1 1/2017 Rogers et al.
2017/0021171 A1 1/2017 Perez et al.
2017/0021172 A1 1/2017 Perez et al.
2017/0027278 A1 2/2017 Roser
2017/0027514 A1 2/2017 Biederman et al.
2017/0027515 A1 2/2017 Wiser
2017/0027523 A1 2/2017 Venkatraman et al.
2017/0027812 A1 2/2017 Hyde et al.
2017/0028185 A1 2/2017 Wiley et al.
2017/0028231 A1 2/2017 Zhao et al.
2017/0028622 A1 2/2017 Westlind et al.
2017/0031874 A1 2/2017 Boudville
2017/0033932 A1 2/2017 Truu et al.
2017/0036021 A1 2/2017 Sharma et al.
2017/0036031 A1 2/2017 Norton et al.
2017/0038401 A1 2/2017 Holmes et al.
2017/0038747 A1 2/2017 Ellis
2017/0043160 A1 2/2017 Goodall et al.
2017/0045862 A1 2/2017 Jia et al.
2017/0046652 A1 2/2017 Haldenby et al.
2017/0046689 A1 2/2017 Lohe et al.
2017/0046694 A1 2/2017 Chow et al.
2017/0046799 A1 2/2017 Chan et al.
2017/0046806 A1 2/2017 Haldenby et al.
2017/0048209 A1 2/2017 Lohe et al.
2017/0048234 A1 2/2017 Lohe et al.

(56) References Cited

U.S. PATENT DOCUMENTS

2017/0048235 A1 2/2017 Lohe et al.
2017/0049352 A1 2/2017 Mirov
2017/0049406 A1 2/2017 Lanzel et al.
2017/0049946 A1 2/2017 Kapur et al.
2017/0053078 A1 2/2017 Lanzel et al.
2017/0055205 A1 2/2017 Morris et al.
2017/0055845 A1 3/2017 Mirov et al.
2017/0055851 A1 3/2017 Al-Ali
2017/0055880 A1 3/2017 Agrawal et al.
2017/0055882 A1 3/2017 Al-Ali et al.
2017/0055887 A1 3/2017 Al-Ali
2017/0055896 A1 3/2017 Al-Ali et al.
2017/0056677 A1 3/2017 Zhang et al.
2017/0058451 A1 3/2017 Smith et al.
2017/0063434 A1 3/2017 Hviid et al.
2017/0065183 A1 3/2017 Abreu
2017/0065230 A1 3/2017 Sinha et al.
2017/0065821 A1 3/2017 Brink et al.
2017/0068774 A1 3/2017 Cluckers et al.
2017/0068970 A1 3/2017 McCormack
2017/0071474 A1 3/2017 Islam
2017/0071487 A1 3/2017 Ritscher et al.
2017/0071506 A1 3/2017 Dwarika
2017/0071510 A1 3/2017 Delbeke et al.
2017/0071545 A1 3/2017 Ritscher et al.
2017/0072121 A1 3/2017 Yomtov et al.
2017/0076068 A1 3/2017 Dobbles et al.
2017/0079368 A1 3/2017 Amos et al.
2017/0079596 A1 3/2017 Teixeira
2017/0080207 A1 3/2017 Perez et al.
2017/0083907 A1 3/2017 McDonough et al.
2017/0084983 A1 3/2017 Baringer et al.
2017/0085545 A1 3/2017 Lohe et al.
2017/0085555 A1 3/2017 Bisikalo et al.
2017/0085967 A1 3/2017 Case, Jr.
2017/0086519 A1 3/2017 Vigano' et al.
2017/0086752 A1 3/2017 Baxi et al.
2017/0091756 A1 3/2017 Stern et al.
2017/0095011 A1 4/2017 Cobbett et al.
2017/0095205 A1 4/2017 Abreu
2017/0095673 A1 4/2017 Ludwig et al.
2017/0095721 A1 4/2017 Bleich et al.
2017/0097994 A1 4/2017 Karavirta
2017/0098367 A1 4/2017 M et al.
2017/0100056 A1 4/2017 Zhu et al.
2017/0100214 A1 4/2017 Wen
2017/0103669 A1 4/2017 Silveratawil et al.
2017/0105474 A1 4/2017 Morrison et al.
2017/0105476 A1 4/2017 Morrison et al.
2017/0106196 A1 4/2017 Ter-Petrosyan et al.
2017/0109735 A1 4/2017 Sheng et al.
2017/0111359 A1 4/2017 Zizi et al.
2017/0112391 A1 4/2017 Stivoric et al.
2017/0112439 A1 4/2017 Dubin et al.
2017/0112671 A1 4/2017 Goldstein
2017/0113042 A1 4/2017 Goodall et al.
2017/0113046 A1 4/2017 Fried et al.
2017/0113057 A1 4/2017 Goodall et al.
2017/0117739 A1 4/2017 Tuseth et al.
2017/0118626 A1 4/2017 Sadhu
2017/0119261 A1 5/2017 Teixeira
2017/0119312 A1 5/2017 Kaskoun et al.
2017/0119968 A1 5/2017 Keenan et al.
2017/0124853 A1 5/2017 Mehta et al.
2017/0127929 A1 5/2017 Schutt et al.
2017/0127975 A1 5/2017 Bozkurt
2017/0127999 A1 5/2017 Linders et al.
2017/0128140 A1 5/2017 Samuelsson et al.
2017/0128722 A1 5/2017 Perez
2017/0128735 A1 5/2017 Gustavson et al.
2017/0132615 A1 5/2017 Castinado et al.
2017/0132630 A1 5/2017 Castinado et al.
2017/0133022 A1 5/2017 Gurijala et al.
2017/0135415 A1 5/2017 Ellis
2017/0135633 A1 5/2017 Connor
2017/0136209 A1 5/2017 Burnett et al.
2017/0136264 A1 5/2017 Hyde et al.
2017/0136265 A1 5/2017 Hyde et al.
2017/0136842 A1 5/2017 Anderson et al.
2017/0140408 A1 5/2017 Wuehler
2017/0143219 A1 5/2017 Ciecko
2017/0143233 A1 5/2017 Audeh et al.
2017/0143266 A1 5/2017 Kovacs et al.
2017/0143267 A1 5/2017 Kovacs et al.
2017/0143268 A1 5/2017 Kovacs et al.
2017/0143282 A1 5/2017 Kovacs et al.
2017/0146385 A1 5/2017 Kovacs et al.
2017/0146386 A1 5/2017 Wiard et al.
2017/0146387 A1 5/2017 Wiard et al.
2017/0146388 A1 5/2017 Kovacs et al.
2017/0146389 A1 5/2017 Kovacs et al.
2017/0146390 A1 5/2017 Kovacs
2017/0146391 A1 5/2017 Kovacs et al.
2017/0147722 A1 5/2017 Greenwood
2017/0147754 A1 5/2017 Kovacs
2017/0147803 A1 5/2017 Zizi et al.
2017/0147837 A1 5/2017 Kovacs et al.
2017/0148240 A1 5/2017 Kovacs et al.
2017/0149773 A1 5/2017 Kovacs et al.
2017/0150895 A1 6/2017 Cobbett et al.
2017/0152486 A1 6/2017 Shen et al.
2017/0156593 A1 6/2017 Ferber et al.
2017/0156606 A1 6/2017 Ferber et al.
2017/0156662 A1 6/2017 Goodall et al.
2017/0156663 A1 6/2017 Heruth et al.
2017/0157411 A1 6/2017 Shahandeh et al.
2017/0160398 A1 6/2017 Venkatraman et al.
2017/0161517 A1 6/2017 Shah
2017/0164850 A1 6/2017 Murphy et al.
2017/0164876 A1 6/2017 Hyde et al.
2017/0164878 A1 6/2017 Connor
2017/0165425 A9 6/2017 Ruchti et al.
2017/0165483 A1 6/2017 Sharma et al.
2017/0168457 A1 6/2017 Sadasivam et al.
2017/0169190 A1 6/2017 Harma et al.
2017/0169695 A1 6/2017 Poisner et al.
2017/0172249 A1 6/2017 Kassatly et al.
2017/0172522 A1 6/2017 Insler et al.
2017/0173216 A1 6/2017 Ju et al.
2017/0173262 A1 6/2017 Veltz
2017/0181671 A1 6/2017 Varsavsky et al.
2017/0181677 A1 6/2017 Varsavsky et al.
2017/0181708 A1 6/2017 Orron et al.
2017/0182330 A1 6/2017 Schneider et al.
2017/0188893 A1 7/2017 Venkatraman et al.
2017/0189756 A1 7/2017 Brothers et al.
2017/0189757 A1 7/2017 Brothers et al.
2017/0189815 A1 7/2017 Tweedale et al.
2017/0193140 A1 7/2017 Brothers et al.
2017/0195475 A1 7/2017 Mehta et al.
2017/0196455 A1 7/2017 Mirov et al.
2017/0196457 A1 7/2017 Thakur et al.
2017/0196458 A1 7/2017 Ternes et al.
2017/0196513 A1 7/2017 Longinotti-Buitoni et al.
2017/0197072 A1 7/2017 Linden et al.
2017/0202461 A1 7/2017 Darty et al.
2017/0202484 A1 7/2017 Al-Shaery et al.
2017/0206532 A1 7/2017 Choi
2017/0209053 A1 7/2017 Pantelopoulos et al.
2017/0209055 A1 7/2017 Pantelopoulos et al.
2017/0209081 A1 7/2017 Davidson
2017/0209666 A1 7/2017 Quigley
2017/0209705 A1 7/2017 Faltys et al.
2017/0215028 A1 7/2017 Rhoads et al.
2017/0215524 A1 8/2017 Rushbrook et al.
2017/0215729 A1 8/2017 Mullin et al.
2017/0215756 A1 8/2017 Galloway et al.
2017/0215757 A1 8/2017 Gil Da Costa et al.
2017/0215765 A1 8/2017 Amos et al.
2017/0216125 A1 8/2017 Hyde et al.
2017/0216610 A1 8/2017 Yoder et al.
2017/0216611 A1 8/2017 Yoder et al.
2017/0216625 A1 8/2017 Pishdad et al.
2017/0216627 A1 8/2017 Brooks et al.

(56) References Cited

U.S. PATENT DOCUMENTS

2017/0221032 A1 8/2017 Mazed
2017/0221052 A1 8/2017 Sheng et al.
2017/0221463 A1 8/2017 Lenhert
2017/0224252 A1 8/2017 Salzar et al.
2017/0224260 A1 8/2017 Darty et al.
2017/0224268 A1 8/2017 Altini et al.
2017/0224291 A1 8/2017 Hampapuram et al.
2017/0224581 A1 8/2017 Johnson et al.
2017/0224990 A1 8/2017 Goldwasser et al.
2017/0228516 A1 8/2017 Sampath et al.
2017/0228627 A1 8/2017 Geissler et al.
2017/0228706 A1 8/2017 Parziale et al.
2017/0228731 A1 8/2017 Sheng et al.
2017/0228734 A1 8/2017 Kurian
2017/0230084 A1 8/2017 Zhu et al.
2017/0231494 A1 8/2017 Pekander
2017/0231495 A1 8/2017 Soro et al.
2017/0231569 A1 8/2017 Kumar et al.
2017/0231597 A1 8/2017 Howard
2017/0231738 A1 8/2017 Severson
2017/0232256 A1 8/2017 Meskens
2017/0232297 A1 8/2017 Prokhorov
2017/0232300 A1 8/2017 Tran et al.
2017/0236177 A1 8/2017 Sebastian et al.
2017/0236196 A1 8/2017 Isaacson et al.
2017/0236407 A1 8/2017 Rhoads et al.
2017/0237569 A1 8/2017 Vandervort
2017/0237570 A1 8/2017 Vandervort
2017/0237694 A1 8/2017 Choudhary et al.
2017/0238659 A1 8/2017 Bohnsack et al.
2017/0238814 A1 8/2017 Gopalakrishnan et al.
2017/0238881 A1 8/2017 Cheng et al.
2017/0239470 A1 8/2017 Wei et al.
2017/0239523 A1 8/2017 Cheng et al.
2017/0243056 A1 8/2017 Cheng et al.
2017/0243177 A1 8/2017 Johnsrud et al.
2017/0243208 A1 8/2017 Kurian et al.
2017/0243209 A1 8/2017 Johnsrud et al.
2017/0243212 A1 8/2017 Castinado et al.
2017/0243213 A1 8/2017 Castinado et al.
2017/0243214 A1 8/2017 Johnsrud et al.
2017/0243217 A1 8/2017 Johnsrud et al.
2017/0243222 A1 8/2017 Balasubramanian
2017/0243286 A1 8/2017 Castinado et al.
2017/0243287 A1 8/2017 Johnsrud et al.
2017/0243508 A1 8/2017 Cheng et al.
2017/0244707 A1 8/2017 Johnsrud et al.
2017/0244721 A1 8/2017 Kurian et al.
2017/0245767 A1 8/2017 Ferber et al.
2017/0246459 A1 8/2017 Kelley et al.
2017/0246521 A1 8/2017 deGreef et al.
2017/0248567 A1 8/2017 Islam
2017/0249115 A1 8/2017 Yuen et al.
2017/0250796 A1 8/2017 Samid
2017/0251232 A1 8/2017 Kaib et al.
2017/0251940 A1 9/2017 Perschbacher et al.
2017/0251974 A1 9/2017 Shreim et al.
2017/0251975 A1 9/2017 Shreim et al.
2017/0252513 A1 9/2017 Buck, Jr. et al.
2017/0255185 A1 9/2017 Hinshaw
2017/0255262 A1 9/2017 Liu
2017/0256000 A1 9/2017 Isaacson et al.
2017/0256001 A1 9/2017 Isaacson et al.
2017/0256003 A1 9/2017 Isaacson et al.
2017/0257162 A1 9/2017 Panther et al.
2017/0258389 A1 9/2017 Howard
2017/0258585 A1 9/2017 Marquez et al.
2017/0259072 A1 9/2017 Newham et al.
2017/0262015 A1 9/2017 Li et al.
2017/0262604 A1 9/2017 Francois
2017/0262862 A1 9/2017 Aljawhari
2017/0264338 A1 9/2017 Yun et al.
2017/0264693 A1 9/2017 Xue et al.
2017/0265578 A1 9/2017 Schneider
2017/0265580 A1 9/2017 Schneider et al.
2017/0265581 A1 9/2017 Chang
2017/0265582 A1 9/2017 Walker et al.
2017/0265583 A1 9/2017 Schneider et al.
2017/0265584 A1 9/2017 Walker et al.
2017/0265586 A1 9/2017 Schneider et al.
2017/0265587 A1 9/2017 Walker et al.
2017/0265588 A1 9/2017 Walker et al.
2017/0265589 A1 9/2017 Walker et al.
2017/0265591 A1 9/2017 Schneider
2017/0265592 A1 9/2017 Schneider et al.
2017/0265594 A1 9/2017 Walker et al.
2017/0265769 A1 9/2017 Quinlan et al.
2017/0265770 A1 9/2017 Quinlan et al.
2017/0266533 A1 9/2017 Dalebout et al.
2017/0270224 A1 9/2017 Singh et al.
2017/0270721 A1 9/2017 Graafstra
2017/0270765 A1 9/2017 Roberts et al.
2017/0272008 A1 9/2017 Schneider
2017/0272316 A1 9/2017 Johnson et al.
2017/0272842 A1 9/2017 Touma et al.
2017/0273599 A1 9/2017 Reese et al.
2017/0273606 A1 9/2017 Estes et al.
2017/0273629 A1 9/2017 Yu et al.
2017/0274267 A1 9/2017 Blahnik
2017/0281020 A1 10/2017 Mulligan et al.
2017/0281867 A1 10/2017 Parikh et al.
2017/0281927 A1 10/2017 Orinski
2017/0281928 A1 10/2017 Orinski
2017/0281957 A1 10/2017 Howard
2017/0282011 A1 10/2017 Jang et al.
2017/0283845 A1 10/2017 Holmes et al.
2017/0284875 A1 10/2017 Walker
2017/0290513 A1 10/2017 O'Reilly et al.
2017/0290528 A1 10/2017 Ternes et al.
2017/0290937 A1 10/2017 Dobrinsky et al.
2017/0290980 A1 10/2017 Friedli et al.
2017/0293266 A1 10/2017 Ji
2017/0295889 A1 10/2017 Beers
2017/0296052 A1 10/2017 Behar et al.
2017/0296076 A1 10/2017 Mahajan et al.
2017/0296107 A1 10/2017 Reid et al.
2017/0296139 A1 10/2017 Giaya et al.
2017/0296813 A1 10/2017 Sharma et al.
2017/0296814 A1 10/2017 Sharma et al.
2017/0296834 A1 10/2017 Kothandaraman et al.
2017/0300653 A1 10/2017 Hresko et al.
2017/0300741 A1 10/2017 Seuss et al.
2017/0300905 A1 10/2017 Withrow et al.
2017/0300910 A1 10/2017 Bethke et al.
2017/0300946 A1 10/2017 Wilkinson et al.
2017/0301214 A1 10/2017 Chen et al.
2017/0303784 A1 10/2017 Huiku
2017/0303786 A1 10/2017 Mullin et al.
2017/0303827 A1 10/2017 Giedwoyn et al.
2017/0304635 A1 10/2017 Aghassian
2017/0306539 A1 10/2017 Gladish et al.
2017/0308044 A1 10/2017 Ellis
2017/0308066 A1 10/2017 Farren et al.
2017/0308663 A1 10/2017 Moya et al.
2017/0308945 A1 10/2017 Loveder et al.
2017/0311878 A1 11/2017 Wu et al.
2017/0311897 A1 11/2017 Faccioli et al.
2017/0311902 A1 11/2017 Ferber et al.
2017/0312161 A1 11/2017 Johnson et al.
2017/0312165 A1 11/2017 Johnson et al.
2017/0312530 A1 11/2017 Schilling et al.
2017/0312612 A1 11/2017 Bleich et al.
2017/0312746 A1 11/2017 Holmes et al.
2017/0316182 A1 11/2017 Blackadar et al.
2017/0316487 A1 11/2017 Mazed
2017/0319119 A1 11/2017 Krasnow et al.
2017/0319122 A1 11/2017 Wild et al.
2017/0319123 A1 11/2017 Voss et al.
2017/0319849 A1 11/2017 Su et al.
2017/0324437 A1 11/2017 Ruttler et al.
2017/0325056 A1 11/2017 Mehta et al.
2017/0325524 A1 11/2017 Hyde et al.
2017/0325525 A1 11/2017 Hyde et al.
2017/0325727 A1 11/2017 Buza

(56) References Cited

U.S. PATENT DOCUMENTS

2017/0325736 A1 11/2017 Cantwell et al.
2017/0326013 A1 11/2017 Hyde et al.
2017/0330257 A1 11/2017 Collier et al.
2017/0330447 A1 11/2017 Mehta et al.
2017/0332733 A1 11/2017 Cluckers et al.
2017/0332980 A1 11/2017 Fifield et al.
2017/0333080 A1 11/2017 Roschak et al.
2017/0333752 A1 11/2017 Korkala et al.
2017/0336781 A1 11/2017 Livaccari et al.
2017/0340049 A1 11/2017 Rice et al.
2017/0340260 A1 11/2017 Chowdhury et al.
2017/0340277 A1 11/2017 Berner, Jr. et al.
2017/0340872 A1 11/2017 Hanson et al.
2017/0340920 A1 11/2017 Posio et al.
2017/0344736 A1 11/2017 Lane
2017/0345105 A1 11/2017 Isaacson et al.
2017/0347895 A1 12/2017 Wei et al.
2017/0348146 A1 12/2017 Drnek et al.
2017/0350878 A1 12/2017 Holmes et al.
2017/0351891 A1 12/2017 Ackley et al.
2017/0354351 A1 12/2017 Krans et al.
2017/0354365 A1 12/2017 Zhou
2017/0354547 A1 12/2017 Abir
2017/0354795 A1 12/2017 Blahnik et al.
2017/0356770 A1 12/2017 Bhatt et al.
2017/0357217 A1 12/2017 Raymann et al.
2017/0357419 A1 12/2017 Raymann et al.
2017/0358041 A1 12/2017 Forbes, Jr. et al.
2017/0358239 A1 12/2017 Arney et al.
2017/0358240 A1 12/2017 Blahnik et al.
2017/0358242 A1 12/2017 Thompson et al.
2017/0360320 A1 12/2017 Sarkar et al.
2017/0361092 A1 12/2017 Sharma et al.
2017/0361162 A1 12/2017 Bailly et al.
2017/0363440 A1 12/2017 Ahmed et al.
2017/0364860 A1 12/2017 Wilkinson et al.
2017/0365101 A1 12/2017 Samec et al.
2017/0366233 A1 12/2017 Hviid et al.
2017/0367576 A1 12/2017 Sanyal et al.
2017/0367585 A1 12/2017 Islam
2017/0367599 A1 12/2017 Sanyal et al.
2017/0368158 A1 12/2017 Vescovi et al.
2017/0372009 A1 12/2017 Sanyal et al.
2017/0372026 A1 12/2017 Sanyal et al.
2017/0372216 A1 12/2017 Awiszus et al.
2017/0373849 A1 12/2017 Donner et al.
2017/0374436 A1 12/2017 Awiszus et al.
2018/0000336 A1 1/2018 Gilad-Gilor et al.
2018/0000345 A1 1/2018 Soro et al.
2018/0000347 A1 1/2018 Perez et al.
2018/0000414 A1 1/2018 Lowet et al.
2018/0001005 A1 1/2018 Casas
2018/0001018 A1 1/2018 Burke et al.
2018/0001023 A1 1/2018 Gerber et al.
2018/0001083 A9 1/2018 Finch et al.
2018/0001184 A1 1/2018 Tran et al.
2018/0006990 A1 1/2018 Munemann
2018/0007467 A1 1/2018 Goran et al.
2018/0008003 A1 1/2018 Davis et al.
2018/0008005 A1 1/2018 Compton et al.
2018/0008151 A1 1/2018 Maertz
2018/0008185 A1 1/2018 Ramu et al.
2018/0008191 A1 1/2018 Cronin et al.
2018/0008193 A1 1/2018 Takahashi et al.
2018/0008206 A1 1/2018 Stahmann et al.
2018/0008831 A1 1/2018 An et al.
2018/0012311 A1 1/2018 Small et al.
2018/0012469 A1 1/2018 Tofighbakhsh
2018/0013815 A1 1/2018 Gold
2018/0019984 A1 1/2018 Isaacson et al.
2018/0020764 A1 1/2018 Walker
2018/0021235 A1 1/2018 Christiano et al.
2018/0021498 A1 1/2018 Yomtov et al.
2018/0021510 A1 1/2018 Burke et al.
2018/0021564 A1 1/2018 Goodall et al.
2018/0021589 A1 1/2018 Wu et al.
2018/0027347 A1 1/2018 Osborne et al.
2018/0028106 A1 2/2018 Leschinsky
2018/0028114 A1 2/2018 Cronin
2018/0028122 A1 2/2018 Golda et al.
2018/0028275 A1 2/2018 Bradley et al.
2018/0028809 A1 2/2018 Ziv
2018/0028827 A1 2/2018 Schilling et al.
2018/0035898 A1 2/2018 Gunderson
2018/0035920 A1 2/2018 Gunderson et al.
2018/0035951 A1 2/2018 Li
2018/0035982 A1 2/2018 Tholen et al.
2018/0036053 A1 2/2018 Toscano et al.
2018/0036115 A1 2/2018 Smirnov
2018/0036147 A1 2/2018 Gregg et al.
2018/0039512 A1 2/2018 Almasan et al.
2018/0040258 A1 2/2018 Kouache
2018/0041345 A1 2/2018 Maim
2018/0042526 A1 2/2018 Hong et al.
2018/0042809 A1 2/2018 Zipper
2018/0043095 A1 2/2018 Finan et al.
2018/0043096 A1 2/2018 Dobbles et al.
2018/0043173 A1 2/2018 Hellman et al.
2018/0045745 A1 2/2018 Holmes et al.
2018/0047074 A1 2/2018 Cronin et al.
2018/0049251 A1 2/2018 Hellman et al.
2018/0049675 A1 2/2018 Kerber
2018/0050189 A1 2/2018 Rump et al.
2018/0050214 A1 2/2018 Rump
2018/0055373 A1 3/2018 Kraiter et al.
2018/0055376 A1 3/2018 Yuen et al.
2018/0055382 A1 3/2018 Woodward et al.
2018/0055386 A1 3/2018 Zielinski et al.
2018/0055500 A1 3/2018 Scott et al.
2018/0056071 A1 3/2018 Swanson et al.
2018/0059126 A1 3/2018 Jones et al.
2018/0060449 A1 3/2018 Cronin et al.
2018/0060520 A1 3/2018 Degen et al.
2018/0064209 A1 3/2018 Hamill
2018/0067516 A1 3/2018 Longinotti-Buitoni et al.
2018/0069899 A1 3/2018 Lang et al.
2018/0070877 A1 3/2018 Tian
2018/0071789 A1 3/2018 Kingston et al.
2018/0072415 A1 3/2018 Cantrell et al.
2018/0072416 A1 3/2018 Cantrell et al.
2018/0074481 A1 3/2018 Kingston et al.
2018/0074488 A1 3/2018 Cantrell et al.
2018/0074521 A1 3/2018 Cantrell et al.
2018/0074522 A1 3/2018 Cantrell et al.
2018/0074523 A1 3/2018 Cantrell et al.
2018/0075386 A1 3/2018 Kingston et al.
2018/0075406 A1 3/2018 Kingston et al.
2018/0075716 A1 3/2018 Mirov et al.
2018/0075724 A1 3/2018 Steiner et al.
2018/0077975 A1 3/2018 Ellis
2018/0078754 A1 3/2018 Perez et al.
2018/0078777 A1 3/2018 Wu et al.
2018/0078843 A1 3/2018 Tran et al.
2018/0081787 A1 3/2018 Riddick et al.
2018/0081955 A1 3/2018 Gupta et al.
2018/0082043 A1 3/2018 Witchey et al.
2018/0082295 A1 3/2018 Boucard
2018/0083786 A1 3/2018 Dierks et al.
2018/0085011 A1 3/2018 Ma et al.
2018/0085021 A1 3/2018 Chakravarthy et al.
2018/0085038 A1 3/2018 Chen et al.
2018/0085040 A1 3/2018 Ferber et al.
2018/0085572 A1 3/2018 Stanslaski et al.
2018/0085576 A1 3/2018 Sharma et al.
2018/0085580 A1 3/2018 Perez et al.
2018/0085585 A1 3/2018 Stanslaski et al.
2018/0085586 A1 3/2018 Stanslaski et al.
2018/0085592 A1 3/2018 Yoder et al.
2018/0089394 A1 3/2018 Hyde et al.
2018/0089627 A1 3/2018 Liss
2018/0089641 A1 3/2018 Chan et al.
2018/0089669 A1 3/2018 Singh
2018/0090229 A1 3/2018 Sanyal et al.
2018/0092551 A1 4/2018 Yuen et al.

(56) References Cited

U.S. PATENT DOCUMENTS

2018/0092554 A1 4/2018 Zhang et al.
2018/0092573 A1 4/2018 Datta et al.
2018/0092577 A1 4/2018 Kane et al.
2018/0094953 A1 4/2018 Colson et al.
2018/0094991 A1 4/2018 McMillen et al.
2018/0096121 A1 4/2018 Goeringer et al.
2018/0096175 A1 4/2018 Schmeling et al.
2018/0101138 A1 4/2018 Raymann et al.
2018/0101655 A1 4/2018 Fogelberg et al.
2018/0103724 A1 4/2018 Ho
2018/0103863 A1 4/2018 Hu et al.
2018/0103874 A1 4/2018 Lee et al.
2018/0103879 A1 4/2018 Masciotti et al.
2018/0103883 A1 4/2018 Darty et al.
2018/0104407 A1 4/2018 Dacey, Jr. et al.
2018/0108024 A1 4/2018 Greco et al.
2018/0108440 A1 4/2018 Stevens et al.
2018/0110294 A1 4/2018 Schneider et al.
2018/0114124 A1 4/2018 Cronn et al.
2018/0115600 A1 4/2018 Almasan et al.
2018/0116334 A1 5/2018 Andon et al.
2018/0116536 A1 5/2018 Katra et al.
2018/0116723 A1 5/2018 Hettrick et al.
2018/0117346 A1 5/2018 Hellman et al.
2018/0117446 A1 5/2018 Tran et al.
2018/0117447 A1 5/2018 Tran et al.
2018/0120225 A1 5/2018 Ditterich
2018/0122211 A1 5/2018 Asano
2018/0123804 A1 5/2018 Smith et al.
2018/0124478 A1 5/2018 Case, Jr.
2018/0125163 A1 5/2018 Bertagna et al.
2018/0125689 A1 5/2018 Perez et al.
2018/0126053 A1 5/2018 Zilbershlag
2018/0126133 A1 5/2018 Cully et al.
2018/0126172 A1 5/2018 Sarkar et al.
2018/0126222 A1 5/2018 Duale et al.
2018/0130034 A1 5/2018 Taylor et al.
2018/0130050 A1 5/2018 Taylor et al.
2018/0130158 A1 5/2018 Atkinson et al.
2018/0131765 A1 5/2018 Puleston et al.
2018/0132032 A1 5/2018 Boesen et al.
2018/0132568 A1 5/2018 Kim et al.
2018/0132697 A1 5/2018 Desu-Kalyanam
2018/0132758 A1 5/2018 Benford
2018/0132778 A1 5/2018 Dugan
2018/0133583 A1 5/2018 Tran et al.
2018/0136486 A1 5/2018 Macnamara et al.
2018/0136633 A1 5/2018 Small et al.
2018/0137461 A1 5/2018 Wilkinson et al.
2018/0137506 A1 5/2018 Kcl et al.
2018/0137512 A1 5/2018 Georgiadis et al.
2018/0138022 A1 5/2018 Lam et al.
2018/0139057 A1 5/2018 Truu et al.
2018/0139518 A1 5/2018 Touma et al.
2018/0139799 A1 5/2018 Hellman et al.
2018/0140191 A1 5/2018 Samuelsson et al.
2018/0140198 A1 5/2018 Islam
2018/0140835 A1 5/2018 Sharma
2018/0144298 A1 5/2018 Rankin
2018/0144342 A1 5/2018 Borandi
2018/0146738 A1 5/2018 Folske et al.
2018/0147024 A1 5/2018 Kall et al.
2018/0147333 A1 5/2018 Rudser
2018/0147349 A1 5/2018 Finan et al.
2018/0147413 A1 5/2018 Ter-Petrosyan et al.
2018/0147449 A1 5/2018 Duale et al.
2018/0150816 A1 5/2018 Liu et al.
2018/0152972 A1 5/2018 Wu et al.
2018/0153404 A1 6/2018 Pekander
2018/0153475 A1 6/2018 Massey et al.
2018/0154075 A1 6/2018 Jho et al.
2018/0156660 A1 6/2018 Turgeon et al.
2018/0158036 A1 6/2018 Zhou et al.
2018/0158266 A1 6/2018 Zizi et al.
2018/0160985 A1 6/2018 Willis
2018/0162186 A1 6/2018 Anderson et al.
2018/0165738 A1 6/2018 Chilukuri et al.
2018/0167394 A1 6/2018 High et al.
2018/0168273 A1 6/2018 Case, Jr.
2018/0168460 A1 6/2018 Morris et al.
2018/0168461 A1 6/2018 Morris et al.
2018/0168463 A1 6/2018 Morris et al.
2018/0168811 A1 6/2018 Ranganathan et al.
2018/0168905 A1 6/2018 Goodall et al.
2018/0169411 A1 6/2018 Goodall et al.
2018/0169412 A1 6/2018 Goodall et al.
2018/0169421 A1 6/2018 Chen et al.
2018/0169474 A1 6/2018 Reddy
2018/0173405 A1 6/2018 Pereira et al.
2018/0173906 A1 6/2018 Rodriguez et al.
2018/0174097 A1 6/2018 Liu et al.
2018/0174188 A1 6/2018 Wilkinson et al.
2018/0174686 A1 6/2018 Zaphrir et al.
2018/0176017 A1 6/2018 Rodriguez et al.
2018/0177397 A1 6/2018 Kall et al.
2018/0177459 A1 6/2018 Eletr et al.
2018/0177963 A1 6/2018 Wang et al.
2018/0181806 A1 6/2018 Chandrashekar et al.
2018/0181909 A1 6/2018 Wilkinson et al.
2018/0181964 A1 6/2018 Zagarese et al.
2018/0182140 A1 6/2018 Biradar et al.
2018/0182489 A1 6/2018 Harma et al.
2018/0183796 A1 6/2018 Smith et al.
2018/0184735 A1 7/2018 Longinotti-Buitoni et al.
2018/0184751 A1 7/2018 Molyneux et al.
2018/0184901 A1 7/2018 Akmandor et al.
2018/0184914 A1 7/2018 Goering et al.
2018/0184944 A1 7/2018 Bodewes et al.
2018/0188704 A1 7/2018 Cella et al.
2018/0188714 A1 7/2018 Cella et al.
2018/0188715 A1 7/2018 Cella et al.
2018/0189452 A1 7/2018 Serhani et al.
2018/0189528 A1 7/2018 Hanis et al.
2018/0189854 A1 7/2018 Gabriele et al.
2018/0191503 A1 7/2018 Alwar et al.
2018/0191693 A1 7/2018 Juels
2018/0192900 A1 7/2018 Wei
2018/0192952 A1 7/2018 Rogers et al.
2018/0192953 A1 7/2018 Shreim et al.
2018/0198617 A1 7/2018 Drouin et al.
2018/0198785 A1 7/2018 Zizi et al.
2018/0198876 A1 7/2018 Ma et al.
2018/0199657 A1 7/2018 Kikukawa
2018/0199671 A1 7/2018 Schneider et al.
2018/0199673 A1 7/2018 Schneider et al.
2018/0199674 A1 7/2018 Walker et al.
2018/0200003 A1 7/2018 Olson
2018/0200185 A1 7/2018 Labib et al.
2018/0203755 A1 7/2018 Das et al.
2018/0203882 A1 7/2018 Hilsdale et al.
2018/0204034 A1 7/2018 Tonnelier
2018/0204111 A1 7/2018 Zadeh et al.
2018/0206586 A1 7/2018 Akay et al.
2018/0206747 A1 7/2018 Rinderknecht et al.
2018/0207429 A1 7/2018 Reinke et al.
2018/0210425 A1 7/2018 Cella et al.
2018/0210426 A1 7/2018 Cella et al.
2018/0210427 A1 7/2018 Cella et al.
2018/0211213 A1 7/2018 Vivier
2018/0211673 A1 7/2018 Sharma et al.
2018/0211718 A1 7/2018 Heath
2018/0213583 A1 7/2018 Al-Ali
2018/0213879 A1 8/2018 Campbell
2018/0214025 A1 8/2018 Homyk et al.
2018/0214026 A1 8/2018 Goodall et al.
2018/0214066 A1 8/2018 Goodall et al.
2018/0214080 A1 8/2018 Peeters et al.
2018/0214690 A1 8/2018 Hodgson-Zingman et al.
2018/0214694 A1 8/2018 Parramon
2018/0218003 A1 8/2018 Banga et al.
2018/0218354 A1 8/2018 Kumar et al.
2018/0219334 A1 8/2018 Kahlman
2018/0221645 A1 8/2018 Medema et al.
2018/0221663 A1 8/2018 Saini

(56) References Cited

U.S. PATENT DOCUMENTS

2018/0225419 A9 8/2018 Anthony et al.
2018/0225649 A1 8/2018 Babar et al.
2018/0227354 A1 8/2018 Gold
2018/0228401 A1 8/2018 Schwartz et al.
2018/0228434 A1 8/2018 Dwarika et al.
2018/0228438 A1 8/2018 Kaskoun et al.
2018/0229674 A1 8/2018 Heinrich et al.
2018/0231393 A1 8/2018 Czaja et al.
2018/0232693 A1 8/2018 Gillen et al.
2018/0232730 A1 8/2018 Harbour et al.
2018/0232817 A1 8/2018 Isaacson et al.
2018/0233016 A1 8/2018 Daniel et al.
2018/0233028 A1 8/2018 Rhoads et al.
2018/0235537 A1 8/2018 Whiting et al.
2018/0238734 A1 8/2018 Hotelling et al.
2018/0240176 A1 8/2018 Cronin et al.
2018/0240357 A1 8/2018 Trench Roca
2018/0241564 A1 8/2018 Peterson
2018/0242691 A1 8/2018 Bohnsack et al.
2018/0242864 A1 8/2018 Hu et al.
2018/0242891 A1 8/2018 Bernstein et al.
2018/0242921 A1 8/2018 Muhsin et al.
2018/0242926 A1 8/2018 Muhsin et al.
2018/0243528 A1 8/2018 Zapol et al.
2018/0243541 A1 8/2018 Kapur et al.
2018/0243567 A1 8/2018 St. Martin et al.
2018/0243573 A1 8/2018 Yoder et al.
2018/0243577 A1 8/2018 Kivi et al.
2018/0247712 A1 8/2018 Muhsin et al.
2018/0249919 A1 9/2018 Pont et al.
2018/0250574 A1 9/2018 Bleich et al.
2018/0253073 A1 9/2018 Cella et al.
2018/0253074 A1 9/2018 Cella et al.
2018/0253075 A1 9/2018 Cella et al.
2018/0253430 A1 9/2018 Grigorescu et al.
2018/0253805 A1 9/2018 Kelly et al.
2018/0255374 A1 9/2018 Cella et al.
2018/0255375 A1 9/2018 Cella et al.
2018/0255376 A1 9/2018 Cella et al.
2018/0255377 A1 9/2018 Cella et al.
2018/0255378 A1 9/2018 Cella et al.
2018/0255379 A1 9/2018 Cella et al.
2018/0255380 A1 9/2018 Cella et al.
2018/0255381 A1 9/2018 Cella et al.
2018/0255382 A1 9/2018 Cella et al.
2018/0255383 A1 9/2018 Cella et al.
2018/0256076 A1 9/2018 Friedman et al.
2018/0256096 A1 9/2018 Galeev et al.
2018/0257306 A1 9/2018 Mattingly et al.
2018/0259976 A1 9/2018 Williams et al.
2018/0260530 A1 9/2018 Kall et al.
2018/0261066 A1 9/2018 Treacy et al.
2018/0261307 A1 9/2018 Couse et al.
2018/0262493 A1 9/2018 Andrade
2018/0263564 A1 9/2018 Avril
2018/0264347 A1 9/2018 Tran et al.
2018/0268237 A1 9/2018 Stanimirovic et al.
2018/0268360 A1 9/2018 Millhouse et al.
2018/0268418 A1 9/2018 Tanksali
2018/0268479 A1 9/2018 Dowling et al.
2018/0268483 A1 9/2018 Jayaram et al.
2018/0270549 A1 9/2018 Awiszus et al.
2018/0271181 A1 9/2018 Ellis
2018/0271211 A1 9/2018 Perrault et al.
2018/0271213 A1 9/2018 Perrault et al.
2018/0274996 A1 9/2018 Rice et al.
2018/0279713 A1 10/2018 Beers et al.
2018/0279901 A1 10/2018 Gaudet et al.
2018/0279952 A1 10/2018 Orron et al.
2018/0279965 A1 10/2018 Pandit et al.
2018/0280177 A1 10/2018 Longley et al.
2018/0280694 A1 10/2018 Mashiach et al.
2018/0284093 A1 10/2018 Brown et al.
2018/0284735 A1 10/2018 Cella et al.
2018/0284736 A1 10/2018 Cella et al.
2018/0284737 A1 10/2018 Cella et al.
2018/0284741 A1 10/2018 Cella et al.
2018/0284742 A1 10/2018 Cella et al.
2018/0284743 A1 10/2018 Cella et al.
2018/0284744 A1 10/2018 Cella et al.
2018/0284745 A1 10/2018 Cella et al.
2018/0284746 A1 10/2018 Cella et al.
2018/0284747 A1 10/2018 Cella et al.
2018/0284749 A1 10/2018 Cella et al.
2018/0284752 A1 10/2018 Cella et al.
2018/0284753 A1 10/2018 Cella et al.
2018/0284754 A1 10/2018 Cella et al.
2018/0284755 A1 10/2018 Cella et al.
2018/0284756 A1 10/2018 Cella et al.
2018/0284757 A1 10/2018 Cella et al.
2018/0284758 A1 10/2018 Cella et al.
2018/0285709 A1 10/2018 Braunstein
2018/0289166 A1 10/2018 Andon et al.
2018/0289275 A1 10/2018 Krusor et al.
2018/0289310 A1 10/2018 Girouard et al.
2018/0289975 A1 10/2018 Kavounas
2018/0289976 A1 10/2018 Chapman et al.
2018/0292794 A1 10/2018 Ellis
2018/0293430 A1 10/2018 Datta et al.
2018/0293577 A1 10/2018 Kim et al.
2018/0295667 A1 10/2018 Hellman et al.
2018/0295895 A1 10/2018 Donohoe et al.
2018/0295933 A1 10/2018 Davis et al.
2018/0296097 A1 10/2018 Islam
2018/0296098 A1 10/2018 Islam
2018/0296136 A1 10/2018 Foxlin et al.
2018/0296142 A1 10/2018 Stahl
2018/0296157 A1 10/2018 Bleich et al.
2018/0296161 A1 10/2018 Shreim et al.
2018/0296847 A1 10/2018 Kaib et al.
2018/0299878 A1 10/2018 Cella et al.
2018/0300772 A1 10/2018 Bushong, Jr.
2018/0300919 A1 10/2018 Muhsin et al.
2018/0301211 A1 10/2018 Pappas et al.
2018/0303343 A1 10/2018 Dubin et al.
2018/0303356 A1 10/2018 Galeev et al.
2018/0303357 A1 10/2018 Galeev et al.
2018/0303396 A1 10/2018 Wild et al.
2018/0304149 A1 10/2018 Galasso et al.
2018/0307185 A1 10/2018 Raymann et al.
2018/0307854 A1 10/2018 Bernau et al.
2018/0307859 A1 10/2018 LaFever et al.
2018/0307959 A1 10/2018 Pigott et al.
2018/0310327 A1 10/2018 Aarnio et al.
2018/0310670 A1 11/2018 Rovekamp, Jr. et al.
2018/0310824 A1 11/2018 Windolf
2018/0310877 A1 11/2018 Zuckerman Stark et al.
2018/0310892 A1 11/2018 Perschbacher et al.
2018/0310964 A1 11/2018 Stevenson et al.
2018/0314801 A1 11/2018 Janssen
2018/0314868 A1 11/2018 Raynesford
2018/0315141 A1 11/2018 Hunn et al.
2018/0315285 A1 11/2018 Janssen
2018/0317808 A1 11/2018 Wang et al.
2018/0317826 A1 11/2018 Muhsin et al.
2018/0321666 A1 11/2018 Cella et al.
2018/0321667 A1 11/2018 Cella et al.
2018/0321672 A1 11/2018 Cella et al.
2018/0322164 A1 11/2018 Dasari et al.
2018/0322445 A1 11/2018 Sayles et al.
2018/0324407 A1 11/2018 Peeters et al.
2018/0325207 A1 11/2018 Krasnow
2018/0325385 A1 11/2018 Deterding et al.
2018/0325435 A1 11/2018 Mistrorigo De Almeida
2018/0325460 A1 11/2018 Wegerich
2018/0326142 A1 11/2018 Perng et al.
2018/0326286 A1 11/2018 Rathi et al.
2018/0326291 A1 11/2018 Tran et al.
2018/0329518 A1 11/2018 Myers et al.
2018/0330369 A1 11/2018 Warner
2018/0332383 A1 11/2018 Boesen et al.
2018/0333051 A1 11/2018 Patrick-Cary
2018/0333107 A1 11/2018 Garcia Sada et al.
2018/0333535 A1 11/2018 Ruchti et al.

(56) References Cited

U.S. PATENT DOCUMENTS

2018/0333585 A1 11/2018 Gaddam et al.
2018/0333586 A1 11/2018 Wasson et al.
2018/0336515 A1 11/2018 Mehring et al.
2018/0338560 A1 11/2018 Molyneux et al.
2018/0338576 A1 11/2018 Meschter et al.
2018/0339445 A1 11/2018 Loveder
2018/0343977 A1 12/2018 Riccomini et al.
2018/0343978 A1 12/2018 Stillman et al.
2018/0343981 A1 12/2018 Hanft
2018/0344220 A1 12/2018 Hayter et al.
2018/0344252 A1 12/2018 An et al.
2018/0344255 A1 12/2018 Orron et al.
2018/0345006 A1 12/2018 Ambrose
2018/0348048 A1 12/2018 Fei
2018/0349893 A1 12/2018 Tsai
2018/0350465 A1 12/2018 Corey et al.
2018/0350468 A1 12/2018 Friedman et al.
2018/0352534 A1 12/2018 Blahnik et al.
2018/0353086 A1 12/2018 Turner et al.
2018/0353111 A1 12/2018 Buxton et al.
2018/0353139 A1 12/2018 Speier et al.
2018/0353219 A1 12/2018 Beyar et al.
2018/0357603 A1 12/2018 Wilkinson et al.
2018/0357725 A1 12/2018 Roth et al.
2018/0358117 A1 12/2018 Neagle
2018/0360355 A1 12/2018 Chavan et al.
2018/0361221 A1 12/2018 Czaja et al.
2018/0365633 A1 12/2018 Hanis et al.
2018/0368701 A1 12/2018 Vule et al.
2018/0368780 A1 12/2018 Bruno et al.
2018/0369065 A1 12/2018 Siedenburg et al.
2018/0369437 A1 12/2018 Grossman et al.
2018/0369438 A1 12/2018 Grossman et al.
2018/0372720 A1 12/2018 Wildburger et al.
2018/0374037 A1 12/2018 Nazzari et al.
2018/0375750 A1 12/2018 Moeller
2018/0375983 A1 12/2018 Bai
2018/0376336 A1 12/2018 Turner et al.
2018/0376586 A1 12/2018 Longinotti-Buitoni et al.
2019/0000317 A1 1/2019 Muhsin et al.
2019/0000400 A1 1/2019 Liu et al.
2019/0000656 A1 1/2019 Pool et al.
2019/0001128 A1 1/2019 Goodall et al.
2019/0005507 A1 1/2019 Rodoni et al.
2019/0005566 A1 1/2019 Black
2019/0007381 A1 1/2019 Isaacson et al.
2019/0007927 A1 1/2019 Blahnik et al.
2019/0008117 A1 1/2019 Dijkstra et al.
2019/0008384 A1 1/2019 Brisben et al.
2019/0008461 A1 1/2019 Gupta et al.
2019/0009019 A1 1/2019 Shor et al.
2019/0012608 A1 1/2019 Teixeira
2019/0012637 A1 1/2019 Gillen
2019/0013090 A1 1/2019 Chait et al.
2019/0015048 A1 1/2019 Baker
2019/0019144 A1 1/2019 Gillen
2019/0019171 A1 1/2019 Silvestre
2019/0019573 A1 1/2019 Lake et al.
2019/0025805 A1 1/2019 Cella et al.
2019/0025806 A1 1/2019 Cella et al.
2019/0025812 A1 1/2019 Cella et al.
2019/0025813 A1 1/2019 Cella et al.
2019/0026690 A1 1/2019 Wappler et al.
2019/0028662 A1 1/2019 Kulcke et al.
2019/0029598 A1 1/2019 LeBoeuf et al.
2019/0029599 A1 1/2019 Golda et al.
2019/0030350 A1 1/2019 Finch et al.
2019/0033845 A1 1/2019 Cella et al.
2019/0033846 A1 1/2019 Cella et al.
2019/0033847 A1 1/2019 Cella et al.
2019/0033848 A1 1/2019 Cella et al.
2019/0033849 A1 1/2019 Cella et al.
2019/0034536 A1 1/2019 Papp et al.
2019/0034605 A1 1/2019 Wang et al.
2019/0034808 A1 1/2019 Palanichamy
2019/0034888 A1 1/2019 Grassadonia et al.
2019/0034889 A1 1/2019 Brock et al.
2019/0034923 A1 1/2019 Greco et al.
2019/0035499 A1 1/2019 Daya
2019/0036886 A1 1/2019 Wu et al.
2019/0036887 A1 1/2019 Miller
2019/0037960 A1 2/2019 Busbee
2019/0037961 A1 2/2019 Busbee et al.
2019/0037969 A1 2/2019 Busbee et al.
2019/0038149 A1 2/2019 Gopalakrishnan et al.
2019/0038214 A1 2/2019 Mikhail et al.
2019/0038496 A1 2/2019 Levesque et al.
2019/0038791 A1 2/2019 Gerrans et al.
2019/0038831 A1 2/2019 Dacey, Jr. et al.
2019/0038902 A1 2/2019 Kaemmerer et al.
2019/0039311 A1 2/2019 Busbee et al.
2019/0041835 A1 2/2019 Cella et al.
2019/0041836 A1 2/2019 Cella et al.
2019/0041840 A1 2/2019 Cella et al.
2019/0041841 A1 2/2019 Cella et al.
2019/0041842 A1 2/2019 Cella et al.
2019/0041843 A1 2/2019 Cella et al.
2019/0041844 A1 2/2019 Cella et al.
2019/0041845 A1 2/2019 Cella et al.
2019/0041846 A1 2/2019 Cella et al.
2019/0043008 A1 2/2019 Vivier
2019/0043010 A1 2/2019 Smith et al.
2019/0044736 A1 2/2019 Vandervort
2019/0045877 A9 2/2019 Beers et al.
2019/0046038 A1 2/2019 Weinstein et al.
2019/0046794 A1 2/2019 Goodall et al.
2019/0046863 A1 2/2019 Eurlings et al.
2019/0049931 A1 2/2019 Tschirschnitz et al.
2019/0050888 A1 2/2019 Elder et al.
2019/0052111 A1 2/2019 Wu et al.
2019/0053470 A1 2/2019 Singh et al.
2019/0053572 A1 2/2019 Patton
2019/0053712 A1 2/2019 Rogers et al.
2019/0053758 A1 2/2019 Biederman et al.
2019/0053915 A1 2/2019 Macke et al.
2019/0054284 A1 2/2019 Smith et al.
2019/0056726 A1 2/2019 Weldemariam et al.
2019/0057454 A1 2/2019 Komenda et al.
2019/0059742 A1 2/2019 Mudge et al.
2019/0059757 A1 2/2019 Balda et al.
2019/0059826 A1 2/2019 Hampapuram et al.
2019/0060644 A1 2/2019 Finch et al.
2019/0061772 A1 2/2019 Prinz
2019/0064344 A1 2/2019 Turner
2019/0064791 A1 2/2019 Cella et al.
2019/0064792 A1 2/2019 Cella et al.
2019/0065733 A1 2/2019 Forehand
2019/0066063 A1 2/2019 Jessamine
2019/0068249 A1 2/2019 Hviid et al.
2019/0069815 A1 3/2019 Burnes et al.
2019/0070350 A1 3/2019 Yomtov et al.
2019/0072917 A1 3/2019 Zeltzer
2019/0072922 A1 3/2019 Cella et al.
2019/0072923 A1 3/2019 Cella et al.
2019/0072924 A1 3/2019 Cella et al.
2019/0072925 A1 3/2019 Cella et al.
2019/0072926 A1 3/2019 Cella et al.
2019/0072928 A1 3/2019 Cella et al.
2019/0073042 A1 3/2019 Thapliyal
2019/0073333 A1 3/2019 Joshua et al.
2019/0073894 A1 3/2019 Mehta et al.
2019/0076033 A1 3/2019 Sweeney et al.
2019/0076066 A1 3/2019 Ajemba et al.
2019/0076067 A1 3/2019 Ajemba et al.
2019/0076070 A1 3/2019 Nogueira et al.
2019/0076600 A1 3/2019 Grosman et al.
2019/0076643 A1 3/2019 Siegle et al.
2019/0077003 A1 3/2019 Lennings et al.
2019/0080791 A1 3/2019 Wolf et al.
2019/0082773 A1 3/2019 Rushbrook et al.
2019/0082985 A1 3/2019 Hong et al.
2019/0083039 A1 3/2019 Shute et al.
2019/0083355 A1 3/2019 Zipper
2019/0083784 A1 3/2019 Raghunathan

(56) References Cited

U.S. PATENT DOCUMENTS

| | | | |
|---|---|---|---|
| 2019/0090585 | A1 | 3/2019 | Loveder et al. |
| 2019/0090589 | A1 | 3/2019 | Rushbrook et al. |
| 2019/0090764 | A1 | 3/2019 | Al-Ali |
| 2019/0090820 | A1 | 3/2019 | Schwenk et al. |
| 2019/0091481 | A1 | 3/2019 | Gustavson et al. |
| 2019/0094374 | A1 | 3/2019 | Graham et al. |
| 2019/0096534 | A1 | 3/2019 | Joao |
| 2019/0099009 | A1 | 4/2019 | Connor |
| 2019/0104989 | A1 | 4/2019 | Breaux et al. |
| 2019/0105505 | A1 | 4/2019 | Schneider et al. |
| 2019/0108427 | A1 | 4/2019 | Geissler et al. |
| 2019/0110755 | A1 | 4/2019 | Capodilupo et al. |
| 2019/0116896 | A1 | 4/2019 | Armour et al. |
| 2019/0116915 | A1 | 4/2019 | Andon et al. |
| 2019/0116935 | A1 | 4/2019 | Avar et al. |
| 2019/0116937 | A1 | 4/2019 | Avar et al. |
| 2019/0117068 | A1 | 4/2019 | Thomson et al. |
| 2019/0117115 | A1 | 4/2019 | Old et al. |
| 2019/0117118 | A1 | 4/2019 | Amos et al. |
| 2019/0117127 | A1 | 4/2019 | Keen et al. |
| 2019/0117966 | A1 | 4/2019 | Kent |
| 2019/0118283 | A1 | 4/2019 | Zhang et al. |
| 2019/0122523 | A1 | 4/2019 | Roberts et al. |
| 2019/0125264 | A1 | 5/2019 | Abreu Oramas |
| 2019/0126003 | A1 | 5/2019 | Bodansky |
| 2019/0126014 | A1 | 5/2019 | Kapur et al. |
| 2019/0130332 | A1 | 5/2019 | Janssen |
| 2019/0132948 | A1 | 5/2019 | Longinotti-Buitoni et al. |
| 2019/0133414 | A1 | 5/2019 | Barnhill et al. |
| 2019/0133484 | A1 | 5/2019 | Muuranto et al. |
| 2019/0134288 | A1 | 5/2019 | Soykan et al. |
| 2019/0137332 | A1 | 5/2019 | Chu et al. |
| 2019/0139252 | A1 | 5/2019 | Zaiss et al. |
| 2019/0142283 | A1 | 5/2019 | Lamego et al. |
| 2019/0146740 | A1 | 5/2019 | Yuen et al. |
| 2019/0147999 | A1 | 5/2019 | Aradottir et al. |
| 2019/0150748 | A1 | 5/2019 | Islam |
| 2019/0150791 | A1 | 5/2019 | Schwartz et al. |
| 2019/0150820 | A1 | 5/2019 | Lee et al. |
| 2019/0150834 | A1 | 5/2019 | Zuckerman-Stark et al. |
| 2019/0151640 | A1 | 5/2019 | Weber et al. |
| 2019/0154723 | A1 | 5/2019 | Kacyvenski et al. |
| 2019/0158472 | A1 | 5/2019 | Juels |
| 2019/0159529 | A1 | 5/2019 | Ellis |
| 2019/0159546 | A1 | 5/2019 | Cohen et al. |
| 2019/0159676 | A1 | 5/2019 | Murphy et al. |
| 2019/0159737 | A1 | 5/2019 | Buckler et al. |
| 2019/0160213 | A1 | 5/2019 | Wampler |
| 2019/0166954 | A1 | 6/2019 | Walker et al. |
| 2019/0167114 | A1 | 6/2019 | Islam |
| 2019/0167237 | A1 | 6/2019 | Stein et al. |
| 2019/0168005 | A1 | 6/2019 | Li et al. |
| 2019/0172197 | A1 | 6/2019 | Buckler et al. |
| 2019/0174007 | A1 | 6/2019 | Matsuura |
| 2019/0174863 | A1 | 6/2019 | McClain |
| 2019/0174871 | A1 | 6/2019 | Walker et al. |
| 2019/0175019 | A1 | 6/2019 | Al-Ali et al. |
| 2019/0175079 | A1 | 6/2019 | Nishida et al. |
| 2019/0175080 | A1 | 6/2019 | Varsavsky et al. |
| 2019/0175082 | A1 | 6/2019 | Varsavsky et al. |
| 2019/0175107 | A1 | 6/2019 | Lu et al. |
| 2019/0175116 | A1 | 6/2019 | Wijshoff et al. |
| 2019/0175411 | A1 | 6/2019 | Awiszus et al. |
| 2019/0175960 | A1 | 6/2019 | Awiszus et al. |
| 2019/0175961 | A1 | 6/2019 | Awiszus et al. |
| 2019/0179412 | A1 | 6/2019 | Penmatcha et al. |
| 2019/0180153 | A1 | 6/2019 | Buckler et al. |
| 2019/0180438 | A1 | 6/2019 | Buckler et al. |
| 2019/0180869 | A1 | 6/2019 | Volpe |
| 2019/0183339 | A1 | 6/2019 | Shah et al. |
| 2019/0183346 | A1 | 6/2019 | Islam |
| 2019/0184077 | A1 | 6/2019 | Novack |
| 2019/0188895 | A1 | 6/2019 | Miller et al. |
| 2019/0190862 | A1 | 6/2019 | Choudhary et al. |
| 2019/0191468 | A1 | 6/2019 | Wu et al. |
| 2019/0192009 | A1 | 6/2019 | Reifman et al. |
| 2019/0192022 | A1 | 6/2019 | Ram et al. |
| 2019/0192076 | A1 | 6/2019 | McHale et al. |
| 2019/0192080 | A1 | 6/2019 | Penders et al. |
| 2019/0192085 | A1 | 6/2019 | Menon et al. |
| 2019/0192086 | A1 | 6/2019 | Menon et al. |
| 2019/0192768 | A1 | 6/2019 | Gupta et al. |
| 2019/0197073 | A1 | 6/2019 | Liu et al. |
| 2019/0197861 | A1 | 6/2019 | Tunnell |
| 2019/0201037 | A1 | 7/2019 | Houser et al. |
| 2019/0201038 | A1 | 7/2019 | Yates et al. |
| 2019/0201039 | A1 | 7/2019 | Widenhouse et al. |
| 2019/0201040 | A1 | 7/2019 | Messerly et al. |
| 2019/0201042 | A1 | 7/2019 | Nott et al. |
| 2019/0201043 | A1 | 7/2019 | Shelton et al. |
| 2019/0201046 | A1 | 7/2019 | Shelton et al. |
| 2019/0201047 | A1 | 7/2019 | Yates et al. |
| 2019/0201075 | A1 | 7/2019 | Shelton et al. |
| 2019/0208295 | A1 | 7/2019 | Case, Jr. |
| 2019/0208865 | A1 | 7/2019 | Walker et al. |
| 2019/0209087 | A1 | 7/2019 | Berner, Jr. et al. |
| 2019/0212323 | A1 | 7/2019 | Gupta et al. |
| 2019/0213458 | A1 | 7/2019 | DeBates et al. |
| 2019/0216350 | A1 | 7/2019 | Sullivan et al. |
| 2019/0223542 | A1 | 7/2019 | Folske et al. |
| 2019/0231166 | A1 | 8/2019 | Anderson |
| 2019/0232592 | A1 | 8/2019 | Tran et al. |
| 2019/0239309 | A1 | 8/2019 | Siagian et al. |
| 2019/0244347 | A1 | 8/2019 | Buckler et al. |
| 2019/0244348 | A1 | 8/2019 | Buckler et al. |

OTHER PUBLICATIONS

Anon, Unknown, "Heat sink selection", Mechanical engineering department, San Jose State University [Jan. 27, 2010]. www.engr.sjsu.edu/ndejong/ME%20146%20files/Heat%20Sink.pptwww.engr.sjsu.edu/ndejong/ME%20146%20files/Heat%20Sink.ppt.

Azar, A, et al., 2009, "Heat sink testing methods and common oversights", Qpedia Thermal E-Magazine, Jan. 2009 Issue. www.qats.com/cpanel/UploadedPdf/January20092.pdf.

Batten, Paul, et al. "Sub-Grid Turbulence Modeling for Unsteady Flow with Acoustic Resonance," available at www.metacomptech.com/cfd++/00-0473.pdf, last accessed Apr. 29, 2010.

Baurle, R. A., and D. R. Eklund. "Analysis of dual-mode hydrocarbon scramjet operation at Mach 4-6.5." Journal of Propulsion and Power 18.5 (2002): 990-1002.

Bentley, Peter J., and Jonathan P. Wakefield. "Generic evolutionary design." Soft Computing in Engineering Design and Manufacturing. Springer London, 1998. 289-298.

Boris Yakobson, "Acoustic waves may cool microelectronics", Nano Letters, ACS (2010).

Boudreau, Albert H. "Hypersonic air-breathing propulsion efforts in the air force research laboratory." AIAA 3255.1 (2005):10.

Calamas, David. Thermal Transport in Systems with Hierarchical Bifurcating Geometries. Diss. The University of Alabama Tuscaloosa, 2013.

Cockrell Jr, Charles E. "Technology Roadrnap for Dual-Mode Scramjet Propulsion to Support Space-Access Vision Vehicle Development." (2002).

Covert, Lance Nicholas. Dual-function heatsink antennas for high-density three-dimensional integration of high-power transmitters. Diss. University of Florida, 2008.

Crane, Jackson T. Radial parallel plate flow with mechanical agitation. Diss. Massachusetts Institute of Technology, 2013.

Dannelley, Daniel. Enhancement of extended surface heat transfer using fractal-like geometries. Diss. The University of Alabama Tuscaloosa, 2013.

Davidson, P. A. (2004). Turbulence: An Introduction for Scientists and Engineers. Oxford University Press. ISBN 978-0-19-852949-1; scholarpedia.org.

Donbar, J., et al. "Post-test analysis of flush-wall fuel injection experiments in a scramjet." AIAA Paper 3197 (2001): 2001.

en.wikipedia.org/wiki/Chaos_theory.

en.wikipedia.org/wiki/Fractal.

(56) References Cited

OTHER PUBLICATIONS en.wikipedia.org/wiki/Heat_sink.
en.wikipedia.org/wiki/Phonon.
Fichera, A., and A. Pagano. "Modelling and control of rectangular natural circulation loops." International journal of heat and mass transfer 46.13 (2003): 2425-2444.
Fichera, Alberto, et al. "A modeling strategy for rectangular thermal convection loops." World Congress. vol. 15. No. 1. 2002.
Forghan, F., Goldthwaite, D., Ulinski, M., Metghalchi, M., 2001, Experimental and Theoretical Investigation of Thermal Performance of Heat Sinks, ISME May.
Fourier, J. B., 1822, Theorie analytique de la chaleur, Paris; Freeman, A., 1955, translation, Dover Publications, Inc, NY.
Frigus Primore in "A Method for Comparing Heat Sinks Based on Reynolds Analogy," available at www.frigprim.com/downloads/Reynolds_analogy_heatsinks.PDF, last accessed Apr. 28, 2010.
Frigus Primore, "Natural Convection and Chimneys," available at www.frigprim.com/articels2/parallel_plchim.html, last accessed Apr. 29, 2010.
Frigus Primore, "Natural Convection and Inclined Parallel Plates," www.frigprim.com/articels2/parallel_pl_Inc.html, last accessed Apr. 29, 2010.
G Falkovich and K.R. Sreenivasan. Lessons from hydrodynamic turbulence, Physics Today, vol. 59, No. 4, pp. 43-49 (Apr. 2006).
G. Falkovich, Scholarpedia, "Cascade and scaling"; Jin, Y.; Uth, M.-F.; Kuznetsov, A. V.; Herwig, H. (Feb. 2, 2015). "Numerical investigation of the possibility of macroscopic turbulence in porous media: a direct numerical simulation study". Journal of Fluid Mechanics 766: 76-103. Bibcode:2015JFM . . . 766 . . . 76J. doi:10.1017/jfm.2015.9.
G. K. Batchelor, The theory of homogeneous turbulence. Cambridge University Press, 1953.
Garibaldi, Dott Ing Pietro. Single-phase natural circulation loops: effects of geometry and heat sink temperature on dynamic behavior and stability. Diss. Ph. D. Thesis, 2008.
Gruber, Mark, et al. "Newly developed direct-connect high-enthalpy supersonic combustion research facility." Journal of Propulsion and Power 17.6 (2001): 1296-1304.
Incropera, F.P. and DeWitt, D.P., 1985, Introduction to heat transfer, John Wiley and sons, NY.
J. Cardy, G. Falkovich and K. Gawedzki (2008) Non-equilibrium statistical mechanics and turbulence. Cambridge University Press.
J. M. McDonough (2007). Introductory Lectures on Turbulence—Physics, Mathematics, and Modeling.
Jackson, K., et al. "Calibration of a newly developed direct-connect high-enthalpy supersonic combustion research facility." AIAA paper (1998): 98-1510.
Jeggels, Y.U., Dobson, R.T., Jeggels, D.H., Comparison of the cooling performance between heat pipe and aluminium conductors for electronic equipment enclosures, Proceedings of the 14th International Heat Pipe Conference, Florianópolis, Brazil, 2007.
Kay, Ira W., W. T. Peschke, and R. N. Guile. "Hydrocarbon-fueled scramjet combustor investigation." Journal of Propulsion and Power 8.2 (1992): 507-512.
Kolmogorov, Andrey Nikolaevich (1941). "Dissipation of Energy in the Locally Isotropic Turbulence". Proceedings of the USSR Academy of Sciences (in Russian) 32: 16-18., translated into English by Kolmogorov, Andrey Nikolaevich (Jul. 8, 1991). Proceedings of the Royal Society A 434 (1980): 15-17. Bibcode:1991RSPSA.434 . . . 15K. doi:10.1098/rspa.1991.0076.
Kolmogorov, Andrey Nikolaevich (1941). "The local structure of turbulence in incompressible viscous fluid for very large Reynolds numbers". Proceedings of the USSR Academy of Sciences (in Russian) 30: 299-303., translated into English by V. Levin. Kolmogorov, Andrey Nikolaevich (Jul. 8, 1991). Proceedings of the Royal Society A 434 (1991): 9-13. Bibcode:1991RSPSA.434 . . . 9K. doi:10.1098/rspa.1991.0075.
Kordyban, T., 1998, Hot air rises and heat sinks—Everything you know about cooling electronics is wrong, ASME Press, NY.
Lance Covert, Jenshan Lin, Dan Janning, Thomas Dalrymple, "5.8 GHz orientation-specific extruded-fin heatsink antennas for 3D RF system integration", Apr. 23, 2008 DOI: 10.1002/mop.23478, Microwave and Optical Technology Letters vol. 50, Issue 7, pp. 1826-1831, Jul. 2008.
Lasance, C.J.M and Eggink, H.J., 2001, A Method to Rank Heat Sinks in Practice: The Heat Sink Performance Tester, 21st IEEE Semi-Therm Symposium.
Li, Wentao, et al. "Fractal-based thinned planar-array design utilizing iterative FFT technique." International Journal of Antennas and Propagation 2012 (2012).
Lienard, J.H., IV & V, 2004, A Heat Transfer Textbook, Third edition, MIT.
Liu, S., et al., "Heat Transfer and Pressure Drop in Fractal Microchannel Heat Sink for Cooling of Electronic Chips," 44 Heat Mass Transfer 221 (2007).
Liu, Y. L., X. B. Luo, and W. Liu. "Cooling behavior in a novel heat sink based on multilayer staggered honeycomb structure." J. Energy Power Eng 4.22 (2010): e28.
Liu, Yonglu, Xiaobing Luo, and Wei Liu. "MNHMT2009-18211." (2009).
ludens.cl/Electron/Thermal.html.
Mandelbrot, B.B. (1982). The Fractal Geometry of Nature. W.H. Freeman and Company. ISBN 0-7167-1186-9.
Mills, A.F., 1999, Heat transfer, Second edition, Prentice Hall.
NJ Ryan, DA Stone, "Application of the FD-TD method to modelling the electromagnetic radiation from heatsinks", IEEE International Conference on Electromagnetic Compatibility, 1997. 10th (Sep. 1-3, 1997), pp. 119-124.
P. A. Durbin and B. A. Pettersson Reif. Statistical Theory and Modeling for Turbulent Flows. Johns Wiley & Sons, 2001.
Palac, Donald T., Charles J. Trefny, and Joseph M. Roche. Performance Evaluation of the NASA GTX RBCC Flowpath. National Aeronautics and Space Administration, Glenn Research Center, 2001.
Pence, D. V., 2002, "Reduced Pumping Power and Wall Temperature in Microchannel Heat Sinks with Fractal-like Branching Channel Networks", Microscale Thermophys. Eng. 5, pp. 293-311.
Potter, C.M. and Wiggert, D.C., 2002, Mechanics of fluid, Third Edition, Brooks/Cole.
Prstic, S., Iyengar, M., and Bar-Cohen, A., 2000, Bypass effect in high performance heat sinks, Proceedings of the International Thermal Science Seminar Bled, Slovenia, Jun. 11-14.
Saint-Gobain, 2004, "Thermal management solutions for electronic equipment" Jul. 22, 2008 www.fff.saint-gobain.com/Media/Documents/S0000000000000001036/ThermaCool%20Brochure.pdf.
Sergent, J. and Krum, A., 1998, Thermal management handbook for electronic assemblies, First Edition, McGraw-Hill.
Sui, Y., Teo, C. J., Lee, P. S., Chew, Y. T., & Shu, C. (2010). Fluid flow and heat transfer in wavy microchannels. International Journal of Heat and Mass Transfer, 53(13), 2760-2772.
T. Bohr, M.H. Jensen, G. Paladin and A. Vulpiani. Dynamical Systems Approach to Turbulence, Cambridge University Press, 1998.
Tavaragiri, Abhay, Jacob Couch, and Peter Athanas. "Exploration of FPGA interconnect for the design of unconventional antennas." Proceedings of the 19th ACM/SIGDA international symposium on Field programmable gate arrays. ACM, 2011.
Wagh, Kanchan H. "A Review on Fractal Antennas for Wireless Communication." IJRECE 3.2 (2015): 37-41.
Wagh, Ms Kanchan, and P. T. Karule. "An Overview of Fractal Antennas for Wireless Communication."
Wang et al., Flow and Thermal Characteristics of Offset Branching Network, Aug. 12, 2009, International Journal of Thermal Science, vol. 49, pp. 272-280 (PDF attachment).
White, F.M., 1999, Fluid mechanics, Fourth edition, McGraw-Hill International.
Y.J. Lee, "Enhanced Microchannel Heat Sinks Using Oblique Fins," IPACK 2009-89059 (2009).
Dannelley, Daniel, "Enhancement of Extended Surface Heat Transfer Using Fractal-Like Geometries", Ph.D. Dissertation U. Alabama 2013.

(56) References Cited

OTHER PUBLICATIONS

Calamas, David, "Thermal Transport in Systems With Hierarchical Bifurcating Geometries", Ph.D. Dissertation U. Alabama 2013.
Meyer, Josua P., Van Der Vyver, Hilde, "Heat Transfer Characteristics of a Quadratic Koch Island Fractal Heat Exchanger", Heat Transfer Engineering, 26(9):22-29, 2005, Taylor & Francis Inc., ISSN: 0145-7632 print / 1521-0537 online, DOI: 10.1080/01457630500205638.
Arovas, Daniel, "Lecture Notes on Thermodynamics and Statistical Mechanics (A Work in Progress)", U.C. San Diego, 2013.

* cited by examiner

SYSTEM AND METHOD FOR MAINTAINING EFFICIENCY OF A FRACTAL HEAT SINK

CROSS REFERENCE TO RELATED APPLICATIONS

The present application is a

Continuation of U.S. patent application Ser. No. 17/107,741, filed Nov. 30, 2020, now U.S. Pat. No. 11,512,905, issued Nov. 29, 2022, which is a Divisional of U.S. patent application Ser. No. 15/205,906, filed Jul. 8, 2016, now U.S. Pat. No. 10,852,069, issued Dec. 1, 2020, which is a Continuation in part of U.S. patent application Ser. No. 14/984,756, filed Dec. 30, 2015, now U.S. Pat. No. 10,041,745, issued Aug. 7, 2018, and is a Continuation in part of U.S. patent application Ser. No. 14/817,962, filed Aug. 4, 2015, now U.S. Pat. No. 10,527,368, issued Jan. 7, 2020; both of which are a Continuation in part of U.S. patent application Ser. No. 13/106,640, filed May 12, 2011, now U.S. Pat. No. 9,228,785, issued Jan. 5, 2016, which is a Non-provisional of, and claims benefit of priority from, U.S. Provisional Patent Application No. 61/331,103, filed May 4, 2010.

This application is related to PCT/IB11/01026, filed May 13, 2011, which claims benefit of priority from U.S. Provisional Patent Application No. 61/331,103, filed May 4, 2010.

The entirety of the foregoing applications are expressly incorporated herein by reference.

FIELD OF THE INVENTION

This invention relates to the field of heatsinks or devices that transfer heat between a concentrated source or sink and a fluid, and systems and methods for maintaining the efficiency of the heatsink and cleaning heatsinks.

BACKGROUND OF THE INVENTION

A heat sink is a term for a component or assembly that transfers heat generated within a solid material to a fluid or gas medium, such as air or a liquid. A heat sink is typically designed to increase the surface area in contact with the cooling fluid or gas surrounding it, such as the air. Approach air velocity, choice of material, fin (or other protrusion) design and surface treatment are some of the design factors which influence the thermal resistance, i.e. thermal performance, of a heat sink. See, en.wikipedia.org/wiki/Heat_sink.

Heatsinks operate by removing heat from an object to be cooled into the surrounding air, gas or liquid through convection and radiation. Convection occurs when heat is either carried passively from one point to another by fluid motion (forced convection) or when heat itself causes fluid motion (free convection). When forced convection and free convection occur together, the process is termed mixed convection. Radiation occurs when energy, for example in the form of heat, travels through a medium or through space and is ultimately absorbed by another body. Thermal radiation is the process by which the surface of an object radiates its thermal energy in the form of electromagnetic waves. Infrared radiation from a common household radiator or electric heater is an example of thermal radiation, as is the heat and light (IR and visible EM waves) emitted by a glowing incandescent light bulb. Thermal radiation is generated when heat from the movement of charged particles within atoms is converted to electromagnetic radiation.

Heat transfer is the exchange of thermal energy between physical systems. The rate of heat transfer is dependent on the temperatures of the systems and the properties and states of the intervening medium through which the heat is transferred. The three fundamental modes of heat transfer are conduction, convection, and radiation. Heat transfer, the flow of energy in the form of heat, is a process by which a system changes its internal energy. The direction of heat transfer is from a region of high temperature to a region of lower temperature, and is governed by the Second Law of Thermodynamics. Heat transfer changes the internal energy of the respective systems, and occurs in a direction that increases the entropy of the collection of systems. Thermal equilibrium is reached when all involved bodies and the surroundings reach the same temperature. Thermodynamic and mechanical heat transfer is calculated with the heat transfer coefficient, the proportionality between the heat flux and the thermodynamic driving force for the flow of heat. See, Daniel Arovas, Lecture Notes on Thermodynamics and Statistical Mechanics (A Work in Progress), Department of Physics, University of California, San Diego, Nov. 14, 2013, expressly incorporated herein by reference in its entirety.

The fundamental modes of heat transfer are: Advection (the transport mechanism of a fluid from one location to another, and is dependent on motion and momentum of that fluid); Conduction or diffusion (the transfer of energy between objects that are in physical contact); Convection (The transfer of energy between an object and its environment, due to fluid motion); and Radiation (The transfer of energy by the emission of electromagnetic radiation in the infrared part of the spectrum).

Heat conduction occurs as hot, rapidly moving or vibrating atoms and molecules interact with neighboring atoms and molecules, transferring some of their energy (heat) to these neighboring particles. Conduction tends to be the most significant means of heat transfer within a solid or between solid objects in thermal contact. Heat transfer between the heat source and heat sink, as well as through the heat sink, are conductive transfer. Advection operates by transferring matter with its thermal energy, over space. Convective heat transfer, or convection, is the transfer of heat from one place to another by the movement of fluids, a process that is essentially the transfer of heat via mass transfer, and usually combines effects of heat conduction within the fluid (diffusion) and heat transference by bulk fluid flow streaming.

Convective cooling is sometimes described as Newton's law of cooling: The rate of heat loss of a body is proportional to the temperature difference between the body and its surroundings, however convective cooling sometimes deviates from this "law". In general, convection is not linearly dependent on temperature gradients, and in some cases is strongly nonlinear.

radiative transfer between two objects is described by and T is the absolute temperature (in Kelvin or Rankine).

Radiance or spectral radiance is a measure of the quantity of radiation that passes through or is emitted. Radiant barriers are materials that reflect radiation, and therefore reduce the flow of heat from radiation sources. The effectiveness of a radiant barrier is indicated by its reflectivity, which is the fraction of radiation reflected. A material with a high reflectivity (at a given wavelength) has a low emissivity (at that same wavelength), and vice versa. At any specific wavelength, reflectivity=1−emissivity.

A heatsink tends to decrease the maximum temperature of the exposed surface, because the power is transferred to a larger volume. This leads to a possibility of diminishing return on larger heatsinks, since the radiative and convective dissipation tends to be related to the temperature differential between the heatsink surface and the external medium. Therefore, if the heatsink is oversized, the efficiency of heat shedding is poor. If the heatsink is undersized, the object may be insufficiently cooled, the surface of the heatsink dangerously hot, and the heat shedding not much greater than the object itself absent the heatsink.

A heat sink transfers thermal energy from a higher temperature to a lower temperature fluid or gas medium, by a process such as radiation, convection, and diffusion. The fluid medium is frequently air, but can also be water or in the case of heat exchangers, oil, and refrigerants. Fourier's law of heat conduction, simplified to a one-dimensional form in the direction x, shows that when there is a temperature gradient in a body, heat will be transferred from the higher temperature region to the lower temperature region. The rate at which heat is transferred by conduction, $q_k$, is proportional to the product of the temperature gradient and the cross-sectional area through which heat is transferred:

$$q_k = kA\frac{dT}{dx} \tag{1}$$

where $q_k$ is the rate of conduction, k is a constant which depends on the heat-conducting material, A is the surface area through which the heat is conducted, and dT/dx is the temperature gradient, i.e., the rate of change of temperature with respect to distance (for simplicity, the equation is written in one dimension). Thus, according to Fourier's law (which is not the only consideration by any means), heatsinks benefit from having a large surface area exposed to the medium into which the heat is to be transferred.

When dust settles on a heatsink, the area changes (typically increases, but by coating a microstructured surface, the area may decrease), and the constant k will typically decrease, since the dust is not an optimized heat transfer material, and often is a heat insulating material. The result is significant loss of heatsink efficiency.

Consider a heat sink in a duct, where air flows through the duct, and the heat sink base is higher in temperature than the air. Assuming conservation of energy, for steady-state conditions, and applying the convection-cooling law, also known as the Newton's law of cooling, gives the following set of equations.

$$\dot{Q} = \dot{m}c_{p,in}(T_{air,out} - T_{air,in}),\ \dot{Q} = \frac{T_{hs} - T_{air,av}}{R_{hs}}, \quad \text{where } T_{air,av} = \frac{T_{air,out} + T_{air,in}}{2}, \tag{2), (3), (4}$$

and $\dot{Q}$ is the first derivative of the thermal energy $$\text{over time} - \dot{Q} = \frac{dQ}{dt}.$$

Using the mean air temperature is an assumption that is valid for relatively short heat sinks. When compact heat exchangers are calculated, the logarithmic mean air temperature is used. $\dot{m}$ is the first derivative of mass over time, i.e., the air mass flow rate in kg/s.

The above equations show that when the airflow through or around the heat sink decreases, this results in an increase in the average air temperature. This in turn increases the heat sink base temperature. And additionally, the thermal resistance of the heat sink will also increase. The net result is a higher heat sink base temperature. The inlet air temperature relates strongly with the heat sink base temperature. Therefore, if there is no air or fluid flow around the heat sink, the energy dissipated to the air cannot be transferred to the ambient air. Therefore, the heat sink functions poorly.

The fractal or branching architecture may be compelled by the thermal transfer design, or other design constraint. For example, a fractal antenna may also serve as a heatsink, with the fractal features not critically optimized as comparted to other designs with respect to heat shedding. See, Casanova, Joaquin J., Jason A. Taylor, and Jenshan Lin. "Design of a 3-D fractal heatsink antenna." Antennas and Wireless Propagation Letters, IEEE 9 (2010): 1061-1064, expressly incorporated herein by reference in its entirety.

See also, Dannelley, Daniel. Enhancement of extended surface heat transfer using fractal-like geometries. Diss. The University of Alabama TUSCALOOSA, 2013; and Lee, S. R., Li, Z. G., Wang, B. G., Chiou, H. S., 2005, "An Application of the Fractal Theory in the Design of Heat Sink for Precision Measurement Instrument," Key Engineering Materials, 295-296, pp. 717-722, each of which is expressly incorporated herein by reference in its entirety.

If a heatsink is initially optimized, the accretion of dust at the surface will de-optimize the air flows and heat conductivity of heatsink fins, and also decrease efficiency on that basis.

Various methods have been proposed for removing dust from heatsink fins, including vibration (See, U.S. 20070058346; 20080121373; 20080121374; 20090272404; 6,544,309; 5,566,377; 8,203,840; 8,400,766), air jets, and the like.

There are various methods to reduce damage to substrates (e.g. semiconductors) while being subjected to vibrations (e.g. ultrasound) for purposes of cleaning (e.g. removing dust etc.). For example, the power intensity of vibration may be lowered using an attenuator, etc. (See, U.S. Pat. No. 6,679,272; US20060260638; WO2008086479A2, each of which is expressly incorporated herein by reference in its entirety).

The frequency of vibrations may be controlled to reduce the effect on nano-dimensioned structures on the substrate (US20130206165, is expressly incorporated herein by reference in its entirety). More generally, the sensitivity of the structure to be protected to vibration as a function of frequency may be determined, and the high sensitivity frequencies may be avoided.

The directionality of waves may be controlled using constructive interference (U.S. Pat. Nos. 6,276,370; 7,614,406, each of which is expressly incorporated herein by reference in its entirety). The angle of incidence of the vibrations onto substrate may be controlled (U.S. Pat. No. 7,238,085 expressly incorporated herein by reference in its entirety). That is, vibrations or shock waves from a transducer have a propagation direction, as they travel along a vector path. As a result, the vibrations may be cancelled by either active means, i.e. a second transducer, or passive means, by causing self-interference. In either case, the vibrations at a point may be cancelled, while in other regions, the vibrations may be significant.

It is noted that the vibrations used to facilitate cleaning may have low damage potential for the sensitive structures per se, but could cause damage as a result of resonances and constructive and/or destructive interference (U.S. Pat. No. 5,834,871; US20050003737, each of which is expressly incorporated herein by reference in its entirety). Therefore, the structures may be designed to avoid enhancement of the vibration amplitude at or near sensitive structures, while potentially ensuring resonances and constructive interference at distal structures where the vibration action is intended.

Thermal interfaces that are elastomeric in nature may be used to isolate the sensitive structures from vibrations (U.S. Pat. No. 6,002,588 expressly incorporated herein by reference in its entirety). Similarly through-holes may be provided within the substrate in order to dampen the vibrations (US20080017219 expressly incorporated herein by reference in its entirety). More generally, a selective thermally conductive vibration damping structure or material may be provided disposed along the path of vibrations from a source to the thermal emitter.

According to one set of embodiments, a transducer is provided to generate a standing wave field of vibrations. However, the sensitive structure is dispose outside of the standing wave. (US20130312787, expressly incorporated herein by reference in its entirety). For example, a transducer may be provided to launch standing waves into a bilateral structure, with the heat source provided along an orthogonal axis wherein vibrations from each side of the transducer bypass or destructively interfere at the heat source. The standing wave is intended to cause movement of the fine feature elements of the heatsink, to dislodge debris.

The heatsink may also be cleansed by controlling factors such as pressure, temperature, nature of cleaning fluid (US20050003737, expressly incorporated herein by reference in its entirety).

Other examples of situations, in which a heat sink has impaired efficiency: (a) pin fins have a lot of surface area, but the pins are so close together that air has a hard time flowing through them; (b) aligning a heat sink so that the fins are not in the direction of flow; (c) aligning the fins horizontally for a natural convection heat sink. Whilst a heat sink is stationary and there are no centrifugal forces and artificial gravity, air that is warmer than the ambient temperature always flows upward, given essentially-still-air surroundings; this is convective cooling.

The most common heat sink material is aluminum. Chemically pure aluminum is not used in the manufacture of heat sinks, but rather aluminum alloys. Aluminum alloy 1050A has one of the higher thermal conductivity values at 229 W/m·K. However, it is not recommended for machining, since it is a relatively soft material. Aluminum alloys 6061 and 6063 are the more commonly used aluminum alloys, with thermal conductivity values of 166 and 201 W/m·K, respectively. The aforementioned values are dependent on the temper of the alloy.

Copper is also used since it has around twice the conductivity of aluminum, but is three times as heavy as aluminum. Copper is also around four to six times more expensive than aluminum, but this is market dependent. Aluminum has the added advantage that it is able to be extruded, while copper cannot. Copper heat sinks are machined and skived. Another method of manufacture is to solder the fins into the heat sink base.

Another heat sink material that can be used is diamond. With a thermal conductivity value of 2000 W/m·K, it exceeds that of copper by a factor of five. In contrast to metals, where heat is conducted by delocalized electrons, lattice vibrations are responsible for diamond's very high thermal conductivity. For thermal management applications, the outstanding thermal conductivity and diffusivity of diamond are essential. CVD diamond may be used as a submount for high-power integrated circuits and laser diodes.

Composite materials also can be used. Examples are a copper-tungsten pseudoalloy, AlSiC (silicon carbide in aluminum matrix), Dymalloy (diamond in copper-silver alloy matrix), and E-Material (beryllium oxide in beryllium matrix). Such materials are often used as substrates for chips, as their thermal expansion coefficient can be matched to ceramics and semiconductors.

Fin efficiency is one of the parameters which make a higher thermal conductivity material important. A fin of a heat sink may be considered to be a flat plate with heat flowing in one end and being dissipated into the surrounding fluid as it travels to the other. As heat flows through the fin, the combination of the thermal resistance of the heat sink impeding the flow and the heat lost due to convection, the temperature of the fin and, therefore, the heat transfer to the fluid, will decrease from the base to the end of the fin. This factor is called the fin efficiency and is defined as the actual heat transferred by the fin, divided by the heat transfer were the fin to be isothermal (hypothetically the fin having infinite thermal conductivity). Equations 5 and 6 are applicable for straight fins.

$$\eta_f = \frac{\tanh(mL_c)}{mL_c},\ mL_c = \sqrt{\frac{2h_f}{kt_f}L_f} \qquad (5), (6)$$

Where $h_f$ is the convection coefficient of the fin (Air: 10 to 100 W/(m$^2$·K), Water: 500 to 10,000 W/(m$^2$·K)); k is the thermal conductivity of the fin material (Aluminum: 120 to 240 W/(m$^2$·K)); $L_f$ is the fin height (m); and $t_f$ is the fin thickness (m).

Another parameter that concerns the thermal conductivity of the heat sink material is spreading resistance. Spreading resistance occurs when thermal energy is transferred from a small area to a larger area in a substance with finite thermal conductivity. In a heat sink, this means that heat does not distribute uniformly through the heat sink base. The spreading resistance phenomenon is shown by how the heat travels from the heat source location and causes a large temperature gradient between the heat source and the edges of the heat sink. This means that some fins are at a lower temperature than if the heat source were uniform across the base of the heat sink. This non-uniformity increases the heat sink's effective thermal resistance.

A pin fin heat sink is a heat sink that has pins that extend from its base. The pins can be, for example, cylindrical, elliptical or square/geometric polygonal. A second type of heat sink fin arrangement is the straight fin. These run the entire length of the heat sink. A variation on the straight fin heat sink is a cross cut heat sink. A straight fin heat sink is cut at regular intervals but at a coarser pitch than a pin fin type.

In general, the more surface area a heat sink has, the better it works. However, this is not always true. The concept of a pin fin heat sink is to try to pack as much surface area into a given volume as possible. As well, it works well in any orientation. Kordyban has compared the performance of a pin fin and a straight fin heat sink of similar dimensions. Although the pin fin has 194 cm$^2$ surface area while the straight fin has 58 cm$^2$, the temperature difference between the heat sink base and the ambient air for the pin fin is 50° C. For the straight fin it was 44° C. or 6° C. better than the pin fin. Pin fin heat sink performance is significantly better than straight fins when used in their intended application where the fluid flows axially along the pins rather than only tangentially across the pins. See, Kordyban, T., Hot air rises and heat sinks—Everything you know about cooling electronics is wrong, ASME Press, NY 1998.

Another configuration is the flared fin heat sink; its fins are not parallel to each other, but rather diverge with increasing distance from the base. Flaring the fins decreases flow resistance and makes more air go through the heat sink fin channel; otherwise, more air would bypass the fins. Slanting them keeps the overall dimensions the same, but offers longer fins. Forghan, et al. have published data on tests conducted on pin fin, straight fin and flared fin heat sinks. See, Forghan, F., Goldthwaite, D., Ulinski, M., Metghalchi, M., Experimental and Theoretical Investigation of Thermal Performance of Heat Sinks, ISME, May. 2001. They found that for low approach air velocity, typically around 1 m/s, the thermal performance is at least 20% better than straight fin heat sinks. Lasance and Eggink also found that for the bypass configurations that they tested, the flared heat sink performed better than the other heat sinks tested. See, Lasance, C. J. M and Eggink, H. J., A Method to Rank Heat Sinks in Practice: The Heat Sink Performance Tester, 21st IEEE SEMI-THERM Symposium 2001.

The heat transfer from the heatsink is mediated by two effects: conduction via the coolant, and thermal radiation. The surface of the heatsink influences its emissivity; shiny metal absorbs and radiates only a small amount of heat, while matte black is a good radiator. In coolant-mediated heat transfer, the contribution of radiation is generally small. A layer of coating on the heatsink can then be counterproductive, as its thermal resistance can impair heat flow from the fins to the coolant. Finned heatsinks with convective or forced flow will not benefit significantly from being colored. In situations with significant contribution of radiative cooling, e.g. in case of a flat non-finned panel acting as a heatsink with low airflow, the heatsink surface finish can play an important role. Matte-black surfaces will radiate much more efficiently than shiny bare metal. The importance of radiative vs. coolant-mediated heat transfer increases in situations with low ambient air pressure (e.g. high-altitude operations) or in vacuum (e.g. satellites in space). See, Fourier, J. B., 1822, Theorie analytique de la chaleur, Paris; Freeman, A., 1955, translation, Dover Publications, Inc, NY; Kordyban, T., 1998, Hot air rises and heat sinks—Everything you know about cooling electronics is wrong, ASME Press, NY; Anon, Unknown, "Heat sink selection", Mechanical engineering department, San Jose State University [27 Jan. 2010]; www.engr.sjsu.edu/ndejong/ME %20146%20files/Heat %20Sink.ppt; Sergent, J. and Krum, A., 1998, Thermal management handbook for electronic assemblies, First Edition, McGraw-Hill; Incropera, F. P. and DeWitt, D. P., 1985, Introduction to heat transfer, John Wiley and sons, NY; Forghan, F., Goldthwaite, D., Ulinski, M., Metghalchi, M., 2001, Experimental and Theoretical Investigation of Thermal Performance of Heat Sinks, ISME May; Lasance, C. J. M and Eggink, H. J., 2001, A Method to Rank Heat Sinks in Practice: The Heat Sink Performance Tester, 21st IEEE SEMI-THERM Symposium; ludens.cl/Electron/Thermal.html; Lienard, J. H., IV & V, 2004, A Heat Transfer Textbook, Third edition, MIT; Saint-Gobain, 2004, "Thermal management solutions for electronic equipment" 22 Jul. 2008 www.fff.saint-gobain.com/Media/Documents/S0000000000000001036/ThermaCool %20Brochure.pdf; Jeggels, Y. U., Dobson, R. T., Jeggels, D. H., Comparison of the cooling performance between heat pipe and aluminium conductors for electronic equipment enclosures, Proceedings of the 14th International Heat Pipe Conference, Florianópolis, Brazil, 2007; Prstic, S., Iyengar, M., and Bar-Cohen, A., 2000, Bypass effect in high performance heat sinks, Proceedings of the International Thermal Science Seminar Bled, Slovenia, June 11-14; Mills, A. F., 1999, Heat transfer, Second edition, Prentice Hall; Potter, C. M. and Wiggert, D. C., 2002, Mechanics of fluid, Third Edition, Brooks/Cole; White, F. M., 1999, Fluid mechanics, Fourth edition, McGraw-Hill International; Azar, A, et al., 2009, "Heat sink testing methods and common oversights", Qpedia Thermal E-Magazine, January 2009 Issue; www.qats-.com/cpanel/UploadedPdf/January20092.pdf Several structurally complex heatsink designs are discussed in Hernon, US App. 2009/0321045, incorporated herein by reference.

The relationship between friction and convention in heatsinks is discussed by Frigus Primore in "A Method for Comparing Heat Sinks Based on Reynolds Analogy," available at www.frigprim.com/downloads/Reynolds_analogy_heatsinks.PDF, last accessed Apr. 28, 2010. This article notes that for, plates, parallel plates, and cylinders to be cooled, it is necessary for the velocity of the surrounding fluid to be low in order to minimize mechanical power losses. However, larger surface flow velocities will increase the heat transfer efficiency, especially where the flow near the surface is turbulent, and substantially disrupts a stagnant surface boundary layer. Primore also discusses heatsink fin shapes and notes that no fin shape offers any heat dissipation or weight advantage compared with planar fins, and that straight fins minimize pressure losses while maximizing heat flow. Therefore, the art generally teaches that generally flat and planar surfaces are appropriate for most heatsinks.

Frigus Primore, "Natural Convection and Inclined Parallel Plates," www.frigprim.com/articels2/parallel_pl_Inc.html, last accessed Apr. 29, 2010, discusses the use of natural convection (i.e., convection due to the thermal expansion of a gas surrounding a solid heatsink in normal operating conditions) to cool electronics. One of the design goals of various heatsinks is to increase the rate of natural convection. Primore suggests using parallel plates to attain this result. Once again, Primore notes that parallel plate heat sinks are the most efficient and attempts to define the optimal spacing and angle (relative to the direction of the fluid flow) of the heat sinks according to the equations in FIG. 1:

Optimum Plate Spacing $$S_{opt} = k_s\left(\frac{L}{dT}\right)^{0.25}\cdot\cos(\gamma)^{-0.25} \tag{1}$$

$$\gamma_{opt} = a\tan\left(\frac{1H}{3W}\right)\ \frac{H}{W} < \sqrt{3}$$

$$\gamma_{opt} = \frac{\pi}{4} - 0.508\left(\frac{H}{W}\right)^{-1.237}\ \frac{H}{W} > \sqrt{3}$$

Total Heat Dissipation $$\dot{Q} = k_v\cdot k_\gamma\cdot A_c\cdot H^{0.5}\cdot dT^{1.5} \tag{2}$$

$$k_\gamma = \sqrt{1+\frac{1}{9}\left(\frac{H}{W}\right)^2}\ \frac{H}{W} < \sqrt{3}$$

$$k_\gamma = 0.307\cdot\left(\frac{H}{W}\right)^{-05} + 0.696\cdot\left(\frac{H}{W}\right)^{-0.5}\ \frac{H}{W} > \sqrt{3}$$

Applied Equation $$\dot{Q} = \eta_v\cdot k_v\cdot k_\gamma\cdot A_c\cdot H^{0.5}\cdot dT_{ref}^{1.5}$$

dT=Temperature difference (K)

$$A_c = W \cdot D \quad (3)$$

$\eta_v$=Volumetric efficiency [– –]

$\dot{Q}$ =Heat dissipation [W]

In another article titled "Natural Convection and Chimneys," available at www.frigprim.com/articels2/parallel_plchim.html, last accessed Apr. 29, 2010, Frigus Primore discusses the use of parallel plates in chimney heat sinks. One purpose of this type of design is to combine more efficient natural convection with a chimney. Primore notes that the design suffers if there is laminar flow (which creates a re-circulation region in the fluid outlet, thereby completely eliminating the benefit of the chimney) but benefits if there is turbulent flow which allows heat to travel from the parallel plates into the chimney and surrounding fluid.

Batten, Paul, et al. "Sub-Grid Turbulence Modeling for Unsteady Flow with Acoustic Resonance," available at www.metacomptech.com/cfd++/00-0473.pdf, last accessed Apr. 29, 2010, expressly incorporated herein by reference, discuss that when a fluid is flowing around an obstacle, localized geometric features, such as concave regions or cavities, create pockets of separated flow which can generate self-sustaining oscillations and acoustic resonance. The concave regions or cavities serve to substantially reduce narrow band acoustic resonance as compared to flat surfaces. This is beneficial to a heat sink in a turbulent flow environment because it allows for the reduction of oscillations and acoustic resonance, and therefore for an increase in the energy available for heat transfer.

Liu, S., et al., "Heat Transfer and Pressure Drop in Fractal Microchannel Heat Sink for Cooling of Electronic Chips," 44 Heat Mass Transfer 221 (2007), discuss a heatsink with a "fractal-like branching flow network." Liu's heatsink includes channels through which fluids would flow in order to exchange heat with the heatsink.

Y. J. Lee, "Enhanced Microchannel Heat Sinks Using Oblique Fins," IPACK 2009-89059, similarly discusses a heat sink comprising a "fractal-shaped microchannel based on the fractal pattern of mammalian circulatory and respiratory system." Lee's idea, similar to that of Liu, is that there would be channels inside the heatsink through which a fluid could flow to exchange heat with the heatsink. The stated improvement in Lee's heatsink is (1) the disruption of the thermal boundary layer development; and (2) the generation of secondary flows.

Pence, D. V., 2002, "Reduced Pumping Power and Wall Temperature in Microchannel Heat Sinks with Fractal-like Branching Channel Networks", Microscale Thermophys. Eng. 5, pp. 293-311, mentions heatsinks that have fractal-like channels allowing fluid to enter into the heat sink. The described advantage of Pence's structure is increased exposure of the heat sink to the fluid and lower pressure drops of the fluid while in the heatsink.

In general, a properly designed heatsink system will take advantage of thermally induced convection or forced air (e.g., a fan). In general, a turbulent flow near the surface of the heatsink disturbs a stagnant surface layer, and improves performance. In many cases, the heatsink operates in a non-ideal environment subject to dust or oil; therefore, the heatsink design must accommodate the typical operating conditions, in addition to operation in the as-manufactured state.

Therefore, two factors appear to conflict in optimizing the configuration of an external: the surface configuration designed to disturb laminar flow patterns, create turbulence, and enhance convective heat transfer, and the desire to efficiently flow large volumes of heat transfer fluid (e.g., air), over the surfaces, which is enhanced by laminar (smooth) flow. Even in passive dissipative device, convective flow may be a significant factor, and reducing air flow volume and velocity by increasing the effective impedance can be counterproductive. On the other hand, in some cases, the amount of energy necessary to move the air is dwarfed by the problem to be solved. In many computing systems, the processors are thermally constrained, that is, the functioning of the processor is limited by the ability to shed heat. In such cases, innovative ways to improve the efficiency of heat transfer may yield significant benefit, even if in some regimes of operation they impose certain inefficiencies.

Prior art heatsink designs have traditionally concentrated on geometry that is Euclidian, involving structures such as the pin fins, straight fins, and flares discussed above.

N J Ryan, D A Stone, "Application of the FD-TD method to modelling the electromagnetic radiation from heatsinks", IEEE International Conference on Electromagnetic Compatibility, 1997. 10th (1-3 Sep. 1997), pp: 119-124, discloses a fractal antenna which also serves as a heatsink in a radio frequency transmitter.

Lance Covert, Jenshan Lin, Dan Janning, Thomas Dalrymple, "5.8 GHz orientation-specific extruded-fin heatsink antennas for 3D RF system integration", 23 Apr. 2008 DOI: 10.1002/mop.23478, Microwave and Optical Technology Letters Volume 50, Issue 7, pages 1826-1831, July 2008 also provide a heatsink which can be used as an antenna.

SUMMARY OF THE INVENTION

In a preferred embodiment, a heatsink employed according to the present technology provides a branched 3D network of elements, which have a high surface area and, especially, near the terminal branches, have microstructured surfaces. As a result, dust may accumulate on the surfaces, resulting in decreased surface area as the dust obscures the microstructuring, increased thermal resistance, and deoptimized air flow patterns. Therefore, various technologies may be provided to reduce or eliminate the dust deposition on the surfaces than may occur in real-world environments:

- vacuum environment;
- filtering of the incoming air which circulates around the heatsink, e.g., using a HEPA filter;
- clean liquid heat transfer medium;
- air jet(s) which operate continuously or periodically to dislodge dust particles;
- inducing electrostatic charge on the dust particles to repel them from the surface of the heatsink;
- high voltage electric fields with or without electric discharge to cause the dust particles to move in response to the fields;
- pyrolizing the dust (or binding factors within the dust that cause sticking to the surfaces), such as by intermittent IR laser emissions, resistive heating of the terminal branches of the heatsink, radiative heating, combustion, or other processes;
- narrowband vibration over a range of frequencies representing resonances in the branches of the heatsink;
- impulse vibration (e.g., from a piezoelectric transducer);
- use of shape memory alloys, and causing a transition through the Curie temperature to induce significant shape change, resulting in surface stresses to dislodge dust.

In various cases, the physical effect sought to be employed to prevent dust accumulation or to dislodge the dust may impair or risk impairing the device being protected by the heatsink. For example, pyrolysis of the dust or its binder requires high temperatures, which would normally diffuse back to the device being protected. However, according to the present technology, this can be prevented by focusing the effect on the terminal branches of the heatsink. For example, a catalytic coating on the tips of the heatsink branches would permit a sub-explosive mixture of a combustible gas to combust at the catalyst, while air flows on other portions of the heatsink could protect the device from overheating. Similarly, use of an infrared (or other wavelength) pulse laser would cause two distinct effects to reduce dust accumulation: first, the laser would heat the immediate region of the heatsink irradiated by the laser, and second, the rapid thermal expansion of the heated material would generate a pressure shock wave that would tend to fracture the aggregated dust material; the amount of heat used need not be significant with respect to the heat load capacity of the heatsink. Therefore, heat-based technologies may acceptably be employed to remove dust.

A current flowing through the branched heatsink would cause heating, with higher temperatures at the narrow terminal branches. The voltages associates with high currents flowing through a metallic heatsink are low, and would generally not cause damage to electronics unless flowing through a forward-biased junction. Therefore, if the heating was performed as periodic pulses, the tips of the branched network would heat, and that heating would tend to reduce binding of the dust and cause a thermal expansion that would cause a strain in the dust layer that would reduce adhesion. Therefore, the dust layer would be disrupted. Similarly, a current passing through a shape memory allow such as Nitinol, would cause mechanical stresses and strains that could disrupt a dust layer, without requiring high temperature excursions beyond the Curie temperature of the material.

The use of vibration, wither continuous or pulsed, may cause damage to the device protected by the heatsink. One way to protect the device is through a liquid or gel-like layer that does not support propagation of shear waves, and exciting the vibrations in a shear mode. As such, the liquid or gel interface, which may be a heat transfer paste, may isolate the device to be protected from the vibration. In some cases, an active vibration suppression technology may be employed, such as a piezoelectric transducer that emits a feedback controlled vibration to reduce the vibration experienced by the device to be protected.

Vibration is particularly interesting as a physical process to dislodge dust and debris and to maintain cleanliness of the heat exchange surfaces. The process imposes three constraints: first, vibration itself creates heat, which may or may not be a significant factor; second, many systems which generate heat may themselves be sensitive to vibration, for example bond wires of integrated circuits; and third, significant vibration may lead to fracture failure of the heatsink, bearing in mind that the vibration should have sufficient amplitude to generate inertia in the particulates at the surface to overcome the adhesive forces, and the movement may also create turbulence in the surrounding heat exchange media. In order to overcome these issues, a vibration isolator may be provided between the heat source and the source of vibration, which may be, for example, a piezoelectric element or electromagnetic element. The vibration isolator may be, for example, a plastic thermal transfer medium (e.g., a paste), a non-shear transmissive solid, such as a wire bundle (e.g., thin copper wires), an active vibration suppression interface, or the like. Further, the branching or fractal characteristics of the heatsink may be exploited to selectively transmit the vibrations distally from the source, by selecting the frequency or frequency range, vibration mode, etc., to generate significant movement of the distal branches of the heatsink, without unduly stressing the heat source. In another embodiment, the heatsink is "separable" from the heat source over a short period, and during that period, a large impulse is launched in the heatsink, to dislodge dust; the heatsink is thereafter reconnected to the source. In another embodiment, the heatsink is supported on an anisotropic mount (e.g., piston in cylinder), that provides good heat transfer, but does not support transmission of vibrations along at least one axis, which is then used as the axis of excitation for dust removal.

Electrostatic charge may cause damage to semiconductors. In order for electrostatic repulsion to be effective, the dust particles should be charged to a net charge of the same polarity as the heatsink, with an oppositely charged collector in the air flow path to divert the dust. The dust may be charged with a radioisotope, typically a low energy alpha or beta particle emitter, or through induced charge by charged plates, screen, or electron emitting surface. The voltages will typically be in the hundreds or low thousands of Volts, and in an environment that maintains such potential differences, discharge events may be common. If the device being protected or other nearby devices are static or static discharge sensitive, the result may be damage to the sensitive components. One way to reduce this issue is to dielectrically isolate the protected device from the electrically charged heatsink. For example, a high thermal conductivity layer, such as a diamond-like layer, may be provided as an electrical conduction barrier, with the sensitive device-side electrically grounded. This configuration might permit (or in some cases, encourage) dust deposition on the grounded portion of the heatsink and sensitive device; however, the structure of the branched network is such that accumulation of dust at the root of the branching network does not substantially impair heatsink operation.

In a vacuum environment, no dust is present, but convective heat transfer is prevented. Nevertheless, heat transfer through radiation may be sufficient, as fractal structures are known to be extremely efficient antennas for transmitting electromagnetic radiation. If the air passing over the heatsink is filtered with a HEPA filter, the presence of dust is significantly reduced, but the air-movement efficiency is also impaired. Air jets (typically with filtered air) may be aimed at portions of the heatsink and used to blow away accumulated dust. These have low efficiency with respect to the air in the jet being used as a heat transfer medium, but are efficient in removing dust. In some cases, an air jet can consolidate and densify loose dust, and therefore such jets should operate frequently, before significant dust accumulation can occur.

In a vacuum or radiative embodiment, the design of the exterior surface may be optimized to maximize emission (generally by maximizing hot surface area), and minimize recapture of radiated heat, among other constraints. This can generally be met by texturing the surface and avoiding hot parallel surfaces and especially by inclining surfaces with respect to each other. In three dimensions, the optimized radiant heatsink may be fractal, since these can be optimized to have high surface area, and obtuse relative angles. Likewise, more distal portions of the heatsink from the heat source may have more reflective surfaces than proximal portions, which may have greater emissivity. When such devices are subject to convective cooling as well, the recapture may be less of a factor in the overall efficiency, but should not be ignored, especially at the high temperature regions of the heatsink. In the convective case, the fluid may have entrained particles or dust, and this dust may be captured by or adhere to surfaces of the heatsink, reducing its efficiency by changing the shape and surface emissivity characteristics, changing the heat diffusion characteristics within the solid phases, and impairing convection.

A time-varying flow of a fluid, e.g., a heat exchange media, can be provided over the heatsink. This achieves a number of advantages. First, while a high flow rate peak may be an inefficient use of energy in terms of running the fan or pump, the high flow rate may assist in dislodging dust by inertia and turbulence. Second, the changes in flow rate will tend to create time-varying tensor flow patterns that increase the probability that the dust or debris will be at least temporarily dislodged from the surface and available for advective flow in the fluid medium. Third, the time varying flow, especially peak rates, can disrupt surface fluid boundary layers, increasing the advective component of the convective transfer process.

In some cases, non-adhesive particles may be entrained in the stream, to assist in removing surface debris. That is, while normally dust and particulates are sought to be avoided near the heatsink, by intentionally entraining specific particles, dust removal may be facilitated. For example, relatively dense particles entrained in a fluid flow can impact the surfaces of the heatsink, and as a result dislodge adherent dust or particles. While often a minor effect, the particles can themselves participate in conductive and advective heat transfer. Further, the heterogeneous fluid with particles can enhance turbulent flow patterns around the surfaces of the heatsink, enhancing heat flow from the surfaces. The heatsink system is typically a closed system, and therefore the entrained particles may then be recollected, filtered (to remove the undesired dust), and reused. In one embodiment, the particles are magnetic, and can therefore be collected magnetically, relaxing the need for a sealed system. Similarly, electrostatic particle collection technology may be employed. With respect to magnetic particles, the heatsink itself may be periodically magnetized, for cause the cool magnetic particles to stick, and thereafter demagnetized, permitting the heated magnetic particles to become free and entrained in the surrounding fluid, thus enhancing the advective heat transfer process. Similarly, in a vacuum or low pressure environment, transient contact of the particles (magnetic or otherwise) with the heat transfer surfaces may facilitate advective heat transfer as an adjunct to radiative heat transfer, and thus the particles need not be entrained in a fluid.

The result of the fluid flow process, especially under dynamically changing conditions, can be complex. For example, the flow can cause turbulent flow around the heat exchange elements, which induce complex pressure differentials, vibrations, and inertial flow patterns. Dynamically changing the flow rate or flow pattern can help distribute the turbulent dynamics over various regions of the heatsink surface. Thus, the entire surface of the heatsink need not be subject to continual high fluid flow rates, and only a small portion of the surface at any given time might be subject to a "jet" of fluid flow, thus reducing the energy disadvantage. Meanwhile, the jet may be strategically focused on portions of the heatsink intended to achieve particular effects. When the jet (or more generally, high flow rate stream) is focused or directed at the hot portion of the heatsink, higher convective heat transfer will occur. However, discontinuous high flow rates may be advantageous, since a reduced fluid flow on a region will tend to cause a diffusive heat transfer to the heat transfer material underlying the cooled surface, and thus lead to higher efficiency heat transfer when the jet or stream returns. Meanwhile, the jet or stream can be directed to other portions of the heatsink. This, in turn, causes dynamic temperature gradients within the heatsink, which can be controlled to causes pulsatile heating at the periphery of the heatsink, especially in a branched network. Thus, for example, in a fractal branched heatsink, the stream of fluid can be controlled to permit various regions of the heatsink to undergo heating and cooling cycles, such that the hot spots on the heatsink are dynamically controlled to be selectively cooled. While a model of the process may be employed, sensors, such as thermal sensors, thermal cameras, passive infrared sensors, optical camera with thermally responsive coating on the heatsink, or the like, may be used to monitor surface temperatures of the heatsink, and adaptively supply coolant as appropriate. Sensors may also be used to detect surface contamination of the heatsink, and a need for removal of the contamination, which may be by fluid jet, entrained particles, mechanical debris removal, or other means.

The fluid flow over the heatsink surface can also cause acoustic resonance, which in the case of a heatsink having a fractal geometry, can be, in the aggregate, a broadband resonance. The flow can be pulsatile, with pulses causing inertial transfer of energy to the debris on the surface, resulting in separation from the underlying heat exchange surface. The flow can also cause stress and strain on the debris coating on the surface, causing separation along the surface plane. In some, the time varying flow can effectively remove the accumulated surface debris. A static flow in some cases could also reduce accumulation, but it is noted that the static flow is presumed to be associated with the accumulation conditions, and maintenance of sufficient continuous flow conditions to remove accumulation may consume excess energy, noise, and abrasion of the heat exchange surfaces.

Liquid heatsinks typically provide for a flow of liquid within a tube or channel or confined space. (In some cases, a spray of a non-volatile fluid over an open heat transfer surface is provided, similar to a machining process). As a result, a relatively large body of heat transfer material is provided with channels provided therein. In such a design, the cross section area of the channels is relatively constant in the aggregate as the fluid travels through the branched channels. As a result, the linear velocity of the fluid flow will be constant. However, when one considers the logistics of a typical design, the flow channels are either planar or the design is radially symmetric.

In a planar configuration, a base of the heatsink interfaces with the heat source, and the fluid flows through the structure above the heat source to withdraw heat. See, Escher, W., B. Michel, and D. Poulikakos. "Efficiency of optimized bifurcating tree-like and parallel microchannel networks in the cooling of electronics." International Journal of Heat and Mass Transfer 52.5 (2009): 1421-1430; Wang et al., "Flow and Thermal Characteristics of Offset Branching Network," 12 Aug. 2009, International Journal of Thermal Science, Vol. 49, Pages 272-280; Yongping, Chen, et al. "Characteristics of Heat and Fluid Flow in Fractal Tree-like Channel Heat Sink [J]." Acta Aeronautica Et Astronautica Sinica 3 (2010): 008; Xu, Peng, et al. "Thermal characteristics of tree-shaped microchannel nets with/without loops." International Journal of Thermal Sciences 48.11 (2009): 2139-2147; Liu, Shutian, Yongcun Zhang, and Peng Liu. "Heat transfer and pressure drop in fractal microchannel heat sink for cooling of electronic chips." Heat and Mass Transfer 44.2 (2007): 221-227; Alharbi, Ali Y., Deborah V. Pence, and Rebecca N.

Cullion. "Thermal characteristics of microscale fractal-like branching channels." Journal of Heat Transfer 126.5 (2004): 744-752; Hong, F. J., et al. "Conjugate heat transfer in fractal-shaped microchannel network heat sink for integrated microelectronic cooling application." International Journal of Heat and Mass Transfer 50.25 (2007): 4986-4998; Lee, Yong-Jiun, Poh-Seng Lee, and Siaw-Kiang Chou. "Enhanced microchannel heat sinks using oblique fins." ASME 2009 InterPACK Conference collocated with the ASME 2009 Summer Heat Transfer Conference and the ASME 2009 3rd International Conference on Energy Sustainability, American Society of Mechanical Engineers, 2009; Senn, S. M., and D. Poulikakos. "Laminar mixing, heat transfer and pressure drop in tree-like microchannel nets and their application for thermal management in polymer electrolyte fuel cells." Journal of Power Sources 130.1 (2004): 178-191; Xiangqi, Wang. "New approaches to micro-electronic component cooling." PhD diss., 2007 (National University of Singapore); U.S. Pat. No. 6,688,381; US 2008037927; U.S. Pat. Nos. 6,333,852; 7,256,751. (All references cited hereinabove are expressly incorporated herein by reference.) The temperature gradient within the heatsink having a planar flow plane would generally be decreasing with distance away from the interface, with the bulk material in and near the fluid flow plane largely isothermal.

In a radially symmetric arrangement, typically a constant cross section branched solid heatsink (e.g., extruded), see e.g., U.S. Pat. No. 4,715,438; US 20080080137, US 20090050293; U.S. Pat. Nos. 8,295,046; 2,535,721, may be placed within a shell or confinement, and a contained fluid permitted to contact the exposed surfaces. In this case, the fluid path is not highly constrained, and the operating temperature may be unstable, for example due to nearly adiabatic movement of fluid masses as a result of density and viscosity differences of the heated fluid. An extruded heatsink is generally a suboptimal shape, since the more distal portions of the structure a constant higher surface by lower thermal gradient. Indeed, due to possible adiabatic movement of hot fluid, in some cases the fluid can heat portions of the heatsink.

A "structurally complex" heatsink is provided in US 20090321045, but without branching networks and without optimized regional heterogeneity.

In a closed, vacuum or filtered system, typically no accumulation of dust, debris or precipitate on the heat exchanger surface occurs.

The techniques discussed above may be classified in five schemes: prevention of deposition; mechanical removal of deposition; thermal degradation of typically organic material; shock waves or vibrations to disrupt surface layer debris; and dynamic configuration.

Most heatsinks are designed using a linear or exponential relationship of the heat transfer and dissipating elements. A known geometry which has not generally been employed is fractal geometry. Some fractals are random fractals, which are also termed chaotic or Brownian fractals and include random noise components. In deterministic fractal geometry, a self-similar structure results from the repetition of a design or motif (or "generator") using a recursive algorithm, on a series of different size scales. As a result, certain types of fractal images or structures appear to have self-similarity over a broad range of scales. On the other hand, no two ranges within the design are identical.

A fractal is defined as "a rough or fragmented geometric shape that can be split into parts, each of which is (at least approximately) a reduced-size copy of the whole." Mandelbrot, B. B. (1982). That is, there is a recursive algorithm which describes the structure. The Fractal Geometry of Nature. W.H. Freeman and Company. ISBN 0-7167-1186-9. This property is termed "self-similarity." For a more detailed discussion of fractals, see the Wikipedia article thereon at en.wikipedia.org/wiki/Fractal incorporated herein by reference. Exemplary images of well-known fractal designs can also be viewed on the Wikipedia page. Due to the fact that fractals involve largely self-repeating patterns, each of which serves to increase the surface area in three-dimensional fractals (perimeter in two-dimensional fractals), three dimensional fractals in theory are characterized by infinite surface area (and two-dimensional fractals are characterized by infinite perimeter). In practical implementations, the scale of the smallest features, which remain true to the generating algorithm, may be 3-25 iterations of the algorithm. Less than three recursions, and the fractal nature is not apparent, while present manufacturing technologies limit the manufacture of objects with a large range of feature scales.

An "approximately" fractal structure is one that, while a true fractal is a result of infinite number of iterations leading sometimes to infinite length of the border (such as Koch snowflake), in reality, any manufactured fractal will be a result of finite number of iterations in the fractal algorithm: 2 or 3, but rarely more than 5 or 6. The approximate fractal design may display various symmetries, and typically has a branched architecture with a tapering cross section from the heat source to the periphery.

Fractal theory is related to chaos theory. See, en.wikipedia.org/wiki/Chaos_theory, expressly incorporated herein by reference. See, Sui, Y., Teo, C. J., Lee, P. S., Chew, Y. T., & Shu, C. (2010). Fluid flow and heat transfer in wavy microchannels. International Journal of Heat and Mass Transfer, 53(13), 2760-2772; Garibaldi, Dott Ing Pietro. Single-phase natural circulation loops: effects of geometry and heat sink temperature on dynamic behavior and stability. Diss. Ph. D. Thesis, 2008; Fichera, A., and A. Pagano. "Modelling and control of rectangular natural circulation loops." International journal of heat and mass transfer 46.13 (2003): 2425-2444; Fichera, Alberto, et al. "A modeling strategy for rectangular thermal convection loops." World Congress. Vol. 15. No. 1. 2002; Crane, Jackson T. Radial parallel plate flow with mechanical agitation. Diss. Massachusetts Institute of Technology, 2013, each of which is expressly incorporated herein by reference.

This fractal nature is useful in a heatsink because the rate at which heat is transferred from a surface, either through convection or through radiation, is typically related to, and increasing with, the surface area. Of course, due to limitations in the technology used to build these heatsinks, engineering compromise is expected. However a feature of an embodiment of the designs proposed herein is that vortices induced by fluid flow over a heat transfer surface will be chaotically distributed over various elements of the surface, thus disrupting the stagnant surface boundary layer and increasing the effective surface area available for heat transfer, while avoiding acoustic resonance which may be apparent from a regular array of structures which produce vortices and turbulence.

Further, a large physical surface area to volume ratio, which is generally useful in heatsink design, can still be obtained using the fractal model. In addition, fractal structures provide a plurality of concave regions or cavities, providing pockets of separated flow which can generate self-sustaining oscillations and acoustic resonance. These pockets serve to reduce the acoustic resonance in turbulent flowing fluid (as compared to flat or Euclidian surfaces), thus allowing for more effective heat transfer between the fractal structure and the surrounding fluid, thereby making the fractal structure ideal for a heatsink.

U.S. Pat. No. 7,256,751, issued to Cohen, incorporated herein by reference, discusses fractal antennas. In the background of this patent, Cohen discusses Kraus' research, noting that Euclidian antennas with low area (and therefore low perimeter) exhibit very low radiation resistance and are thus inefficient. Cohen notes that the advantages of fractal antennas, over traditional antennas with Euclidian geometries, is that they can maintain the small area, while having a larger perimeter, allowing for a higher radiation resistance. Also, Cohen's fractal antenna features non-harmonic resonance frequencies, good bandwidth, high efficiency, and an acceptable standing wave ratio.

In the instant invention, this same wave theory may be applied to fractal heatsinks, especially with respect to the interaction of the heat transfer fluid with the heatsink. Thus, while the heat conduction within a solid heatsink is typically not modeled as a wave (though modern thought applies phonon phenomena to graphene heat transport), the fluid surrounding the heating certainly is subject to wave phenomena, complex impedances, and indeed the chaotic nature of fluid eddies may interact with the chaotic surface configuration of the heatsink.

The efficiency of capturing electric waves in a fractal antenna, achieved by Cohen, in some cases can be translated into an efficiency transferring heat out of an object to be cooled in a fractal heatsink as described herein. See, Boris Yakobson, "Acoustic waves may cool microelectronics", Nano Letters, ACS (2010). Some physics scholars have suggested that heat can be modeled as a set of phonons. Convection and thermal radiation can therefore be modeled as the movement of phonons. A phonon is a quasiparticle characterized by the quantization of the modes of lattice vibration of solid crystal structures. Any vibration by a single phonon is in the normal mode of classical mechanics, meaning that the lattice oscillates in the same frequency. Any other arbitrary lattice vibration can be considered a superposition of these elementary vibrations. Under the phonon model, heat travels in waves, with a wavelength on the order of 1 μm. In most materials, the phonons are incoherent, and, therefore, on macroscopic scales, the wave nature of heat transport is not apparent or exploitable.

The thermodynamic properties of a solid are directly related to its phonon structure. The entire set of all possible phonons combine in what is known as the phonon density of states which determines the heat capacity of a crystal. At absolute zero temperature (0 Kelvin or −273 Celsius), a crystal lattice lies in its ground state, and contains no phonons. A lattice at a non-zero temperature has an energy that is not constant, but fluctuates randomly about some mean value. These energy fluctuations are caused by random lattice vibrations, which can be viewed as a gas-like structure of phonons or thermal phonons. However, unlike the atoms which make up an ordinary gas, thermal phonons can be created and destroyed by random energy fluctuations. In the language of statistical mechanics this means that the chemical potential for adding a phonon is zero. For a more detailed description of phonon theory, see the Wikipedia article thereon available at en.wikipedia.org/wiki/Phonon (last accessed Apr. 16, 2010) incorporated herein by reference.

In certain materials, such as graphene, phonon transport phenomena are apparent at macroscopic levels, which make phonon impedance measurable and useful. Thus, if a graphene sheet were formed to resonate at a particular phonon wavelength, the resonant energy would not be emitted. On the other hand, if the graphene sheet were configured using a fractal geometry, the phonon impedance would be well controlled over a broad range of wavelengths, with sharp resonances at none, leading to an efficient energy dissipation device.

One aspect of the technology therefore employs a thermally responsive technology, such as a memory metal actuator (which may be passive or active), or other active or passive element, to change the configuration of the heatsink under various conditions. It is noted that in an automotive radiator, a thermostat is provided to shunt flow around the radiator when the engine is cool. This is distinguished herein, in various alternate ways. For example, a variable geometry heatsink according to the present technology may have an external surface exposed to an unconstrained heat transfer medium, such as air. See, Baurle, R. A., and D. R. Eklund. "Analysis of dual-mode hydrocarbon scramjet operation at Mach 4-6.5." Journal of Propulsion and Power 18.5 (2002): 990-1002; Cockrell Jr, Charles E. "Technology Roadrnap for Dual-Mode Scramjet Propulsion to Support Space-Access Vision Vehicle Development." (2002); Boudreau, Albert H. "Hypersonic air-breathing propulsion efforts in the air force research laboratory." AIAA 3255.1 (2005): 10; Kay, Ira W., W. T. Peschke, and R. N. Guile. "Hydrocarbon-fueled scramjet combustor investigation." Journal of Propulsion and Power 8.2 (1992): 507-512; Jackson, K., et al. "Calibration of a newly developed direct-connect high-enthalpy supersonic combustion research facility." AIAA paper (1998): 98-1510; Donbar, J., et al. "Post-test analysis of flush-wall fuel injection experiments in a scramjet", AIAA Paper 3197 (2001): 2001; Gruber, Mark, et al. "Newly developed direct-connect high-enthalpy supersonic combustion research facility." Journal of Propulsion and Power 17.6 (2001): 1296-1304; Andrews, Earl H. "Scramjet development and testing in the United States", AIAA paper 1927 (2001): 2001; Palac, Donald T., Charles J. Trefny, and Joseph M. Roche, Performance Evaluation of the NASA GTX RBCC Flowpath, NASA, Glenn Research Center, 2001; 2003/0155110; 2004/0187861; 2005/0245659; 2009/0016019; 2009/0321047; 2010/0089549; 2010/0236236, 2010/0252648; 2011/0174462; 2012/0293952; 2014/0360699; 4,654,092; 4,931,626; 5,371,753; 5,483,098; 5,548,481; 5,510,598; 6,128,188; 6,330,157; 6,689,486; 7,080,989; 7,778,029; 8,228,671; 8,385,066; JP 03-070162; JP 04-291750; JP 61-098565; JP 63-006915; WO 99/04429, each of which is expressly incorporated herein by reference in its entirety.

For example, in one embodiment, a thermodynamic model of the system, encompassing at least the heat source, the heat sink, the thermal transfer medium, and a device to induce thermal transfer medium flow, determines, under each set of conditions, the optimal configuration. For example, at low loads, the heat sink may operate passively, without flows induced by an active device to induce flow in the thermal transfer medium. In such a case, radiative heat transfer may be important, as well as thermally-induced convection. Under high loads, the active device to induce flow in the thermal transfer medium may induce maximum flows, and the heatsink configured for minimal turbulence with laminar flows where possible. In intermediate states, the system may assume a configuration which is optimized according to a cost function, which may involve the effect of heat/temperature on the heat source, energy consumed by the active device to induce flow in the thermal transfer medium, noise resulting from induced flow, etc. This allows efficient use of an "oversized" heatsink, since the heatsink characteristics are variably controlled. In these intermediate states of configuration, efficiency may be improved by allowing the heatsink to assume a variable configuration. Since the optimum heatsink configuration depends on, e.g., ambient temperature, humidity, atmospheric pressure, heat load, air flow rate, gravitational vector with respect to the heatsink, etc., the model should explore the range of combinations of the device to induce thermal transfer medium flow, the variable geometry, and to a lesser extent, control over the heat source. An example of the later is that for a given power dissipation, it may be more efficient to have thermal cycles reaching a maximum temperature than a constant temperature. During the cycles, the geometry may change. Indeed, if the system is not in a static steady state, the geometry may optimally change during or in anticipation of temperature changes. An example here is that as the heat source produces a heat peak, the heat diffuses over time through a solid heatsink material. There is a lag, and so the temperature of the heat source is different that the temperature of the heatsink, and the heatsink itself has variations in temperature at different positions. Typically, there is a single actuator which controls the entire heatsink, though this is not a limitation, and there may be multiple actuators to control different parts of the heatsink independently or semi-independently. The device to induce thermal transfer medium flow may have a variable flow rate, and also may have multiple independently controlled portions. However, as the heat begins to peak, the device to induce thermal transfer medium flow may also increase activity. This, in turn, can reduce the temperature of various portions of the heatsink, depending on the relationship of the device to induce thermal transfer medium flow and the variable geometry heatsink. Thus, the entire system may operate in a phased cyclic or dynamic manner, with asynchronous maxima and minima of the various functions.

In practice, a heatsink may be provided for a microprocessor having multiple cores. Under low load, the device to induce thermal transfer medium flow may be off, or at a low flow rate. The heatsink in this case optimally has the greatest spread for radiative and passive convective cooling. In case of a higher load, the processor itself may have the option of distributing the load over multiple cores, and spatially spreading the heat dissipation, or concentrating the load in a single core which may get hot. Since temperature differentials increase heat flow, the concentrated heat source may selectively transfer heat to sub-portion of the heatsink, and thus that portion may be able to efficiently shed the heat under the passive or low energy cost state. As the load further increases, the processor as a whole typically becomes thermally limited, and as a result, the entire die or processor complex is treated as a unitary source, spreading heat to all elements of the heatsink. Initially, the temperature is low, and the system would seek to operate in the most efficient state of the device to induce thermal transfer medium flow. This may include laminar flow over the heat dissipating elements of the heatsink. In the next regime, the heat increases, and as a result, the device to induce thermal transfer medium flow must increase its flow rate. At this point, a compromise may be made, between minimum energy cost (and thus a minimization of the energy to drive the device to induce thermal transfer medium flow), and effective heat dissipation. In this regime, the heatsink may be configured to induce turbulence in the medium flow around it. This, in turn, increases the resistance to flow, but reduces the boundary layer effect. Advantageously, in this regime, a fractal physical relationship of element of the heatsink may act to reduce peak acoustic emission with respect to frequency. Likewise, by avoiding sharp acoustic resonances, there may be a more effective transfer of heat with lower losses as acoustic energy. Further, the interaction of the elements of the heatsink may be further optimized to achieve higher efficiency. Finally, at maximum heat load, presumably at the limit of the heatsink, the system enters a maximum heat dissipation mode. For example, this mode is one traditionally analyzed as the maximum capacity of the heatsink and device to induce thermal transfer medium flow system, and as such would typically assume or nearly assume a traditional optimized geometry. However, both due to the fact that the system may include fractal geometry elements for other regimes of operation, and because these may be exploited to gain efficiencies over traditional symmetric and regular geometries, the maximum heart dissipation configuration may be somewhat different than a parallel plate heatsink, for example. Note that not all regions of the heatsink need to operate within the same regime at the same time, and even under a steady state heat load, may vary cyclically, randomly or chaotically (over a relevant timescale). In this case, the term "chaotically" is intended to assume its technical meaning under chaos and fractal theory, and not adopt a lay interpretation. On the other hand, "randomly" is intended to encompass true randomness, pseudorandom variations, and deterministic changes that over the relevant timescale have statistical characteristics that model randomness within an acceptable margin of error, the acceptability relating to achieving a suitable regime of operation. For example, because some attributes of turbulent flow are random, even though they are more technically chaotic, the random features may be used to advantage. For example, the device to induce thermal transfer medium flow may be subject to a tinsel type flow disruptor, which in some regimes appears to be a random variation in air flow speed, direction, vortex, etc. While this may increase noise, it also can create persistent disruptions in boundary layers, even on smooth and regular heatsink elements. That is, either the heatsink geometry and the device to induce thermal transfer medium flow, or both, may have fractal or chaotic tendencies.

According to one embodiment, the geometry involves branching elements, to increase surface area of the elements. An actuator may be used to alter angles or even to open and close branches. For example, a heatsink formed of a shape memory alloy (SMA) (such as Nitinol), may be produced by an additive manufacturing process, e.g., a 3D printer or 2.5D printer. Such a device may be thermally processed to have characteristic shape changes at temperature transitions, and indeed, the composition of the alloy may be controlled during fabrication to produce a variety of transition temperatures. Therefore, a 3D heatsink may be provided which inherently changes shape through a series of transitions as the temperature is increased and decreased. In this embodiment, the changes tend to be monotonic with increasing temperature, though by engineering the angles and physical configuration, the actual physical shape and heat dissipation properties may assume a non-monotonic function. Note that in this embodiment, it is generally preferred that only the branch points are formed of SMA, and the bulk be formed of a high thermal conductivity material, such as copper and/or silver, or to a lesser extent, aluminum.

According to another embodiment, actuators, which may be SMA, solenoids, or otherwise, are controlled to change the position of repositionable elements. In this case, independent control can be exercised which is not dependent on temperature, but typically, the number of controlled elements is more constrained due to manufacturing and control feasibility issues. The actuators may alter a spacing, angle, position, or engagement of heat sink elements. When a set of regularly spaced and sized elements are controlled according to a constant or spectrally-defined distribution, this can be controlled to operate within highly predictable regimes. On the other hand, if the elements are not regularly sized and spaced, or are controlled in irregular manner, the resulting fluid dynamics will likely require a statistical flow (e.g., Monte Carlo) analysis, rather than a simplifying presumption of static function. This will especially be the case if the thermal time-constants of the heat flow from the heat source, to the heatsink, and then to the heat transfer fluid, are near or within the range of time-constants of the turbulence or chaotically varying flows of the heat transfer fluid. Typically, the thermal heat transfer time-constants are longer than the turbulent or chaotic variation time-constants, and therefore this meeting this presumption requires either generating low frequency turbulent or chaotic variations of the heat transfer fluid medium, or making the heatsink (and perhaps other elements) with short time-constants, such as using short/thin/small elements, using phonon transport phenomena, or other means.

In another embodiment, the time-constant(s) of the thermal transfer medium flow is much shorter than the relevant thermal time-constants of the heat source and heatsink, and the purpose of the turbulent or chaotic disruption is to alter the convective heat transfer characteristics of the heatsink, such as reducing the boundary layers or making them dynamically changing over time and space.

Another aspect of the technology involves planar heatsinks, such as used in antenna designs. In this case, the present technology may have corresponding effect to that discussed above, especially where a device to induce thermal transfer medium flow is provided to cool a generally planar heatsink system. It is noted that any heatsink in actuality must be considered in three dimensions, and the fact that it may have expanses of a thin uniform thickness layer does not defeat use of three dimensional analysis to understand its functioning and optimization. In the case of a printed circuit board-type heatsink, a variable geometry is typically infeasible. Similarly, there a planar heatsink structure serves a secondary purpose, such as an antenna, the physical configuration is constrained by this other purpose. However, the device to induce thermal transfer medium flow is typically not so constrained, and therefore provides a controllable variable. Further, in many cases, the requirement for "thinness" of a 2D heatsink does not preclude texturing on an exposed surface, which itself may have a fractal variation.

In some cases, a variable geometry may be achieved by altering flow characteristics of thermal transfer medium flow, and for example, a deflector may be controlled to change a direction of impingement. Advantageously, a surface of a heatsink can have anisotropic features, which respond differently to different flow direction. Thus, the efficiency of the fan can be optimized other than by fan speed alone, to provide another control variable. This may have particular importance where the fan itself is highly constrained, and cannot simply be made oversized, or where energy efficiency is an overriding concern.

The technology is not limited to cooling gas fluids, and may encompass liquids. Typically, cooling liquids are recycled, and therefore operate within a physically closed system. Use of fractal branching fluid networks is known, but various principles discussed above, such as variable geometry, variations in flow rate over different regimes of operation, different directions of flow over surfaces, and intentional induction of chaotic flow patterns may be adopted to advantage.

Many fractal designs are characterized by concave regions or cavities. See, for example, FIGS. 2 and 3. While sets of concavities may be useful in improving aerodynamics and fluid dynamics to increase turbulence, if they are disposed in a regular array, they will likely produce an acoustic resonance, and may have peaks in a fluid impedance function. On the other hand, the multiscale nature of a fractal geometric design will allow the system to benefit from the concavities, while avoiding a narrowly tuned system.

The present technology proposes, according to one embodiment, a fractal-shaped heatsink for the purpose of dissipating heat. Benefits of a fractal heatsink, over a traditional heatsink having a Euclidian geometry may include: (1) the fractal heatsink has a greater surface area, allowing for more exposure of the hot device to the surrounding air or liquid and faster dissipation of heat; and (2) due to the plethora of concave structures or cavities in fractal structures, the fractal heatsink is better able to take advantage of turbulent flow mechanics than a traditional heatsink, resulting in heat entering and exiting the heatsink more quickly (3) acoustic properties, especially in forced convection systems.

The technology provides, according to various embodiments, a heatsink to cool an object through conduction (diffusion), convection and radiation. See, en.wikipedia.org/wiki/Heat_transfer.

With respect to conduction, the present technology observes that when heat energy is conducted by phonon transport, wave phenomena are pertinent, and thus a fractal branching network can advantageously be used to reduce reflections at discontinuities and decrease complex impedance. Further, a fractal geometry may assist in optimizing the cross-section area and surface area (for radiation and convective transfer) under given constraints.

With respect to convection, a fractal geometry may provide acoustic benefits, by distributing acoustic energy across a wide band, and thus ensuring "whiteness" of a noise spectrum and absence of sharp resonances. Further, a fractal geometry may provide high or maximum surface area, and produce turbulent cooling medium flows to reduce boundary later effects. Depending on the constraints imposed, a fractal geometry may also provide chimneys or defined flow paths through a network of elements, and thus control an impedance of coolant flow, though generally, a fractal branching network will produce higher flow impedance than corresponding smooth regular surfaces. In some cases, a textured surface or configuration (as might be achieved by a fractal geometry) can actually increase laminar flow some distance away from the surface, by creating a controlled disturbed intermediate layer.

With respect to radiation, a fractal geometry can avoid parallel surfaces which can limit radiative dissipation. For example, a parallel plate heatsink will radiatively transfer heat between the plates, and thus limit the effectiveness of radiation from the bulk of the surfaces as an effective dissipation mechanism. On the other hand, irregular angles and surface branches may help to avoid reabsorption of thermal radiation by the elements of the heatsink, and thus enhance radiative dissipation.

For the smallest heatsink elements, on the order of 10-100 nm, the focus of the heat transfer may be on radiation rather than convection. Electron emission and ionization may also be relevant. Larger heatsink elements, approximately >1 mm in size, will generally rely on convection as the primary form of heat transfer. In a fractal geometry system, elements spanning these regimes may be provided in a single system.

In one embodiment, the heatsink comprises a heat exchange device with a plurality of heat exchange elements having a fractal variation therebetween. A heat transfer fluid, such as air, water, or another gas or liquid, is induced to flow through the heat exchange device. The heat transfer fluid has turbulent portions. The fractal variation in the plurality of heat exchange elements substantially reduces the narrow band acoustic resonance resulting from fluid flow around the heatsink elements as compared to a heatsink having a linear or Euclidian geometric variation between the plurality heat exchange elements. The turbulent flow also disturbs the stagnant surface boundary layer, leading to more efficient heat transfer, but generally reduced flow rates for the same motive force. Note that, since turbulence dissipates energy, under some conditions, the heat added to the system by inducing the heat transfer fluid flow can be a significant factor.

When a heat transfer fluid (air, gas or liquid) is induced to flow over a surface, there may be turbulence in the fluid. The fractal shape of the heatsink would generally provide a range of physical size parameters, and thus for any given flow rate, would typically induce turbulent flow over some portion of a fractal geometry array. Notably, because the flow for a given heatsink may vary over a range of speeds, and the temperature and viscosity of the fluid varies over a range of conditions, a fractal geometry facilitates optimization over a range of parameters.

In fluid dynamics, turbulence or turbulent flow is a flow regime characterized by chaotic property changes. This includes low momentum diffusion, high momentum convection, and rapid variation of pressure and flow velocity in space and time. See, en.wikipedia.org/wiki/Turbulence; www.scholarpedia.org/article/Turbulence, expressly incorporated herein by reference. Flow in which the kinetic energy dies out due to the action of fluid molecular viscosity is called laminar flow. While there is no theorem relating the non-dimensional Reynolds number (Re) to turbulence, flows at Reynolds numbers larger than 5000 are typically (but not necessarily) turbulent, while those at low Reynolds numbers usually remain laminar. In Poiseuille flow, for example, turbulence can first be sustained if the Reynolds number is larger than a critical value of about 2040; moreover, the turbulence is generally interspersed with laminar flow until a larger Reynolds number of about 4000. In turbulent flow, unsteady vortices appear on many scales and interact with each other. Drag due to boundary layer skin friction increases. The structure and location of boundary layer separation often changes, sometimes resulting in a reduction of overall drag. Although laminar-turbulent transition is not governed by Reynolds number, the same transition occurs if the size of the object is gradually increased, or the viscosity of the fluid is decreased, or if the density of the fluid is increased. Turbulence is characterized by the following features: Irregularity: Turbulent flows are always highly irregular. For this reason, turbulence problems are normally treated statistically rather than deterministically. Turbulent flow is chaotic. However, not all chaotic flows are turbulent. Diffusivity: The readily available supply of energy in turbulent flows tends to accelerate the homogenization (mixing) of fluid mixtures. The characteristic which is responsible for the enhanced mixing and increased rates of mass, momentum and energy transports in a flow is called "diffusivity". Rotationality: Turbulent flows have non-zero vorticity and are characterized by a strong three-dimensional vortex generation mechanism known as vortex stretching. In fluid dynamics, they are essentially vortices subjected to stretching associated with a corresponding increase of the component of vorticity in the stretching direction—due to the conservation of angular momentum. In general, the stretching mechanism implies thinning of the vortices in the direction perpendicular to the stretching direction due to volume conservation of fluid elements. As a result, the radial length scale of the vortices decreases and the larger flow structures break down into smaller structures. The process continues until the small scale structures are small enough that their kinetic energy can be transformed by the fluid's molecular viscosity into heat, i.e., atomic scale random motion. This is why turbulence is always rotational and three dimensional. Dissipation: To sustain turbulent flow, a persistent source of energy supply is required because turbulence dissipates rapidly as the kinetic energy is converted into internal energy by viscous shear stress. It therefore becomes apparent that, because turbulent flow is chaotic, an optimization of heatsink geometry responsive to chaotic features can achieve efficiencies over a range of operating regimes, and at particular operating regimes.

Turbulence causes the formation of eddies of many different length scales. Most of the kinetic energy of the turbulent motion is contained in the large-scale structures. The energy "cascades" from these large-scale structures to smaller scale structures by an inertial and essentially inviscid mechanism. This process continues, creating smaller and smaller structures which produces a hierarchy of eddies. Eventually this process creates structures that are small enough that molecular diffusion becomes important and viscous dissipation of energy finally takes place. The scale at which this happens is the Kolmogorov length scale.

Via this energy cascade, turbulent flow can be realized as a superposition of a spectrum of flow velocity fluctuations and eddies upon a mean flow. The eddies are loosely defined as coherent patterns of flow velocity, vorticity and pressure. Turbulent flows may be viewed as made of an entire hierarchy of eddies over a wide range of length scales and the hierarchy can be described by the energy spectrum that measures the energy in flow velocity fluctuations for each length scale (wavenumber). The scales in the energy cascade are generally uncontrollable and highly non-symmetric. Nevertheless, based on these length scales these eddies can be divided into three categories.

Integral length scales: Largest scales in the energy spectrum. These eddies obtain energy from the mean flow and also from each other. Thus, these are the energy production eddies which contain most of the energy. They have the large flow velocity fluctuation and are low in frequency. Integral scales are highly anisotropic. The maximum length of these scales is constrained by the characteristic length of the apparatus.

Kolmogorov length scales: Smallest scales in the spectrum that form the viscous sub-layer range. In this range, the energy input from nonlinear interactions and the energy drain from viscous dissipation are in exact balance. The small scales have high frequency, causing turbulence to be locally isotropic and homogeneous.

Taylor microscales: The intermediate scales between the largest and the smallest scales which make the inertial subrange. Taylor microscales are not dissipative scale but pass down the energy from the largest to the smallest. Taylor microscales play a dominant role in energy and momentum transfer in the wavenumber space.

The Russian mathematician Andrey Kolmogorov proposed the first statistical theory of turbulence, based on the aforementioned notion of the energy cascade (an idea originally introduced by Richardson) and the concept of self-similarity (e.g., fractal relationships). For very high Reynolds numbers, the small scale turbulent motions are statistically isotropic (i.e. no preferential spatial direction could be discerned). In general, the large scales of a flow are not isotropic, since they are determined by the particular geometrical features of the boundaries (the size characterizing the large scales will be denoted as L). Thus, Kolmogorov introduced a second hypothesis: for very high Reynolds numbers the statistics of small scales are universally and uniquely determined by the kinematic viscosity (v) and the rate of energy dissipation (s). With only these two parameters, the unique length (Kolmogorov length scale) that can be formed by dimensional analysis is $$\eta = \left(\frac{\nu^3}{\varepsilon}\right)^{1/4}.$$

A turbulent flow is characterized by a hierarchy of scales through which the energy cascade takes place. Dissipation of kinetic energy takes place at scales of the order of Kolmogorov length η, while the input of energy into the cascade comes from the decay of the large scales, of order L. These two scales at the extremes of the cascade can differ by several orders of magnitude at high Reynolds numbers. In between there is a range of scales (each one with its own characteristic length r) that has formed at the expense of the energy of the large ones. These scales are very large compared with the Kolmogorov length, but still very small compared with the large scale of the flow (i.e., $\eta \ll r \ll L$). Since eddies in this range are much larger than the dissipative eddies that exist at Kolmogorov scales, kinetic energy is essentially not dissipated in this range, and it is merely transferred to smaller scales until viscous effects become important as the order of the Kolmogorov scale is approached. Within this range inertial effects are still much larger than viscous effects, and it is possible to assume that viscosity does not play a role in their internal dynamics (for this reason this range is called "inertial range"). Kolmogorov theory is at present under revision. The theory implicitly assumes that the turbulence is statistically self-similar at different scales. This essentially means that the statistics are scale-invariant in the inertial range. However, there is evidence that turbulent flows deviate from this idealized behavior. See, Davidson, P. A. (2004). Turbulence: An Introduction for Scientists and Engineers. Oxford University Press. ISBN 978-0-19-852949-1;

G. Falkovich, Scholarpedia, "Cascade and scaling" scholarpedia.org;

Jin, Y.; Uth, M. F.; Kuznetsov, A. V.; Herwig, H. (2 Feb. 2015). "Numerical investigation of the possibility of macroscopic turbulence in porous media: a direct numerical simulation study". Journal of Fluid Mechanics 766: 76-103. Bibcode:2015JFM . . . 766 . . . 76J. doi:10.1017/jfm.2015.9;

G Falkovich and K. R. Sreenivasan. Lessons from hydrodynamic turbulence, Physics Today, vol. 59, no. 4, pages 43-49 (April 2006);

J. Cardy, G. Falkovich and K. Gawedzki (2008) Nonequilibrium statistical mechanics and turbulence. Cambridge University Press;

P. A. Durbin and B. A. Pettersson Reif. Statistical Theory and Modeling for Turbulent Flows. Johns Wiley & Sons, 2001;

T. Bohr, M. H. Jensen, G. Paladin and A. Vulpiani. Dynamical Systems Approach to Turbulence, Cambridge University Press, 1998;

J. M. McDonough (2007). Introductory Lectures on Turbulence—Physics, Mathematics, and Modeling;

Kolmogorov, Andrey Nikolaevich (1941). "The local structure of turbulence in incompressible viscous fluid for very large Reynolds numbers". Proceedings of the USSR Academy of Sciences (in Russian) 30: 299-303., translated into English by V. Levin: Kolmogorov, Andrey Nikolaevich (Jul. 8, 1991). Proceedings of the Royal Society A 434 (1991): 9-13. Bibcode:1991RSPSA.434 . . . 9K. doi: 10.1098/rspa.1991.0075; Kolmogorov, Andrey Nikolaevich (1941). "Dissipation of Energy in the Locally Isotropic Turbulence". Proceedings of the USSR Academy of Sciences (in Russian) 32: 16-18., translated into English by Kolmogorov, Andrey Nikolaevich (Jul. 8, 1991). Proceedings of the Royal Society A 434 (1980): 15-17. Bibcode: 1991RSPSA.434 . . . 15K. doi:10.1098/rspa.1991.0076;

G. K. Batchelor, The theory of homogeneous turbulence. Cambridge University Press, 1953.

Therefore, the efficiency of heat transfer may be increased as compared to a heat exchange device having a linear or Euclidian geometric variation between several heat exchange elements, at least over certain regimes of operation.

The heat exchange device may include a highly conductive substance whose heat conductivity exceeds 850 W/(m·K). Examples of such superconductors include graphene, diamond, and diamond-like coatings. Alternatively, the heat exchange device may include carbon nanotubes. At such high thermal conductivities, phonon heat transport may be at play.

A heatsink according to the present technology may be manufactured, for example, as a 3D print or as a casting. Further, a cast design may be produced by a lost wax or lost foam design from a 3D printed form or template. Thus, in practice, a design is generated on a computer-aided design (CAD) system, which may, for example, employ algorithms to optimize the shape according to various criteria, such as size, weight, heat load, air flow, other convective heat transfer parameters, infrared radiation recapture, and other criteria. The design is then converted, by a computer assisted manufacturing (CAM) system, such as an additive manufacturing "3D" printer or 2.5D printer (layers), into a form. The form, if produced using a metal sintering or ceramic process, may itself be a heatsink, though more typically the form is a polymer, which can then be used to create a mold. The mold, in turn, can be used to create multiple templates, which can be used in a casting process. As a result, relatively complex mechanical designs can be replicated in volume. In some cases, when the heatsink is molded, the metal may be heterogeneous, resulting in a range of properties over different regions of the mold.

The design, in some cases, will result in a fractal shape, which may have branches or multiple levels of branches, with multiple characteristic scales, which may have some symmetries or repetitions, or be absent symmetries and repetitions. A design which lacks symmetries or repetitions, and is self-similar at various scales, is considered "fractal". A design which adopts some of these characteristics, or functionally emulates some of these characteristics, is considered "fractal-like". A design representing an array of uniform, repeating elements of the same scale is generally considered non-fractal. In some cases, a branching array having multi-way symmetry may in some cases be considered fractal-like. A multiscale fractal (i.e., with asymmetries within each scale range) with outwardly tapering branches will tend to carry and dissipate heat further from the heat source than a symmetric design, since by nature the larger cross section branches will carry hear further than their smaller, higher surface area per mass cousin branches, and the asymmetry will tend to assure that some branches indeed have larger cross sections; however, this is not the only effect to be obtained. Since the fractal is typically generated by an iterative function system (IFS) responsive to its local environment, the fractal may be optimized by a steering function to steer heat flow to areas with highest convective heat loss, while avoiding heat flow toward branches which do not efficiently shed heat. Similarly, in a vacuum heatsink emitter, the heat loss tends to be radiative, and the optimization can address maximization of net radiative heat loss within the constrained environment.

The present technology, in an ambient atmosphere, may be subject to dust or fiber buildup due to particulates in the flow of cooling air. Filtering of the air to completely remove such particulates is inefficient, since the required filter would require significant energy to operate, and that energy both increases the heat load of the aggregate system to be shed, increases power consumption, and presents a compromise with respect to use of the same energy of more globally, system manufacturing and operating cost, that could be reallocated to a net higher efficiency, such as a heatsink with less susceptibility to dust or fiber deposition and a higher cooling air flow rate. However, the dust deposition may be modelled, and included within a design equation, e.g., an iterative function system, for generating an optimal heatsink which may have resulting fractal or fractal-like features.

As discussed herein, there are a number of strategies available to remove dust that has accumulated on the heatsink surfaces, and the system, including the heat source, heatsink, dust, air flow (e.g., fan) system, as well as the dust abatement system, may be together modelled. This model will typically have a time variance, and the operating point of the aggregate system may change over time, especially if the dust abatement system operates discontinuously. In such a system, the heat flow vectors within the heatsink may change over time in relative magnitude to each other, and the design system therefore typically models the system over its range of operation. In one embodiment, a fan controller (typically the only controllable part of the heatsink) may be controlled based not simply on a temperature and/or temperature rise rate of the heatsink, but also a convective and fluid dynamic model of the system, including measured or estimate dust, fiber, debris, etc. The fan controller may in some cases speed up the fan in an attempt to flow off dust, or create turbulence to disrupt dust, or to create velocity/pressure gradient dependent flow patterns around the heatsink to achieve efficient and/or optimal heat transfer. Maintaining low operating temperatures of the heat source and energy cost are not necessarily the only critical variables, and therefore in some cases, the fan will run at a fan speed which is energy-inefficient with respect to the lowest speed (lowest energy cost) that will achieve the desired cooling of the heat source.

The controller may also implement an acoustic/sonic model, especially where turbulent air flow is intentionally created, and the model may be used to ensure that acoustic emissions are not objectionable or outside of a predetermined or adaptive limit. See, U.S. Pat. No. 6,850,252, expressly incorporated herein by reference. Likewise, in some cases, the sounds emitted by the heatsink system may be intentionally timed to external cues.

Various variations on this heatsink will be apparent to skilled persons in the art. For example, the heatsink could include a heat transfer surface that is connected to the heat exchange device and is designed to accept a solid to be cooled. Alternatively, there could be a connector that is designed to connect with a solid to be cooled in at least one point. In another embodiment, there are at least three connectors serving to keep the solid and the heatsink in a fixed position relative to one another. Various connectors will be apparent to persons skilled in the art. For example, the connector could be a point connector, a bus, a wire, a planar connector or a three-dimensional connector. In another embodiment, the heatsink has an aperture or void in the center thereof designed to accept a solid to be cooled. The heatsink may also be integral to the heat source, or attached by other means.

This heatsink is typically intended to be used to cool objects, and may be part of a passive or active system. Modern three-dimensional laser and liquid printers can create objects such as the heatsinks described herein with a resolution of features on the order of about 16 μm, making it feasible for those of skilled in the art to use such fabrication technologies to produce objects with a size below 25 cm. Alternatively, larger heatsinks, such as car radiators, can be manufactured in a traditional manner, designed with an architecture of elements having a fractal configuration. For example, a liquid-to-gas heat exchanger (radiator) may be provided in which segments of fluid flow conduit have a fractal relationship over three levels of recursion, i.e., paths with an average of at least two branches. Other fractal design concepts may be applied concurrently, as may be appropriate.

Yet another embodiment of the invention involves a method of cooling a solid by connecting the solid with a heatsink. The heatsink comprises a heat exchange device having a plurality of heat exchange elements having a fractal variation therebetween. A heat transfer fluid having turbulent portions is induced to flow with respect to the plurality of heat exchange elements. The fractal variation in the plurality of heat exchange elements serves to substantially reduce narrow band resonance as compared to a corresponding heat exchange device having a linear or Euclidean geometric variation between a plurality of heat exchange elements.

A preferred embodiment provides a surface of a solid heatsink, e.g., an internal or external surface, having fluid thermodynamical properties adapted to generate an asymmetric pattern of vortices over the surface over a range of fluid flow rates. For example, the range may comprise a range of natural convective fluid flow rates arising from use of the heatsink to cool a heat-emissive object. The range may also comprise a range of flow rates arising from a forced convective flow (e.g., a fan) over the heatsink.

The heatsink may cool an unconstrained or uncontained fluid, generally over an external surface of a heatsink, or a constrained or contained fluid, generally within an internal surface of a heatsink.

It is therefore an object of the present invention to provide a heatsink system comprising: a base structure configured to interface with a heat source; a heat exchange device configured to receive heat from the base structure, and emit the received heat from a heat exchange surface, into an external surrounding heat exchange medium, the heat exchange surface being subject to accumulation of particles; and a particle dislodging device configured to mechanically disrupt an accumulation of particles on the plurality of heat exchange elements.

It is also an object of the present invention to provide a method of heat transfer, comprising: providing a base structure configured to interface with a heat source; receiving heat from the base structure with a heat exchange device configured to emit the received heat from a heat exchange surface, into an external surrounding heat exchange medium; and reducing an accumulation of particles on the heat exchange surface with at least one of a particle degrading device and a particle dislodging device.

It is a further object of the present invention to provide a heatsink comprising: a base structure configured to interface with a heat source; a heat exchange device configured to receive heat from the base structure, and emit the received heat from a heat exchange surface, into an external surrounding heat exchange medium, the heat exchange surface being subject to accumulation of particles; and a particle degrading device configured to chemically degrade an accumulation of particles on the plurality of heat exchange elements.

It is a still further object of the present invention to provide a system comprising: a fractal heat exchange device comprising: a base structure configured to interface with a heat source; a plurality of heat exchange elements having approximately fractal geometry, the plurality of heat exchange elements attached to the base structure, configured to receive heat from the base structure and emit the heat into an external surrounding through radiation and convection in heat exchange medium; and a pyrolizer to pyrolize dust particles.

Another object of the present invention provides a method of heat transfer comprising providing a base structure configured to interface with a first heat source; receiving heat from the base structure with a fractal heat exchange device configured to emit the received heat from a plurality of heat exchange elements, into an external surrounding heat exchange medium; providing a second heat source distant from the first heat source, the second heat source used to heat dust particles in a vicinity of the first heat source; pyrolizing dust particles using heat from the second heat source; and dissipating the heat used to pyrolize dust particles.

A still further object of the present invention provides a fractal heat exchange device comprising: a base structure configured to interface with a heat source; a plurality of heat exchange elements having approximately fractal geometry, the a plurality of heat exchange elements attached to the base structure and configured to receive heat from the base structure and emit the heat into an external surrounding through radiation and convection in heat exchange medium; and a vibrator to vibrate at least a subset of the plurality of heat exchange elements to dislodge dust particles from heat exchange elements, wherein the base structure comprises vibration isolator to prevent vibrations from damaging the heat source. The vibrator may be one of a piezoelectric transducer and electromagnetic transducer. The vibration isolator may be one of a plastic thermal transfer medium, a non-shear transmissive solid and an active vibration suppression interface. The non-shear transmissive solid may be a copper wire bundle. The base structure may further comprise an anisotropic vibration transmissive mount to isolate vibrations from the heat source. The anisotropic vibration transmissive mount may comprise a piston in a cylinder.

Another object of the present invention provides a method of heat exchange comprising: providing a base structure configured to interface with a heat source; receiving heat from the base structure with a heat exchange device configured to emit the received heat from a plurality of heat exchange elements, into an external surrounding heat exchange medium; providing a source of vibration to vibrate the plurality of heat exchange elements; vibrating the plurality of heat exchange elements to dislodge dust particles therefrom; and dissipating vibrations before they reach the heat source.

It is also an object of the present invention to provide a method heat exchange comprising: providing a base structure configured to interface with a heat source; receiving heat from the base structure with a heat exchange device configured to emit the received heat from a plurality of heat exchange elements, into an external surrounding heat exchange medium; providing a time-varying flow of the heat exchange medium over the plurality of heat exchange elements; and dislodging dust particles accumulated on the plurality of heat exchange elements.

It is a still further object of the present invention to provide a fractal heat exchange device comprising: a base structure configured to interface with a heat source; a plurality of heat exchange elements having approximately fractal geometry, the a plurality of heat exchange elements attached to the base structure and being configured to receive heat from the base structure and emit the heat into an external surrounding through radiation and convection in heat exchange medium; an electrostatic charge generator; and an electrostatic discharge device, wherein the electrostatic charge generator is configured to induce static electricity on a surface of at least a portion of the plurality of heat exchange elements to repel dust particles from accumulating thereon.

It is another object of the present invention to provide a method of heat exchange comprising: providing a base structure configured to interface with a heat source; receiving heat from the base structure with a heat exchange device configured to emit the received heat from a plurality of heat exchange elements, into an external surrounding heat exchange medium; inducing a first static electric charge having a polarity on the surface of at least a portion of the a plurality of heat exchange elements; and inducing a second static electric charge on dust particles, the second static electric charge having the same polarity as the polarity of the first static electric charge.

Another object of the present invention is to provide a system comprising: a fractal heat exchange device, the heat exchange device further comprising: a base structure configured to interface with a heat source; a plurality of heat exchange elements having approximately fractal geometry, the plurality of heat exchange elements being attached to the base structure and being configured to receive heat from the base structure and emit the heat into an external surrounding heat transfer medium by radiation and convection; and at least one of a fan and a compressor, configured to induce a time-varying flow of the heat transfer medium over the plurality of heat exchange elements, wherein at least portions of the time varying flow of the heat transfer medium over the plurality of heat exchange elements are turbulent, having a turbulence pattern that changes over time.

The particle-dislodging device may comprise a vibrator configured to vibrate a plurality of heat exchange elements comprising the heat exchange surface. The particle-dislodging device may also comprise at least one of a piezoelectric transducer and an electromagnetic transducer. The particle-dislodging device may also comprise a rotating motor configured to induce a vibration in the plurality of heat exchange elements. The particle-dislodging device may also comprise a fan or pump configured to induce a time-varying flow of heat exchange media over the plurality of heat exchange elements. The time-varying flow of heat exchange media may comprise entrained particles or liquid, e.g., a gas-liquid mixture. The particle-dislodging device may further comprise an electrostatic charge generator. The particle-dislodging device may also comprise an electrostatic discharge device. The particle-dislodging device may comprise at least one shape memory alloy. The particle dislodging system may comprise an electrical-vibration transducer and an oscillating signal generator, receiving a feedback signal from the feedback transducer, configured to excite the vibration transducer. The particle-dislodging device may comprise a fan or compressor, configured to induce a flow of a gaseous heat transfer medium over a plurality of heat exchange elements of the heat exchange surface. The particle dislodging device may comprise a fan or compressor, configured to induce a flow of a gaseous heat transfer medium over the heat exchange surface along at least one vector, having at least one control input, wherein the at least one vector is altered in dependence on the at least one control input.

The system may further comprise at least one a vibrational transducer, controlled to cancel vibrations at the base structure produced by the particle-dislodging device. A vibration damper may be provided, configured to damp vibrations at the base structure. A feedback transducer may be provided, configured to detect vibrations.

The heat exchange surface may comprise a plurality of heat exchange elements having resonances over a range of frequencies, and the particle-dislodging device comprises an electrical-vibration transducer and an oscillating signal generator, configured to generate vibrations over the range of frequencies, to resonate the plurality of heat exchange elements. The heat exchange surface may also comprise a plurality of heat exchange elements having characteristic dimensions over at least two orders of size scales. The heat exchange surface may comprise a plurality of heat exchange elements, and the particle-dislodging device may comprise an actuator configured to alter at least one spatial relationship of a first of the plurality of heat exchange elements with respect to a second of the plurality of heat exchange elements. The actuator may be a passively activated member responsive to temperature. The actuator may also be actively controlled by an automated electronic processor in dependence on a computational heat exchange model of the heatsink system.

The accumulation of particles on the heat exchange element may be reduced with a particle-degrading device. The particle-degrading device may comprise a pyrolizer, degrading the particles by pyrolysis. The particle-degrading device may also comprise a pump configured to cause a time varying flow of a liquid solvent entrained in a gas heat exchange medium on the heat exchange surface. The particle-degrading device may comprise a laser. The particle-degrading device may comprise an electrical discharge plasma emitter.

The accumulation of particles on the heat exchange surface may be reduced by vibration. The accumulation of particles on the heat exchange surface may be reduced with a piezoelectric transducer. The accumulation of particles on the heat exchange surface may be reduced with an electromagnetic transducer. The accumulation of particles on the heat exchange surface may be reduced with a rotating motor configured to induce a vibration in the plurality of heat exchange elements. The accumulation of particles on the heat exchange surface may be reduced with at least one active system, which induces a time-varying flow of heat exchange media over the heat exchange surface. The time-varying flow of heat exchange media may comprise entrained particles. The time-varying flow of heat exchange media may comprise a liquid mixed with a gas. The method may further comprise inducing a flow of a gaseous heat transfer medium comprising an entrained solvent over the plurality of heat exchange elements. The accumulation of particles on the heat exchange surface may be reduced by generating an electrostatic charge. The accumulation of particles on the heat exchange surface may be reduced by use of an electrostatic discharge generator. The accumulation of particles on the heat exchange surface may be reduced by heating and cooling at least one shape memory alloy. The accumulation of particles on the heat exchange surface may be reduced by selectively activating a laser. The accumulation of particles on the heat exchange surface may be reduced by inducing transient thermal changes proximate to the heat exchange surface. The accumulation of particles on the heat exchange surface may be reduced by selectively generating vibrations with a vibrational transducer, controlled to cancel vibrations at the base structure. The accumulation of particles on the heat exchange surface may be reduced by inducing vibrations in a plurality of heat exchange elements of the heat exchange surface, and damping vibrations at the base structure. The accumulation of particles on the heat exchange surface may be reduced by inducing a flow of a gaseous heat transfer medium over the heat exchange elements along at least one vector, having at least one control input, wherein the at least one vector is altered in dependence on the at least one control input.

The method may further comprise detecting vibrations with a feedback transducer, and generating vibration with an electrical-vibration transducer in dependence on a signal received from the feedback transducer. The heat exchange surface comprises a plurality of heat exchange elements having resonances over a range of frequencies, the method further comprising generating vibrations over the range of frequencies, to resonate the plurality of heat exchange elements.

The heat exchange surface may comprise a plurality of heat exchange elements having characteristic dimensions over at least two orders of size scales. The plurality of heat exchange elements may have fractal-like features, or have fractal-like relationships with each other. The heat exchange surface may comprise a plurality of heat exchange elements, and the accumulation of particles on the heat exchange surface may be reduced by altering at least one spatial relationship of a first of the plurality of heat exchange elements with respect to a second of the plurality of heat exchange elements with an actuator. The actuator may be a passively activated member responsive to temperature. The actuator may be actively controlled by an automated electronic processor in dependence on a computational heat exchange model.

DETAILED DESCRIPTION OF THE PREFERRED EMBODIMENTS

Figure 2:
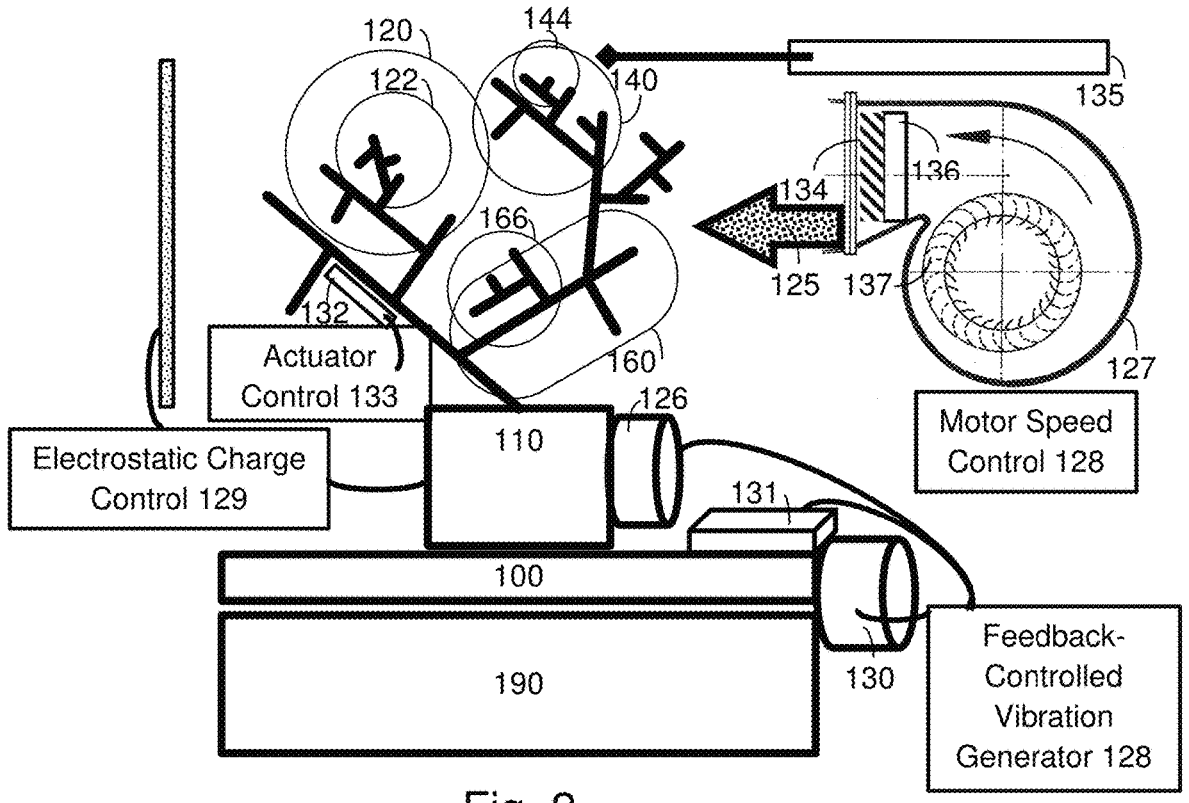
FIG. 2 illustrates a fractal heatsink that is an exemplary embodiment of the invention. In this embodiment, the heatsink is placed adjacent to the object to be cooled.

FIG. 2 illustrates a heatsink implementing a first embodiment of this invention. Note that the illustration is in two dimensions, but a three dimensional embodiment is both possible and preferred. There is a heat transfer surface 100 that allows the heatsink to rest comfortably on a surface, such as the solid to be cooled 190. In the illustrated embodiment, the heat transfer surface 100 is roughly planar, having a closed Euclidian cross-section on the bottom. However, it might also have another shape, for example if the solid to be cooled does not have a planar face. The heat transfer surface may also comprise an anisotropic vibration transfer thermal interface material, such as a braided or straight fine copper wire bundle. Such a bundle advantageously has strands of different length, which, for example, could permit destructive interference of vibrations transmitted along each strand. A fractal-shaped heat exchange device begins at point 110. The base of the fractal-shaped heat exchange device at point 110 may also or alternately include a piston and cylinder, to provide vibrational isolation along the piston movement axis, while also transmitting heat from the heat source to the heatsink along the peripheral wall of the cylinder to the inner wall of the piston. The working fluid within the cylinder may be a heat transfer fluid, and a set of valves may be actuated based on the vibration to induce a flow. The heat transfer fluid may be a phase change fluid, and the gaseous phase may vent from the cylinder through a valve. Note that the heatsink has three branches leaving from point 110—branch 120, branch 140, and branch 160. Also note that the branch structure initiating from point 110 is nearly identical to that at point 122 and 142, even though only point 110 is a true starting point. Thus, the fractal property of self-similarity is present. We call the structure that begins at point 110 the "first motif," the structure from point 122 the "second motif," and the structure that begins from point 142 the "third motif." Note that, in the embodiment illustrated in FIG. 2, the replication from first to second motif and from second to third motif involves a linear displacement (upward) and a change of scale. In branches not going in the same direction as the prior branch, there is also a rotation. Under the limitations for ideal fractals, the second motif and third motif are a smaller, similar copy of the first motif. However, due to the limitations imposed by human-made structures and machines, the fractals designed here are generally finite and the second motif will thus be an inexact copy of the first motif, i.e. if there are N levels starting from the first motif, the second motif level will have N−1 levels, if N is very large, the difference is insignificant. In other words, the self-similarity element required in fractals is not preserved perfectly in the preferred designs due to the limitations of available machinery, other feasibility constraints, and various design issues. In addition, the benefits are achieved without requiring fractal relationships over more than a few "orders" of magnitude (iterations of the fractal recursive algorithm). For example, in the embodiment illustrated in FIG. 2, there are no continuing branch divisions and iterations at point 162, even though an ideal fractal would have them. In an ideal fractal, there would be an infinite number of sub-branches from 110, 122, and 142. However, an imperfect fractal shape, as illustrated in FIG. 2, will serve the purposes of this invention.

FIG. 2 shows various embodiments of the invention, which may be used individually, in combination, or in subcombination. When ambient air flows over a textured surface, such as a branching fractal or fractal-like shape, dust, fibers and/or debris may accumulate. In addition, in some cases, pollutants or oils may deposit. Such depositions tend to reduce the efficiency of heat transfer, and when sufficiently thick, should be removed or disrupted. According to one embodiment, a particle-dislodging device configured to mechanically disrupt an accumulation of particles on the plurality of heat exchange elements is provided, e.g., vibration transducer 126, fan 127, actuator 132, etc.

Thus, for example, the particle-dislodging device may comprise a vibration transducer 126 configured to vibrate a plurality of heat exchange elements comprising the heat exchange surface. The vibration transducer 126 may be, for example, a piezoelectric transducer, an electromagnetic transducer, or a rotating motor. In the case of a vibration transducer, it is preferred that the vibrations be emitted at resonant frequencies of the heat exchange elements; which advantageously span a range due to the fractal or fractal-like disposition. Therefore, vibrational energy can be selectively targeted to certain elements, without resonant vibration of the entire structure. The vibrational energy may be controlled to scan a range of frequencies, or to target specific frequencies corresponding to targeted structures.

The system may further comprise at least one vibrational transducer 130, controlled by a feedback-controlled vibration generator 128 to cancel vibrations at the base structure produced by the particle dislodging device 126, based on a signal from a vibration sensing transducer 131.

A vibration damper may be provided to damp vibrations at the base structure, e.g., near the point 110. This may be an isotropic or anisotropic vibration isolator, and for example may comprise a bundle of wires (e.g., copper), a piston and cylinder, a particle-filled polymeric thermal interface material, copper nanotubes, or the like.

A fan 126 or a heat transfer fluid (which may be gaseous or liquid) pump/compressor may be provided, which in turn may be controlled by e.g., motor speed control 128 to induce a time-varying flow of heat exchange media over the plurality of heat exchange elements. The fan 126 or pump/compressor may be configured to induce a flow of a gaseous heat transfer medium over the heat exchange surface along at least one vector, having at least one control input, wherein the at least one vector is altered in dependence on the at least one control input, by, for example a set of louvers 137. The flow rate may also be controlled over time, in dependence on thermal load, desired turbulence or other convective heat transfer phenomenon, acoustic emissions, or other criteria.

The heat exchange media may comprises entrained particles 125, such as magnetic particles 125, which impinge on the surfaces of the heat exchange elements, and can dislodge surface debris. Advantageously, a magnetic collector can capture the particles for reuse, after mixed debris is separated. The entrained particles 125 may also be liquid droplets in a gas-liquid mixture.

In an alternate embodiment, the particle-dislodging device comprises an electrostatic charge generator and an electrostatic discharge device 129. These cooperate to charge the surfaces of the heat exchanger, which in conjunction with a collection plate/discharge device, induce a force on the surface particles to move from the heat exchange surface to the collection plate.

The particle-dislodging device may also comprise a shape memory alloy 132, which for example is passively controlled by a temperature, or actively controlled by control 133 to change the configuration of the heatsink. The control 133 may include an automated electronic processor in dependence on a computational heat exchange model of the heatsink system. Other types of actuator configured to alter at least one spatial relationship of a first portion of the heat exchange elements with respect to a second portion of the heat exchange elements are possible.

In an alternate embodiment, the particle-degrading device is configured to chemically degrade an accumulation of particles on the plurality of heat exchange elements. For example, the particle-degrading device may be a pyrolizer 134, discharge plasma emitter 136, solvent wash (solvent as entrained particles 125), etc. These chemical degradation effects need not be constant, and can thus vary in intensity, duty cycle, etc. over time.

A laser 135 may be provided to ablate or disrupt the accumulation. The laser may be, for example, controlled by electronically controlled mirrors. On some cases, a continuous scanning is desired, and the control may be a simple area scan of a pulsed laser beam.

The fractal heatsink has a much larger surface area than the heat transfer surface alone, or a regular array of heatsink because all of the "branches" and "leaves" of the fern-like fractal shape serve to increase the surface area. In addition, if a heat transfer fluid is induced to flow above the heat transfer surface 100, the turbulent portions of the heat transfer fluid near the surface will be increased by the textures inherent in the fractal variation in the heat exchange element 110. Because the fractal patterns is itself non-identically repeating within the fractal design, this will serve to substantially reduce narrow band acoustic resonance as compared to a corresponding heat exchange device having a repeating design, e.g., a linear or geometric variation between several heat exchange elements, thereby further aiding in the heat transfer process.

In a preferred embodiment, the heat transfer surface 100 and the roughly fractal-shaped heat exchange element 110 are all made out of an efficient heat conductor, such as copper or aluminum, or more preferably, having a portion whose heat conductivity exceeds 850 W/(m*K), such as graphene with a heat conductivity of between 4840 and 5300 W/(m*K) or diamond with a heat conductivity between 900 and 2320 W/(m*K). This would allow heat to quickly enter the heatsink from the solid and for heat to quickly exit the heatsink through the branches and leaves of the fern-like fractal 110. In another embodiment, the heatsink is formed, at least in part, of carbon nanotubes, which display anisotropic heat conduction, with an efficient heat transfer along the long axis of the tube. Carbon nanotubes are submicroscopic hollow tubes made of a chicken-wire-like or lattice of carbon atoms. These tubes have a diameter of just a few nanometers and are highly heat conductive, transferring heat much faster than diamond, and in some cases comparable to graphene. See web.mit.edu/press/2010/thermopower-waves.html (last accessed Apr. 15, 2010) incorporated herein by reference.

Also note that this exemplary embodiment provides a plethora of openings, e.g., 124 and 126, between the branches or fractal sub-elements to ensure that all of the branches are exposed to the surrounding air, gas or liquid and to allow the heat to escape from the heatsink into the surroundings. In one embodiment of the invention, at least two of these openings are congruent, as are openings 124 and 126 illustrated here. An embodiment of the invention allows the openings to be filled with the air or liquid from the surrounding medium. Due to the limitation imposed by the solid's flat shape, it is not possible to increase the exposure of the fern-like fractal to the solid. However, the air or liquid outside of the solid are perfect for the fractal's exposure.

Under the phonon model of heat exchange, applicable to carbon nanotubes, graphene materials, and perhaps others, the fractal shape is advantageous to ensure the escape of the phonons into the surrounding fluid medium because the fractal configuration may avoid peaked internal reflection of waves, and provide high surface exposure to the fluid heat transfer medium. Skilled persons in the art will realize that this could be achieved through many known structures. For example, graphene, which is one-atom-thick carbon and highly heat conductive, would be an advantageous material to use to build a 2D implementation of the fractal heatsink herein described.

When a turbulently flowing fluid passes around an obstacle, concave regions or cavities in the obstacle create pockets of separated flow which generates self-sustaining oscillations and acoustic resonance. Convex regions may also be provided. These regions may be provided in a fractal arrangement. In this aspect of the technology, fractal is meant to signify self-similar but with differences in scale and optionally another attribute. The regions may produce substantially reduced narrow band acoustic resonance as compared to regularly spaced and arranged disruptions in the flow pattern. Likewise, the presence of disruptions disturbs the surface layer and may enhance convective heat transfer.

Figure 3:
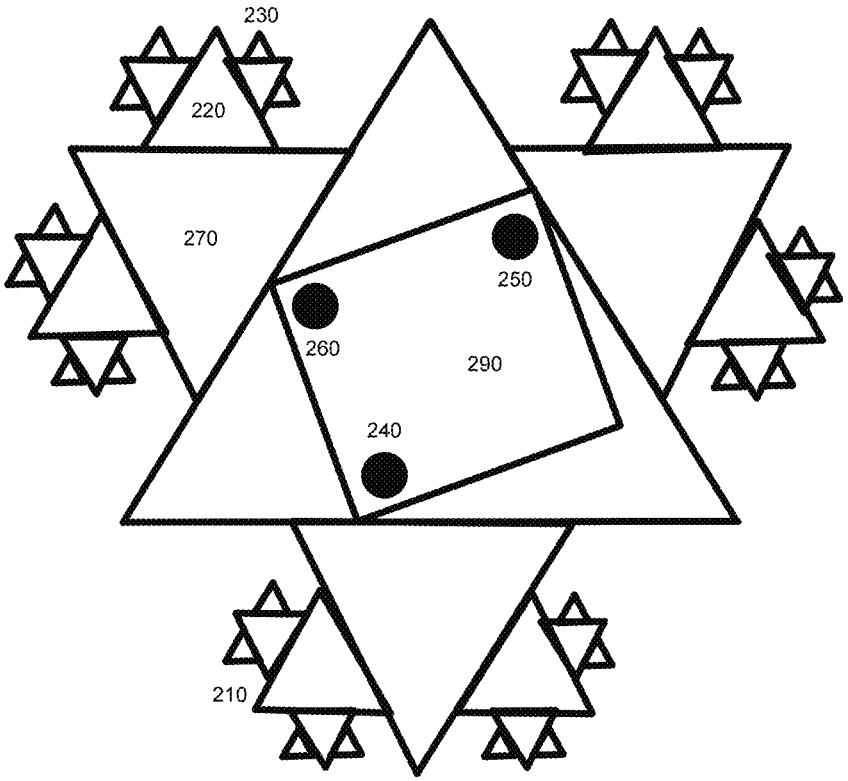
FIG. 3 illustrates a fractal heatsink that is an exemplary embodiment of the invention. In this embodiment, the heatsink is placed either adjacent to or surrounding the object to be cooled.

FIG. 3 illustrates another embodiment of the invention. A solid to be cooled that has an arbitrary shape 290 is located inside (illustrated) or outside (not illustrated) a two-dimensional or three-dimensional roughly fractal shaped 210 heatsink. In one embodiment, the heatsink 210 has an aperture 270 designed to hold the solid. Note that, as in FIG. 2, the fractal heat exchange element has multiple motifs, starting with the large triangle at 210, to progressively smaller triangles at 220 and 230. However, note that the fractal does not keep extending infinitely and there are no triangles smaller than the one at 230. In other words, the fractal heatsink 210 has multiple recursive fractal iterations 220 and 230, but the fractal iterations stop at level 230 for simplicity of design and manufacturability. Also note that the fractal submotifs 220 and 230 are of different dimensional sizes from the original fractal motif 210 and protrude from the original fractal shape 210. Here, the first motif is a large triangle, and the latter motifs are smaller triangles, which involve a rotation, linear displacement, and change of scale of the prior motif. In one embodiment, the fractal shape has some apertures in it (not illustrated) to allow the solid to be cooled to connect with other elements. Also, the solid to be cooled is connected to the fractal shape at point connector 240 and through bus wires at 250 and 260. The solid should be connected to the fractal heatsink in at least one point, either through a point connection, a bus wire connection, or some other connection. If it is desired that the solid be fixed inside the heatsink, there may be at least three connection points, as illustrated. However, only one connection point is necessary for conduction between the solid to be cooled and the heatsink. Preferably, the point or bus wire connection is built using a strong heat conductor, such as carbon nanotubes or a diamond-like coating.

Figure 1:
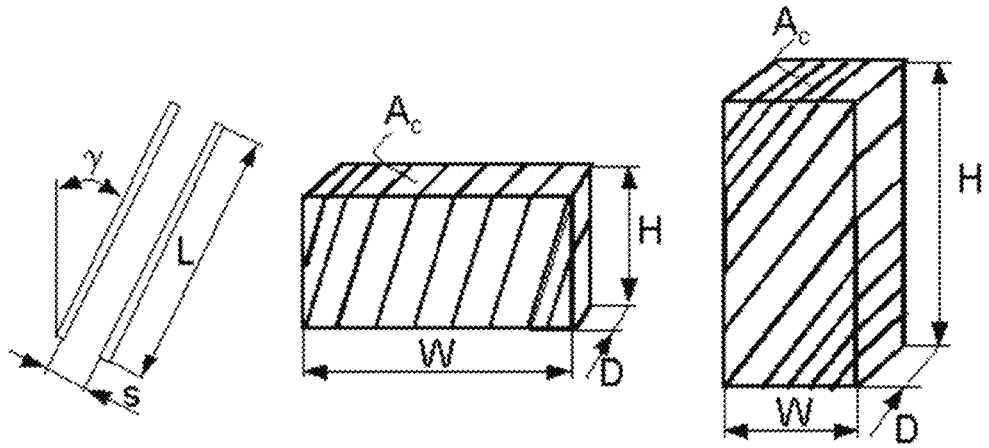
FIG. 1 shows a set of governing equations for a parallel plate heatsink.

Note that, as in FIG. 1, the fractal structure 210 in FIG. 2 has multiple concave regions or cavities. When a turbulently flowing fluid passes around this fractal heatsink, the concave regions or cavities substantially reduce the narrow band acoustic resonance as compared to a flat or Euclidian structure. This allows for more energy to be available to for heat transfer.

In yet another embodiment of the invention, the heatsink 210 in FIG. 3 could be constructed without the connections at points 240, 250, and 260. In one embodiment, a liquid or gas would fill the aperture 270 with the intent that the liquid or gas surround the solid to be cooled, hold it in place, or suspend it. Preferably, the liquid or gas surrounding the solid would conduct heat from the solid to the heatsink, which would then cause the heat to exit.

Figure 4:
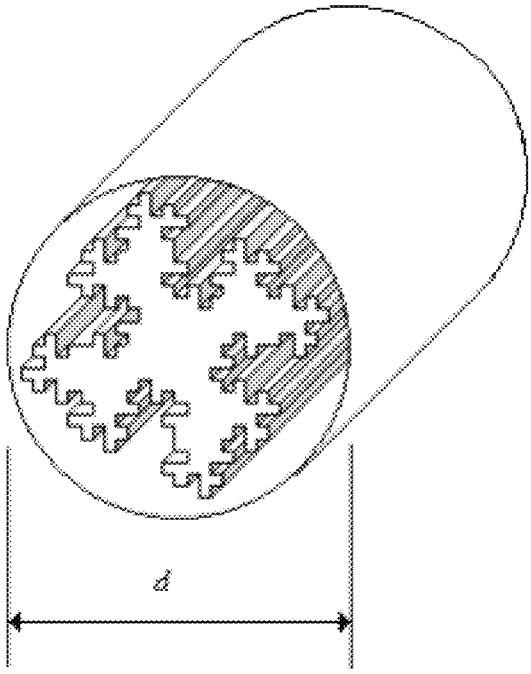
FIG. 4 illustrates a fractal heatsink that is an exemplary embodiment of the invention. In this embodiment, the heatsink is based on a Quadratic Koch Island.

In another embodiment of the invention, the heatsink comprises a heat exchange device which is structurally configured based on a Quadratic Koch Island as illustrated in FIG. 4.

Figure 5A:
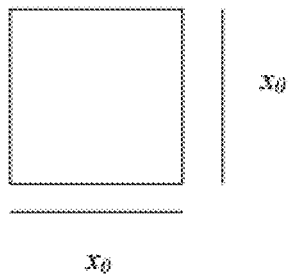
FIG. 5A illustrates the basis for the Quadratic Koch Island.
Figure 5B:
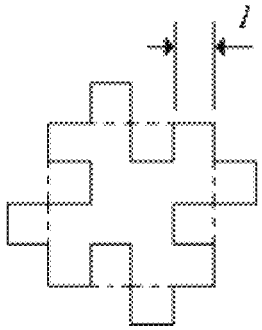
FIG. 5B illustrates a Quadratic Koch Island obtained after application of one iteration.
Figure 5C:
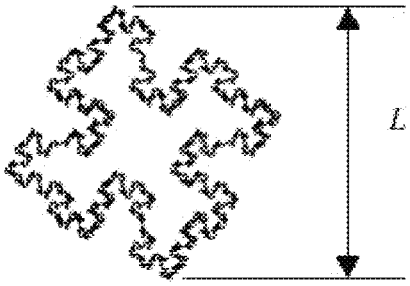
FIG. 5C illustrates a Quadratic Koch Island obtained after application of several iterations.

FIG. 5A illustrates a square with dimension $x_0$ that forms the basis for the Quadratic Koch Island. FIG. 5B illustrates a Quadratic Koch Island obtained after application of one fractal on the square. The fractal with section lengths of l is applied to each side of the square in the first iteration. Similarly, after several such iterations, a Quadratic Koch Island as illustrated in FIG. 5C may be obtained.

Figure 6:
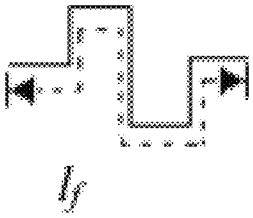
FIG. 6 illustrates the total length of all the fractal segments of a Quadratic Koch Island.

FIG. 6 illustrates the length of the fractal $l_f$ which is the total length of all the fractal segments. The length of each fractal section, l(n), decreases with each iteration of the fractal. The fractal section length is described by eq. 7.

$$l(n)=(1/4)^n x_0 \tag{7}$$

where, $x_0$ is the length of the side of the original square, n is the number of iterations As can be seen from eq. 7, the fractal section length decreases after each iteration. When the number of iterations becomes increasingly large, the section length tends towards being negligible.

Further, it may be mathematically shown that the overall length L of the fractal may be obtained from eq. 8.

$$L(n) = x_0\left(1 + \frac{2}{3}\left(1 - \frac{1}{4^n}\right)\right) \tag{8}$$

where, $x_0$ is the length of the side of the original square, n is the number of iterations Similarly, it may be shown that the circumference C of the Quadratic Koch Island can be obtained from eq. 9.

$$C=4(2^n x_0) \tag{9}$$

where, $x_0$ is the length of the side of the original square, n is the number of iterations It is evident that with each iteration, the circumference C increases. However, the cross-sectional area remains constant at $x_0^2$ since when a fractal area is added the same area is subtracted elsewhere.

In one embodiment, the number of iterations corresponding to the Quadratic Koch Island may be greater than 5. Consequently, the heat exchange device functions as a compact heat exchanger. In other words, the heat exchange device has a large heat transfer area per unit exchanger volume. As a result, several advantages are obtained such as, but not limited to, reduction in space, weight, power requirements and costs. In another embodiment, the number of iterations corresponding to the Quadratic Koch Island may be less than or equal to 5. Consequently, the heat exchange device may function as a non-compact heat exchanger.

It may be shown with heat transfer analysis that heat transfer and heat transfer coefficient increase independently of each other with every application of the fractal. Further, the increase may be double, or greater, with every fractal iteration. In general, the increase in heat transfer follows a trend of $2^n$. Moreover, pumping power increases at almost one and a half the rate. Pumping power is the power needed to pump the heat transfer fluid through the heat exchange device.

Figure 7A:
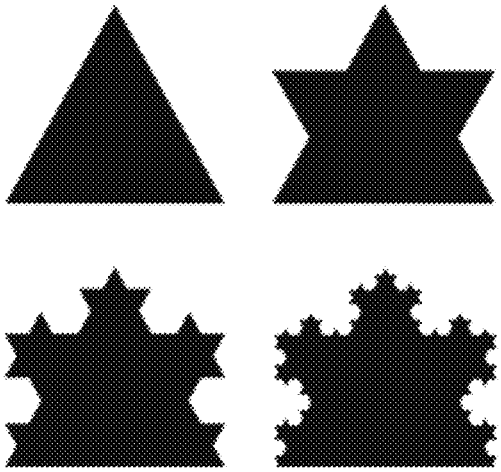
FIG. 7A illustrates a fractal heatsink that is an exemplary embodiment of the invention. In this embodiment, the heatsink is based on a modified Koch Snowflake.
Figure 7B:
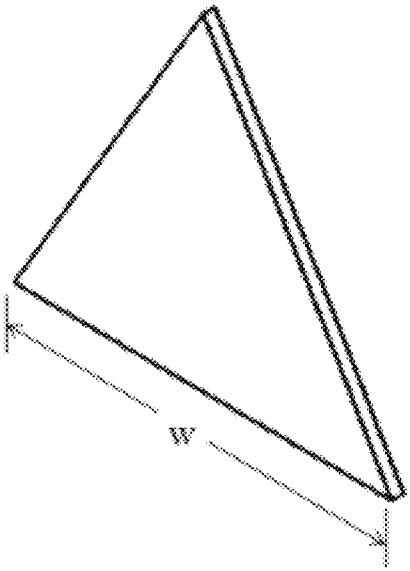
FIG. 7B illustrates the basis for generating the modified Snowflake.

In yet another embodiment of the invention, the heatsink comprises a heat exchange device which is structurally configured based on a modified Koch Snowflake as illustrated in FIG. 7A. The basis for generating the modified Snowflake is an equilateral triangle of width w as illustrated in FIG. 7B. In the first iteration, two smaller equilateral triangles of width ⅓ of the base width w are added onto two sides of the base triangle. Similarly, by applying a second and a third iteration, the modified Koch Snowflakes as illustrated in FIG. 7A may be obtained.

The surface area, $A_s(n)$, of the modified Koch Snowflake may be obtained from eq. 10.

$$A_s(n) = 2\left(wt + \frac{\sqrt{3}}{4}w^2\right) + \sum_1^n \left[\left(\frac{w}{3^n}\right)^2\left(\frac{\sqrt{3}}{2}\right) + \left(\frac{w}{3^n}\right)t\right]2^{2n-1} \tag{10}$$

where, w is the width of the base triangle n is the number of iterations t is the thickness of the modified Koch Snowflake It is evident that the surface area of the modified Koch Snowflake increases with each iteration. More specifically, it may be observed that after 5 iterations there is an increase in surface area of about 58%.

Further, the mass of the modified Koch Snowflake may be obtained using eq. 11.

$$m(n) = \left\{\frac{\sqrt{3}}{4}w^2 + \sum_1^n \left[\left(\frac{w}{3^n}\right)^2\left(\frac{\sqrt{3}}{4}\right)\right]2^{2n01}\right\}\rho t \tag{11}$$

where, w, n, and t are as above, and ρ is the density of the material making up the modified Koch Snowflake.

It may be observed that the change in surface area with respect to the baseline case (i.e., n=0) is a function of width (w) and thickness (t). However, the change in mass with respect to the baseline is dependent on the fractal geometry chosen. The mass of the modified Koch Snowflake increases with each iteration. However, it converges to a maximum value of mass increase of approximately 40%.

A heat transfer effectiveness (ε) of the modified Koch Snowflake may be defined as the ratio of heat transfer achieved to heat transfer that would occur if the modified Koch Snowflake was not present. ε may be calculated from eq. 13.

$$\varepsilon = \frac{\dot{Q}_c}{hA_b(T_b - T_\infty)} \tag{13}$$

where, $\dot{Q}$ is the heat rate h is the heat transfer co-efficient

A is the area

T is the temperature

Further, a heat transfer efficiency (η) of the modified Koch Snowflake may be defined as the ratio of heat transfer achieved to the heat transfer that would occur if the entire modified Koch Snowflake was at the base temperature. η may be calculated from eq. 12.

$$\eta = \frac{\dot{Q}_c}{hA_S(T_b - T_\infty)} \tag{12}$$

where, $\dot{Q}$, h, A, and T are as above.

The heat transfer effectiveness (ε) increases with each iteration. In an embodiment, the modified Koch Snowflake corresponding to three iterations may be used to form the heat exchange device. Accordingly, in this case, the heat transfer effectiveness (ε) may increase by up to 44.8%. Further, the increase in heat transfer effectiveness (ε) per mass may be up to 6%. In one embodiment, the material used to make the modified Koch Snowflake may be aluminum. Consequently, heat transfer effectiveness (ε) per mass of approximately two times larger than that obtained using copper may be achieved.

Further, the heat transfer effectiveness (ε) per mass depends on the thickness of the modified Koch Snowflake. In an embodiment, the ratio of width (w) to thickness (t) corresponding to the modified Koch Snowflake may be 8. Accordingly, an increase in heat transfer effectiveness (ε) per mass of up to 303% may be achieved at the fourth iteration.

Figure 8A:
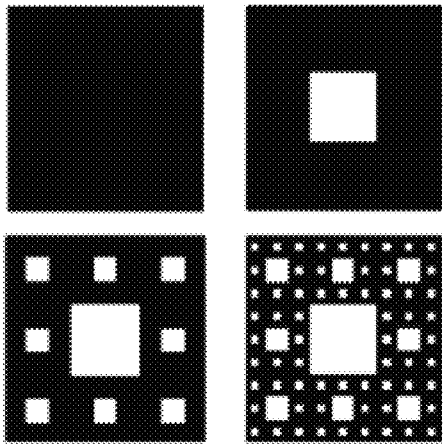
FIG. 8A illustrates a fractal heatsink that is an exemplary embodiment of the invention. In this embodiment, the heatsink is based on a Sierpinski Carpet.
Figure 8B:
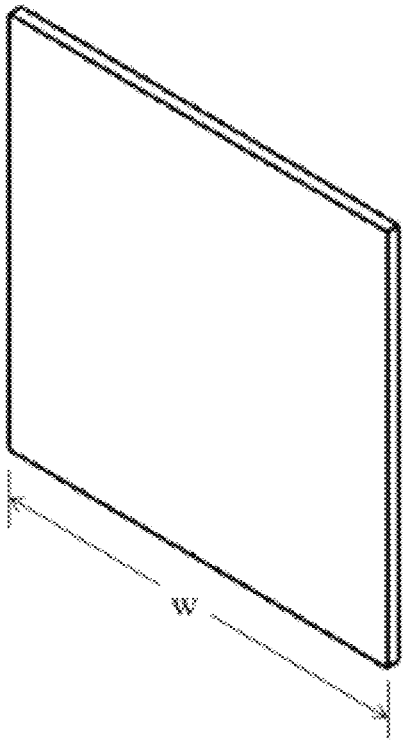
FIG. 8B illustrates the basis for generating the Sierpinski Carpet.

In yet another embodiment of the invention, the heatsink comprises a heat exchange device which is structurally configured based on a Sierpinski Carpet as illustrated in FIG. 8A. The Sierpinski Carpet is formed by iteratively removing material from a base geometry such as, but not limited to, a square as illustrated in FIG. 8B. In the first iteration, a square with ⅓ of the base width (w) is removed. Similarly, by performing second and third iterations, the Sierpinski Carpets as illustrated in FIG. 8A may be obtained.

The surface area, $A_s(n)$, of the Sierpinski Carpet may be obtained from eq. 13.

$$A_s(n) = 2w^2 + 3wt - \sum_1^n 8^{n-1}\left[2\left(\frac{w}{3^n}\right)^2 - 4\left(\frac{w}{3^n}\right)t\right] \tag{13}$$

where, w is the width of the base square n is the number of iterations t is the thickness of the Sierpinski Carpet Starting from n=0, with each subsequent iteration, the surface area of the Sierpinski carpet initially reduces before reaching a minimum. However, after reaching the minimum, the surface area increases with each subsequent iteration. For example, at a width (w) of 0.0508 m an increase in surface area of 117% may be obtained after five iterations. Similarly, at a width (w) of 0.0254 m, a surface area increase of 265% may be obtained after five iterations.

Further, the mass of the Sierpinski Carpet may be obtained using eq. 14.

$$m(n) = \left\{w^2 - \sum_1^n \left[8^{n-1}\left(\frac{w}{3^n}\right)^2\right]\right\}\rho t \tag{14}$$

where w, n, and t are as above, and p is the density of the material making up the Sierpinski carpet It may be seen from eq. 11 that with each iteration, the mass of the Sierpinski carpet decreases. For example, after five iterations, there is a reduction of 45% of mass of the Sierpinski carpet.

The heat transfer effectiveness (e) corresponding to the Sierpinski carpet increases with each iteration. In an embodiment, the Sierpinski carpet corresponding to three iterations may be used to form the heat exchange device. Accordingly, in this case, the heat transfer effectiveness (ε) may increase by up to 11.4%. Further, the increase in heat transfer effectiveness (ε) per mass corresponding to the Sierpinski carpet may be up to 59%. In one embodiment, the material used to make the Sierpinski carpet may be aluminum. Consequently, heat transfer effectiveness (ε) per mass of approximately two times larger than that obtained using copper may be achieved.

Further, the heat transfer effectiveness (ε) per mass corresponding to the Sierpinski carpet depends on the thickness of the corresponding to the Sierpinski carpet. In an embodiment, the ratio of width (w) to thickness (t) corresponding to the corresponding to the Sierpinski carpet may be 8. Accordingly, an increase in heat transfer effectiveness (ε) per mass of up to 303% may be achieved at the fourth iteration.

In other embodiments, the heatsink may comprise a heat exchange device which is structurally configured based on, but not limited to, one or more fractals selected from the group comprising: A "scale 2" and "scale 3" Mandelbox; Sierpinski tetrahedron; Fractal pyramid; Dodecahedron fractal; 3D quadratic Koch surface (type 1); 3D quadratic Koch surface (type 2); Jerusalem cube; Icosahedron fractal; Octahedron fractal; Von Koch surface; Menger sponge; 3D H-fractal; and Mandelbulb.

Figure 9:
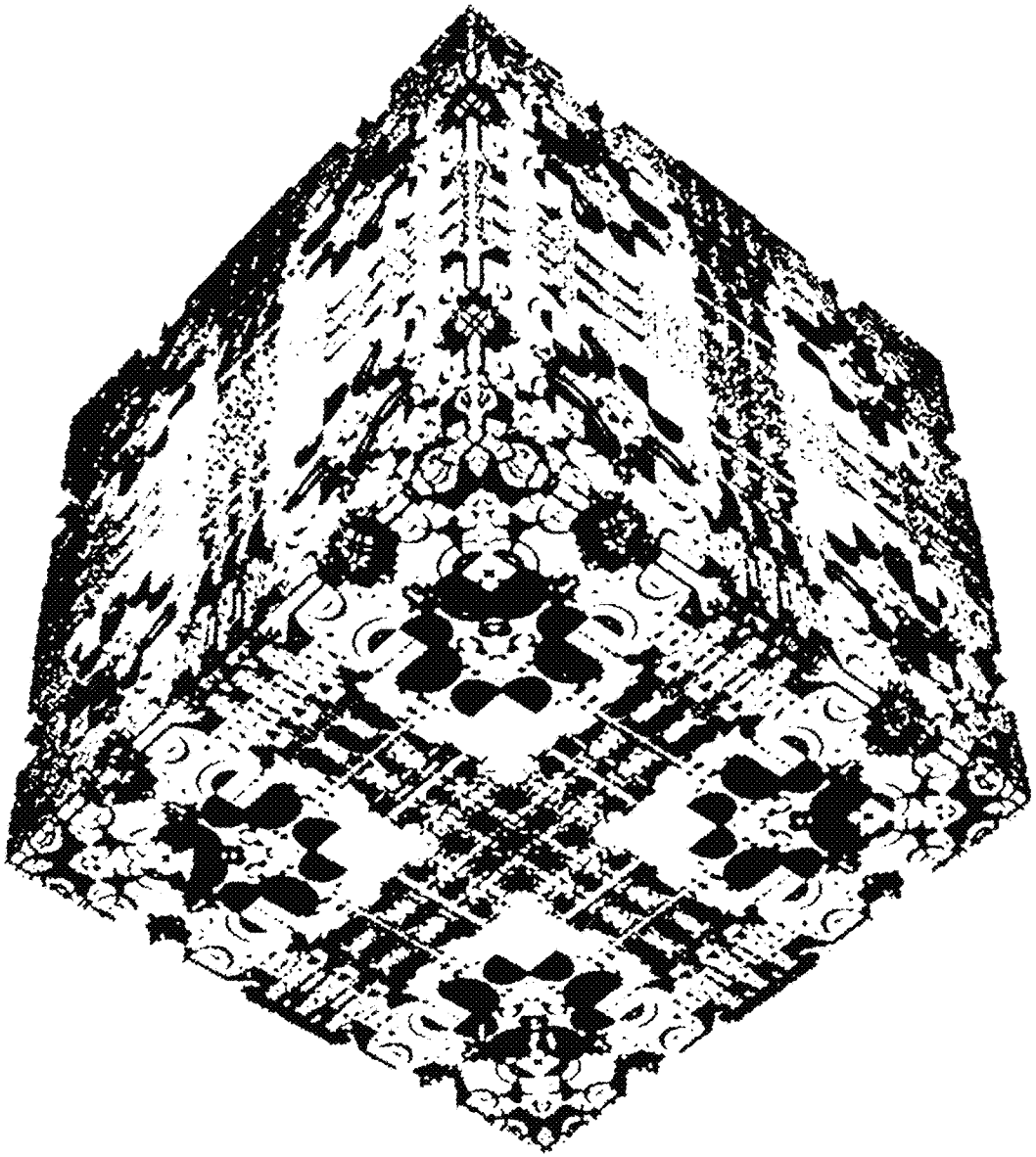
FIG. 9 illustrates a fractal heatsink that is an exemplary embodiment of the invention. In this embodiment, the heatsink is based on a Mandelbox.

In accordance with an embodiment, the heatsink may comprise a heat exchange device which is structurally configured based on a Mandelbox as exemplarily illustrated in FIG. 9. A Mandelbox is a box-like fractal object that has similar properties as that of the Mandelbrot set. It may be considered as a map of continuous, locally shape preserving Julia sets. Accordingly, the Mandelbox varies at different locations, since each area uses a Julia set fractal with a unique formula. The Mandelbox may be obtained by applying eq. 15 repeatedly to every point in space.

That point v is part of the Mandelbox if it does not escape to infinity.

$$v=s*\text{ballFold}(r_i,f*\text{boxFold}(v))+c \tag{15}$$

where boxFold(v) means for each axis a:

if v[a]>1 v[a]=2−v[a]

else if v[a]<−1 v[a]=−2−v[a]

and ballFold(r, v) means for v's magnitude m:

if m<r m=m/$r^2$ else if m<1 m=1/m

In an instance, using the values of s=2, r=0.5 and f=1 in eq.12, the standard Mandelbox may be obtained.

Figure 10:
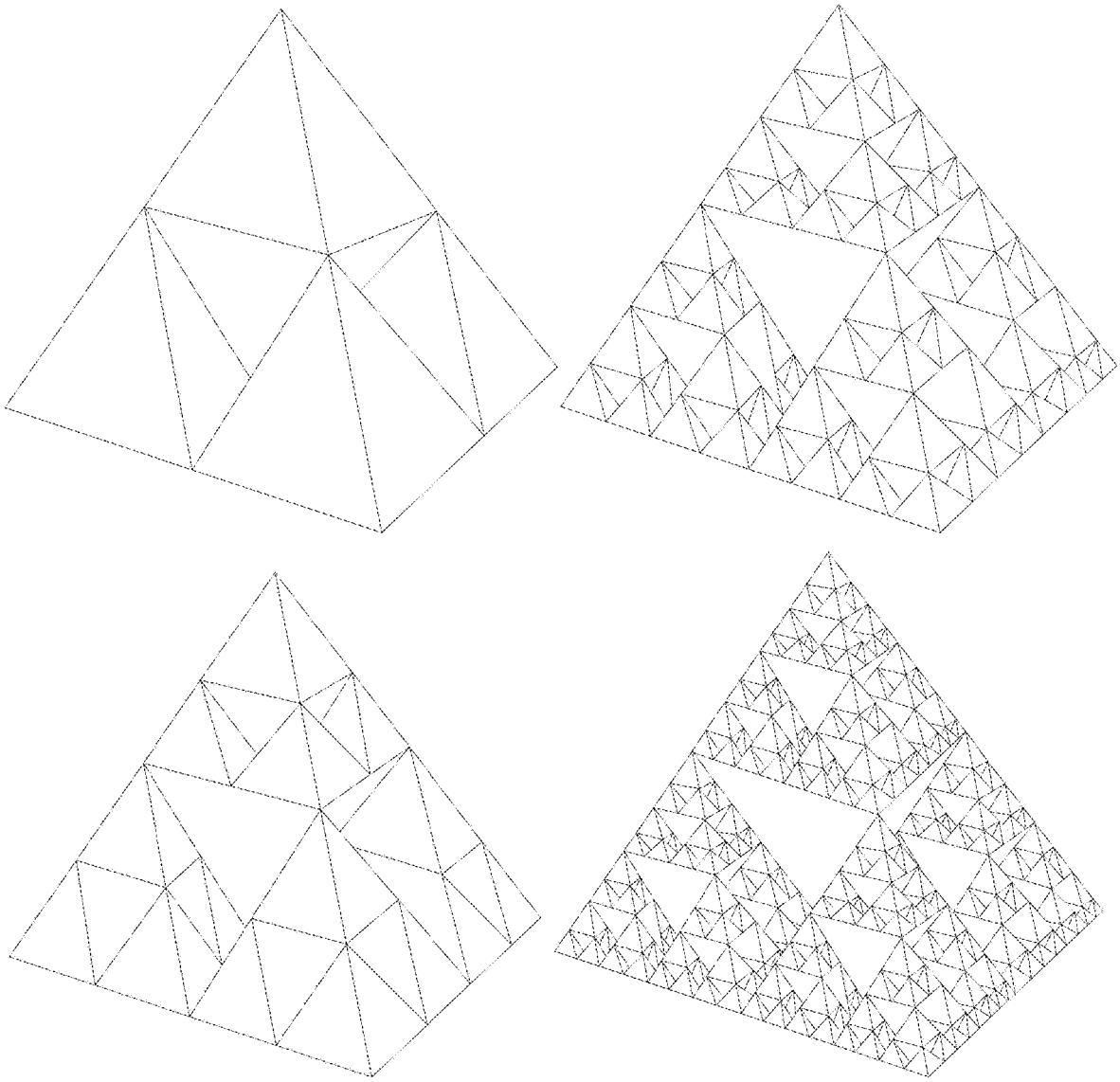
FIG. 10 illustrates a fractal heatsink that is an exemplary embodiment of the invention. In this embodiment, the heatsink is based on a Sierpinski tetrahedron.

In accordance, with another embodiment, the heatsink may comprise a heat exchange device which is structurally configured based on a Sierpinski tetrahedron. The Sierpinski tetrahedron, also called as tetrix, is a three-dimensional analogue of the Sierpinski triangle. The Sierpinski tetrahedron may be formed by repeatedly shrinking a regular tetrahedron to one half its original height, putting together four copies of this tetrahedron with corners touching, and then repeating the process. This is illustrated in FIG. 10 for the first four iterations. The Sierpinski tetrahedron constructed from an initial tetrahedron of side-length L has the property that the total surface area remains constant with each iteration.

The initial surface area of the (iteration-0) tetrahedron of side-length L is $L^2\sqrt{3}$. At the next iteration, the side-length is halved and there are 4 such smaller tetrahedra. Therefore, the total surface area after the first iteration may be calculated by eq. 16.

$$4\left(\left(\frac{L}{2}\right)^2\sqrt{3}\right)=4\frac{L^2}{4}\sqrt{3}=L^2\sqrt{3} \tag{16}$$

This remains the case after each iteration. Though the surface area of each subsequent tetrahedron is ¼ that of the tetrahedron in the previous iteration, there are 4 times as many—thus maintaining a constant total surface area. However, the total enclosed volume of the Sierpinski tetrahedron decreases geometrically, with a factor of 0.5, with each iteration and asymptotically approaches 0 as the number of iterations increases.

Figure 11:
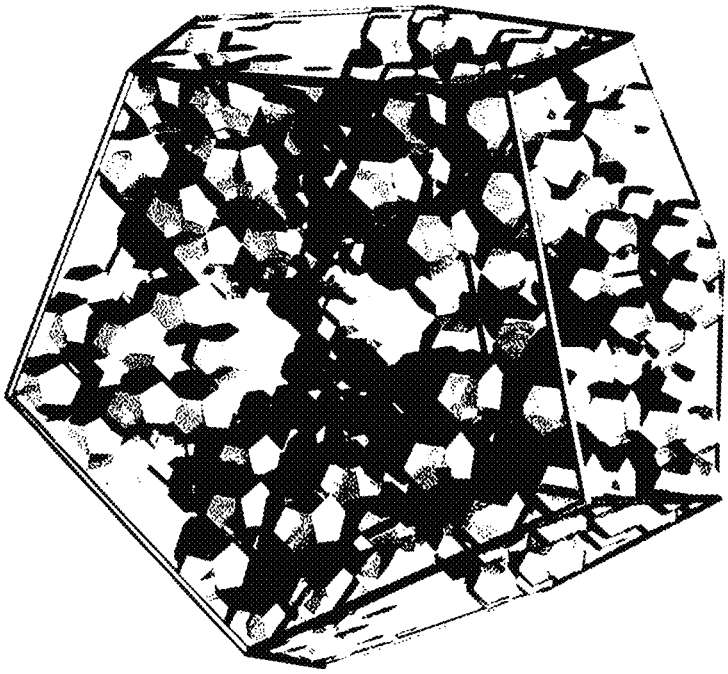
FIG. 11 illustrates a fractal heatsink that is an exemplary embodiment of the invention. In this embodiment, the heatsink is based on a Dodecaedron fractal.

In accordance with another embodiment, the heatsink may comprise a heat exchange device which is structurally configured based on a dodecaedron fractal. The dodecahedron fractal, also called as dodecahedron flake, may be formed by successive flakes of twenty regular dodecahedrons, as exemplarily illustrated in FIG. 11 for second iteration. Each flake is formed by placing a dodecahedron scaled by $1/(2+\varphi)$ in each corner, wherein $\varphi=(1+\sqrt{5})/2$.

Figure 12:
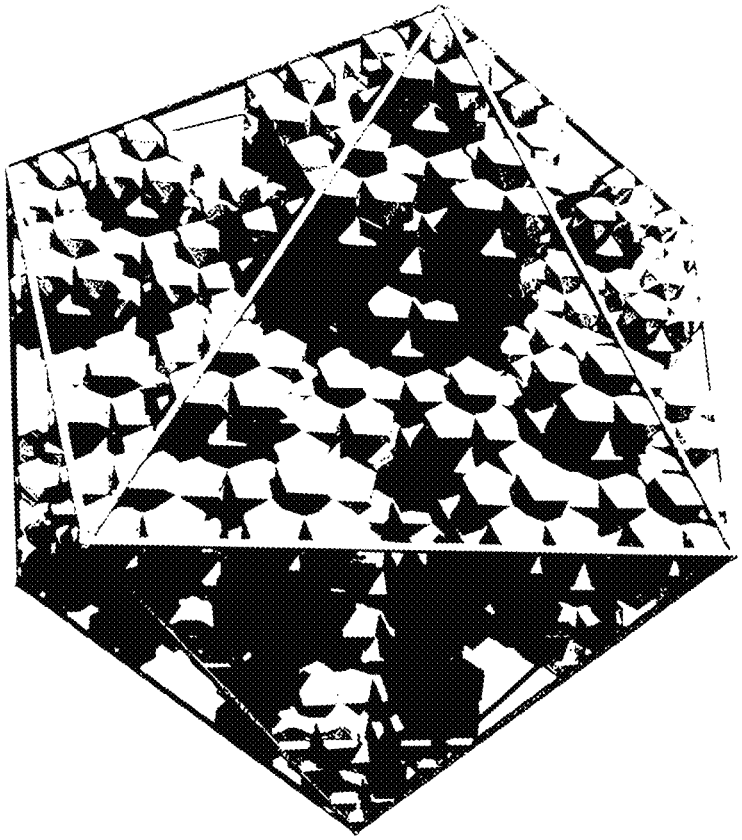
FIG. 12 illustrates a fractal heatsink that is an exemplary embodiment of the invention. In this embodiment, the heatsink is based on a Icosahedron flake.

In accordance with another embodiment, the heatsink may comprise a heat exchange device which is structurally configured based on an icosahedron flake, also called as a Sierpinski icosahedron. The icosahedron flake may be formed by successive flakes of twelve regular icosahedrons, as exemplarily illustrated in FIG. 12 for third iteration. Each flake may be formed by placing an icosahedron scaled by $1/(2+\varphi)$ in each corner, wherein $\varphi=(1+\sqrt{5})/2$.

Figure 13:
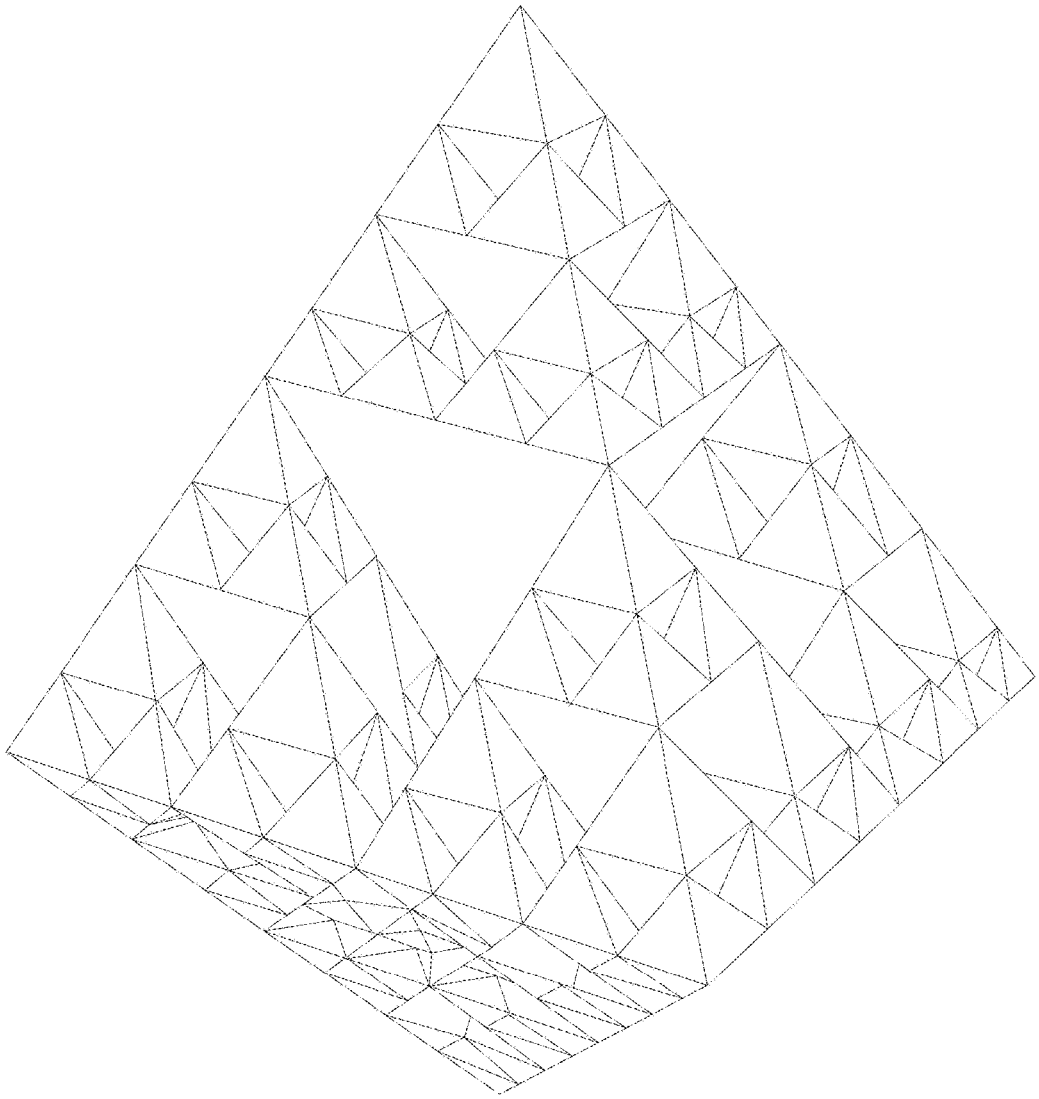
FIG. 13 illustrates a fractal heatsink that is an exemplary embodiment of the invention. In this embodiment, the heatsink is based on an Octahedron flake.

In accordance with another embodiment, the heatsink may comprise a heat exchange device which is structurally configured based on an octahedron flake. The octahedron flake, or Sierpinski octahedron, may be formed by successive flakes of six regular octahedrons, as exemplarily illustrated in FIG. 13 for third iteration. Each flake may be formed by placing an octahedron scaled by ½ in each corner.

Figure 14:
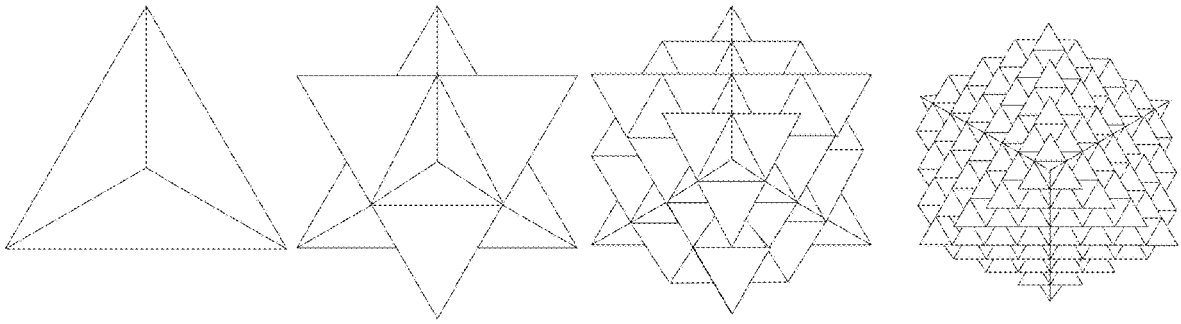
FIG. 14 illustrates a fractal heatsink that is an exemplary embodiment of the invention. In this embodiment, the heatsink is based on a 3D Quadtratic Koch.

In accordance with another embodiment, the heatsink may comprise a heat exchange device which is structurally configured based on a 3D Quadtratic Koch. As exemplarily illustrated in FIG. 14, the 3D Quadratic Koch may be obtained by growing a scaled down version of a triangular pyramid onto the faces of the larger triangular pyramid with each iteration. FIG. 14 illustrates the first four iterations.

Figure 15:
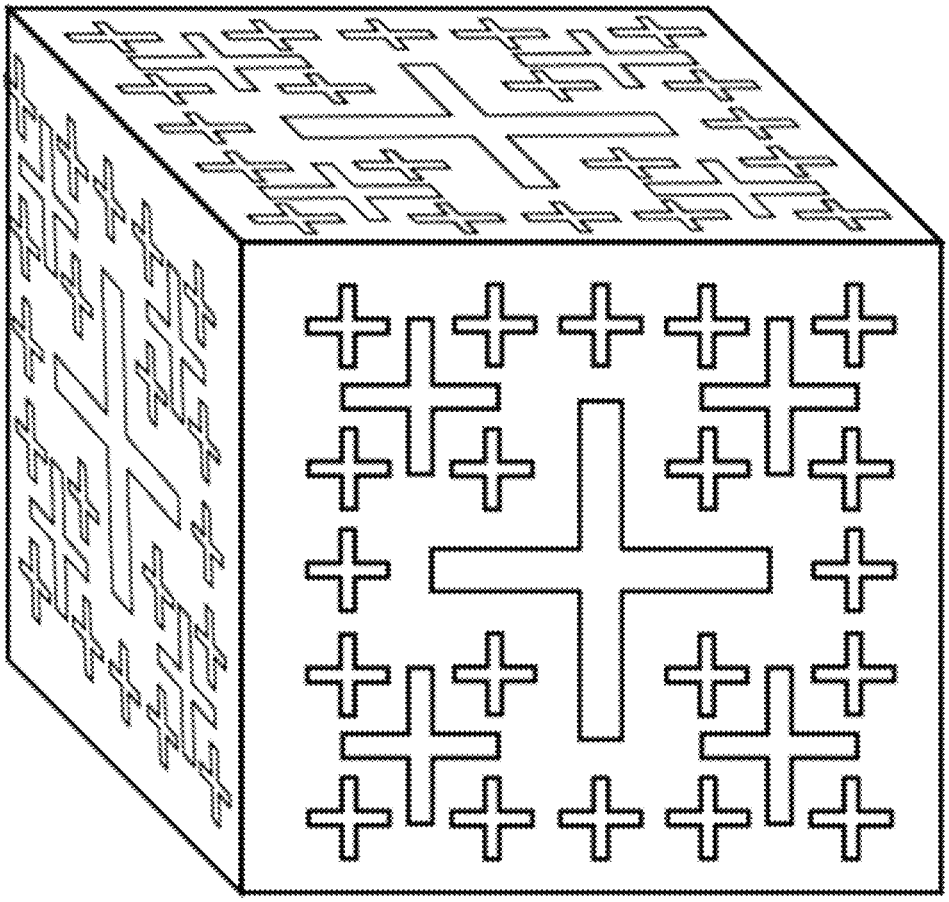
FIG. 15 illustrates a fractal heatsink that is an exemplary embodiment of the invention. In this embodiment, the heatsink is based on a Jerusalem cube.

In accordance with another embodiment, the heatsink may comprise a heat exchange device which is structurally configured based on a Jerusalem cube, as exemplarily illustrated in FIG. 15. The Jerusalem cube may be obtained by recursively drilling Greek cross-shaped holes into a cube. The Jerusalem Cube may be constructed as follows:

1. Start with a cube.
2. Cut a cross through each side of the cube, leaving eight cubes (of rank +1) at the corners of the original cube, as well as twelve smaller cubes (of rank +2) centered on the edges of the original cube between cubes of rank +1.
3. Repeat the process on the cubes of rank 1 and 2.

Each iteration adds eight cubes of rank one and twelve cubes of rank two, a twenty-fold increase.

Figure 16:
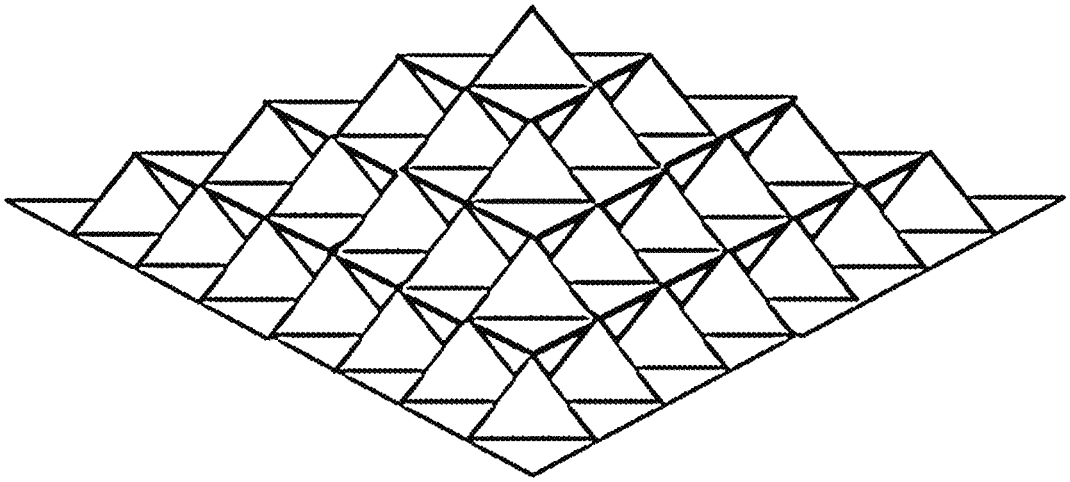
FIG. 16 illustrates a fractal heatsink that is an exemplary embodiment of the invention. In this embodiment, the heatsink is based on a von Koch surface.

In accordance with another embodiment, the heatsink may comprise a heat exchange device which is structurally configured based on a von Koch surface, as exemplarily illustrated in FIG. 16. The von Koch surface may be constructed by starting from an equilateral triangular surface. In the first iteration, the midpoints of each side of the equilateral triangular surface are joined together to form an equilateral triangular base of a hollow triangular pyramid. This process is repeated with each iteration.

Figure 17:
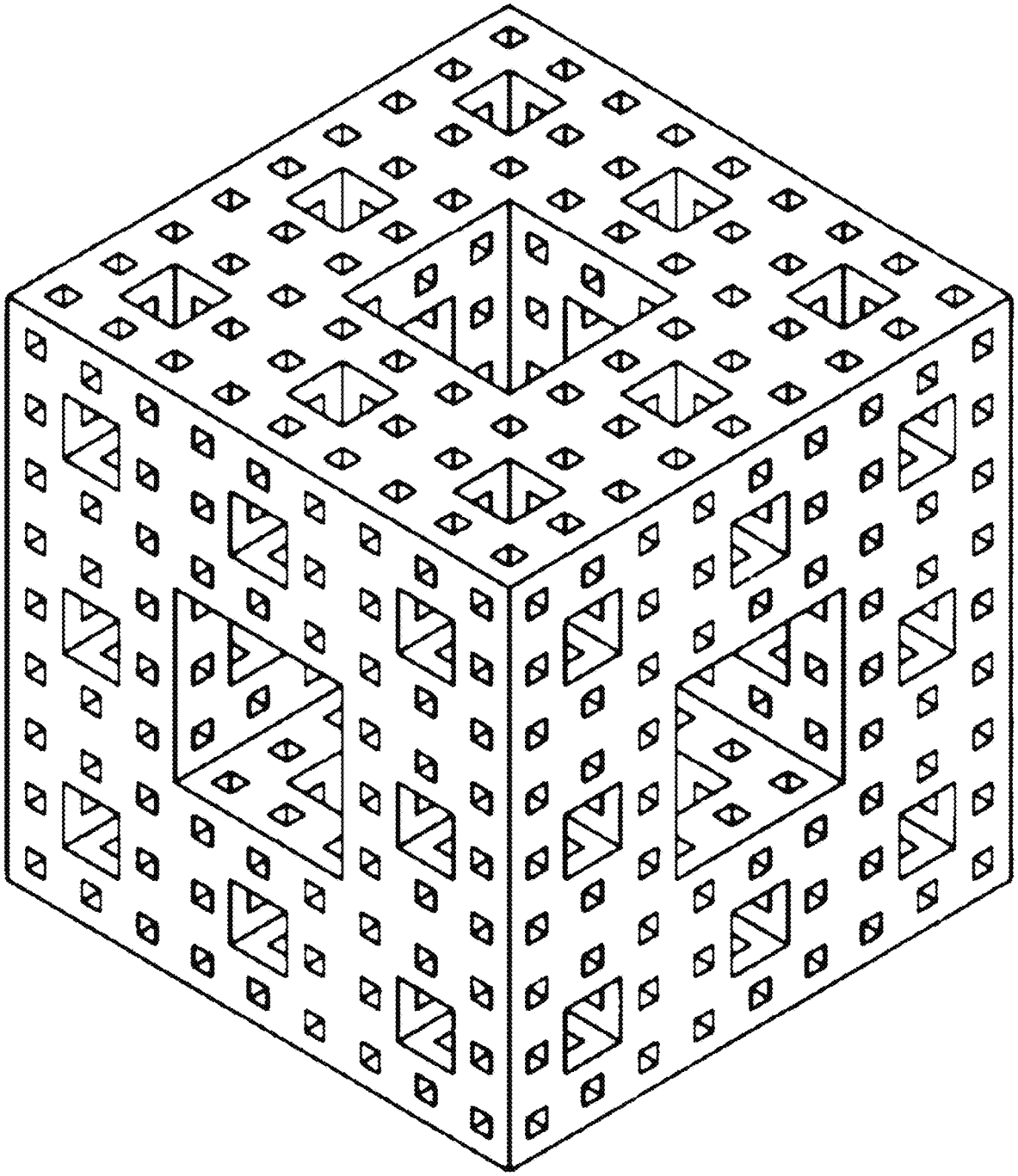
FIG. 17 illustrates a fractal heatsink that is an exemplary embodiment of the invention. In this embodiment, the heatsink is based on a Menger sponge.

In accordance with another embodiment, the heatsink may comprise a heat exchange device which is structurally configured based on a Menger sponge, as exemplarily illustrated in FIG. 17. The Menger sponge may be constructed as follows:

1. Begin with a cube (first image).
2. Divide every face of the cube into 9 squares, like a Rubik's Cube. This will sub-divide the cube into 27 smaller cubes.
3. Remove the smaller cube in the middle of each face, and remove the smaller cube in the very center of the larger cube, leaving 20 smaller cubes (second image). This is a level-1 Menger sponge (resembling a Void Cube).

4. Repeat steps 2 and 3 for each of the remaining smaller cubes, and continue to iterate ad infinitum.

Figure 18:
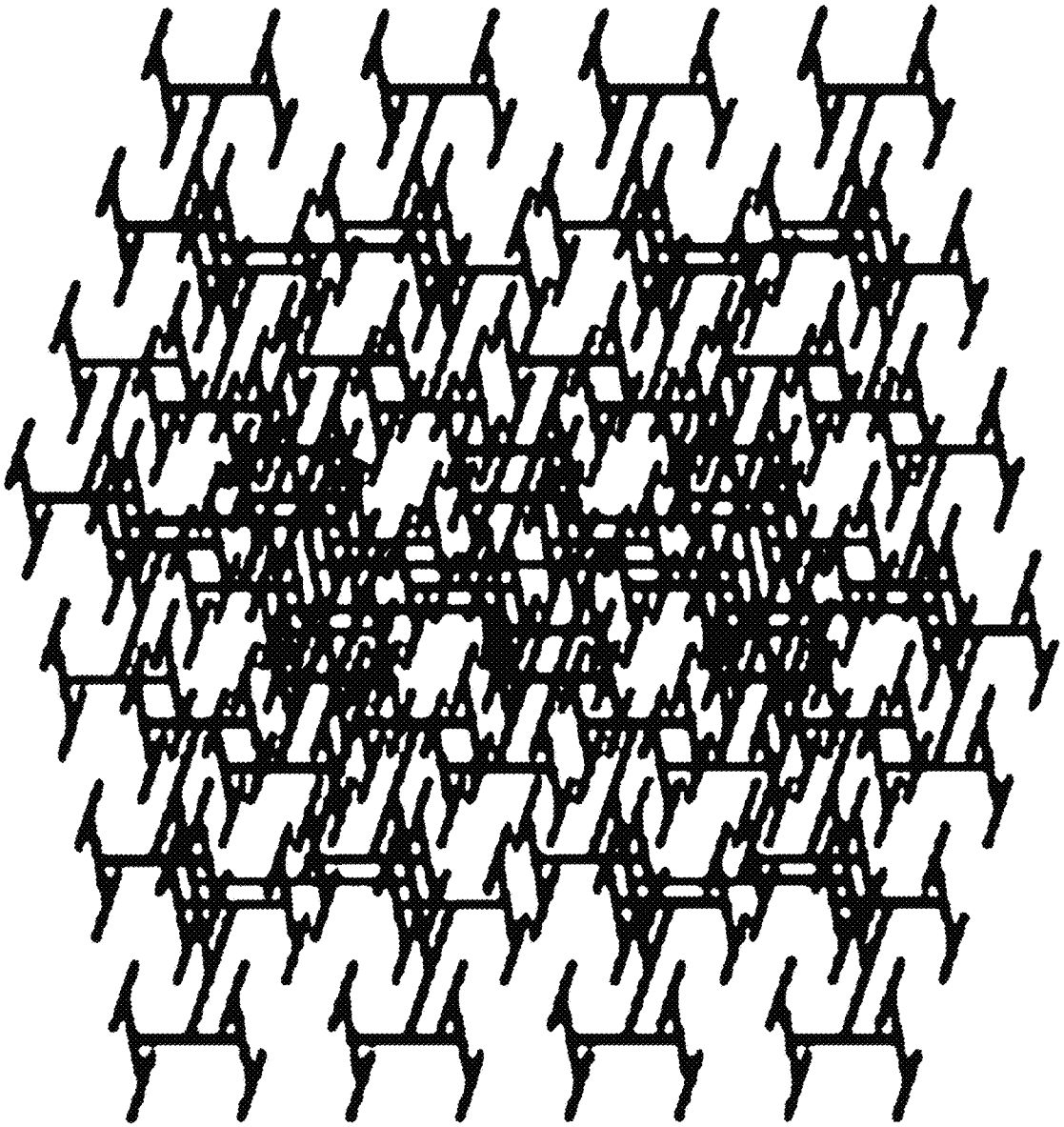
FIG. 18 illustrates a fractal heatsink that is an exemplary embodiment of the invention. In this embodiment, the heatsink is based on a 3D H fractal.

In accordance with another embodiment, the heatsink may comprise a heat exchange device which is structurally configured based on a 3D H fractal, as exemplarily illustrated in FIG. 18. The 3D H fractal is based on an H-tree which may be constructed by starting with a line segment of arbitrary length, drawing two shorter segments at right angles to the first through its endpoints, and continuing in the same vein, reducing (dividing) the length of the line segments drawn at each stage by 12. Further, by adding line segments on the direction perpendicular to the H tree plane, the 3D H fractal may be obtained.

Figure 19:
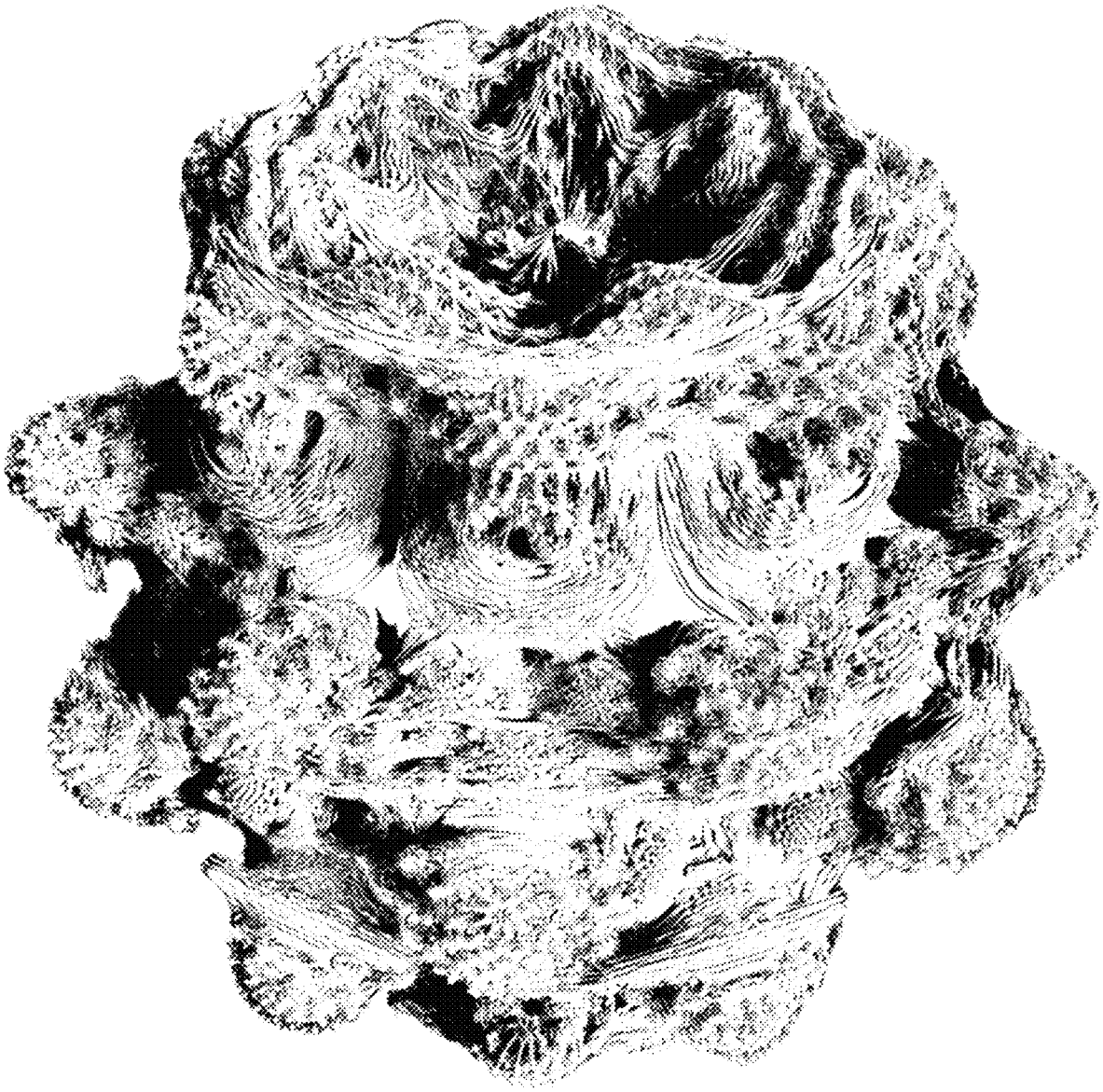
FIG. 19 illustrates a fractal heatsink that is an exemplary embodiment of the invention. In this embodiment, the heatsink is based on a Mandelbulb.
Figure 20:
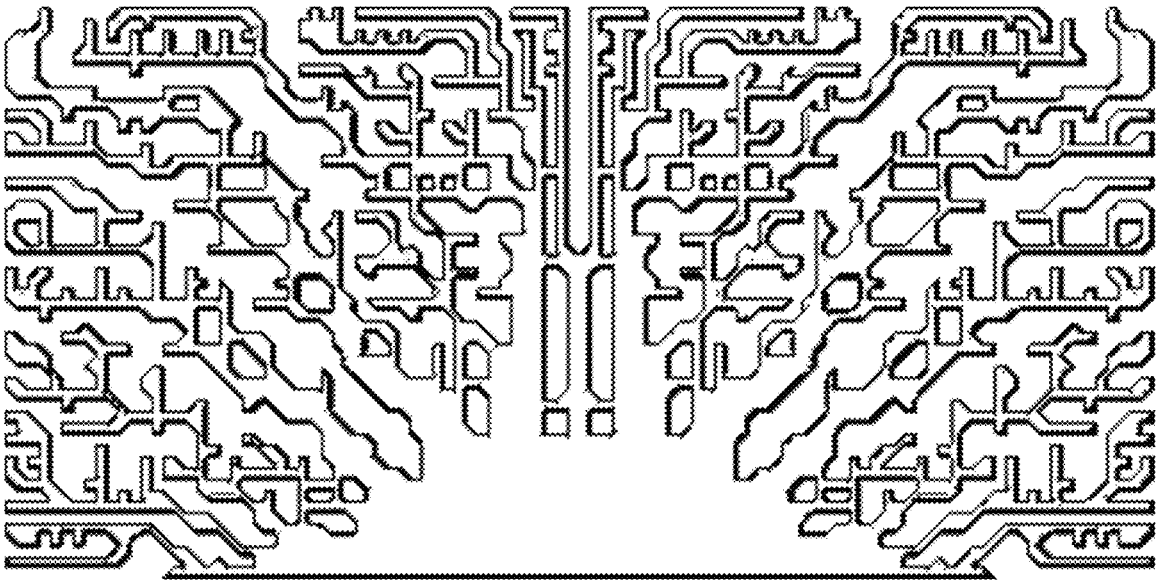
FIGS. 20-37 illustrate various heatsink designs and proposals, which may be used in conjunction with various embodiments of the technology.
Figure 21:
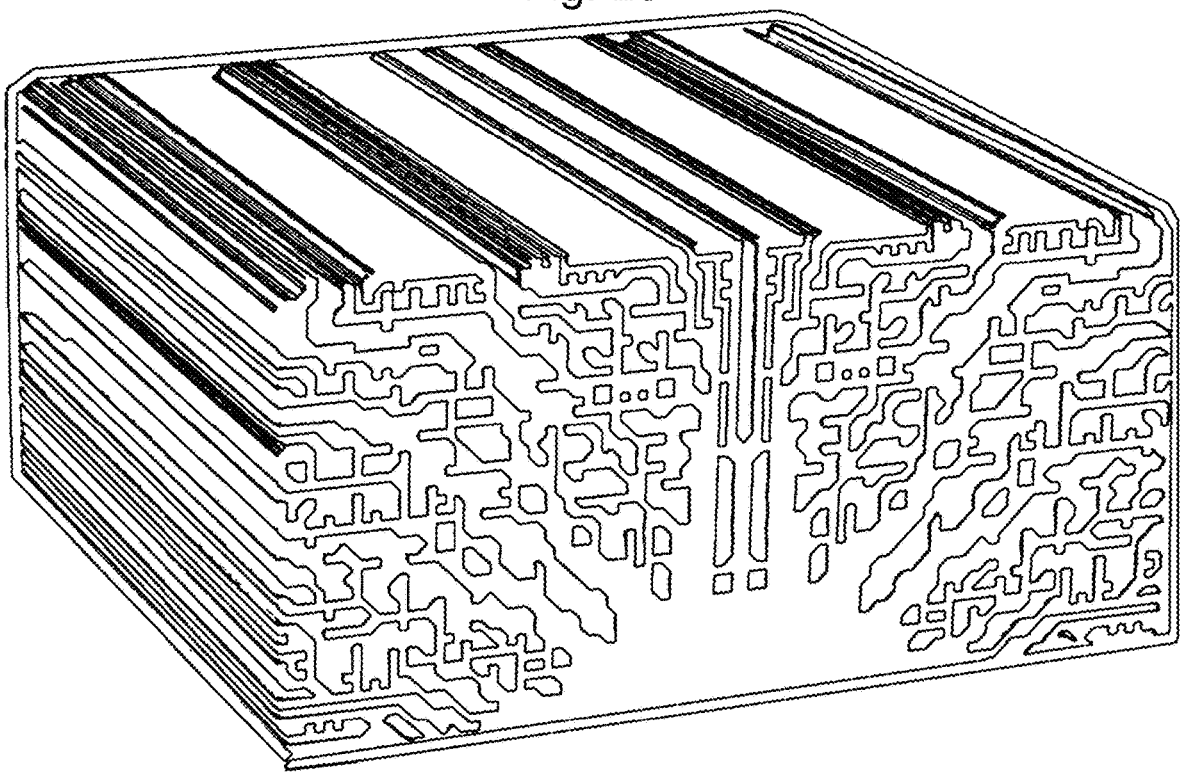
Figure 22:
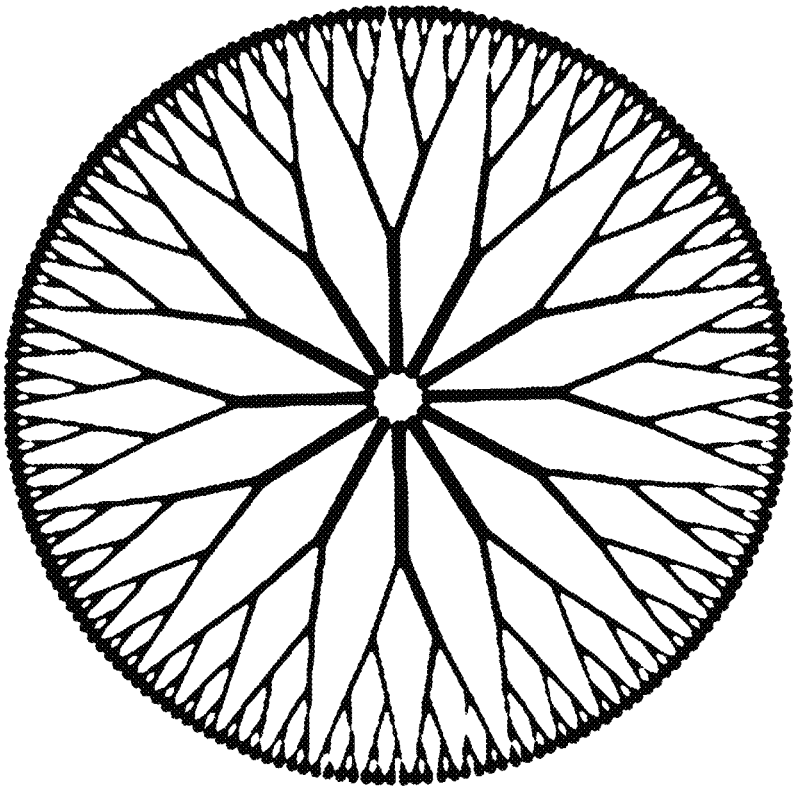
Figure 23:
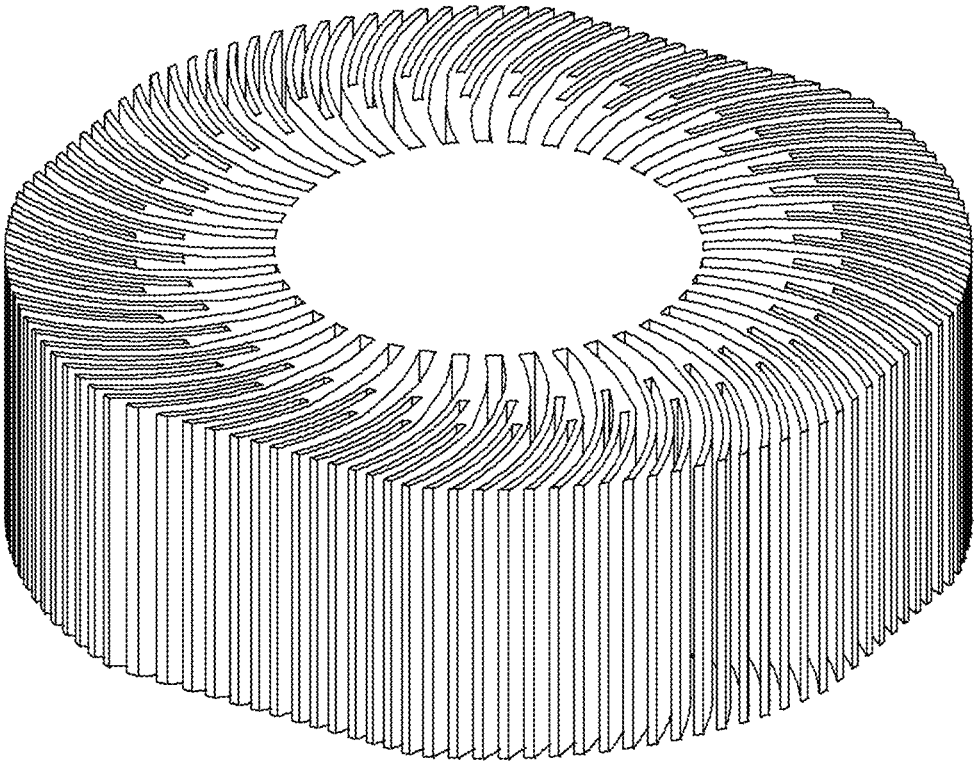
Figure 24:
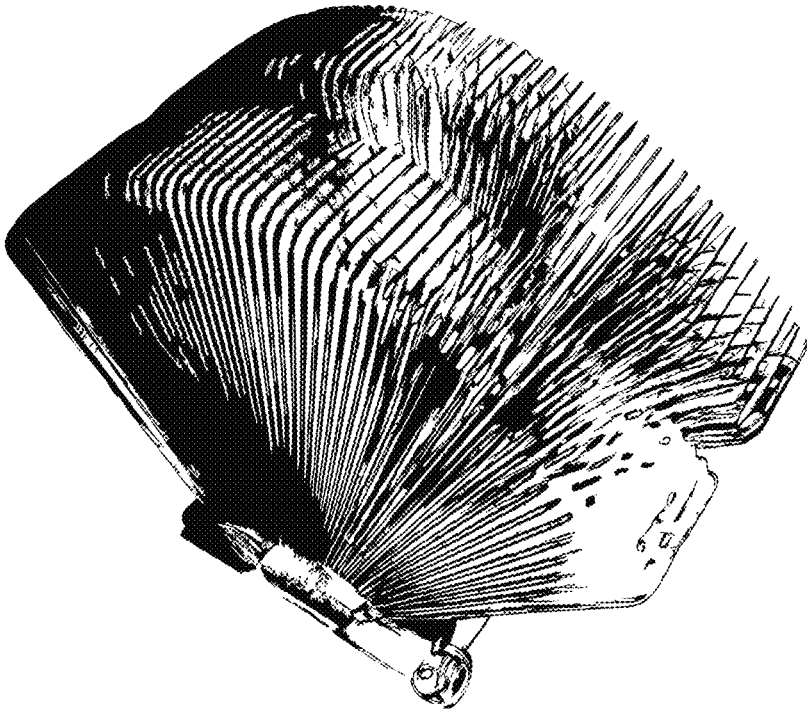
Figure 25:
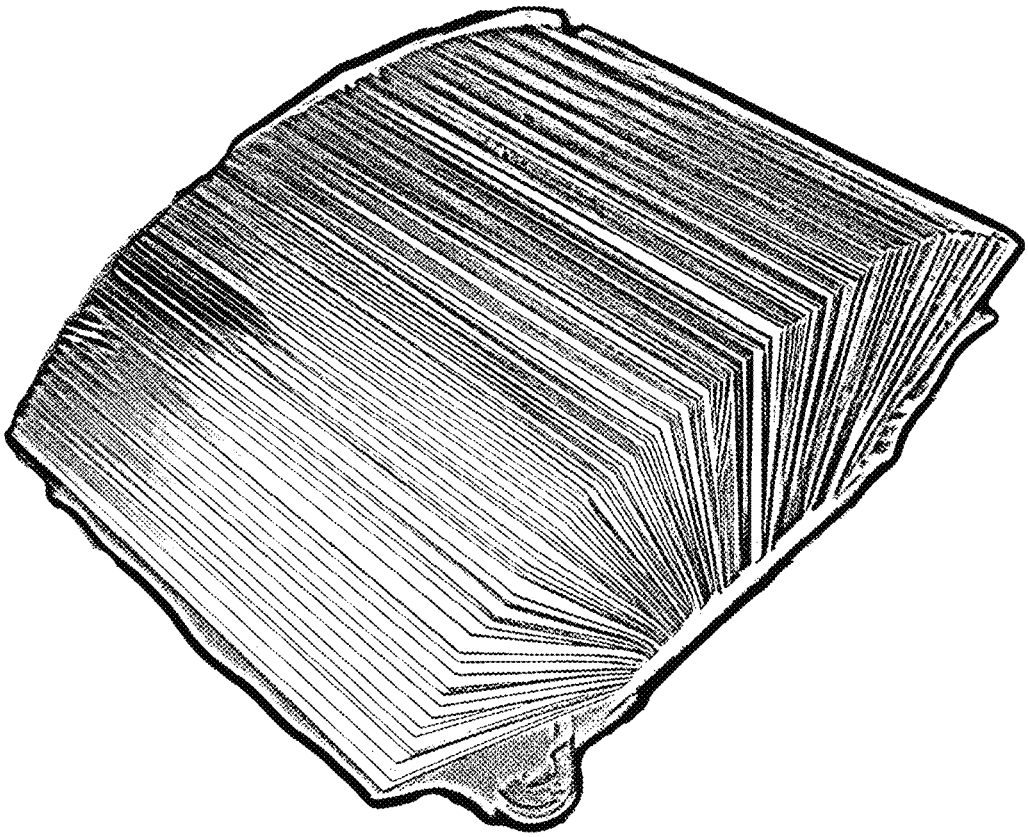
Figure 26:
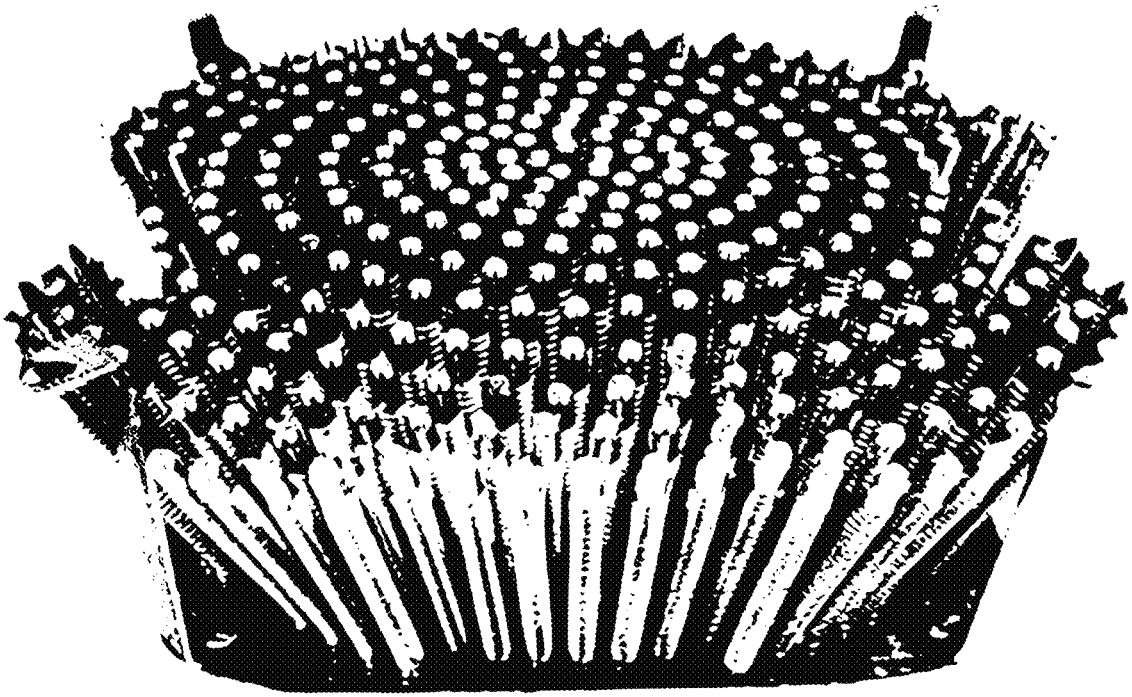
Figure 27:
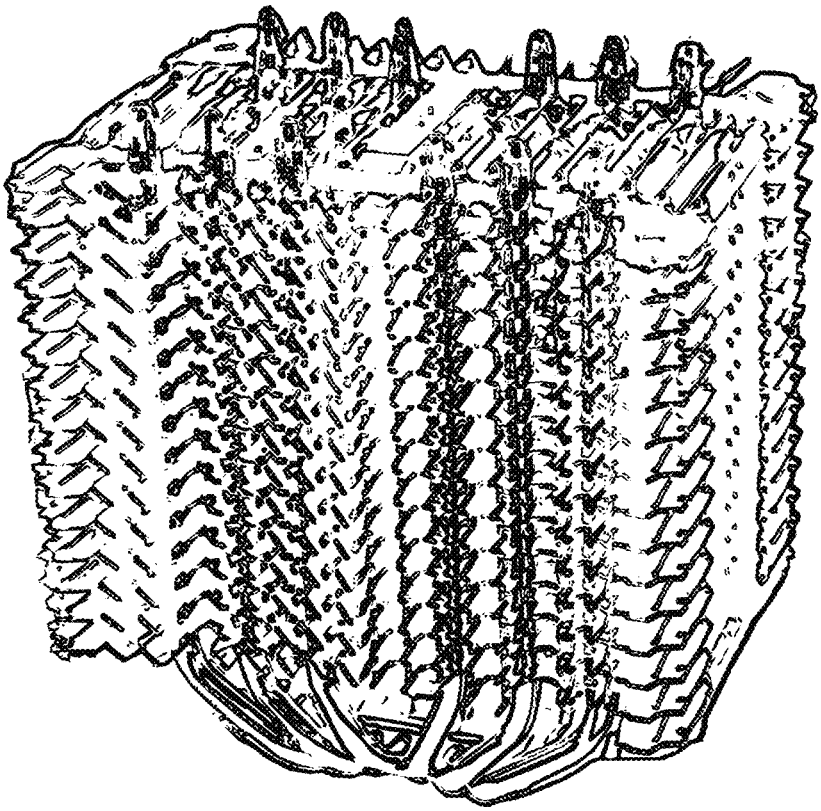
Figure 28:
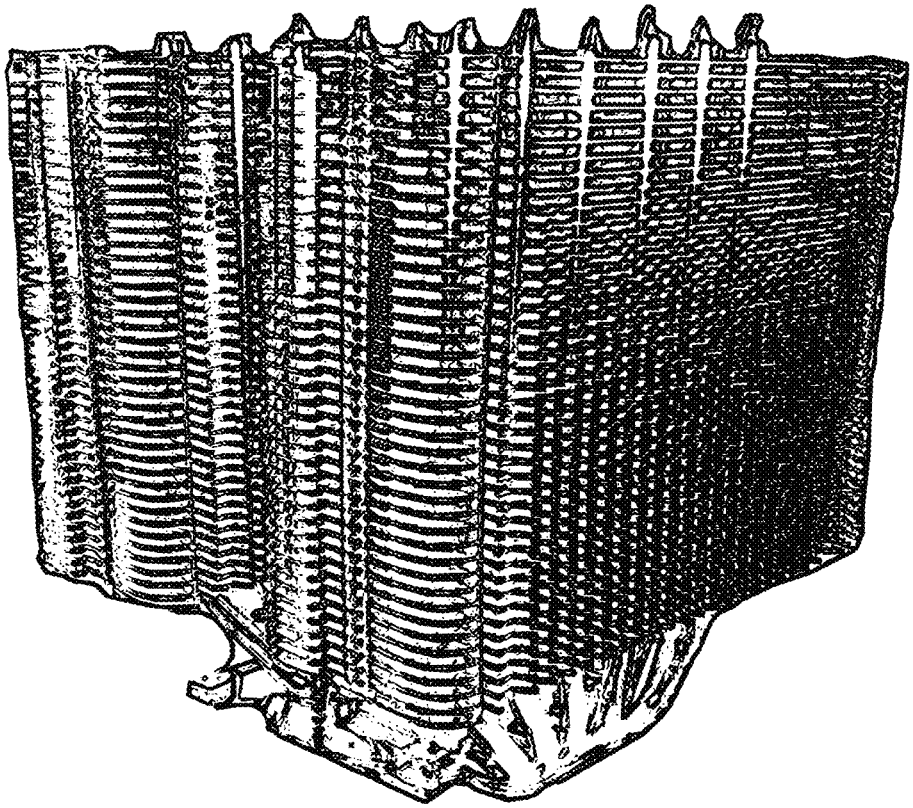
Figure 29:
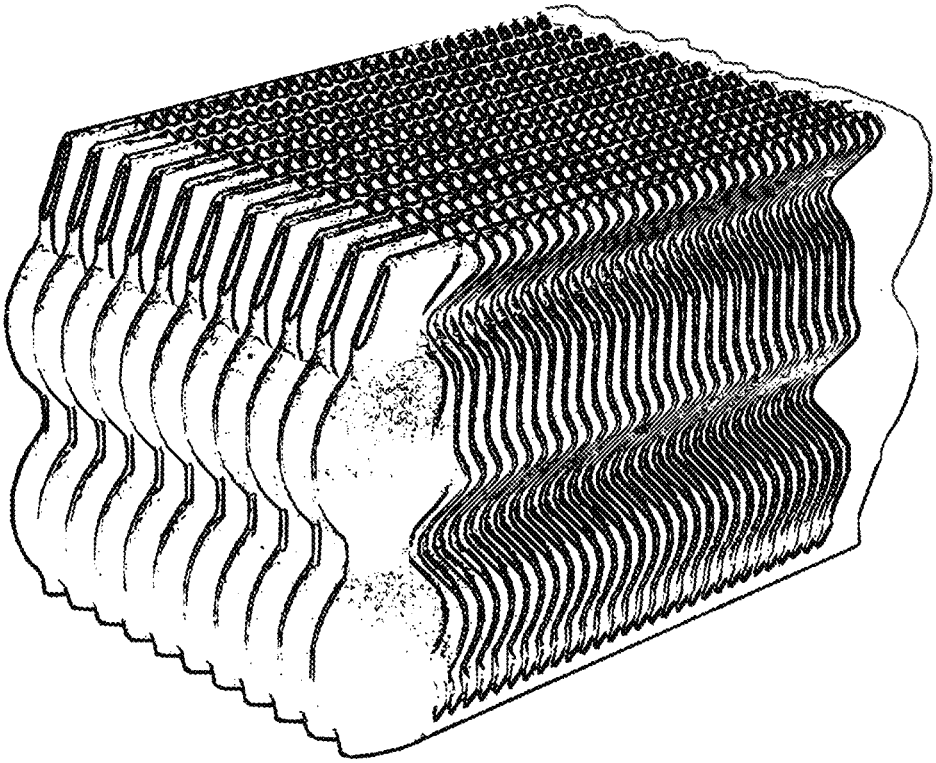
Figure 30:
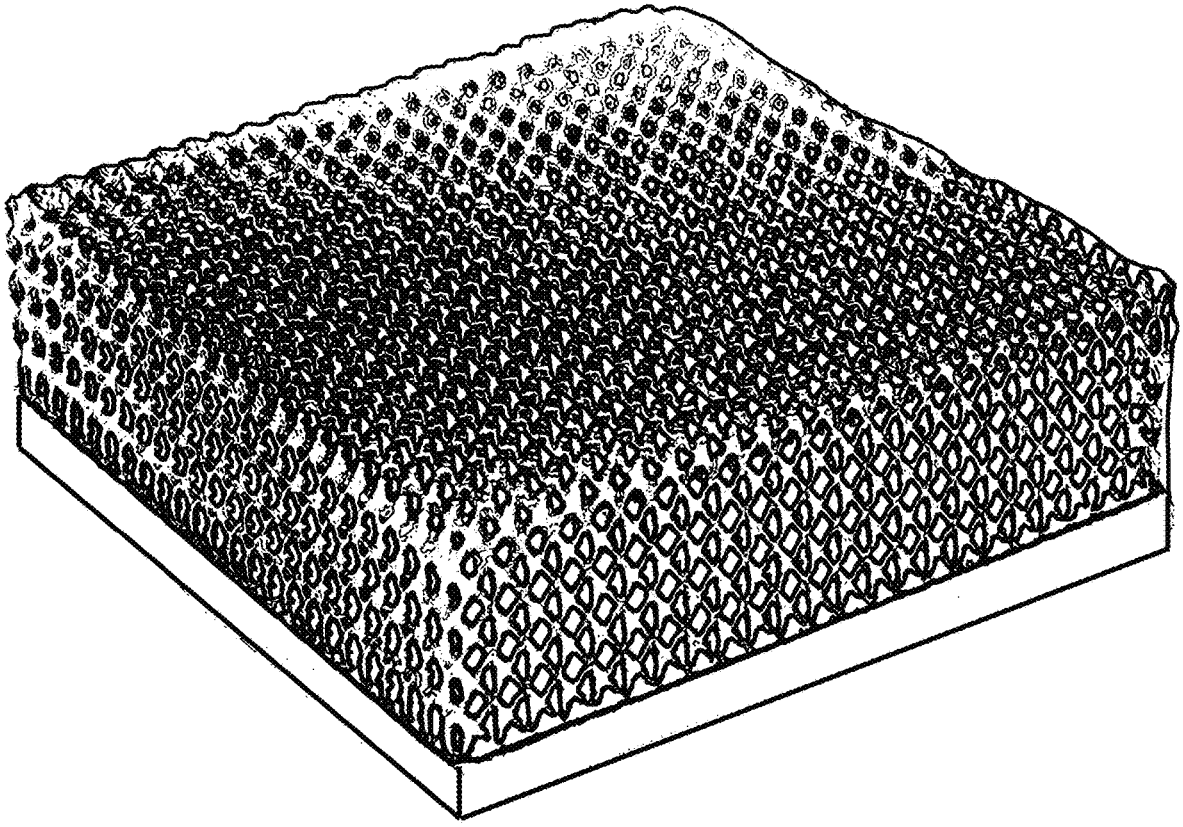
Figure 31:
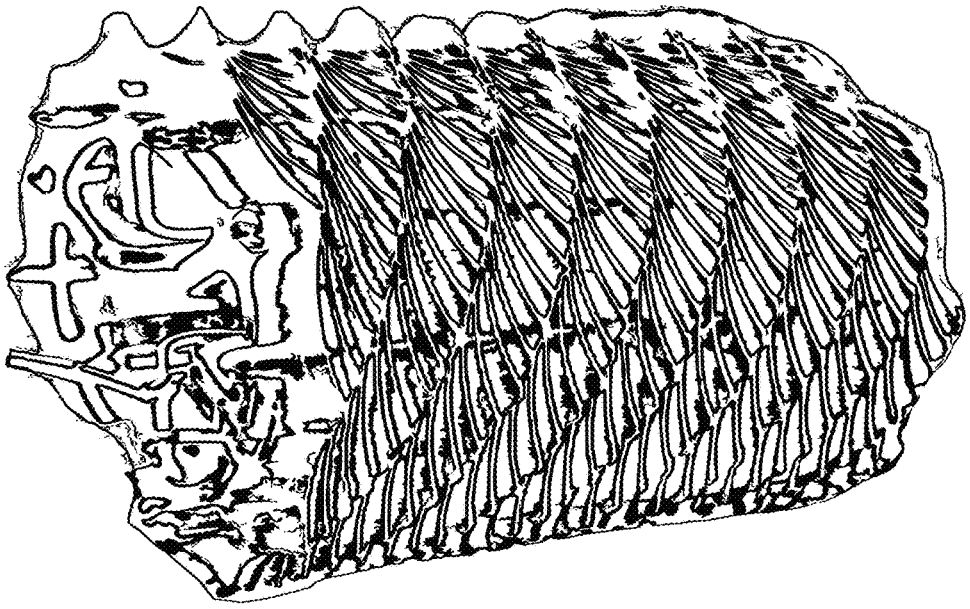
Figure 32:
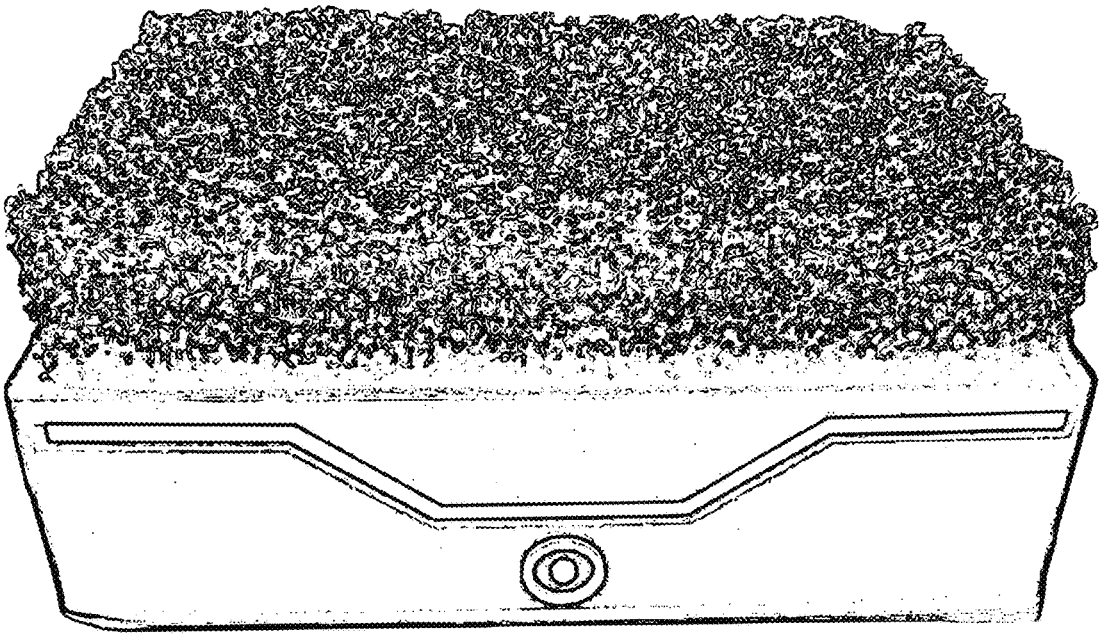
Figure 33:
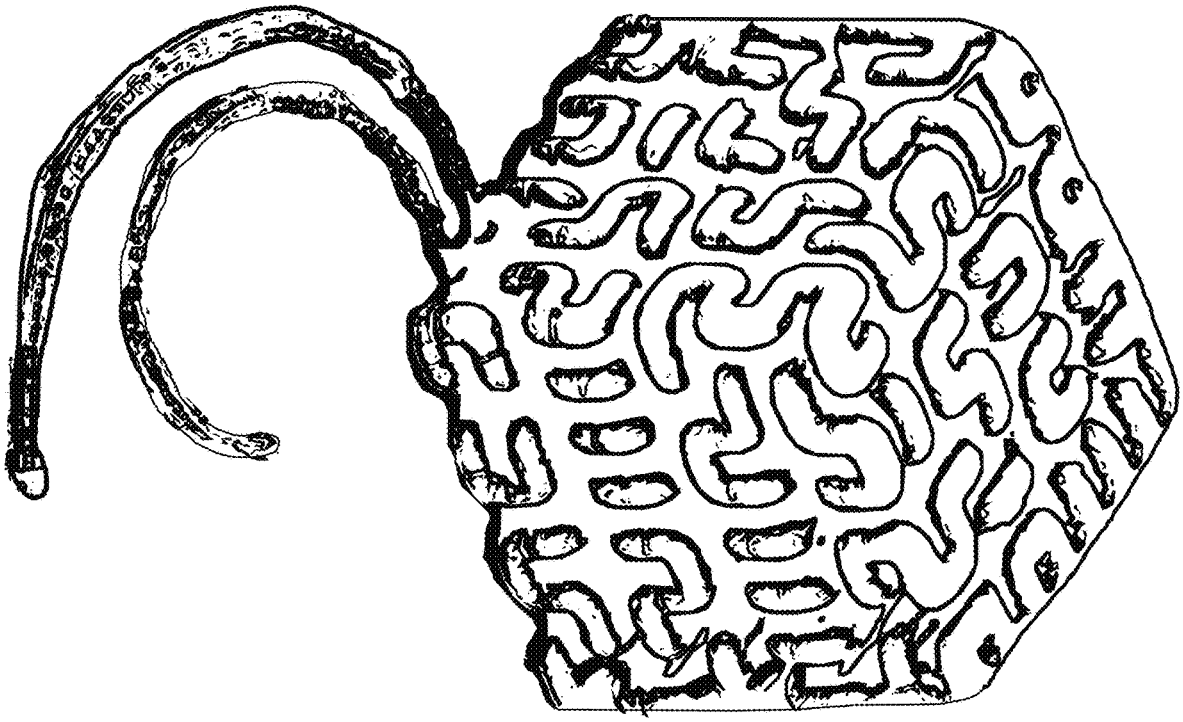
Figure 34:
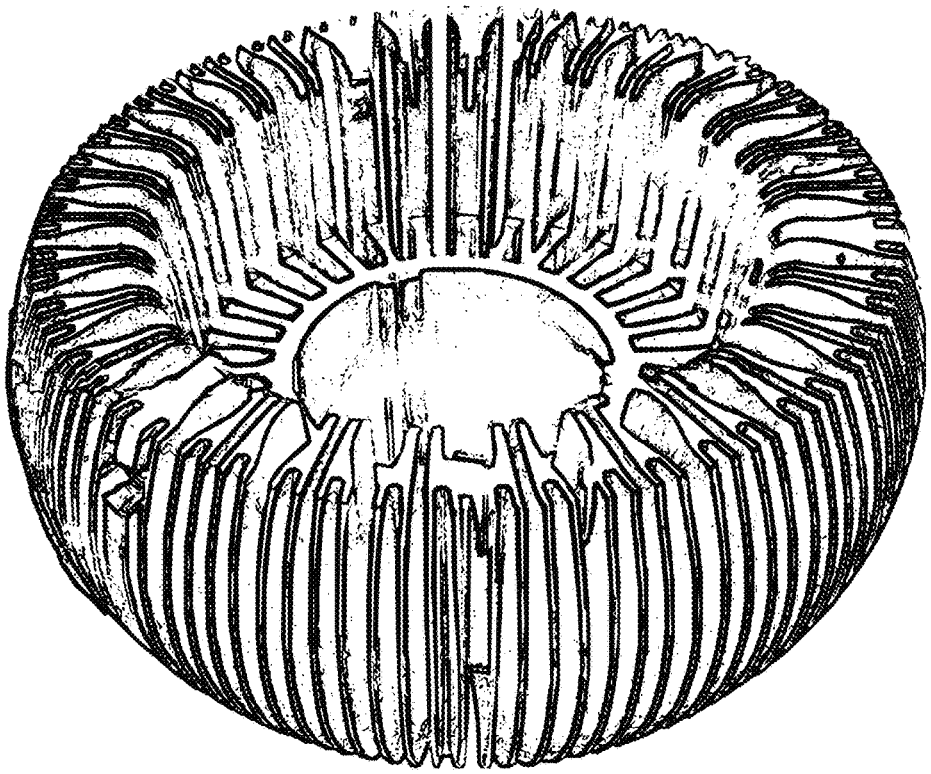
Figure 35:
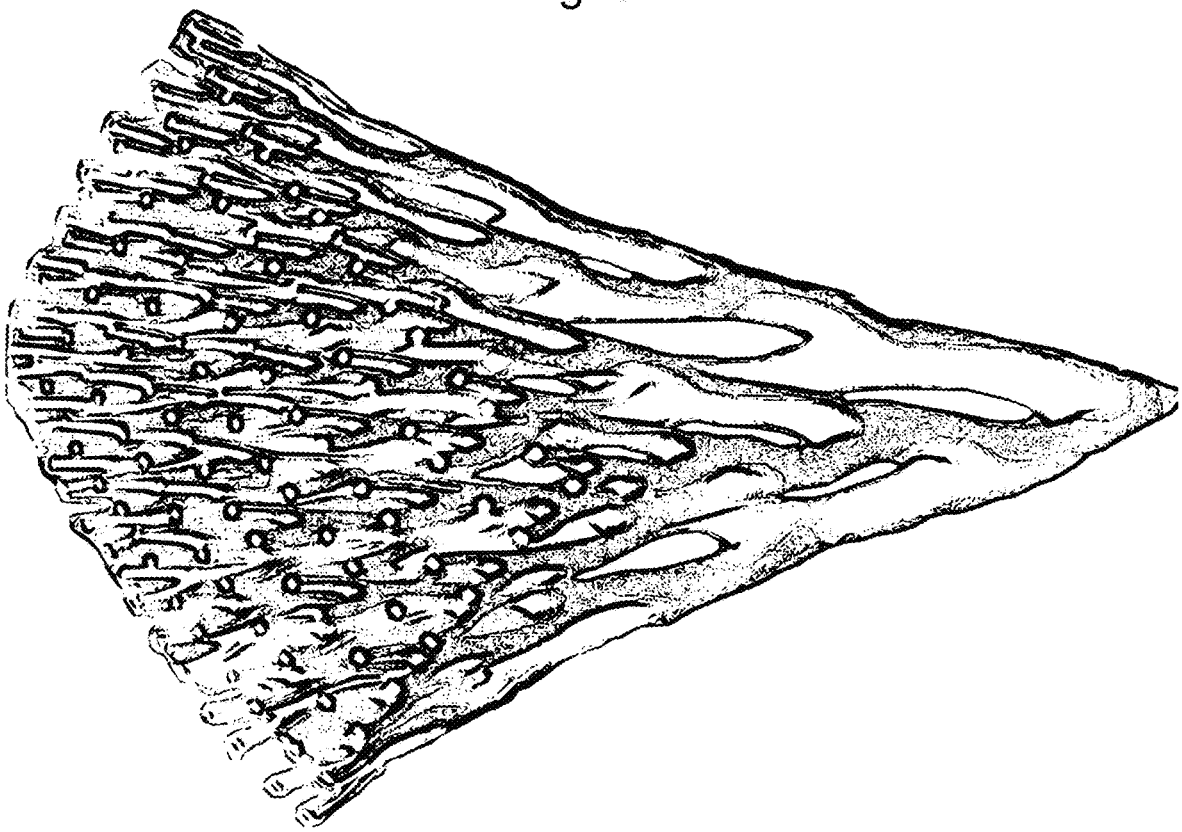
Figure 36:
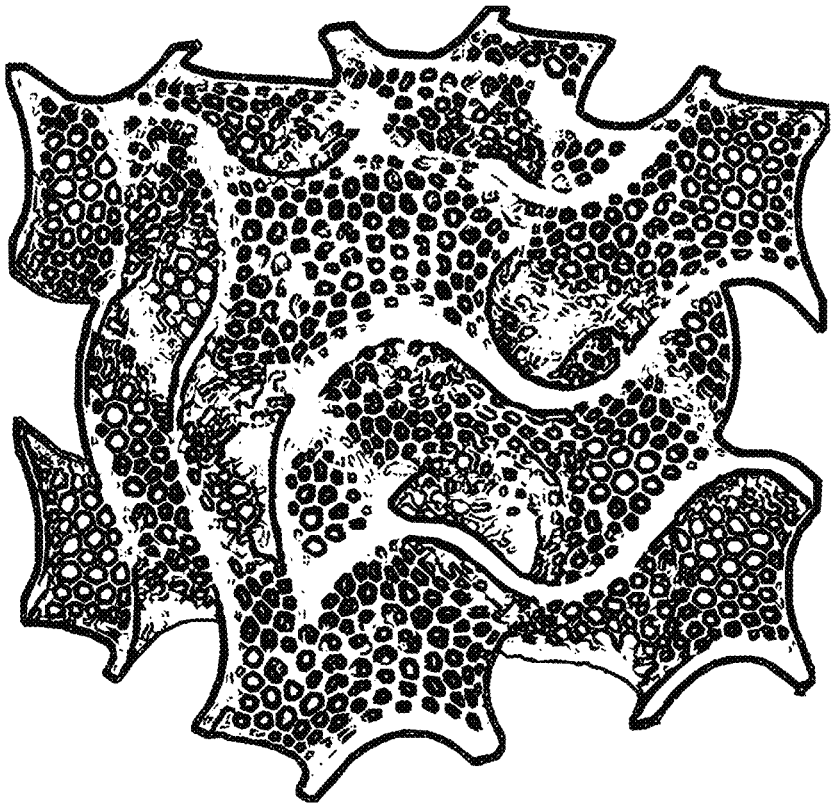
Figure 37:
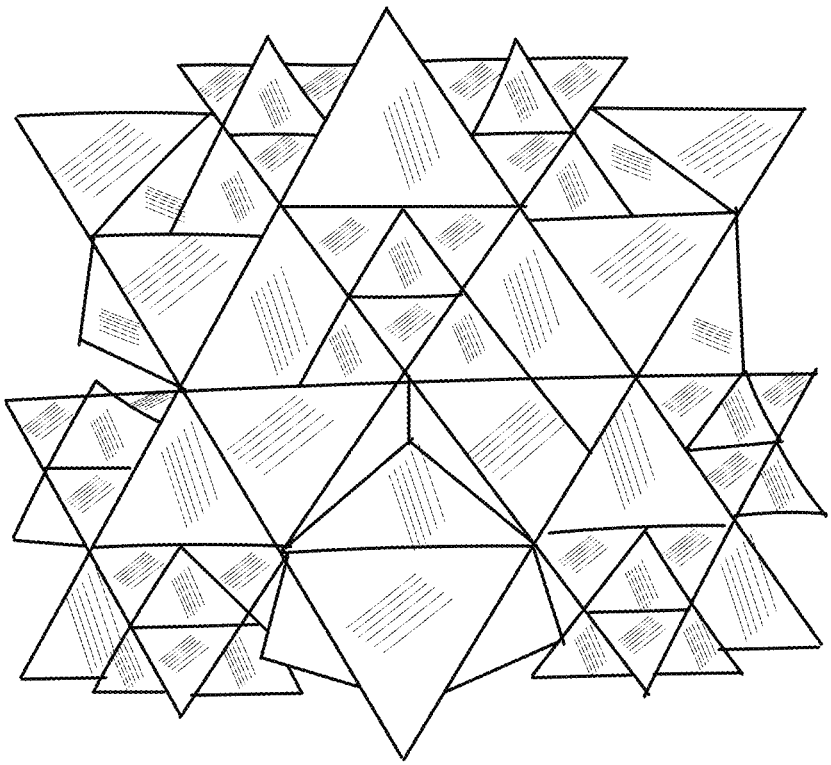

In accordance with another embodiment, the heatsink may comprise a heat exchange device which is structurally configured based on a Mandelbulb, as exemplarily illustrated in FIG. 19. The Mandelbulb is a three-dimensional analogue of the Mandelbrot set. The Mandelbulb may be defined as the set of those C in $\mathbb{R}^3$ for which the orbit of <0, 0, 0> under the iteration $v \mapsto v''+c$ is bounded, where the "nth power" of the vector $v=\langle x,y,z\mathbb{R}$ in $\rangle^3$ is given by eq. 17.

$$v'':=r''\langle \sin(n\theta)\cos(n\phi,\sin(n\theta)\sin(n\phi),\cos(n\theta)\rangle \quad (17)$$

Where $$r=\sqrt[n]{x^2+y^2+z^2},$$

$$\phi=\arctan(y/x)=\arg(x+yi), \text{ and}$$

$$\theta=\arctan(\sqrt[n]{x^2+y^2}/z)=\arccos(z/r).$$

In accordance with another embodiment of the invention disclosed herein, the heatsink comprises a heat exchange device having a plurality of heat exchange elements which are perforated. As a result, an enhanced heat transfer may be achieved. Additionally, use of perforations may increase heat transfer by up to a factor of two per pumping power. Further, in a specific embodiment, the plurality of heat exchange elements may be hollow. The combination of hollow heat exchange elements with perforations can result in increases in heat transfer greater than that of a solid heat exchange element of the same diameter. Additionally, increases in heat transfer per pumping power of up to 20% could be achieved by varying the inclination angle and diameter of the perforations in aligned arrays of the plurality of heat exchange elements. Furthermore, one or more of the number of perforations and shape of perforations may be configured in order to control the heat transfer. For instance, under natural convection, heat transfer is directly proportional to the number of square perforations. In another instance, circular and square perforations may be used to obtain higher Nusselt number. Since heat transfer is proportional to Nusselt number, greater heat transfer may be achieved with such an arrangement. In yet another instance, the Nusselt number corresponding to the plurality of heat exchange elements may be varied based on one or more of a pitch, a hole diameter, a surface area and flow velocity. In particular, by modifying the pitch of the perforations, the Nusselt number and hence heat transfer may be increased.

In an embodiment, the heat transfer effectiveness of the plurality of heat exchange elements may be greater than or equal to a minimum value such that addition of the plurality of heat exchange elements is justified. As a non-limiting example, the minimum value may be ten.

In another embodiment, a spacing between the plurality of heat exchange elements is determined based on a height of the plurality of heat exchange elements. In a specific embodiment, for a given heat rate, an optimal spacing between the plurality of heat exchange elements may decrease with an increase in height of the plurality of heat exchange elements.

In yet another embodiment, a shape corresponding to the plurality of heat exchange elements may be configured to provide enhanced heat transfer. For instance, the plurality of heat exchange elements may be fluted. As a result, an increase in heat transfer by up to 9% may be achieved. In another instance, the plurality of heat exchange elements may be wavy providing an increase in heat transfer by up to 6%. In one embodiment, the shape corresponding to the plurality of heat exchange elements may be triangular, circular, elliptical, rectangular and trapezoidal. For instance, the plurality of heat exchange elements may be elliptically annular. Further, an elliptical aspect ratio corresponding to the plurality of heat exchange elements may be varied in order to obtain greater heat transfer efficiency. As a non-limiting example, the elliptical aspect ratio may be increased in order to obtain higher heat transfer efficiency. In another instance, the plurality of heat exchange elements may be trapezoidal with an optimal aspect number of 1.5. In yet another instance, the plurality of heat exchange elements may be diamond shaped pin fins. Further, the pitch corresponding to the plurality of heat exchange elements may be varied to obtain enhanced heat transfer. For example, the pitch may be varied in proportion to the required heat transfer coefficient. As a result, increase in heat transfer up to 340% beyond that of flat pin fins may be achieved.

In other embodiments of the invention, the surface geometry of the plurality of heat exchange elements may be varied in order to provide enhanced heat transfer. For instance, square ribs along the plurality of heat exchange elements may be used. As a result, thermal performance may increase by up to 30%. In another instance, diamond shaped surface protrusions may be provided over the plurality of heat exchange elements. Consequently, thermal performance may be increased by up to 38% while also leading to better flow distribution. In yet another instance, grooves may be created on the surfaces of the plurality of heat exchange elements. As a result, heat transfer could increase by up to 25%. In a further instance, dimples may be placed on the flat base of the plurality of heat exchange elements forming a pin fin. Consequently, an increase in heat transfer by up to 8% may be achieved while also reducing the friction factor by up to 18%. Further, in an instance, convex shaped dimples may be used to obtain greater heat transfer.

In some other embodiments, an orientation of the plurality of heat exchange elements may be varied in order to enhance heat transfer. For instance, in case the number of the plurality of heat exchange elements is large, the plurality of heat exchange elements may be oriented vertically with respect to the flat base of the plurality of heat exchange elements. In another instance, in case the plurality of heat exchange elements are short with a finning factor of less than 2.7, a horizontal orientation may be used in order to provide better heat transfer.

In other embodiments, the plurality of heat exchange elements may be configured in order to control an amount of heat transfer by radiation. For example, the height of the plurality of heat exchange elements may be maintained short. As a result, up to 55% of the heat transfer may take place by radiation. On the other hand, the height of the plurality of heat exchange elements may be increased in order to reduce the amount of heat transfer by radiation. As another example, the plurality of heat exchange elements may be circular around an annular heat pipe. Further, a ratio of spacing between the plurality of heat exchange elements and diameter of the plurality of heat exchange elements may be controlled in order to vary the amount of heat transfer by radiation. For instance, the ratio may be decreased in order to decrease the amount of heat transfer by radiation. Similarly, the ratio may be increased in order to increase the amount of heat transfer by radiation.

In an embodiment, the number of iterations corresponding to the fractal variation between respective branches of the plurality of heat exchange elements may be configured in order to control heat transfer. For instance, the number of iterations may be increased in order to obtain greater heat transfer. However, beyond a certain limit, heat transfer may not be directly proportional to the number of iterations. Additionally, varying the number of iterations may also control diffusion rate across the surfaces of the plurality of heat exchange elements based on the fact that diffusion rate is directly proportional to the number of iterations. However, a certain number of iterations such as, but not limited to, four to five iterations, the diffusion rate may converge.

In another embodiment, a dimension corresponding to the fractal variation between respective branches of the plurality of heat exchange elements may be configured in order to control heat transfer. In general, the heat transfer is directly proportional to the fractal dimension. However, this relationship is valid only till a limited number of iterations.

In yet another embodiment, the number of branches corresponding to the plurality of heat exchange elements may be configured to control the heat transfer. Under natural convection, heat transfer effectiveness is found to be directly proportional to the number of branches. However, after a certain number of branch generations, heat transfer effectiveness saturates. Further, a branching ratio may be configured in order to obtain minimum resistance to heat conduction and hence greater heat transfer. In a non-limiting example, a branching ratio of 0.707 or 0.7937 may be used.

In another embodiment, heat transfer may be controlled based on the velocity of fluidic heat exchange medium flowing over the plurality of heat exchange elements. In general, the heat transfer is directly proportional to the velocity of fluidic heat exchange medium under forced convection. Additionally, the optimal number of branches required to maximize heat transfer has been found to reduce with increase in velocity of fluidic heat exchange medium. Accordingly, under forced convection with higher velocity, less number of branches may be required to achieve a required amount of heat transfer. In another embodiment, heat transfer by the plurality of heat exchange elements in the form of an array of perforated fins may be controlled by varying a pumping power. In this case, the heat transfer can be inversely proportional to the pumping power with small increase for turbulent cross-flow but significant increase for parallel flow.

In accordance with embodiments disclosed herein, the heat sink may be manufactured using manufacturing techniques such as, but not limited to, injection molding, die casting, extrusion, forging, gravitational molding, CNC milling, CNC punching, stamping, wire cut machine and wire cut Electrical Discharge Machining (EDM), additive manufacturing (e.g., 3D printing, 2.5D printing, etc.

In a particular embodiment, the heatsink may be manufactured by a machining processing employing cutting tools and controlled slicing techniques to construct the plurality of heat exchange elements from a solid block of material such as, but not limited to, copper or aluminum. This technique is preferable to construct the plurality of heat exchange elements with smaller thickness than is possible by other techniques such as extrusion. Advantages of the heatsink manufactured using this technique include high aspect ratio, thin fin, low tooling cost, easy and inexpensive to prototype, unidirectional flow and single piece construction.

In another embodiment, the heatsink may be manufactured by bending sheets made of, but not limited to, copper or aluminum into fins to form the plurality of heat exchange elements. The fins are then bonded to the flat base of the heatsink. This technique allows the flat base and the fins to be made of different materials. Advantages of this manufacturing technique include light weight of fins, lower tooling cost and differing materials for the flat base and the fins.

In yet another embodiment, the heatsink may be manufactured from sheets of material such as, but not limited to, copper or aluminum bonded onto the flat base using one or more of epoxy, soldering and brazing. This technique of manufacturing is suitable for high power application with low thermal resistance and where forced air cooling is available.

In a further embodiment, the heatsink may be manufactured using die casting. In this technique, material such as, but not limited to, liquid aluminum is forced under high pressure into re-usable steel molds. This technique is specially suited when the plurality of heat exchange elements are of complex shapes.

Those skilled in the art will recognize many ways to fabricate the heatsinks described herein. For example, modern three-dimensional laser and liquid printers can create objects such as the heatsinks described herein with a resolution of features on the order of 16 μm. Also, it is possible to grow a crystal structure using a recursive growth algorithm or through crystal growth techniques. For example, US Patent Application No. 2006/0037177, expressly incorporated herein by reference, describes a method of controlling crystal growth to produce fractals or other structures through the use of spectral energy patterns by adjusting the temperature, pressure, and electromagnetic energy to which the crystal is exposed. This method might be used to fabricate the heatsinks described herein. For larger heatsinks, such as those intended to be used in car radiators, traditional manufacturing methods for large equipment can be adapted to create the fractal structures described herein.

FIGS. 20-37 illustrate various heatsink designs and proposals, which may be used in conjunction with various embodiments of the technology. In general, these provide heat transfer surfaces with large surface area, and in many cases, small terminal features, which can accumulate or trap dust or particles. According to the present technology, the accumulation or dust and/or particles may be reduced by the various means disclosed herein.

This document describes in detail illustrative examples of the inventive apparatus, methods, and articles of manufacture for making and using fractal heatsinks, along with systems and methods for removing dust and particles from their surfaces. Neither the specific embodiments of the invention as a whole, nor those of its features necessarily limit the general principles underlying the invention. The specific features described herein may be used in some embodiments, but not in others, in the various combinations and permutations, without departure from the spirit and scope of the invention as set forth herein. Various physical arrangements of components and various step sequences also fall within the intended scope of the invention. Many additional modifications are intended in the foregoing disclosure, and it will be appreciated by those of ordinary skill in the art that in some instances some features of the invention will be employed in the absence of a corresponding use of other features. The illustrative examples therefore do not limit the metes and bounds of the invention and the legal protection afforded the invention, which function is carried out by current and future claims and their equivalents.

What is claimed is:

1. A heatsink controller, for cooling a heatsink comprising a base structure configured to interface with a heat source, a heat transmissive body, configured to receive heat from the base structure, and a heat transfer surface surrounding the heat transmissive body, configured to transfer heat to a surrounding heat transfer medium, the heatsink controller comprising at least one automated electronic processor producing a control signal for controlling a flow of a heat transfer medium from a variable tensor heat transfer medium flow device with respect to the heat transfer surface, to:

in a first mode, dissipate heat from the heat source to maintain the heat source within a thermal limit; and in a second mode, concurrently achieve different turbulent flow characteristics of the heat transfer medium over different regions of the heat transfer surface, the different regions being dependent on the control signal which varies over time, to selectively dislodge a deposit on different regions of the heat exchange surface due to selective turbulent interaction of the heat transfer medium with the heat transfer surface.

2. The heatsink controller according to claim 1, wherein the heatsink controller is configured to control a peak flow rate of the heat transfer medium over time over different portions of the heat transfer surface.

3. The heatsink controller according to claim 1, wherein the heatsink controller comprises a computational heat exchange model of the heatsink.

4. The heatsink controller according to claim 1, further comprising a feedback sensor input to the automated electronic processor.

5. The heatsink controller according to claim 1, wherein the automated electronic processor is further configured to perform the second mode in discontinuous accumulation abatement cycles.

6. The heatsink controller according to claim 1, wherein the control signal comprises a component which controls a heat transfer medium flow magnitude over time.

7. The heatsink controller according to claim 1, wherein the control signal comprises a component which controls a heat transfer medium flow direction over time.

8. The heatsink controller according to claim 1, wherein the automated electronic processor is further configured to produce the control signal dependent on a temperature rise rate of the heatsink.

9. The heatsink controller according to claim 1, wherein the automated electronic processor is further configured to estimate an accumulation of the deposit.

10. The heatsink controller according to claim 1, wherein the first mode is optimized based on a temperature and an energy consumption, and the second mode is distinct from the first mode.

11. The heatsink controller according to claim 1, wherein the heat transfer surface has a fractal geometry, and the control signal is selectively dependent on the fractal geometry.

12. The heatsink controller according to claim 1, wherein the heat transfer medium is air in an open system, and the variable tensor heat transfer medium flow device comprises a fan.

13. The heatsink controller according to claim 1, further comprising a feedback transducer configured to detect vibrations, producing a feedback input to the automated electronic processor, wherein the control signal is produced dependent on the feedback input.

14. The heatsink controller according to claim 1, further comprising an element configured to mechanically deform in response to changes in temperature to change an interaction of the heat transfer surface and the heat transfer medium.

15. A heatsink control method, for controlling cooling of a heatsink comprising a base structure configured to interface with a heat source, a heat transmissive body, configured to receive heat from the base structure, and a heat transfer surface surrounding the heat transmissive body, configured to transfer heat to a surrounding heat transfer medium, the method comprising:

in a first mode, automatically producing a control signal for controlling a flow of a heat transfer medium from a variable tensor heat transfer medium flow device with respect to the heat transfer surface with at least one automated processor, to dissipate heat from the heat source maintain operation below a temperature limit, optimized for at least one of energy consumption and noise generation; and in a second mode, producing the control signal to concurrently achieve different turbulent flow characteristics of the heat transfer medium over different regions of the heat transfer surface, wherein the different regions vary dependent on the control signal, to selectively dislodge a deposit on the heat exchange surface.

16. The method according to claim 15, wherein the second mode is effective to dissipate heat from the heat source to operate below the temperature limit, wherein the first mode and the second mode are not concurrent.

17. The method according to claim 15, further comprising controlling a peak flow rate of the heat transfer medium over time over different portions of the heat transfer surface, dependent on a computational heat exchange model of the heatsink and a feedback signal from a feedback sensor.

18. The method according to claim 15, wherein the second mode is discontinuous.

19. The method according to claim 15, wherein heat transfer medium has a flow direction which various over time in response to the control signal.

20. A heatsink system, comprising:

a base structure configured to interface with a heat source; a heat transmissive body, configured to receive heat from the base structure;

a heat transfer surface surrounding the heat transmissive body, configured to transfer heat to a surrounding heat transfer medium;

a variable tensor heat transfer medium flow device comprising a variable speed fan, configured to induce a variable tensor flow of the heat transfer medium with respect to the heat transfer surface responsive to a control signal;

a heatsink controller comprising at least one automated electronic processor producing the control signal, to:

in a first mode, dissipate heat from the heat source to maintain the heat source within a predetermined thermal limit optimized for at least one of energy consumption and noise generation; and in a second mode, maintain the heat source within a predetermined thermal limit and concurrently achieve different turbulent flow characteristics of the heat transfer medium over different regions of the heat transfer surface, the different turbulent flow characteristics varying over time dependent on the control signal, to selectively dislodge a deposit on the heat exchange surface due to selective turbulent interaction of the heat transfer medium with the heat transfer surface.

* * * * *